US006068374A

United States Patent [19]

Kurata et al.

[11] Patent Number: 6,068,374

[45] Date of Patent: May 30, 2000

[54] IMAGE FORMING APPARATUS

[75] Inventors: Mitsuru Kurata, Kawasaki; Tokihide Ebata, Yokohama; Yasushi Miura, Kawasaki; Yasuyuki Takanaka, Yokohama; Kazunari Nishimoto; Yoshiko Miyashita, both of Kawasaki; Takeshi Irizawa, Oizumi-machi, all of Japan

[73] Assignee: Canon Kabushiki Kaisha, Tokyo, Japan

[21] Appl. No.: 08/383,320

[22] Filed: Feb. 3, 1995

[30] Foreign Application Priority Data

| | | | |
|---|---|---|---|
| Feb. 8, 1994 | [JP] | Japan | 6-014727 |
| Feb. 8, 1994 | [JP] | Japan | 6-014731 |
| Feb. 8, 1994 | [JP] | Japan | 6-014732 |
| Mar. 9, 1994 | [JP] | Japan | 6-038763 |

[51] Int. Cl.[7] ..... B41J 29/13

[52] U.S. Cl. ..... 347/108; 347/100; 347/101; 347/8

[58] Field of Search ..... 347/19, 100, 101, 347/102, 8, 91, 108, 42; 346/136, 33 F; 358/406, 504

[56] References Cited

U.S. PATENT DOCUMENTS

| | | | |
|---|---|---|---|
| 4,141,231 | 2/1979 | Kudlich | 68/205 R |
| 4,271,688 | 6/1981 | Tillotson | 68/5 D |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,620,807 | 11/1986 | Polit | 400/56 |
| 4,723,129 | 2/1988 | Endo et al. | 347/56 |
| 4,725,849 | 2/1988 | Koike et al. | 347/106 |
| 4,740,796 | 4/1988 | Endo et al. | 347/56 |
| 5,225,853 | 7/1993 | Kobayashi et al. | 347/33 |
| 5,274,399 | 12/1993 | Uchida et al. | 346/134 |
| 5,280,308 | 1/1994 | Takahashi et al. | 346/134 |

FOREIGN PATENT DOCUMENTS

| | | | |
|---|---|---|---|
| 844560 | 7/1976 | Belgium . | |
| 844560 | 11/1976 | Belgium . | |
| 0377339 | 7/1990 | European Pat. Off. . | |
| 0 534 337 | 3/1993 | European Pat. Off. . | |
| 0 535 914 | 4/1993 | European Pat. Off. . | |
| 2752843 | 6/1978 | Germany . | |
| 59-64378 | 4/1984 | Japan . | |
| 62-53492 | 3/1987 | Japan | B41J 2/01 |
| 62-053492 | 3/1987 | Japan . | |
| 346589 | 7/1991 | | |
| 3046589 | 7/1991 | Japan . | Japan . |
| 439042 | 2/1992 | Japan | B41J 2/01 |
| 4039042 | 2/1992 | Japan . | |
| 531905 | 2/1993 | | |
| 5031905 | 2/1993 | Japan . Japan | B41J 2/05 |
| 5-112037 | 5/1993 | Japan . | |
| 5212851 | 8/1993 | Japan | B41J 2/01 |
| WO 82/02375 | 7/1982 | WIPO . | |

*Primary Examiner*—N. Le
*Assistant Examiner*—Shih-Wen Hsieh
*Attorney, Agent, or Firm*—Fitzpatrick, Cella, Harper & Scinto

[57] ABSTRACT

An image forming apparatus includes conveying device for conveying a printing medium in the substantially horizontal direction in the printing range where a printing agent is applied to the printing medium while a printing plane of the printing medium orients in the upward direction, a printer section including a plurality of printing heads located opposite to a platen portion of the printing range for applying the printing agent to the printing medium in the downward direction so as to form printed images on the printing medium by activating the printing heads, and supporting device for slidably displacing the printer section relative to the platen portion in the conveying direction of the printing medium conveyed by the conveying device, between the position where the printer section is located opposite to the platen portion and the non-opposing position spaced away from the preceding position. With such construction, a maintenance service can easily be conducted for the conveying device.

32 Claims, 80 Drawing Sheets

IMAGE FORMING APPARATUS

BACKGROUND OF THE INVENTION

1. Field of the Invention

The present invention relates generally to an image forming apparatus. More particularly, the present invention relates to an image forming apparatus including ink jet type printing heads each adapted to eject ink therefrom to a cloth or a textile (hereinafter referred to simply as a cloth) usable as a printing medium for forming printed image on the printing medium with ink. Further, the present invention relates to an apparatus for fitting a conveying belt to an image forming apparatus of the foregoing type and removing the former from the latter. Moreover, the present invention relates to a method of fitting a conveying belt to an image forming apparatus of the foregoing type and removing the former from the latter.

2. Description of the Related Art

As a latest technology, an ink jet type textile printing apparatus has been increasingly known in the art. This type of textile printing apparatus has the advantageous effects based on a main reason that no original is required for an image to be printed on a printing medium in contrast with a conventional screen textile printing process. Specifically, one of the advantageous effects is such that the ink jet type textile printing apparatus has a high degree of freedom in respect of an image to be printed on the printing medium and the other one is such that the ink jet type textile printing apparatus can be produced at a low cost compared with the total textile printing installation.

A typical conventional ink jet type textile printing apparatus is disclosed in an official gazette of Japanese Patent Application Laying-Open No. 5-212851. As is apparent especially from FIG. 2 in the official gazette, each printing operation is performed by ejecting ink from a plurality of ink jet heads toward a cloth which is conveyed in the vertical direction. In other words, ink is ejected from the ink jet heads in the horizontal direction. A printer section including a plurality of ink jet heads and a conveying mechanism including an endless conveying belt are arranged in the printing section adapted to eject ink therefrom with a cloth held in the clamped state therebetween while they face to each other.

A tacky layer is placed on the surface of the endless conveying belt, and a cloth serving as a printing medium is adhesively attached to the tacky layer of the endless conveying belt to hold the cloth in the flattened state. Next, as the endless conveying belt is intermittently driven, the cloth is intermittently conveyed at a distance equal to a predetermined width.

After images are printed on the surface of the printing medium within the range defined by a single printing width in accordance with a hitherto known serial printing process, the cloth is pulled by a cloth winding roller disposed on the most downstream side of a conveying path while an adequate intensity of tensile force is applied to the cloth. As the cloth is conveyed further together with the endless conveying belt, it is peeled away from the tacky layer on the surface of the endless conveying belt, and subsequently, it is conveyed via a path as shown in the drawing and wound around the winding roller.

Next, immediately after the cloth is peeled from the endless conveying belt, part of the cloth having images printed thereon is dried by a drying unit for drying ink remaining on the cloth in the non-dried state. One of a process of blowing hot air to a cloth having images printed thereon, a process of irradiating infrared rays to a cloth and similar processes is adequately selected for the drying unit. This step of drying is especially effective in the case that a liquid printing agent is employed for each printing operation.

For example, as shown in FIG. 1, provided that confirming paths L for visually confirming the printed state images printed on the cloth is formed in the image forming apparatus between a head carriage 5010 having a plurality of ink jet heads 5100 mounted thereon and a drying unit 5600 both of which are spaced away from each other, an operator 80 can visually check printed images immediately after completion of each printing operation while handling an operation board or panel 5900 with his hand.

Therefore, even in the case that there arise malfunctions that ink can not be ejected from the ink jet heads 5100 due to clogging of the ink jet heads 5100 with foreign materials and abnormality occurs with the printed image, the operator 80 can visually observe printed image immediately after completion of each printing operation. This makes it possible to detect that the printing operation is incorrectly achieved, and moreover, prevent the incorrectly printed part from being enlarged by adequately handing the operation panel 5900 with an operator's hand without any delay.

In FIG. 1, reference numeral 5130 designates an endless conveying belt, reference numeral 5021 designates a winding roll, and reference numeral 5011 designates an unwinding roller for unwinding a cloth 1800 serving as a printing medium therefrom.

Generally, the printer section of the textile printing apparatus can slidably be displaced in the horizontal direction in order to assure that the distance between the printer section and the cloth can be adjusted as desired and the endless conveying belt can be exchanged with another one after the printer section is displaced.

Also with respect to the ink jet type textile printing apparatus as described above, many requests have been raised from users for improving a printing speed of the textile printing apparatus without any exception among various kinds of printer sections employable for textile printing apparatus.

In the case that the printing speed of the textile printing apparatus is to be improved under a condition that each textile printing operation is performed with a comparatively long continuous cloth, a method of most directly realizing the improvement of the printing speed is such that the number of ink ejecting nozzles formed in each ink jet head is increased, i.e., the length of each ink jet head is elongated. In more detail, the width of one line printed per single scanning performed with each ink jet head can be enlarged by increasing the number of ink ejecting nozzles arranged in the conveying direction of a printing medium such as a cloth or the like (i.e., by elongating the length of each ink jet head as measured in the conveying direction), whereby the printing speed of the textile printing apparatus can be improved by increasing a quantity of conveyance of the printing medium corresponding to the enlarged width of each printed line.

In the case that each ink jet head in the textile printing apparatus as disclosed in the official gazette of the aforementioned prior invention is designed to have a longer length, ink ejecting nozzles in each ink jet head are arranged in the vertical direction, causing a difference in pressure head between adjacent ink ejecting nozzles to become comparatively large. This difference in pressure head between adjacent ink ejecting nozzles is expressed in the form of a difference in a quantity of ejected ink between adjacent ink ejecting nozzles, resulting in a quality of printed image being degraded.

On the other hand, a textile printing apparatus including a plurality of ink jet heads each adapted to eject ink in the downward direction, i.e., including a plurality of so-called downward orienting ink jet heads as disclosed in an official gazette of Japanese Patent Application Laying-Open No. 5-31905 filed by an applicant to the present invention has been known in the art. According to this prior invention, the aforementioned problems in connection with the difference in pressure head between adjacent ink ejecting nozzles can be solved because ink ejecting nozzles in each ink jet head are arranged in the horizontal direction.

Advantageous effects derived from the downward orienting ink jet heads are such that recovering treatment can uniformly be conducted for all ink ejecting nozzles by ink suction or the like in connection with the equality in pressure head between adjacent ink ejecting nozzles, and moreover, invasion of water droplets adhering to an ink ejecting plane into the ink ejecting nozzles can reliably be prevented.

However, when the downward orienting ink jet heads are used for the textile printing apparatus as they are, it is anticipated that various kinds of problems appear due to factors specific to this type of textile printing apparatus.

As far as the textile printing apparatus is concerned, the distance between the ink jet heads and the cloth (head gap) should adequately be adjusted corresponding to the thickness of a various kind of cloth to be used. In addition, to assure that the endless conveying belt is easily exchanged with another one, it is desirable that all of the ink jet heads (i.e., the whole printer section) can easily be displaced from the printing position. However, in contrast with a printer for business use or personal use, the textile printing apparatus including a plurality of downward orienting ink jet heads has problems that the printer section is constructed with larger dimensions and heavy weight and it is not easy to conduct adjustment and displacement for the textile printing apparatus for the reason that the ink jet heads and the belt conveying section are located opposite to each other in the vertical direction.

Further, to suppress an occurrence of incorrect printing operation, it is necessary that an operator can quickly confirm a quality of printed image after completion of each printing operation. In the case that a plurality of downward orienting ink jet heads are used for the textile printing apparatus, as shown in, e.g., FIG. 2, it is necessary that a printing medium 1800 can be conveyed in the horizontal direction while a plurality of ink jet heads 5100 face to a conveying belt 5131.

To assure that the printed state of images printed on the printing medium 1800 conveyed in the horizontal direction by the conveying belt 5131 can be confirmed immediately after the images are printed on the printing medium 1800, it is thinkable that a conveying path upwardly extending from a downstream end 5132 of the conveying belt 5131 at a substantially right angle relative to the conveying plane of the conveying belt 5131 is formed in the folded state, and the printed state of images can visually be confirmed by an operator 80 via confirmation paths L as shown in FIG. 2.

However, since a high intensity of tension is applied to the printing medium 1800 via a winding roller 5021, causing the printing medium 1800 to be forcibly pulled by the winding roller 5021, there arise problems that the printing medium 1800 is sharply bent immediately after it is peeled from the tacky layer of the conveying belt 5131 at the downstream end 5132 of the conveying belt 5131, and printed images which are not still perfectly dried immediately after completion of each printing operation are disturbed or deformed.

In addition, there arises another problem that a line-shaped bent track appears on the printing medium 1800 or the printed images due to bending of the printing medium 1800 at the downstream end 5132 of the conveying belt 5131.

Provided that a guide roll having a certain diameter is disposed at the position located inside of the folded line in order to prevent the printing medium 1800 being sharply folded, the guide roll comes in contact with the printing plane of the printing medium 1800. This leads to the result that images printed on the printing medium 1800 are disturbed or deformed prior to drying treatment.

In the case that any guide roll can not be disposed at the position located inside of the folded line and properties of the tacky layer on the conveying belt 5131 are deteriorated due to repeated use of the conveying belt 5131 for a long time, the printing medium 1800 is peeled from the conveying belt 5131 at a point 5133 located upstream of the downstream end of the printing medium 1800, resulting in the conveying path being bent as represented by a phantom line 1801. This leads to the result that printed images are disturbed or deformed prior to drying treatment due to rubbing contact of the printing medium 1800 with a drying unit 5600, a printer frame 5050 or a similar component.

In the case that a plurality of ink jet heads each having a number of ink ejecting nozzles arranged as printing elements therein are used for the textile printing apparatus, to prevent the density of each printed image from fluctuating from image to image attributable to fluctuation in a quantity of ink ejected from each ink ejecting nozzle, a certain unit may be arranged in the textile printing apparatus for forming a test pattern on an adequate printing medium, measuring the fluctuation in a quantity of ejected ink by optically reading the test pattern, and then obtaining data required for correcting the fluctuation in a quantity of ejected ink. However, when a measure is taken so as to allow a series of steps as mentioned above to be easily practiced, the textile printing apparatus is unavoidably constructed with larger dimensions due to the arrangement of the foregoing unit. In practice, it is desirable that the textile printing apparatus is not constructed with large dimensions.

SUMMARY OF THE INVENTION

The present invention has been made in consideration of the aforementioned background.

It is an object of the present invention to provide an image forming apparatus including a printer section having a plurality of ink jet heads arranged therein so as to allow a printing agent to be ejected in the downward direction therefrom on a printing medium to be conveyed in a conveying section in the substantially horizontal direction wherein at least one of the aforementioned problems can be solved by the image forming apparatus, and each printing operation can be achieved at a high speed to print images each having a high quality on the printing medium.

Another object of the present invention is to provide an image forming apparatus including a printer section having a plurality of ink jet heads arranged therein so as to allow a printing agent to be ejected in the downward direction therefrom on a printing medium to be conveyed in a conveying section in the substantially horizontal direction wherein the printer section can easily be separated from the conveying section when a maintenance service is performed for the image forming apparatus.

A further object of the present invention is to provide an image forming apparatus wherein there is not any possibility that it is constructed with large dimensions because of the arrangement of a separating mechanism for separating the printer section from the conveying section.

A further object of the present invention is to provide an image forming apparatus which assures that a maintenance service can easily be conducted for the conveying section when an endless conveying belt is exchanged with another one.

A further object of the present invention is to provide an image forming apparatus which assures that a maintenance service can easily be conducted for the conveying section, and moreover, a head gap between the printer section and the conveying section can easily and reliably be adjusted.

A further object of the present invention is to provide an image forming apparatus which assures that the head gap can easily be adjusted at a high accuracy by utilizing a simple mechanism.

A further object of the present invention is to provide an image forming apparatus including a printer section having a plurality of ink jet heads arranged therein so as to allow a printing agent to be ejected in the downward direction therefrom on a printing medium to be conveyed in a conveying section in the substantially horizontal direction wherein the image forming apparatus is equipped with means for enabling an operator to easily observe printed images each having a high quality immediately after completion of each printing operation.

A further object of the present invention is to provide an image forming apparatus including a printer section having a plurality of ink jet heads arranged therein so as to allow a printing agent to be ejected in the downward direction therefrom on a printing medium to be conveyed in a conveying section in the substantially horizontal direction wherein the printer section can easily be separated from the conveying section, and a test pattern forming section can easily be arranged on the conveying section.

A still further object of the present invention is to provide an image forming apparatus which assures that there does not arise a malfunction that the image forming apparatus is constructed with large dimensions.

In a first aspect of the present invention, there is provided an image forming apparatus comprising:

conveying means for conveying a printing medium in the substantially horizontal direction in the printing range where a printing agent is applied to the printing medium, while a printing plane of the printing medium orients in the upward direction, a printer section including a plurality of printing heads for forming printed images on the printing medium therewith, each of the printing heads being adapted to eject the printing agent to the printing medium in the downward direction while the printer section is located opposite to a platen portion of the conveying means in the printing range, and supporting means for slidably supporting the printer section relative to the platen portion in such a manner as to enable it to be slidably displaced in the conveying direction of the printing medium conveyed by the conveying means between the position where the printer section and the platen portion are located opposite to each other and the non-opposing position spaced away from the preceding position.

Here, the supporting means may include guide members disposed on the opposite sides of the conveying means as viewed in the conveying direction so as to enable the printer section to be slidably displaced along the guide members.

The conveying means may include a pair of conveying rollers disposed not only on the upstream side but also on the downstream side as viewed in the conveying direction and a conveying belt spanned between both the conveying rollers while recirculatively extending therebetween.

The pair of conveying rollers may be supported between supporting members located inside of the guide members.

Ink may be used as the printing agent, and each of the printing heads is an ink jet printing head for ejecting the ink therefrom.

Each of the ink jet printing heads may include an element for generating thermal energy required for allowing a phenomenon of film boiling to appear in ink as energy to be utilized for ejecting ink therefrom.

The image forming apparatus may further include adjusting means for adjusting a gap between the printing heads and the printing medium to be conveyed on the platen portion.

The image forming apparatus may further include platen means for thrusting part of the conveying belt between the pair of conveying rollers to restrictively define the printing plane of the printing medium in cooperation with the printing heads, and adjusting means for adjusting the gap between the printer heads and the printing medium to be conveyed on the conveying means by raising and lowering the platen means.

The image forming apparatus may further include means for adjusting an intensity of tension to be applied to the conveying belt by changing a distance between the pair of conveying rollers as the platen means is raised or lowered.

The printer section may be supported on a member having sliders secured thereto so as to be slidably displaced along the guide members, via adjusting means for adjusting the gap between the printer heads and the printing medium to be conveyed on the conveying means by changing a height of the printer section relative to the member.

The plurality of jacks may be arranged between the member and the printer section so as to enable the adjusting means to be actuated while the adjusting means and the member are disengaged from each other.

The printing medium may be a cloth.

The labelling member for adhesively placing the cloth to a tacky layer on the conveying belt of the conveying means may be disposed on the printer section side, and the labelling member may be supported so as not to obstruct the slidable displacement between the opposing position and the non-opposing position.

The guide members may be inclined relative to the platen portion in the vertical direction.

The image forming apparatus may include driving means for displacing the printer section along the guide members and position determining means for adjustably determine the position of the printer section on the guide members.

The platen portion may extend in the horizontal direction, and the guide members may be inclined from the horizontal direction.

The guide members may extend in the horizontal direction, and the platen portion may be inclined from the horizontal direction.

The conveying means may include a conveying belt which is spanned between a pair of conveying rollers, the conveying belt being recirculatively extending therebetween.

The printing medium may be a cloth.

The printer section may be an ink jet printer section including a plurality of ink jet heads each adapted to eject ink therefrom so as to perform a printing operation with ink ejected from the ink jet heads.

Each of the ink jet heads may generate gas bubbles in ink by utilizing thermal energy, and ejects ink therefrom as the gas bubbles grow.

In a second aspect of the present invention, there is provided an image forming apparatus comprising:

conveying means for conveying a printing medium in the substantially horizontal direction in the printing range where a printing agent is applied to the printing medium, while a printing plane of the printing medium orients in the upward direction, a printer section including a plurality of printing heads for forming printed images on the printing medium therewith, each of the printing heads being adapted to eject the printing agent to the printing medium in the downward direction with the aid of a plurality of printing elements while the printer section is located opposite to a platen portion of the conveying means in the printing range, supporting means for slidably supporting the printer section relative to the platen portion in such a manner as to enable it to be slidably displaced in the conveying direction of the printing medium conveyed by the conveying means between the position where the printer section and the platen portion are located opposite to each other and the non-opposing position spaced away from the preceding position, and a test pattern forming section adapted to be located opposite to the printer section when the printer section and the conveying means are located at the non-opposing position, so as to allow a test pattern to be formed for measuring fluctuation in a quantity of the printing agent applied to the printing medium from the printing elements.

Here, the supporting means may include guide members disposed on the opposite sides of the conveying means as viewed in the conveying direction so as to enable the printer section to be slidably displaced along the guide members, and the test pattern forming section is arranged at the fore parts of the slide members.

The test pattern forming section may be arranged above a supplying portion for supplying the printing medium to the conveying means.

The test pattern forming section may include a placing portion for placing a cut sheet of test pattern thereon.

The test pattern forming section may include means for conveying a continuous sheet-like test pattern forming medium to the position located opposite to the printing heads.

Reading means for measuring the fluctuation by optically reading the continuous sheet-like test pattern forming medium may be disposed downstream of a conveying path of the test pattern forming medium relative to the position located opposite to the printing heads.

The image forming apparatus may further include means for correcting a driving signal for the printing element based on the measured fluctuation.

Ink may be used as the printing agent, and each of the printing heads may be an ink jet printing head for ejecting ink therefrom.

Each of the ink jet printing heads may include an element for generating thermal energy required for allowing a phenomenon of film boiling to appear in ink as energy to be utilized for ejecting ink therefrom.

The printing medium may be a cloth.

In a third aspect of the present invention, there is provided an image forming apparatus comprising:

conveying means for conveying a printing medium in the substantially horizontal direction in the printing range where a printing agent is applied to the printing medium while a printing plane of the printing medium orients in the upward direction, a printer section including a plurality of printing heads for forming printed images on the printing medium therewith, each of the printing heads being adapted to eject the printing agent to the printing medium in the downward direction while the printer section is located opposite to a platen portion of the conveying means in the printing range, and extension path forming means for extending the printing medium conveyed by the conveying means in the substantially same direction as the conveying direction of the printing medium conveyed by the conveying means to form an extension path serving as part of a conveying path.

Here, the extension path can visually be observed from the outside of the image forming apparatus.

The image forming apparatus may further include observing means for visually observing the printing plane of the printing medium to be conveyed by the conveying means.

The controlling portion for controlling at least the printer section, the conveying means and the extension path forming means may be arranged at the position where visual observation can be executed with the aid of the observing means.

The observing means may be arranged directly above the extension path.

In a fourth aspect of the present invention, there is provided an image forming apparatus comprising:

conveying means for conveying a printing medium in the substantially horizontal direction in the printing range where a printing agent is applied to the printing medium while a printing plane of the printing medium orients in the upward direction, a printer section including a plurality of printing heads for forming printed images on the printing medium therewith, each of the printing heads being adapted to eject the printing agent to the printing medium in the downward direction while the printer section is located opposite to a platen portion of the conveying means in the printing range, and extension path forming means for extending the printing medium conveyed by the conveying means and parted away from the conveying means in the substantially same direction as the conveying direction of the printing medium conveyed by the conveying means or in the slantwise upward direction to form an extension path serving as part of a conveying path.

Here, the conveying means may include a tacky portion for conveying the printing medium while holding the latter thereon.

The extension path can visually be observed from the outside of the image forming apparatus.

The image forming apparatus may further include observing means for visually observing the printing plane of the printing medium to be conveyed by the conveying means.

The controlling portion for controlling at least the printer section, the conveying means and the extension path forming means may be arranged at the position where visual observation can be executed with the aid of the observing means.

The observing means may be arranged directly above the extension path.

The printer section may include guide rails disposed in the direction orienting at a right angle relative to the conveying direction of the printing medium to be conveyed by the conveying means, a carriage adapted to be reciprocably displaced on the guide rails, and a plurality of printing heads mounted on the carriage so as to allow a printing agent to be applied to the printing plane of the printing medium therefrom in the downward direction.

Ink may be used as the printing agent, and each of the printing heads may be an ink jet printing head for ejecting ink therefrom.

Each of the ink jet printing heads may include an element for generating thermal energy required for allowing a phenomenon of film boiling to appear in ink as energy to be utilized for ejecting ink therefrom.

In a fifth aspect of the present invention, there is provided a conveying belt fitting/removing apparatus for fitting a conveying belt to an image forming apparatus or removing the former from the latter, the image forming apparatus comprising:

conveying means for conveying a printing medium in the substantially horizontal direction in the printing range where a printing agent is applied to the printing medium while a printing plane of the printing medium orients in the upward direction, a printer section including a plurality of printing heads for forming printed images on the printing medium therewith, each of the printing heads being adapted to eject the printing agent to the printing medium in the downward direction while the printer section is located opposite to a platen portion of the conveying means in the printing range, and supporting means for slidably supporting the printer section relative to the platen portion in such a manner as to enable it to be slidably displaced in the conveying direction of the conveying medium between the position where the printer section and the platen portion are located opposite to each other and the non-opposing position spaced away from the preceding position, wherein, the conveying means including a pair of conveying rollers disposed not only on the upstream side but also on the downstream side as viewed in the conveying direction and a conveying belt spanned between both the conveying rollers while recirculatively extending therebetween, and the pair of conveying rollers being supported between supporting members disposed on side plates inside of the opposite slide rails, wherein the conveying belt fitting/removing apparatus includes fitting/removing means which is constructed such that the pair of conveying rollers are supported at the opposite end parts thereof in cooperation with one of the supporting members when the other supporting member is disengaged from the conveying means without any possibility that fitting/removing of the conveying belt is obstructed.

Here the fitting/removing means may include frame members each located inside of a side plate and having holes formed therethrough so as to allow shafts for the pair of conveying rollers to extend through the holes, and a support shaft to be connected to other side plate via a U-shaped groove formed at the upper part of one side plate and holes formed through the frame members.

In a sixth aspect of the present invention, there is provided a conveying belt fitting/removing method of fitting a conveying belt to an image forming apparatus or removing the former from the latter, the image forming apparatus comprising:

conveying means for conveying a printing medium in the substantially horizontal direction in the printing range where a printing agent is applied to the printing medium while a printing plane of the printing medium orients in the upward direction, a printer section including a plurality of printing heads for forming printed images on the printing medium therewith, each of the printing heads being adapted to eject the printing agent to the printing medium in the downward direction while the printer section is located opposite to a platen portion of the conveying means in the printing range, and supporting means for slidably supporting the printer section relative to the platen portion in such a manner as to enable it to be slidably displaced in the conveying direction of the printing medium conveyed by the conveying means between the position where the printer section and the platen portion are located opposite to each other and the non-opposing position spaced away from the preceding position, wherein the conveying means including a pair of conveying rollers disposed not only on the upstream side but also on the downstream side as viewed in the conveying direction and a conveying belt spanned between both the conveying rollers while recirculatively extending therebetween, and the pair of conveying rollers being supported between supporting members disposed on side plates inside of the opposite slide rails, wherein the opposite ends of the pair of conveying rollers are supported in cooperation with one of the supporting members disposed on the opposite sides when the other supporting member is disengaged from the conveying means without any possibility that the pair of conveying rollers are supported only by the other supporting member in the cantilever fashion, and the conveying belt is fitted to or removed from the image forming apparatus after one of the supporting members disposed on the opposite sides is disengaged from the conveying means while the opposite ends of the pair of conveying rollers are adequately supported.

In a seventh aspect of the present invention, there is provided an image forming apparatus including conveying means for conveying a printing medium at least in the printing range while the printing medium is adhesively placed on a tacky sheet on a conveying belt and a printer section located opposite to a platen portion of the conveying means in the printing range, wherein the image forming apparatus includes a labelling roller on the upstream side of the conveying belt for bringing the printing medium in adhesive contact with the tacky sheet on the conveying belt, and the labelling roller serves also as a sheet labelling roller for allowing the tacky sheet to adhere to the conveying belt.

Here the conveying belt may convey the printing medium in the substantially horizontal direction.

The space located on the upstream side of the labelling roller as viewed in the conveying direction may be not covered with the printer section and a holding portion for holding the printer section.

The printer section and the holding portion for holding the printer section may be escapably displaced away from the position where the printer section is located opposite to the conveying belt, by actuating a displacing mechanism, and when they are escapably displaced in that way, the space located on the upstream side of the labelling roller as viewed in the conveying direction is not covered by the conveying means, the printer section and the holding portion for holding the printer section.

The surface of the labelling roller may be coated with a layer of fluororesin.

In an eighth aspect of the present invention, there is provided an image forming apparatus comprising:

conveying means for conveying a printing medium in the substantially horizontal direction in the printing range where a printing agent is applied to the printing medium while a printing plane of the printing medium orients in the upward direction, a printer section including a plurality of printing heads for forming printed images on the printing medium therewith, each of the printing heads being adapted to eject the printing agent to the printing medium in the downward direction while the printer section is located opposite to a platen portion of the conveying means in the printing range, and observing means for visually observing the printing plane of the printing medium to be conveyed by the conveying means.

In a ninth aspect of the present invention, there is provided an image forming apparatus comprising:

conveying means for conveying a printing medium in the substantially horizontal direction in the printing range where a printing agent is applied to the printing medium while a printing plane of the printing medium orients in the upward direction, a printer section including a plurality of printing heads for forming printed images on the printing medium therewith, each of the printing heads being adapted to eject the printing agent to the printing medium in the downward direction while the printer section is located opposite to a platen portion of the conveying means in the printing range, and adjusting means for adjusting the gap between the printer heads and the printing medium to be conveyed on the conveying means.

In a tenth aspect of the present invention, there is provided an image forming apparatus including conveying means for conveying a printing medium which is unwound from a unwinding roller and a printer section located opposite to a platen portion of the conveying means in the printing range, wherein the image forming apparatus includes a tension roller on the upstream side of the conveying means for absorbing an extra quantity of the printing medium unwound from the unwinding roller.

In an eleventh aspect of the present invention, there is provided an image forming apparatus including conveying means for conveying a printing medium and a printer section located opposite to a platen portion of the conveying means in the printing range, wherein the conveying means includes a pair of conveying rollers disposed not only on the upstream side but also on the downstream side as viewed in the conveying direction, a conveying belt spanned between both the conveying rollers while recirculatively extending therebetween and preventing turning-up means for preventing turning-up at the opposite the conveying belt.

According to the present invention, when a maintenance service is conducted for the image forming apparatus, the printer section can slidably be displaced away from the conveying section in the printing medium conveying direction, i.e., in the substantially horizontal direction, whereby the printer section and the conveying section can easily be separated from each other. Since the printer section can slidably be displaced in the conveying direction, there does not arise a malfunction that the image forming apparatus is constructed with large dimensions.

In addition, while the printer section is separated from the conveying section, a maintenance service can easily be conducted for the conveying section. The conveying belt is recirculatively driven by a pair of conveying rollers, and the exchanging of the conveying belt with another one is achieved by removing it from the conveying section and then fitting a new conveying belt to the conveying section without any possibility that the conveying rollers are held in the cantilever fashion. Consequently, a conveying belt fitting/removing operation can easily be performed.

Further, since the image forming apparatus is equipped with means for adjusting the head gap between the printer section and the conveying section, the head gap can easily and reliably be adjusted.

With respect to the image forming apparatus constructed in accordance with the present invention, the head gap can easily be adjusted at a high accuracy with a simple structure by inclining a guide member relative to the platen portion of the conveying section with the aid of a sliding mechanism for slidably displacing the printer section in the conveying direction in order to easily exchange the conveying belt with another one.

Additionally, according to the present invention, the printer section including a plurality of downward orienting ink jet heads can slidably be displaced away from and toward the conveying section in the printing medium conveying direction, i.e., in the substantially horizontal direction. Since the test pattern forming section is arranged to face to the printer section while the conveying section is not located opposite to the printer section, a maintenance service for the conveying section and correction of any type of fluctuation can easily be executed.

Finally, according to the present invention, the printing medium can be peeled from the conveying belt without any possibility that the printing medium and images printed on the printing medium are injured or deformed, and moreover, an operator standing upright by an operation board can visually confirm the printed state of the printing medium immediately after completion of each printing operation without delay. Thus, in the case that there arises a malfunction that images are incorrectly printed on the printing medium, he can take an adequate measure for coping with the foregoing malfunction.

Other objects, features and advantages of the present invention will become apparent from reading of the following description which has been made in conjunction with the accompanying drawings.

BRIEF DESCRIPTION OF THE DRAWINGS

FIG. 6A-1, 6A-2 and FIG. 6B are side views showing an embodiment wherein the printer section is slidably displaced away from and toward the conveying section, respectively;

DESCRIPTION OF THE PREFERRED EMBODIMENTS

The present invention will now be described in detail hereinafter with respect to the following items with reference to the accompanying drawings which illustrate preferred embodiments thereof.

(1) Outline of an image forming apparatus (see FIG. 3)

Figure 4:
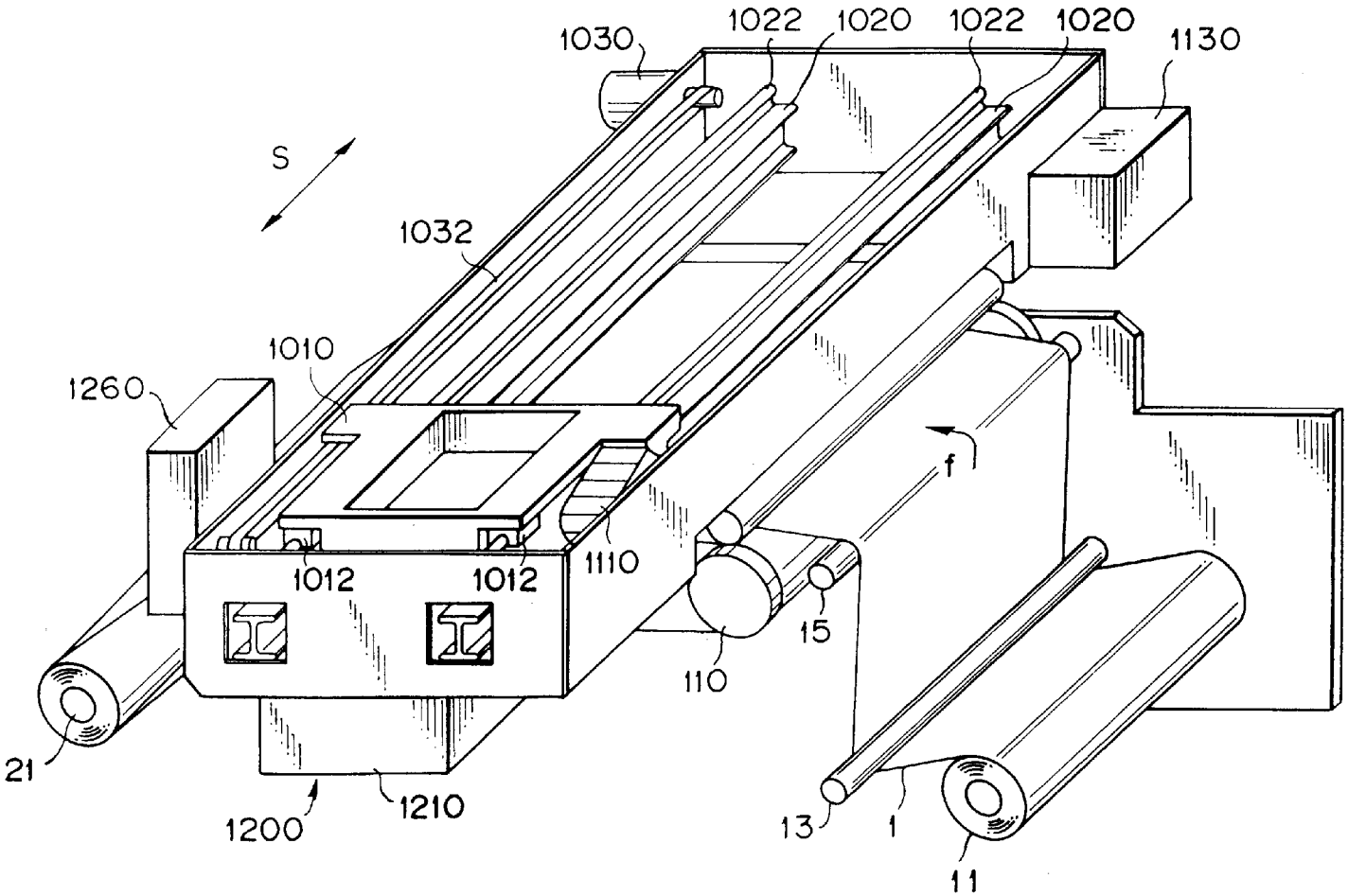
FIG. 4 is a schematic perspective view of the textile printing apparatus shown in FIG. 3A, showing the arrangement of a printer section and a conveying section.
Figure 5:
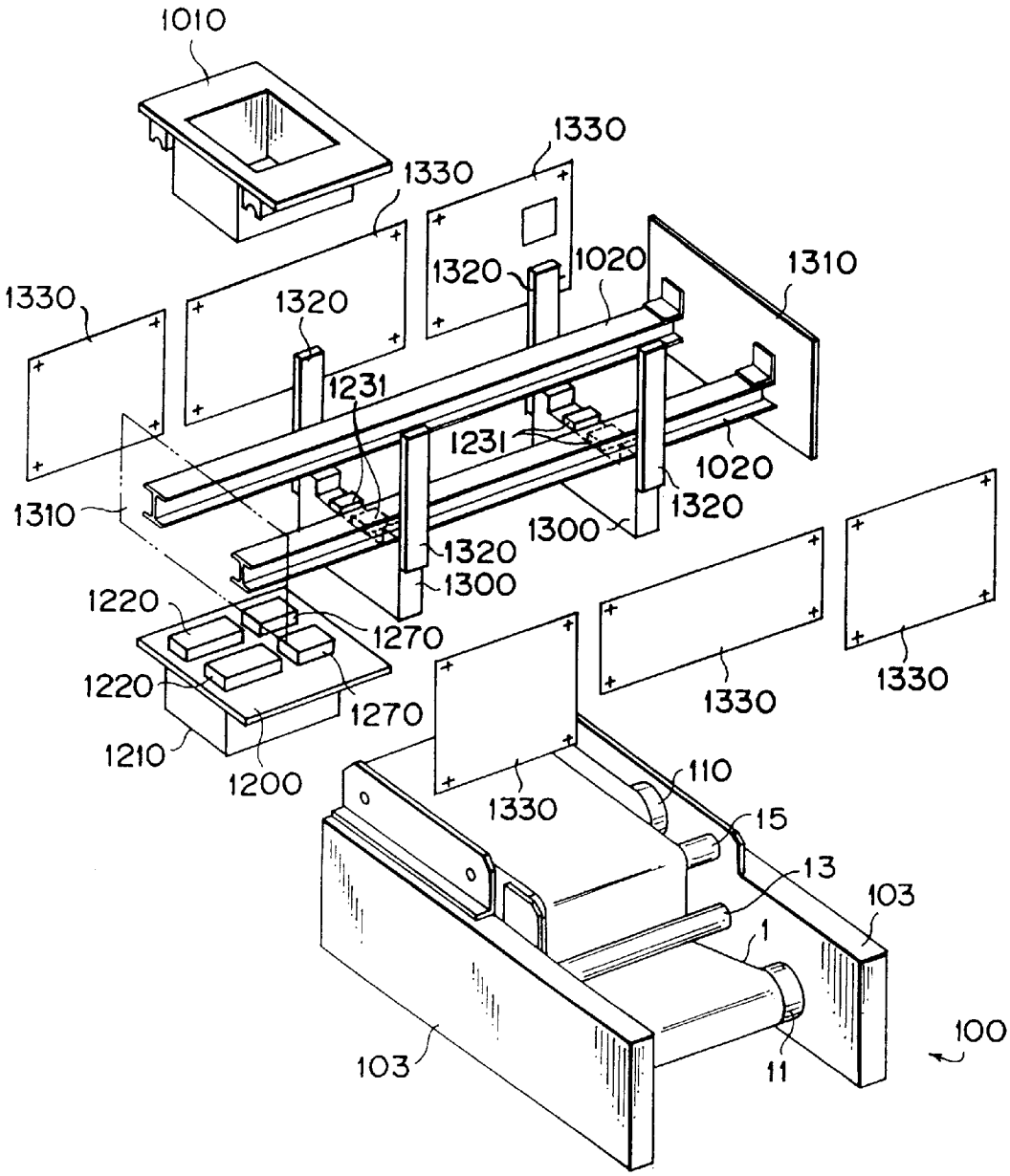
FIG. 5 is a schematic perspective view of the textile printing apparatus shown in FIG. 3A, showing the printer section and the conveying section in the disassembled state.

(2) Structure of a printer section (see FIG. 4 and FIG. 5)

(3) A sliding mechanism and other items (see FIG. 6 to FIG. 13)

(4) An HS station (see FIG. 14 to FIG. 22)

(5) A position where a drying heater is arranged and other items (see FIG. 23 to FIG. 26)

(6) Structure of a conveying section (see FIG. 27 to FIG. 43)

(7) Operation of the image forming apparatus and a maintenance service to be performed for the image forming apparatus (see FIG. 44 to FIG. 49)

(8) A head gap adjusting mechanism (see FIG. 50 to FIG. 57)

Figure 58:
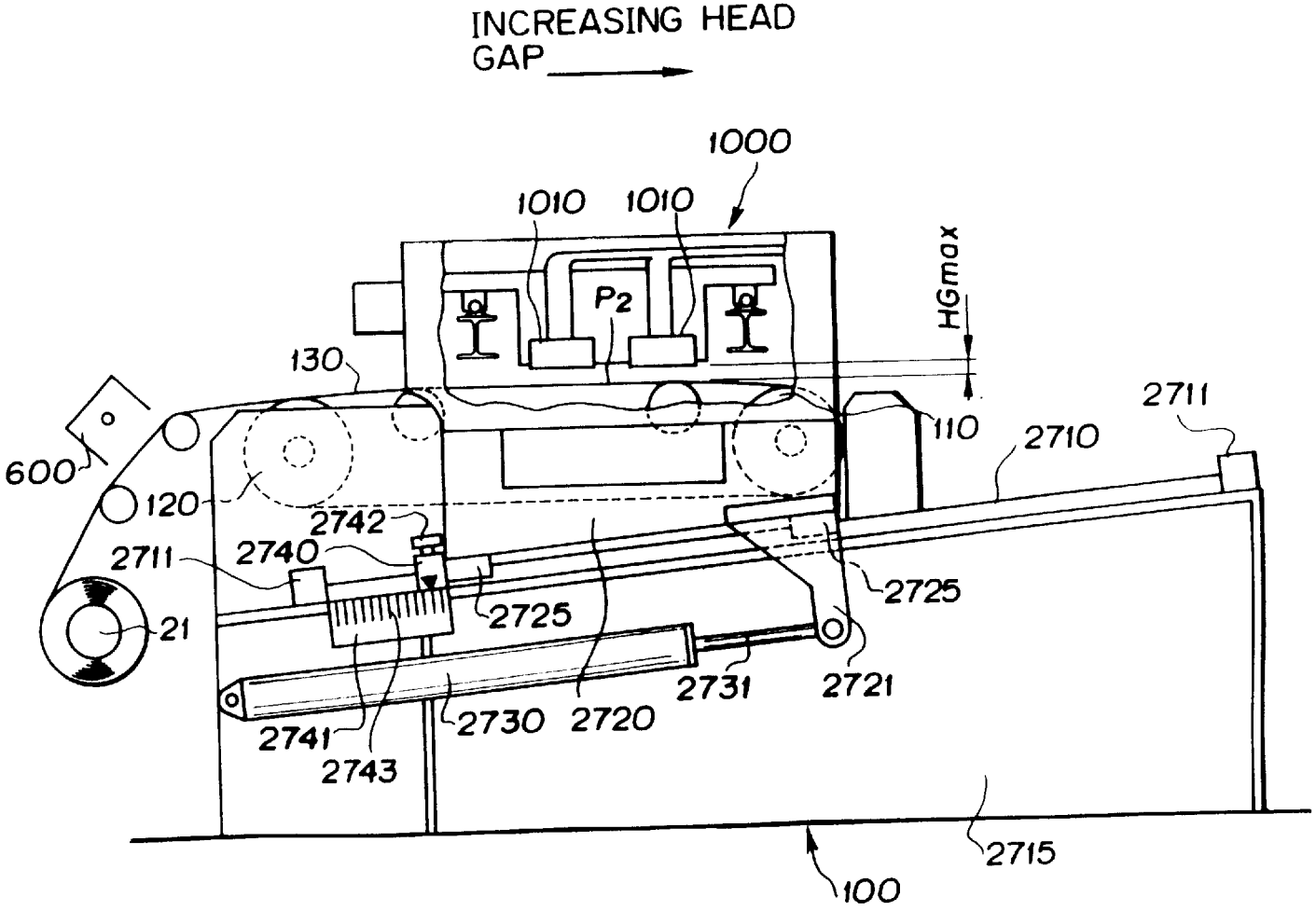
FIG. 58 is a schematic side view showing a still further embodiment wherein a head gap adjusting mechanism is arranged in operative association with a sliding mechanism for the textile printing apparatus.
Figure 59:
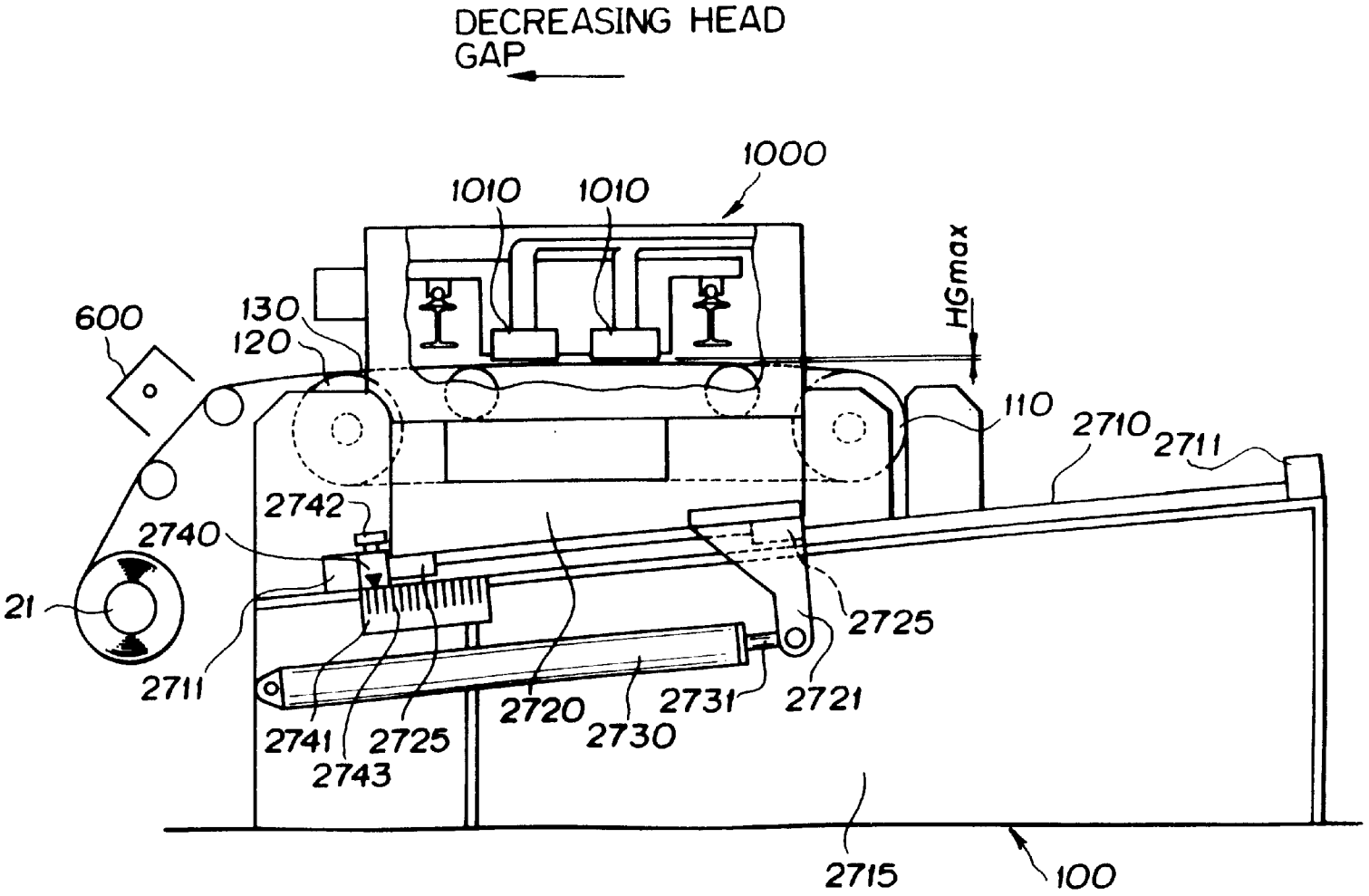
FIG. 59 is a side view of the head gap adjusting mechanism shown in FIG. 58, showing another operative state of the head gap adjusting mechanism.
Figure 60:
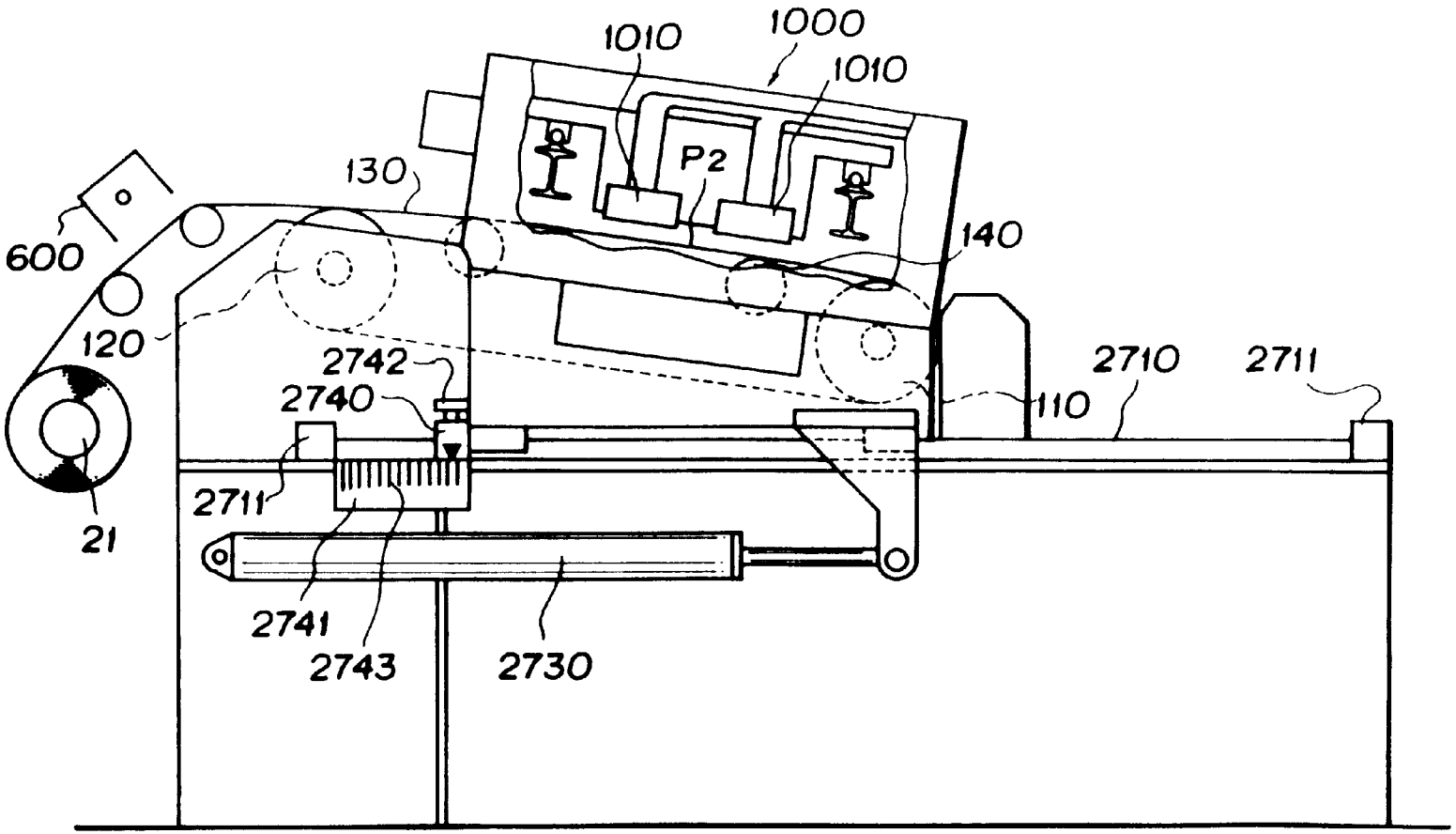
FIG. 60 is a schematic side view showing a modified embodiment wherein a head gap adjusting mechanism is arranged in operative association with a sliding mechanism for the textile printing apparatus.

(9) Another head gap adjusting mechanism to be actuated with the aid of a sliding mechanism (see FIG. 58 to FIG. 60)

(10) An observing mechanism for visually observing a printed image immediately after an image is printed on the printing medium (FIG. 64 to FIG. 74)

(11) Other item (see FIG. 59)

(1) Outline of an image forming apparatus

Figures 3A, 3B:
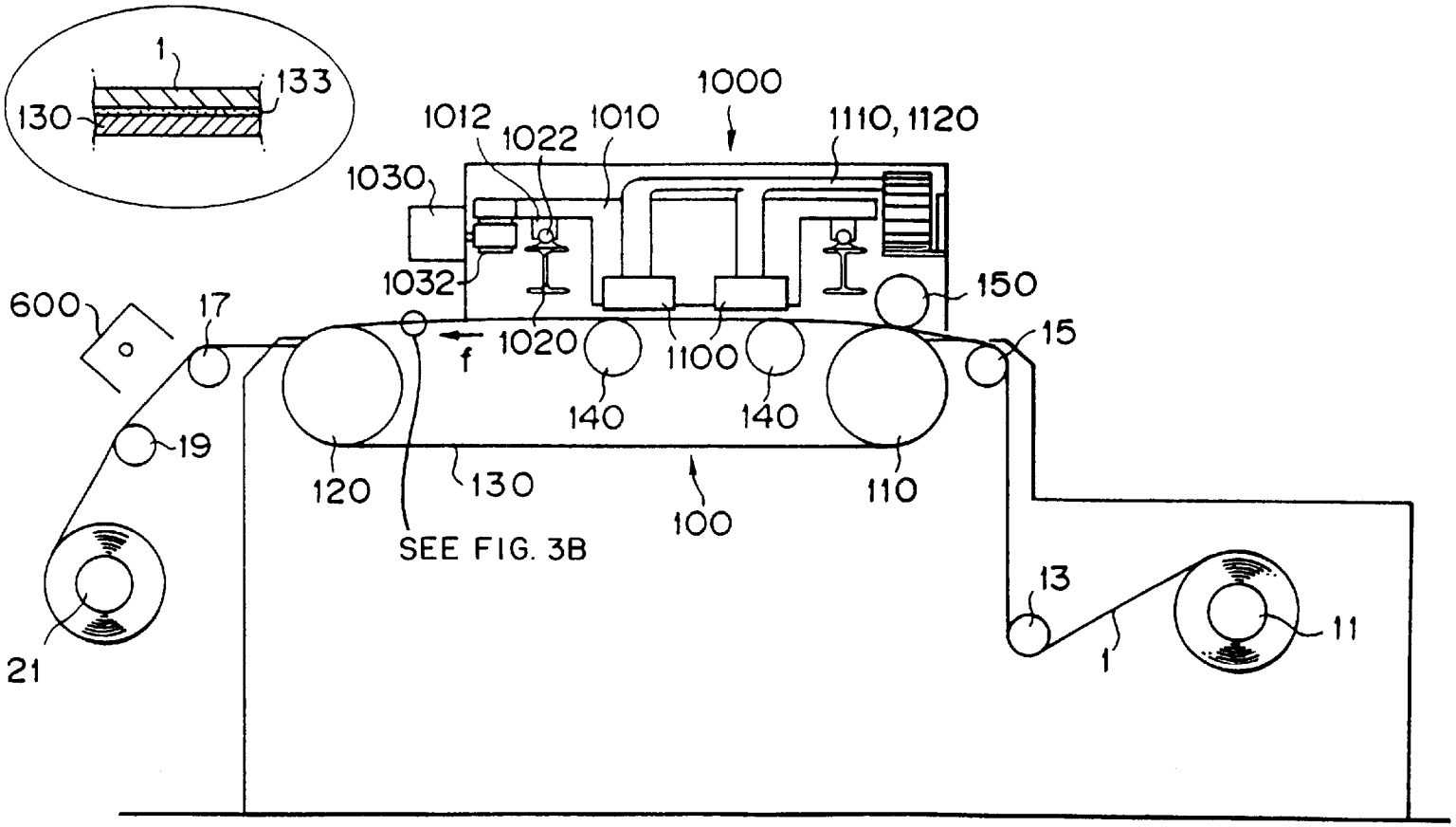
FIG. 3A is a schematic sectional side view showing the structure of a textile printing apparatus serving as an example of an image forming apparatus constructed in accordance with an embodiment of the present invention.
FIG. 3B is an enlargement of a section of FIG. 3A.

FIG. 3A is a schematic sectional side view showing by way of example the structure of a textile printing apparatus serving as an image forming apparatus. In the drawing, reference numeral 1 designates a cloth usable as a printing medium. As an unwinding roller 11 is rotated, the cloth 1 is unwound from the unwinding roller 11, and subsequently, it is conveyed in the substantially horizontal direction with the aid of a conveying section 100 arranged opposite to a printer section 1000. Thereafter, the cloth 1 is wound about a winding roller 21 via a feeding roller 17 and an intermediate roller 19.

The conveying section 100 includes a conveying roller 110 disposed on the upstream side of the printer section 1000, a conveying roller 120 disposed on the downstream side of the same, an endless conveying belt 130 recirculatively extending between both the conveying rollers 110 and 120, and a pair of platen rollers 140 for expansively holding the conveying belt 130 within the predetermined range by applying an adequate intensity of tension to the conveying belt 130. Among these components, the platen rollers 140 are especially used for improving flatness of the cloth 1 by restrictively flattening one surface of the cloth 1 to be printed during a printing operation. In the shown case, the conveying belt 130 is made of a metallic material as disclosed in an official gazette of Japanese Patent Application Laying-Open No. 5-212851, and as shown at FIG. 3B on an enlarged scale, a tacky layer 133 is placed on the upper surface of the conveying belt 130 in the form of a sheet. While the cloth 1 is conveyed in that way, it is brought in adhesive contact with the conveying belt 130 in the presence of the tacky layer 133 in cooperation of a press roller 150 with the conveying roller 120, whereby the flatness of the cloth 1 is reliably maintained during the printing operation.

As the cloth 1 is conveyed while maintaining its flatness, a printing agent is applied to the cloth 1 within the range defined between both the platen rollers 140 by activating the printer section 1000. On completion of the printing operation, the cloth 1 is peeled off from the tacky layer 133 placed on the conveying belt 130 at the location of the conveying roller 120, and thereafter, it is dried by a drying heater 600 disposed at the intermediate location of the cloth winding path. The drying heater 600 is advantageously employable especially in the case that a liquid based printing agent is used for the cloth 1, and dimensions given to the drying heater 600 and the location of the latter will be described later with reference to FIG. 23 to FIG. 26. Incidentally, the drying heater 600 is typically exemplified by a heater for blowing warm air toward the cloth 1 and a heater for irradiating infrared rays toward to the cloth 1.

(2) Structure of the printer section

FIG. 4 is a schematic perspective view showing the structure of the printer section 1000 and the conveying system for the cloth 1, and FIG. 5 is a schematic perspective view showing the printer section 1000 and the conveying system in the disassembled state. Now, the structure of the printer section 1000 will be described below with reference to FIG. 4 and FIG. 5 in addition to FIG. 3.

Referring to FIG. 3 and FIG. 4, the printer section 1000 includes a carriage 1010 adapted to be scanned in the direction different from the f arrow-marked conveying direction (auxiliary scanning direction) of the cloth 1, e.g., the S arrow-marked direction of a width of the cloth orienting at a right angle relative to the f arrow-marked conveying direction. Reference numeral 1020 designates a support rail which extends in the S arrow-marked direction (main scanning direction). In the shown case, two support rails 1020 slidably support sliders 1012, each fixedly secured to the carriage 1010, via slide rails 1022 thereon for the purpose of guiding the slidable movement of the sliders 1012. Reference numeral 1030 designates a motor which serves as a driving power source for performing main scanning for the carriage 1010. The driving power generated by the motor 1030 is transmitted to the carriage 1010 via an endless belt 1032 and other associated components.

The carriage 1010 includes a plurality of printing heads 1100 each having a number of printing agent applying elements arranged therein in the predetermined direction (i.e., in the f arrow-marked conveying direction in this embodiment). It should be noted that the printing heads 1100 are received in the carriage 1010 in the direction different from the foregoing predetermined direction (i.e., in the s arrow-marked main scanning direction in this embodiment) with two-staged structure as viewed in the conveying direction. In more detail, a plurality of printing heads 1100 are arranged at each stage corresponding to plural kinds of printing agents each exhibiting a different color in order to enable a color printing operation to be performed therewith. The kind of color to be employed for each printing agent and the number of printing heads can adequately be selected corresponding to an image to be formed on the cloth 1. For example, an image is formed by using three kinds of primary colors composed of yellow (Y), magenta (M) and cyan (C). Alternatively, an image may be formed by using four kinds of colors composed of three primary colors and black (Bk). In the case that desired expression can not be attained or can hardly be attained merely with three primary colors, an image is formed by using a special color (e.g., a metallic color such as gold color, silver color or the like, a clear red color or a clear blue color) in place of the three primary colors or in addition to the same. Otherwise, an image may be formed by using plural kinds of printing agents each exhibiting a same color but having a different density.

In this embodiment, as shown in FIG. 3, a plurality of printing heads 1100 arranged in the S arrow-marked main scanning direction are received in the carriage 1010 with two-staged structure as viewed in the f arrow-marked conveying direction. The kind of color to be exhibited by a printing agent used by each printing head at each stage, the number of printing heads arranged at each stage and the order of arrangement of the printing heads are same at each stage or they may differ from stage to stage corresponding to an image to be printed. The image range printed in response to main scanning performed for the printing heads at the first stage can repeatedly be printed by the printing heads at the second stage. In this case, an image may complementarily be formed by the printing heads at each stage while the printing of a part of the image is omitted. Alternatively, an image may be printed in the overlapped state by the printing heads at both the stages. Otherwise, an image may be printed at a high speed while a unit printing range is distributively allocated to each of the printing heads at both the stages. It should be noted that the number of stages each including a plurality of printing heads should not be limited only to two stages but it may be one stage or three or more stages.

In this embodiment, an ink jet head, e.g., a bubble jet head named by Canon Kabushiki Kaisha is used as a printing head 1100. In detail, the bubble jet head includes a plurality of heat generating elements each adapted to generate thermal energy as energy to be utilized for ejecting ink therefrom by allowing a phenomenon of film boiling to appear in ink. As the cloth 1 is conveyed by the conveying section 100 in the substantially horizontal direction, ink is ejected toward the cloth 1 from a plurality of ink ejecting orifices each serving as a printing agent applying element with a downward attitude. At this time, since ink ejection is achieved without any difference in pressure head among the ink ejecting orifices, an excellent image can be formed under uniform ejecting conditions, and moreover, uniform recovering treatment can be conducted for all the ink ejecting orifices.

When the printing heads are arranged while the longitudinal direction of each printing head coincides with the upward/downward direction, after cleaning the ink ejecting plane of each printing head by actuating a wiping blade to be described later, there arises a malfunction that part of the ink remaining on the surface of the printing head is scattered away to enter the interior of the carriage. On the contrary, when the printing heads are arranged while the ink ejecting direction downwardly orients, ink particles scattered from the printing heads fall down away from the printing heads by their own dead weight. Thus, there does not arise the foregoing malfunction.

In this embodiment, the conveying path for the printing medium is arranged in the horizontal direction. Thus, in the case that a medium having high rigidity such as a plate-like material or the like is used as a printing medium, a space required for holding the printing medium can easily be maintained. In addition, in the case that a medium having heavy weight is used as a printing medium, a high intensity of holding force is not required. Consequently, any type of printing medium can easily be handled.

When structural arrangement inclusive of easiness of attachment and detachment of the printing medium is taken into account, it is acceptable that the ink ejecting direction downwardly orients and the conveying path for the recording medium is arranged in the horizontal direction in order to construct the textile printing apparatus with smaller dimensions.

Referring to FIG. 3 again, a flexible cable 1110 is connected to the respective printing heads 1100 in such a manner as to follow the movement of the carriage 1010, whereby various kinds of signals such as head driving signal, head state indicating signal or the like are sent to and received from a controlling unit (not shown). In addition, plural kinds of inks are supplied from an ink supply source 1130 including various kinds of inks via a plurality of flexible tubes 1120.

In this embodiment, since each of the printing heads 1100 is designed in the form of an ink jet head, a special mechanism is arranged in the textile printing apparatus. This special mechanism will be described below with reference to FIG. 4 and FIG. 5.

Reference numeral 1200 designates a recovering unit which serves to hold each printing head 1100 in the recovered state. The recovering unit 1200 performs a recovering operation for each printing head 1100 in order to hold the latter in the ink ejecting state. To this end, the recovering unit 1200 is substantially composed of capping means 1220, clogged state preventing means 1231 and a wiping blade 1270.

The capping means 1220 comes in contact with an ink ejecting orifice plane of each printing head 1100 while any printing operation is not performed, in order to assure that each ink ejecting orifice is not dried, foreign material does not enter each ink ejecting orifice or the foreign material included in the ink ejecting orifice is removed from the latter. Concretely, while any printing operation is not performed, each printing head 1100 is displaced to the position where it faces to the corresponding capping means 1220. Subsequently, the capping means 1220 is driven by driving means 1210 in the capping direction so that each ink ejecting orifice is capped with the capping means 1220 by bringing an elastic member or the like in tight contact with the ink ejecting orifice plane.

Each clogged state preventing means 1231 serves to receive ejected ink when the ink printing head 1100 performs an ink ejecting operation (preliminary ink ejecting operation) for uniformalizing ink ejecting conditions, and ink to be ejected is refreshed by the ink ejecting operation. The clogged state preventing means 1231 is disposed on the support rail 1020 at the position located outside of the printing range defined by the printing head 1100 while facing to the capping means 1220. A liquid receiving member for adsorptively receiving preliminarily ejected ink is disposed not only at the position between the capping means 1220 and the printing range but also at the position on the opposite side to the foregoing position. It should be noted that a liquid holding member is disposed in the liquid receiving member and a sponge-like porous member is used as a material to be employed for the liquid holding member.

Each capping means 1220 is adequately combined with a detergent tank 1260 and an air pump (not shown) in order to eject a detergent from the detergent tank 1260 and blowing air from the air pump.

In addition, a wiping blade 1270 adapted to slidably wipe the ink ejecting orifice plane of the printing head 1100 is disposed at the position between the capping means 1220 and the printing range in order to removably wipe water droplets and dust particles adhering to the ink ejecting orifice plane of the printing head 1100 by slidably displacing the wiping blade 1270.

The printing section 1000 composed of the aforementioned components is constructed in the box-like configuration by using steel sheets or plates. In this embodiment, the structure as shown in FIG. 5 is employed for the printer section 1000 in consideration of simplification of the construction of the printer section 1000 as well as designing of the printer section 1000 with light weight. Specifically, in this embodiment, printer boards 1300 are placed on an opposing pair of side plates 103 in the conveying section, I-shaped steel members 1020 (each serving as a support rail) are supported on the printer boards 1300 at the positions located inside of the opposite ends of the support rails 1020, and scanning rails 1022 are placed on the upper surfaces of the support rails 1020 so as to enable the carriage 1010 to slidably move along the scanning rails 1022. Side plates 1310 for the printer section 1000 are firmly secured to the opposite ends of the support rails 1020, support columns 1320 are fixed to the printer boards 1300, and moreover, a plurality of covers 1330 are attached to the support columns 1320 while extending in parallel with the scanning rails 1022. Recovering units 1200 are arranged in the space between the printer boards 1300 and the side plates 1310.

In this embodiment, since the support rails 1020 are supported at the positions located inside of the opposite ends thereof, a quantity of deflection of each support rail 1020 caused by the displacement of the carriage 1010 varies to a small extent. In addition, the deflection of each support rail 1020 itself can be suppressed to remain at a low level. Further, since it is few required that the outer peripheral surface of the printer section 1000 has a high strength because the skeleton of the printer section 1000 is built by using I-shaped steel members, it becomes possible to construct the outer peripheral wall of the printer section 1000 by using a sheet of metallic material such as steel or the like, resulting in the printer section 1000 being designed and constructed at a reduced cost with light weight.

(3) A sliding mechanism and other items

In this embodiment, the cloth 1 is conveyed in the substantially horizontal direction, and a plurality of printer heads 1100 each designed in the form of an ink jet head are arranged with downward attitude. Thus, the printer section 1000 is located directly above the conveying section 100. In this embodiment, the printer section 1000 is supported by a plurality of side plates 103 for the conveying section 100.

On the other hand, there sometimes arises a necessity for conducting maintenance services such as replacement of the worn conveying belt 130 with new one, repairing of damaged or injured components, cleaning of contaminated components and or the like for the conveying section 100. To practically conduct each maintenance service, it is required that the conveying section 100 is opened. To this end, the printer section 1000 should be evacuated from the position above the conveying section 100 before the latter is opened. In practice, however, it is not desirable that the printer section 1000 is disconnected from the conveying section 100 every time a maintenance service is conducted, because loosening and removing of threads and other tightening components are troublesome in view of dimensions and a weight of the printer section 1000, and moreover, the gap between respective ink ejecting orifices and the cloth 1 (hereinafter referred to simply as a head gap) should be readjusted when the printer section 1000 is mounted on the conveying section 100 after completion of each maintenance service. In this embodiment, the foregoing problem is solved by enabling the printer section 1000 to be slidably displaced between the position located opposite to the conveying section 100 and the non-opposing position spaced away from the preceding position.

Figure 1:
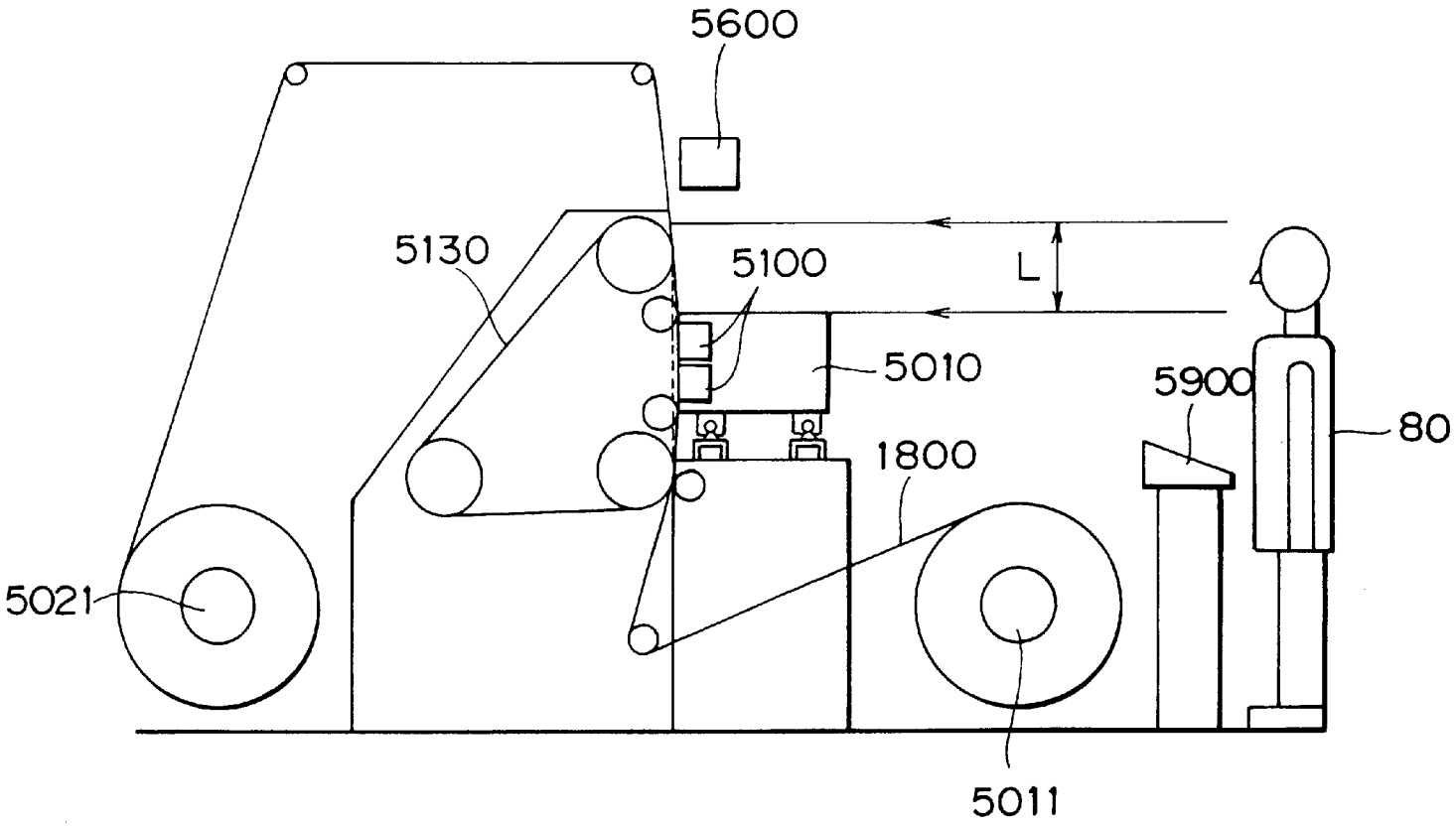
FIG. 1 (PRIOR ART)
FIG. 1 is a schematic sectional side view showing the structure of a conventional image forming apparatus.
Figures 1, 2, 6A:
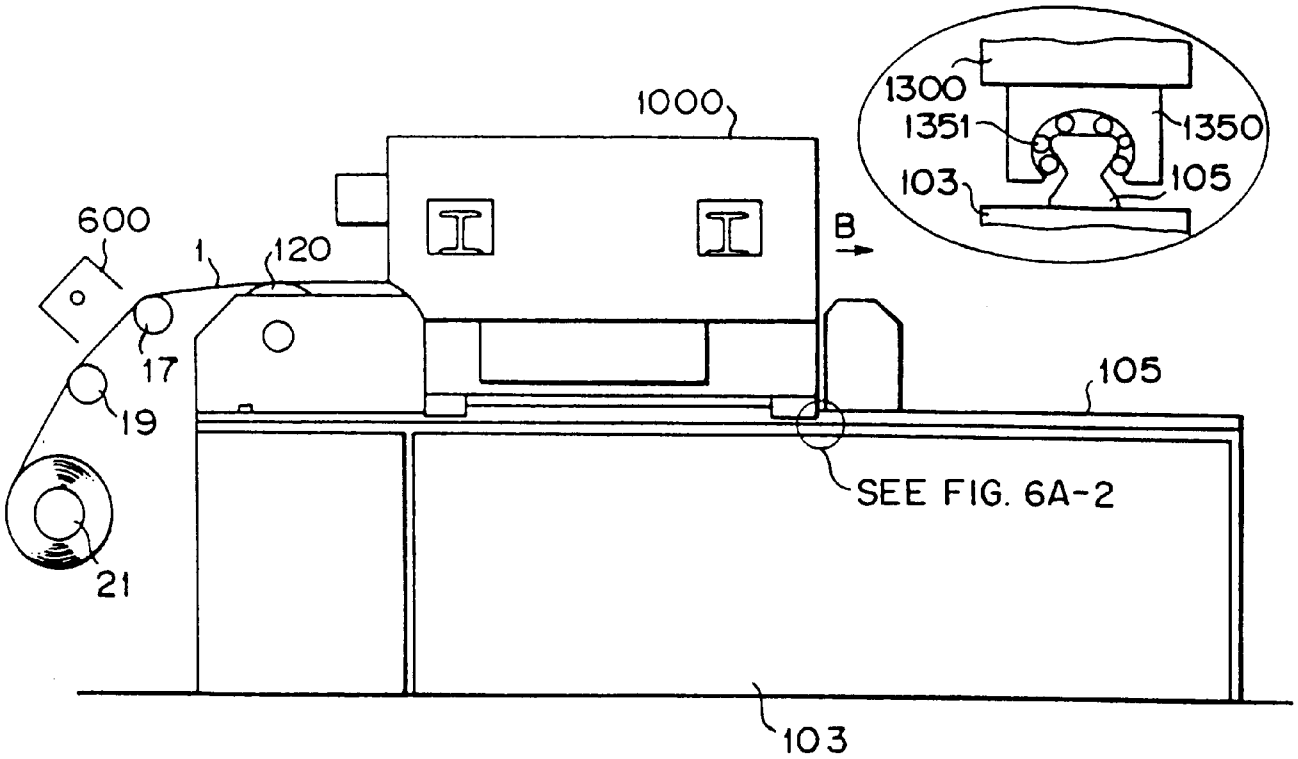
Figure 6B:
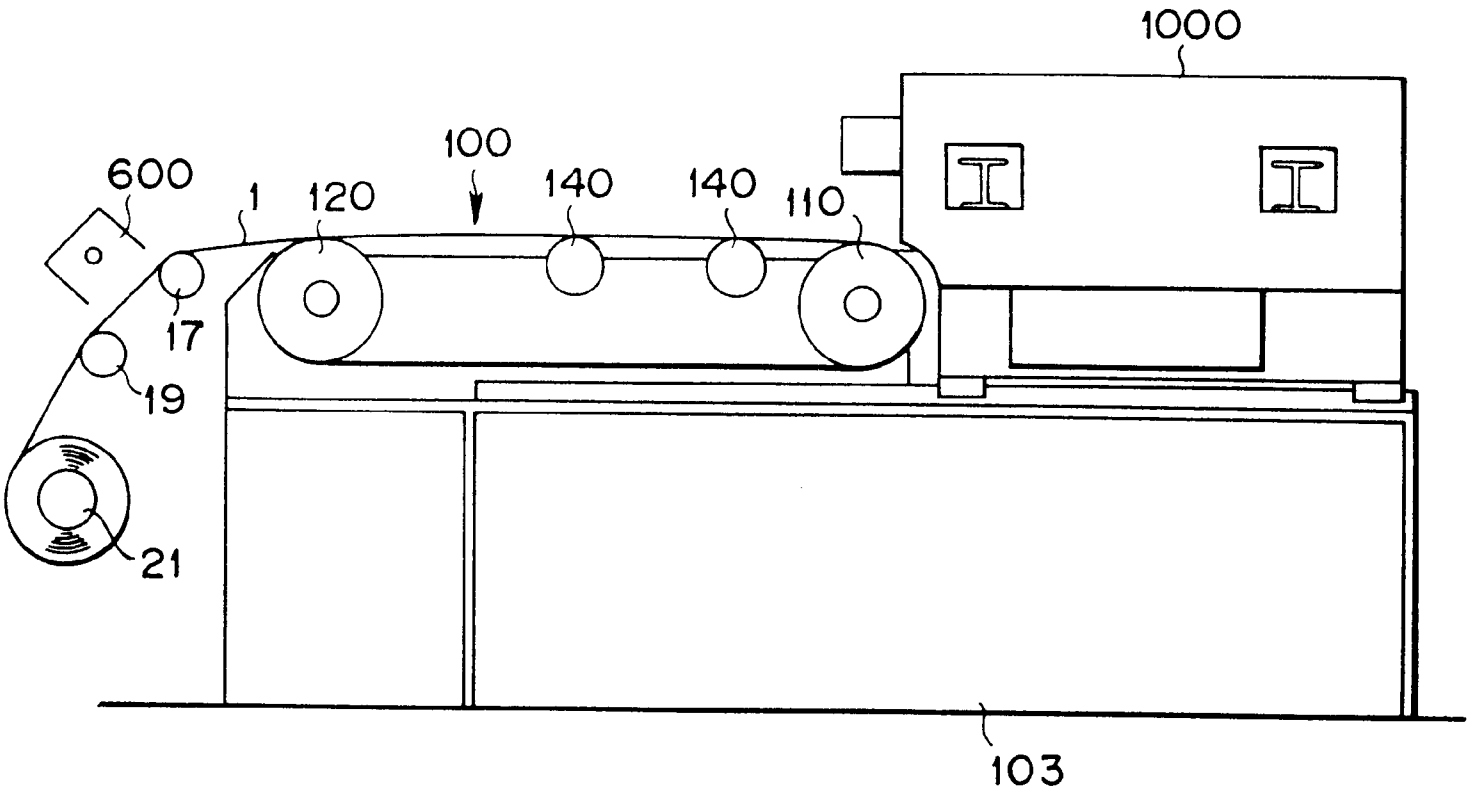

FIG. 6A-1 and FIG. 6B are sectional views which schematically illustrate the structure and operation of the printer section 1000 constructed in consideration of the foregoing problem, respectively. In this embodiment, slide rails 105 are arranged on an opposing pair of side plates 103 for the conveying section 100, and sliders (slide bushes) 1350 are secured to a printer board 1300 of the printer section 1000 so as to allow the sliders 1350 to be engaged with the slide rails 105. With such construction, the printer section 1000 is supported on the side plates 103 for the conveying section 100 via the slide rails 105 and the sliders 135.

Figure 2:
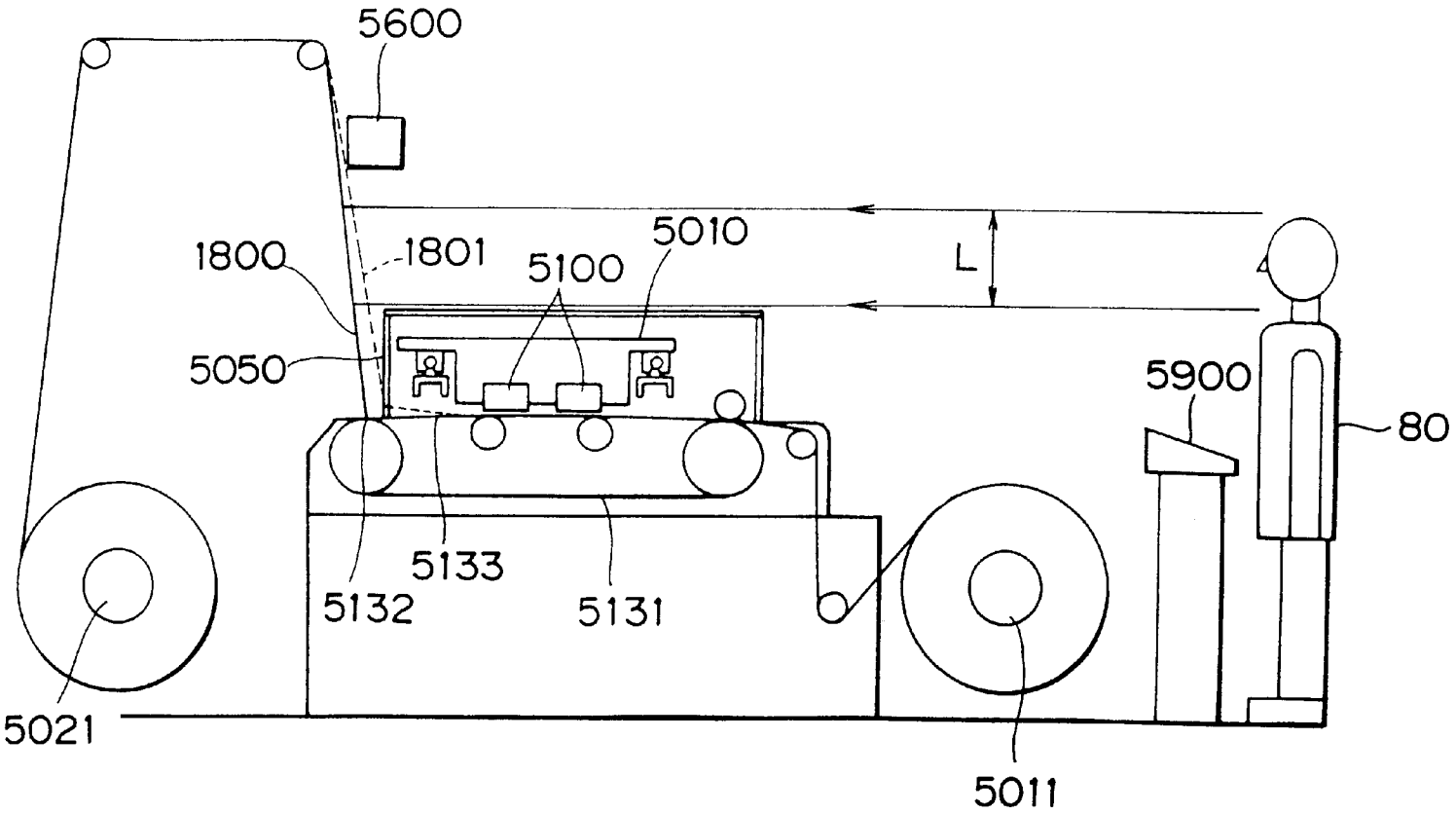
FIG. 2 (PRIOR ART)
FIG. 2 is a schematic sectional side view showing the structure of another conventional image forming apparatus.

As is apparent from FIG. 6A-2 that is a fragmentary enlarged view as seen in the B arrow-marked direction, each slide rail 105 is a member having a substantially I-shaped sectional contour, and the slider 1350 is fitted onto the slide rail 105 via a plurality of balls 1351. When the conveying section 100 is opened, the printer section 1000 is slidably displaced in the B arrow-marked direction so that the interior of the conveying section 100 is exposed to the outside as shown in FIG. 6B. While this state is maintained, each desired operation can be performed. After completion of the operation, the printer section 1000 is returned to the original position above the conveying section 100 as shown in FIG. 6B. It is recommendable that an adequate locking mechanism is disposed not only at the normal printing position (as shown in FIG. 6A) but also at the escaped position (as shown in FIG. 6B) in order to reliably prevent the printer section 1000 from being slidably displaced at each of the foregoing positions.

Specifically, according the shown embodiment, when a certain maintenance service is performed for the conveying section 100, it is sufficient that the printer section 1000 is slidably displaced even though it is constructed with comparatively large dimensions and weight like the textile printing apparatus as shown in the drawings. Consequently, it is not necessary to perform a troublesome operation for allowing the printer section to be connected to and disconnected from the conveying section 100 every time the conveying section 100 is opened for conducting maintenance services as mentioned above. Since the head gap is restrictively defined by engaging the slide rails 105 with the sliders 1350, there does not arise a necessity for readjusting the head gap with the exception of the case that a cloth 1 having a different thickness is used for the textile printing apparatus, as long as a necessary fitting accuracy is maintained for the slide rails 105 and the sliders 1350. Incidentally, a mechanism for adjusting the head gap corresponding to the thickness of the cloth 1 will be described later.

Figure 7:
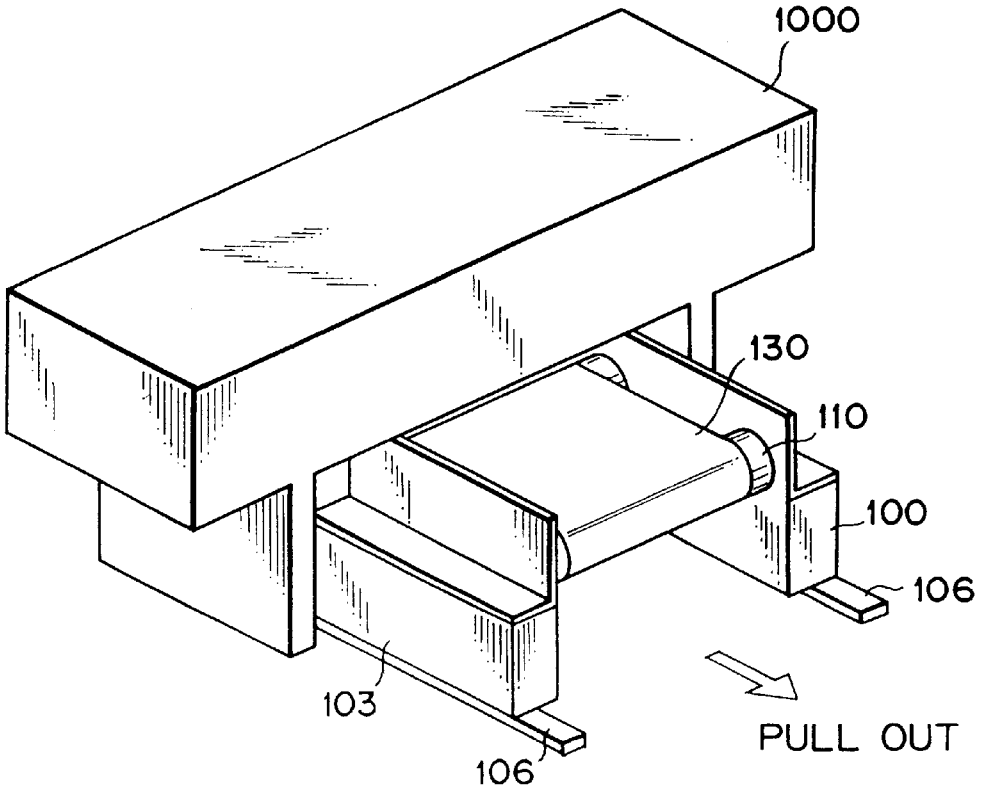
FIG. 7 is a schematic perspective view showing an embodiment wherein the conveying section is slidably displaced away from and toward the printer section.

In the aforementioned embodiment, the printer section 1000 is displaced away from and toward the conveying section 100. Alternatively, the conveying section 100 itself may be slidably displaced in such a manner that the printer section 1000 is immovably mounted on a housing of the textile printing apparatus and the conveying section 100 is supported on slide rails 106 via sliders (not shown) fitted to the lower surfaces of the side plates 103 as shown in FIG. 7.

Next, description will be made below with respect to an operation for exchanging the conveying belt 130 with another one as an example of maintenance services to be conducted for the conveying section 100 which is opened by escapably displacing the printer section 1000 away from the conveying section 100 as shown in FIG. 6B.

Figure 8A:
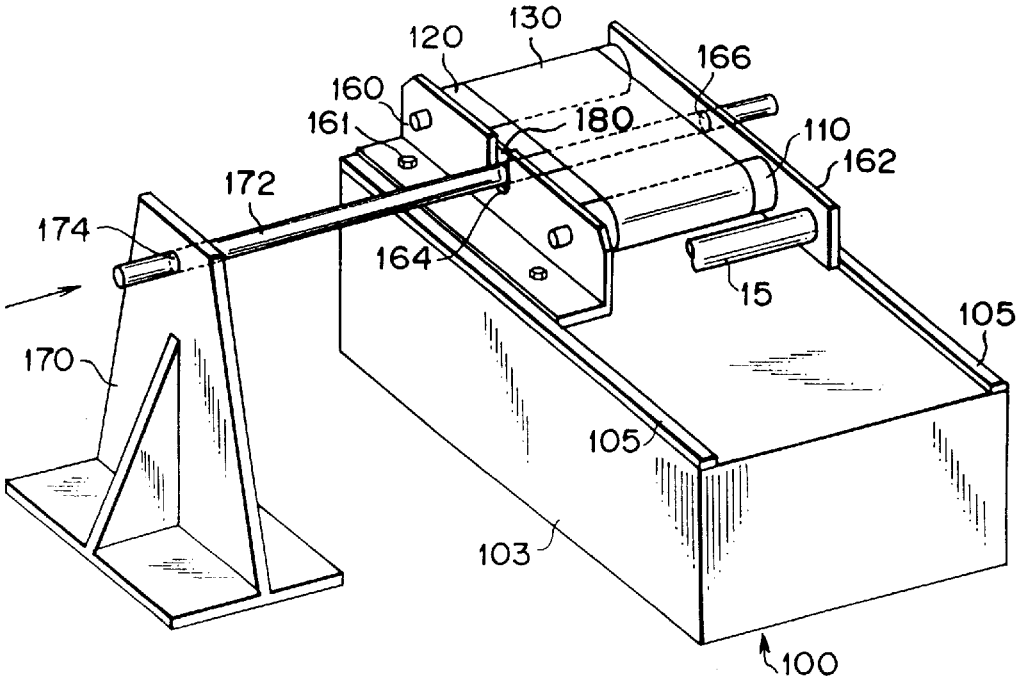
FIG. 8A is a schematic perspective view showing an apparatus and a method for fitting a conveying belt to the conveying section and removing the former from the latter.
Figure 8B:
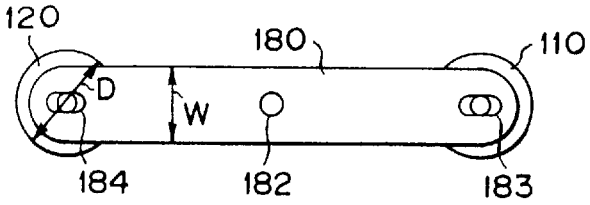
FIG. 8B is an explanatory side view showing an inside frame disposed sideward of the conveying belt.
Figure 9:
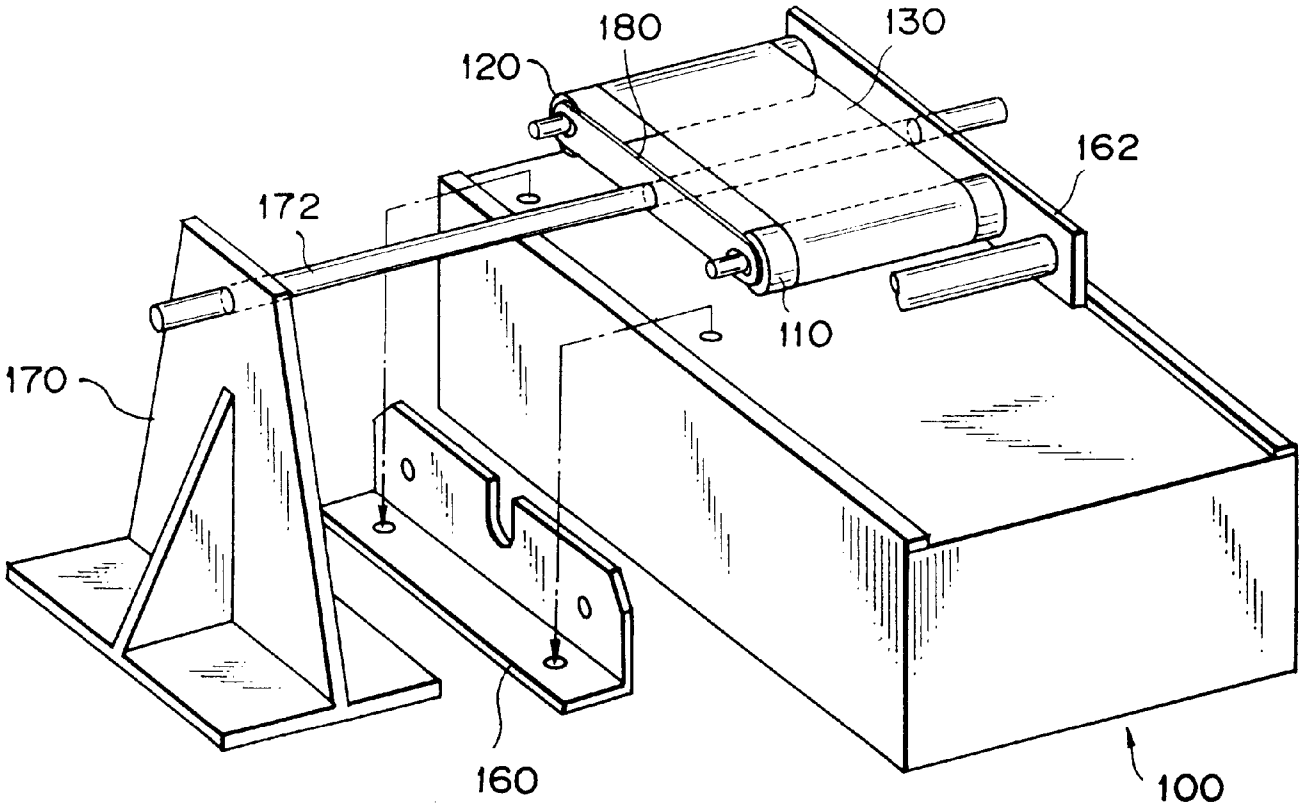
FIG. 9 is an explanatory perspective view showing the conveying belt fitting and removing method.
Figure 10:
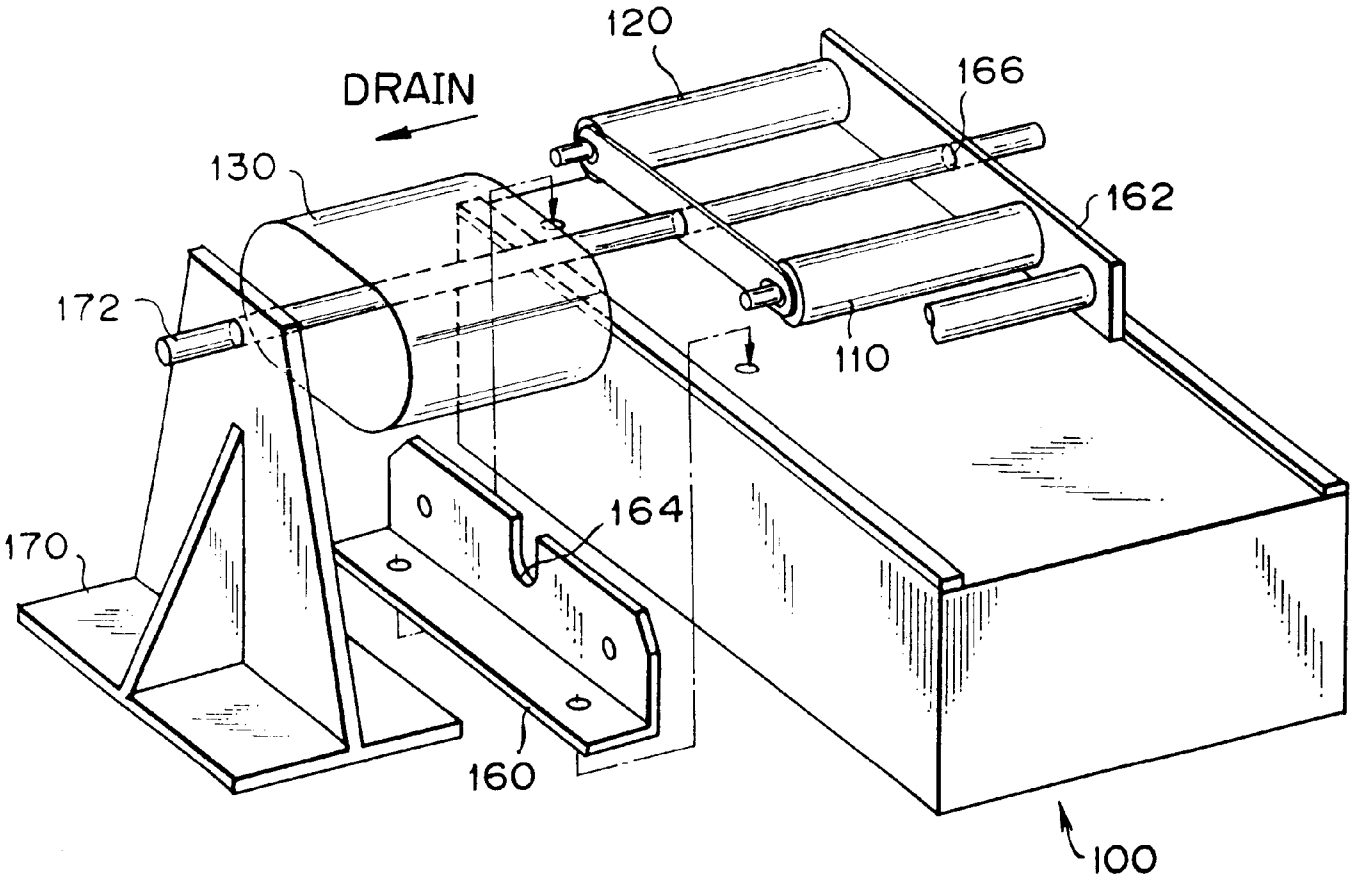
FIG. 10 is another explanatory perspective view showing the conveying belt fitting and removing method.

FIG. 8 to FIG. 10 show a procedure for achieving the foregoing exchanging operation, respectively.

In FIG. 8A, reference numerals 160 and 162 designate an opposing pair of side plates which are disposed on the upper surface of the conveying section 100 at the positions located inside of the side plates 103 for the conveying section 100 for rotatably supporting conveying rollers 110 and 120 (or platen rollers 140), respectively. A U-shaped groove 164 is formed on the one side plate 160 for receiving a support shaft 172 therein, and a bearing hole 166 is formed on the other side plate 162 for receiving the outer end part of the support shaft 172 therethrough.

To assure that both the conveying rollers 110 and 120 are smoothly rotated, bearings are fitted into roller bearing parts of the side plates 160 and 162, and bearings at least for one conveying roller (e.g., the follower roller 110) are fitted into the side plates 160 and 162 so as to be dislocated at a certain distance in the conveying direction of the cloth 1. The bearings for the one conveying roller are normally biased by the resilient force of a spring or a similar member in such a direction that the distance between both the conveying rollers 110 and 120 is enlarged, causing a certain intensity of tension to be applied to the conveying belt 130. A pair of platen rollers 140 as shown in FIG. 3 are arranged between both the conveying rollers 110 and 120, and the uppermost ends of the platen rollers 140 are located slightly above the plane as defined by the line extending between the uppermost ends of both the conveying rollers 110 and 120 in order to improve flatness of the conveying belt 130 or the cloth 1 within the printing range. With this construction, a certain intensity of tension is applied to the conveying belt 130, and in this embodiment, since the distance between both the conveying rollers 110 and 120 can be changed corresponding to the intensity of tension (in other words, the distance therebetween can be reduced against the resilient force of the spring), the intensity of tension to be applied to the conveying belt 130 can be adjusted to an adequate value.

In FIG. 8A and FIG. 8B, reference numeral 180 designates an inside frame disposed inside of the one side plate 160. A hole 182 for allowing the support shaft 172 to be inserted therethrough is formed on the inside frame 180, and moreover, elongated holes 183 and 184 are likewise formed on the inside frame 180 for enabling both the conveying rollers 110 and 120 to be relatively displaced away from and toward each other. As shown in FIG. 8B, a width W of the inside frame 180 is dimensioned to be smaller than a diameter D of each of the conveying rollers 110 and 120. Thus, there does not arise a malfunction that the conveying belt 130 interferes with the conveying rollers 110 and 120 when it is exchanged with another one.

A procedure of achieving the operation for exchanging the conveying belt 130 with another one will be described below with reference to FIGS. 8A and 8B to FIG. 10.

When the conveying belt 130 is removed from the conveying section 100, first, a support platform 170 is placed sideward of the conveying section 100, and the support shaft 172 is inserted through a bearing hole 174 formed through the support platform 170. In addition, the support shaft 172 is inserted through the U-shaped groove 164 on the one side plate 160, a hole 182 on the inside frame 180 and a bearing hole 166 on the other support plate 162 while the outer end part of the support shaft 172 is pivotally supported by the bearing hole 166.

As is apparent from FIG. 8A, since the conveying rollers 110 and 120 and the conveying belt 130 are supported by the support platform 170, the inside frame 180 and the side plate 162, the side plate 160 can be disconnected from the conveying section 100 by loosening and removing bolts 161 as shown in FIG. 9. While the foregoing state is maintained, the conveying belt 130 becomes entirely free. At this time, the conveying belt 130 can easily be drawn from the conveying section 100 in the A arrow-marked direction in FIG. 10.

Thereafter, when the side plate 160 is firmly mounted on the conveying section 100 again from the disconnected state shown in FIG. 10, the support shaft 172 is supported by the U-shaped groove 164 and the bearing hole 166, whereby the conveying belt 130 can be removed from the conveying section 100 while the support platform 170 is dislocated away from the shown position.

Subsequently, a new conveying belt 130 is placed around the support shaft 172, and the support platform 170 is mounted again at the original position. While this state is maintained, the support shaft 172 is held by the support platform 170 and the bearing hole 166. Thus, the support plate 160 can be disconnected from the conveying section 100.

Thereafter, the new conveying belt 130 is displaced past the inside frame 180 so that it is spanned between both the conveying rollers 110 and 120. Subsequently, when the side plate 160 is firmly mounted on the conveying section 100, the belt exchanging operation is completed.

Finally, the support shaft 172 is drawn from the conveying section 100, and it is then dislocated away from the conveying section 100 together with the support platform 170.

According to the aforementioned embodiment, the conveying belt 130 can easily be replaced with another one merely with the aid of manual force even though each of the conveying rollers 110 and 120 and other components has a heavy weight.

The textile printing apparatus constructed in the above-described manner may adequately be modified. For example, the number of support shafts may increasingly be set to two or more depending on the weight of each conveying roller and other factors. In connection with the above description on the textile printing apparatus, illustration of the structure of each platen roller 140 shown in FIG. 3 is omitted for the purpose of simplification. However, bearing portions for the platen rollers 140 may be constructed in the same manner as those for the conveying roller 110, and moreover, the platen rollers 140 may be displaced in the upward/downward direction as will be described later. For example, with respect to each platen roller 140, one bearing is fitted into the one side plate 160 via the inside frame 180, while other bearing is fitted into the other side plate 162.

In the case of this embodiment, the labelling roller 150 disposed for bringing the cloth 1 in adhesive contact with the tacky layer 133 of the conveying belt 130 is located on the printer section 1000 side. To improve properties of adhesiveness, the labelling roller 150 is normally biased toward the conveying roller 110. In view of the foregoing fact, it is preferable that the textile printing apparatus is constructed in such a manner as not to obstruct the slidable movement of the printer section 1000 at all when a maintenance service or the like is performed for the conveying section 100.

Figure 11A:
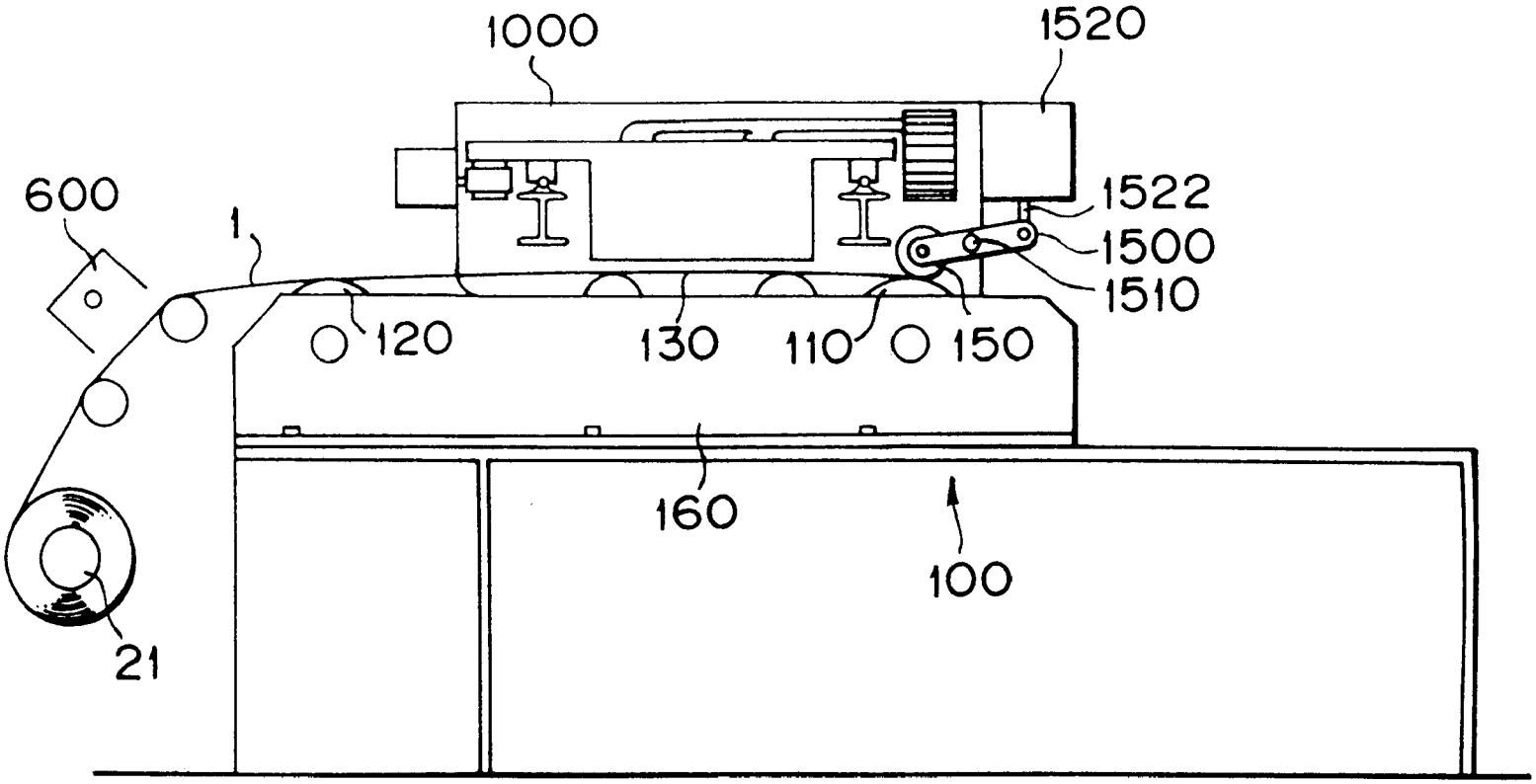
FIG. 11A and FIG. 11B are schematic side views showing an embodiment wherein a labelling roller is engaged with and disengaged from the conveying section by slidably displacing the printer section, respectively.
Figure 11B:
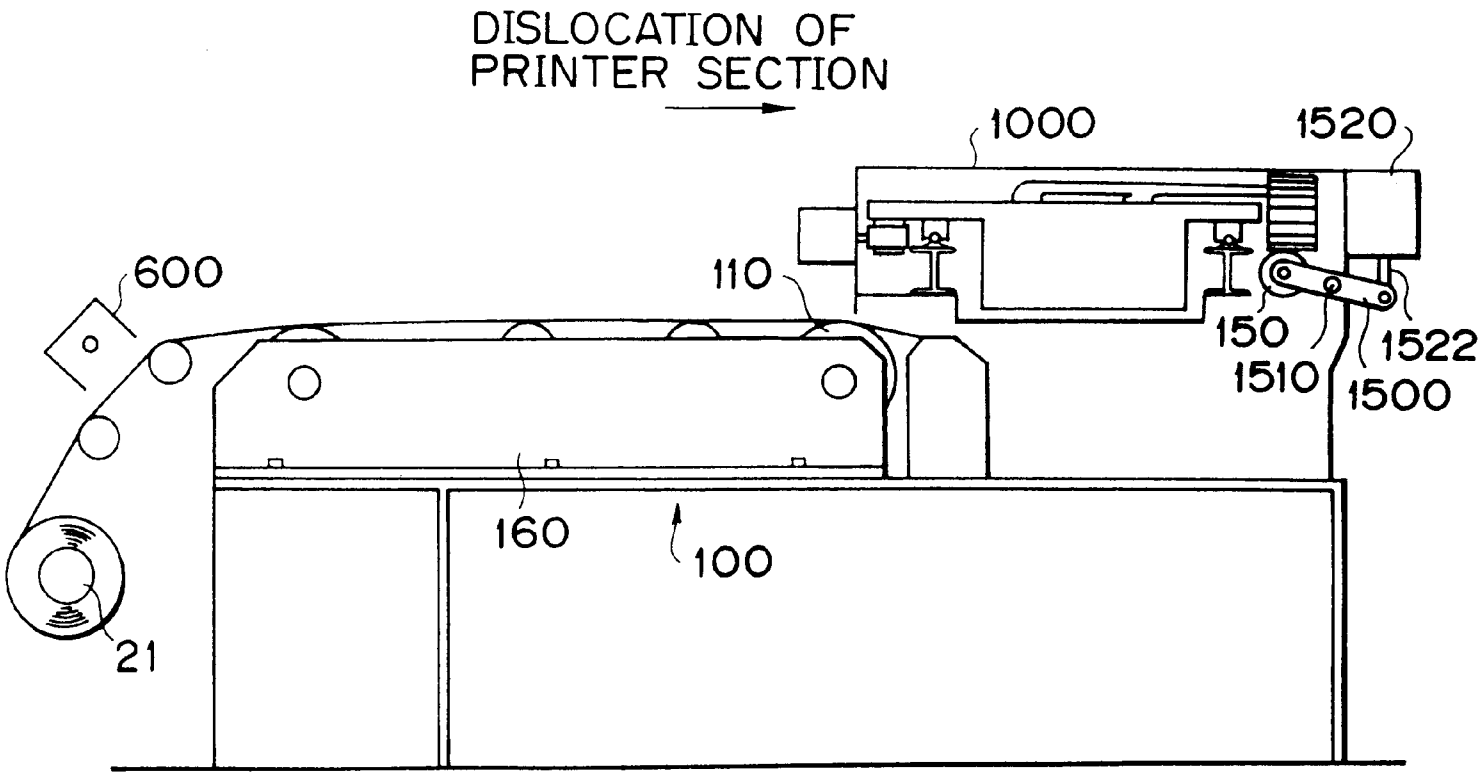

FIG. 11A and FIG. 11B are schematic side views which illustratively shows the structure of the textile printing apparatus constructed in consideration of the foregoing requirement and a mode of operation of the same, respectively. In the shown embodiment, the labelling roller 150 is supported by one end of an arm 1500, and the intermediate part of the arm 1500 is pivotally supported by a shaft 1510 disposed on the printer section 1000. A rod 1522 of a pneumatic cylinder 1520 is operatively connected to other end of the arm 1500 so that the arm 1500 is turned about the shaft 1510 corresponding to forward/rearward displacement of the rod 1522 caused by actuation of the pneumatic cylinder 1520. This makes it possible to bias the labelling roller 150 against the labelling roller 110 or release the labelling roller 150 from the biased state.

Specifically, referring to FIG. 11A, the pneumatic cylinder 1520 is actuated to displace the rod 1522 in the rearward direction, causing the labelling roller 150 to be biased against the conveying roller 110. While the foregoing state is maintained, it is possible to execute a printing operation with the textile printing apparatus. When a maintenance service or the like is performed for the conveying section 100, the pneumatic cylinder 1520 is actuated to displace the rod 1522 in the forward direction, whereby the labelling roller 150 is sufficiently parted away from the conveying roller 110. Subsequently, when the printer section 1000 is slidably displaced as shown in FIG. 11B while the foregoing state is maintained, the labelling roller 150 does not interfere with the slidable displacement of the printer section 1000. In addition, when the printer section 1000 is returned to the original position where each printing operation is achieved, it is slidably displaced as the state shown in FIG. 11B is left unchanged, and thereafter, the rod 1522 is displaced in the rearward direction when it reaches the predetermined position. At this time, any interference does not occur between the labelling roller 150 and the conveying roller 110.

Provided that the labelling roller 150 is not immovably held without any biasing of the labelling roller 150 against the conveying roller 110 but it is resiliently supported to such an extent that it does not obstruct the slidable displacement of the printer section 1000, the textile printing apparatus may be constructed in the following manner.

Figure 12A:
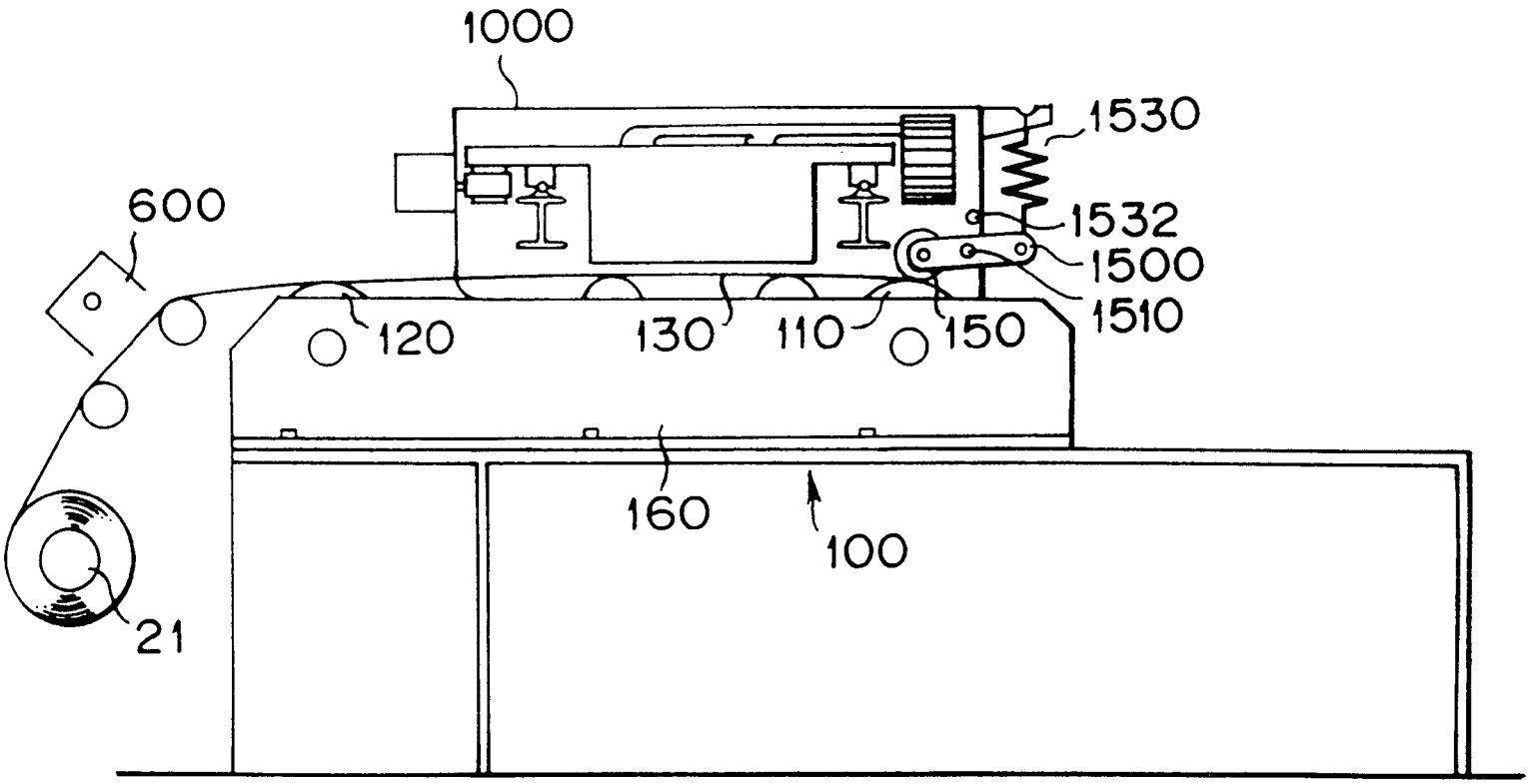
FIG. 12A and FIG. 12B are schematic side views showing another embodiment wherein a labelling roller is engaged with and disengaged from the conveying section by slidably displacing the printer section, respectively.
Figure 12B:
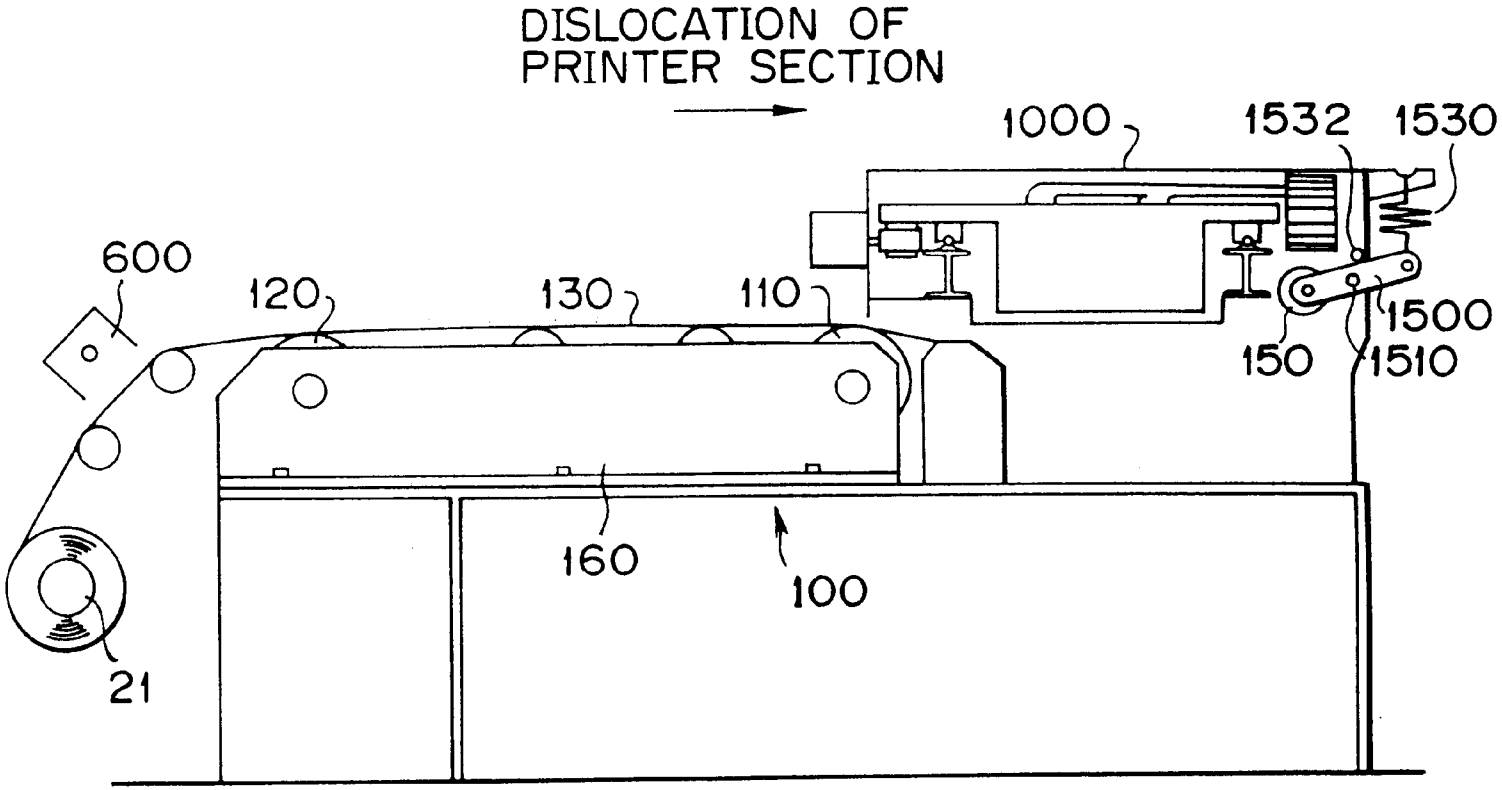

Specifically, as shown in FIG. 12A and FIG. 12B, the right-hand end of the arm 1500 is resiliently supported by a tension spring 1530 so that the arm 1500 is normally biased to turn about the labelling roller 150 in the anticlockwise direction. Thus, the labelling roller 150 is biased against the conveying roller 110. While the state of the printer section 1000 shown in FIG. 12A is transferred to the state of the same shown in FIG. 12B, the labelling roller 150 is permitted to vertically move as the tension spring 1530 is expanded or contracted. For this reason, there does not arise a malfunction that the slidable movement of the printer section 1000 is largely obstructed. In the drawings, reference numeral 1532 designates a stopper. The stopper 1532 collides against the arm 1500 in the course of the slidable displacement of the printer section 1000 for preventing the arm 1500 from being turned in excess of a necessary angle in order to assure that the labelling roller 150 is smoothly brought in contact with the conveying roller 110.

In the embodiment shown in FIGS. 11A and 11B and FIGS. 12A and 12B, the labelling roller 150 is supported on the printer section 1000 side. Alternatively, the labelling roller 150 may be supported on the base side of the textile printing apparatus so as to bias it against the conveying roller 110 and release it from the biased state.

Figure 13A:
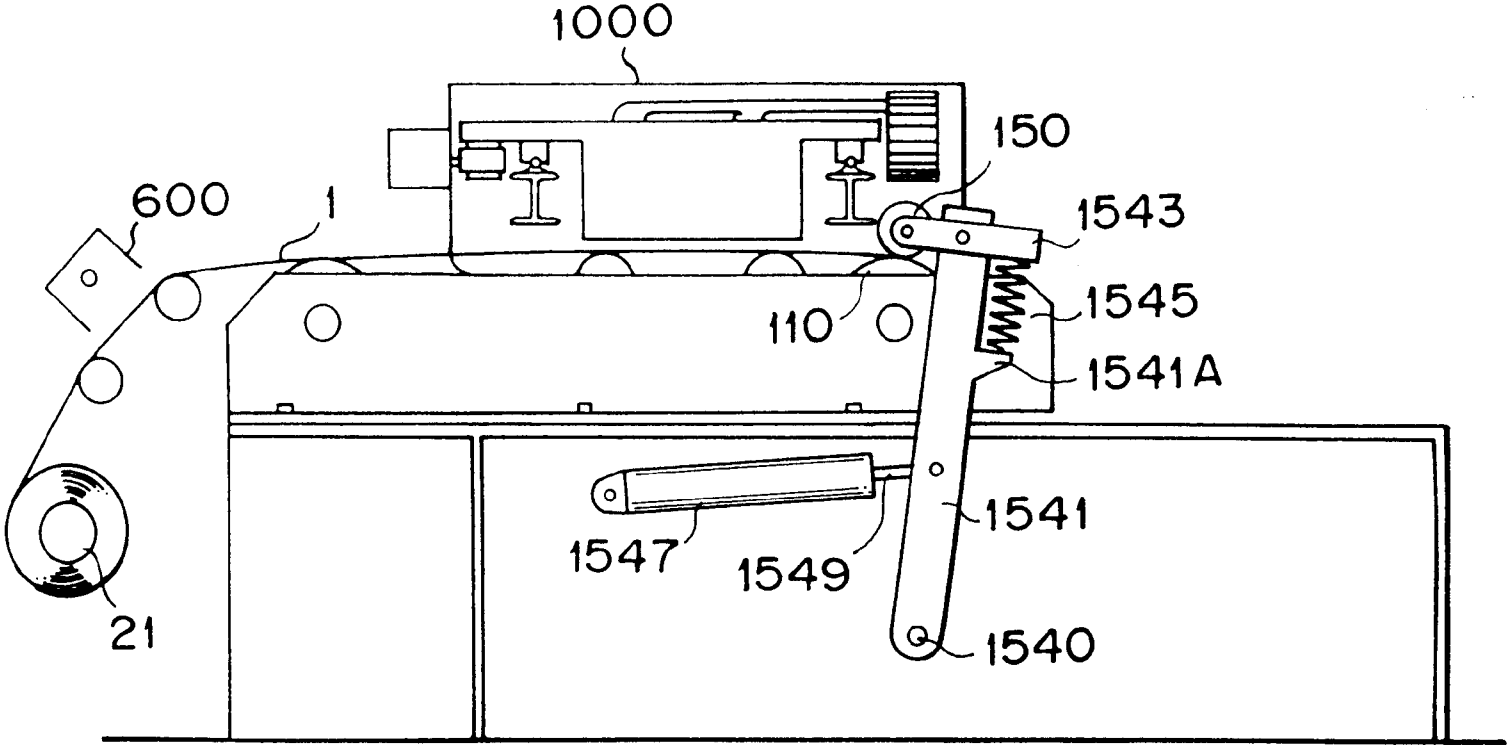
FIG. 13A and FIG. 13B are schematic side views showing further embodiment wherein a labelling roller is engaged with and disengaged from the conveying section by slidably displacing the printer section, respectively.
Figure 13B:
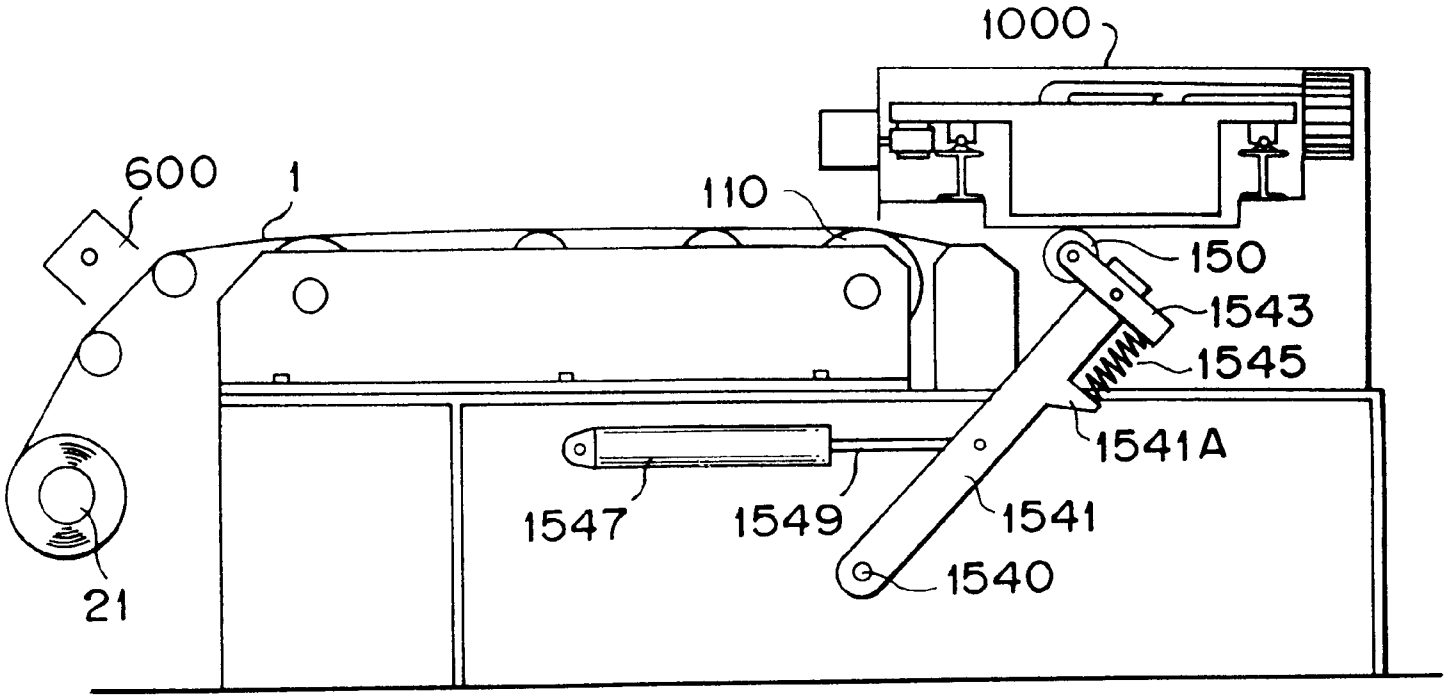

FIG. 13A and FIG. 13B are schematic side views which illustrate the structure of the textile printing apparatus constructed in consideration of the foregoing structural requirement and a mode of operation of the same, respectively. In this embodiment, the textile printing apparatus includes an arm 1541 of which one end is turnably supported to turn about a shaft 1540 disposed on the base side thereof and an arm 1543 pivotally supported on the other end side of the arm 1541. A labelling roller 150 is rotatably fitted to the left-hand end of the arm 1543, and a spring 1545 is spanned between the right-hand end of the arm 1543 and a protuberance 1541A of the arm 1541. With this construction, the labelling roller 150 is adequately biased toward the conveying roller 110 by the resilient force of the spring 1545 while assuring that the labelling roller 150 is smoothly brought in contact with the conveying roller 110, and moreover, the former is smoothly released from the contact state of the latter. In addition, a rod 1549 of a pneumatic cylinder 1547 is engaged with the intermediate part of the arm 1541, and when the rod 1549 is driven in the forward/rearward direction, the printer section 1000 is displaced to the operative position where a printing operation can be performed (see FIG. 13A) or to the inoperative position wherein the slidable movement of the printer section 1000 is permitted without any particular obstruction (see FIG. 13B).

Referring to FIG. 11 and FIG. 13, a pneumatic cylinder is employed as driving means for escapably displacing the labelling roller 150. Alternatively, other type of driving means, e.g., a hydraulic cylinder, a solenoid valve or the like may be employed in place of the pneumatic cylinder.

Various kinds of material can be employed for the adhesive layer 133 placed on the conveying belt 130. For example, in the case that the adhesive layer 131 is composed of a double-sided adhesive tape, it is necessary to prepare means for thrusting one surface of the double-sided adhesive tape against the conveying belt 130. To this end, it is acceptable that a roller exclusively usable for the thrusting means is disposed. Otherwise, the labelling roller 150 employed for the textile printing apparatus constructed in accordance with the shown embodiment may serve also as thrusting means. In this case, the double-sided adhesive tape can be placed on the adhesive layer 131 by inserting the latter into the nip portion between the conveying roller 110 and the labelling roller 150 and then driving the conveying belt 130. In this case, it is recommendable that a material exhibiting poor adhesiveness is employed for the labelling roller 150.

The aforementioned mechanism for slidably displacing the printer section is constructed based mainly on the technical concept that the respective printing heads are arranged with a downward attitude and the cloth facing to these printing heads is conveyed in the horizontal direction. A modified embodiment to be described below is practiced by positively utilizing the structure for conveying the cloth in the horizontal direction.

Since the conventional ink jet textile printing apparatus is constructed such that a cloth labelling roller for allowing the cloth to adhere to the conveying belt is disposed below the printer section, in the case that the cloth labelling roller is utilized when a new tacky sheet adheres to the conveying belt, a printer unit and associated components become an obstacle, resulting in the tacky sheet failing to simply adhere to the cloth conveying belt. In view of the foregoing problem, usually, an exclusively usable tacky sheet labelling roller is prepared for peeling the used tacky sheet exhibiting degraded adhesiveness from the conveying belt and then allowing a new adhesive tape to adhere to the same when a maintenance service is performed for the textile printing apparatus.

In contrast with the conventional textile printing apparatus, according to the modified embodiment, since the textile printing apparatus is constructed such that the cloth is conveyed in the printing range in the horizontal direction, the cloth labelling roller is not covered with the printer unit and associated components, and it becomes easy to dispose the cloth labelling roller at the position where it can visually be recognized from the outside of the textile printing apparatus. This makes it possible to use the cloth labelling roller also for the purpose of allowing the tacky sheet to adhere to the conveying belt.

Figure 62:
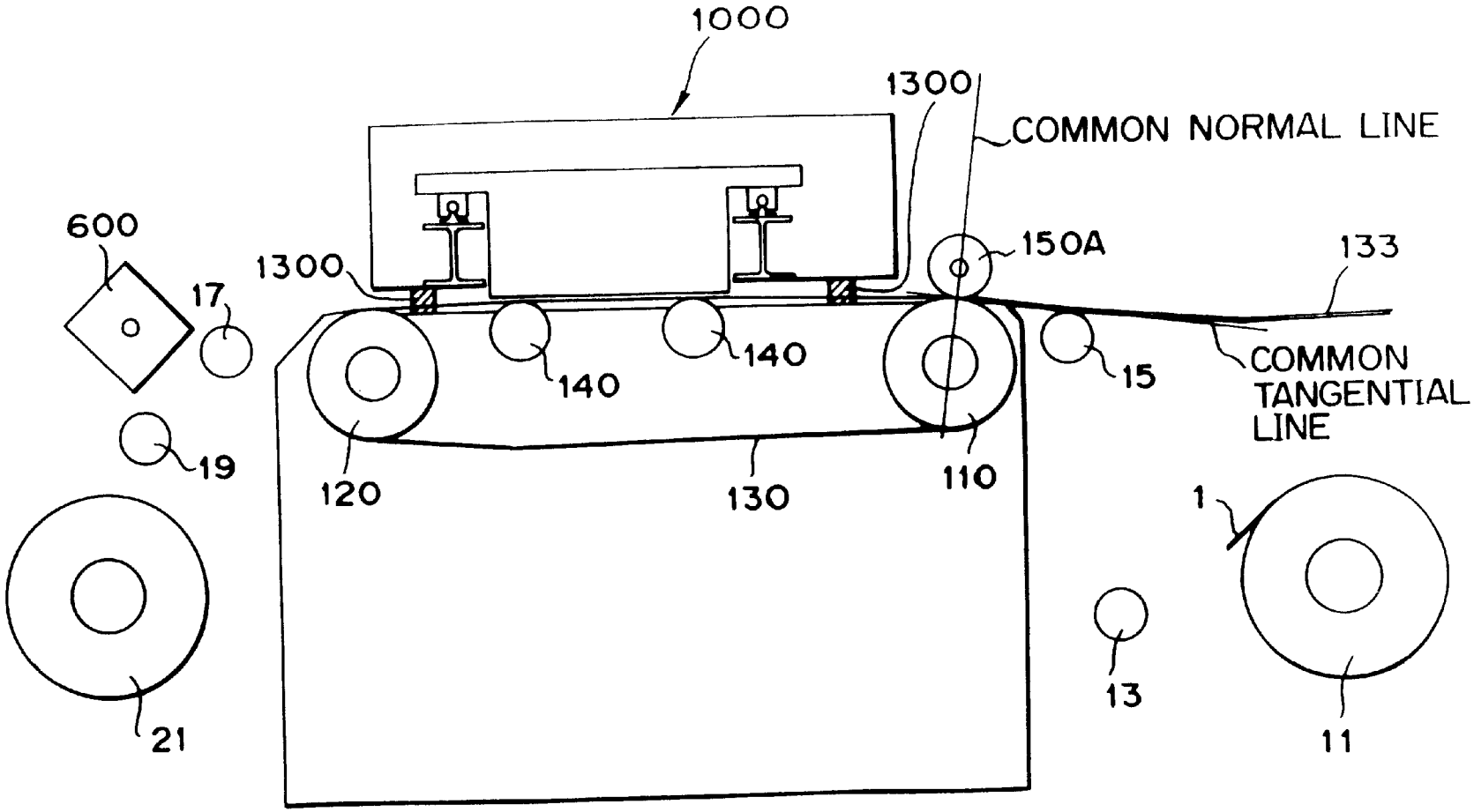
FIG. 62 is a schematic sectional view showing the structure of textile printing apparatus including a cloth labelling roller in accordance with a modified embodiment of the present invention.
Figure 63:
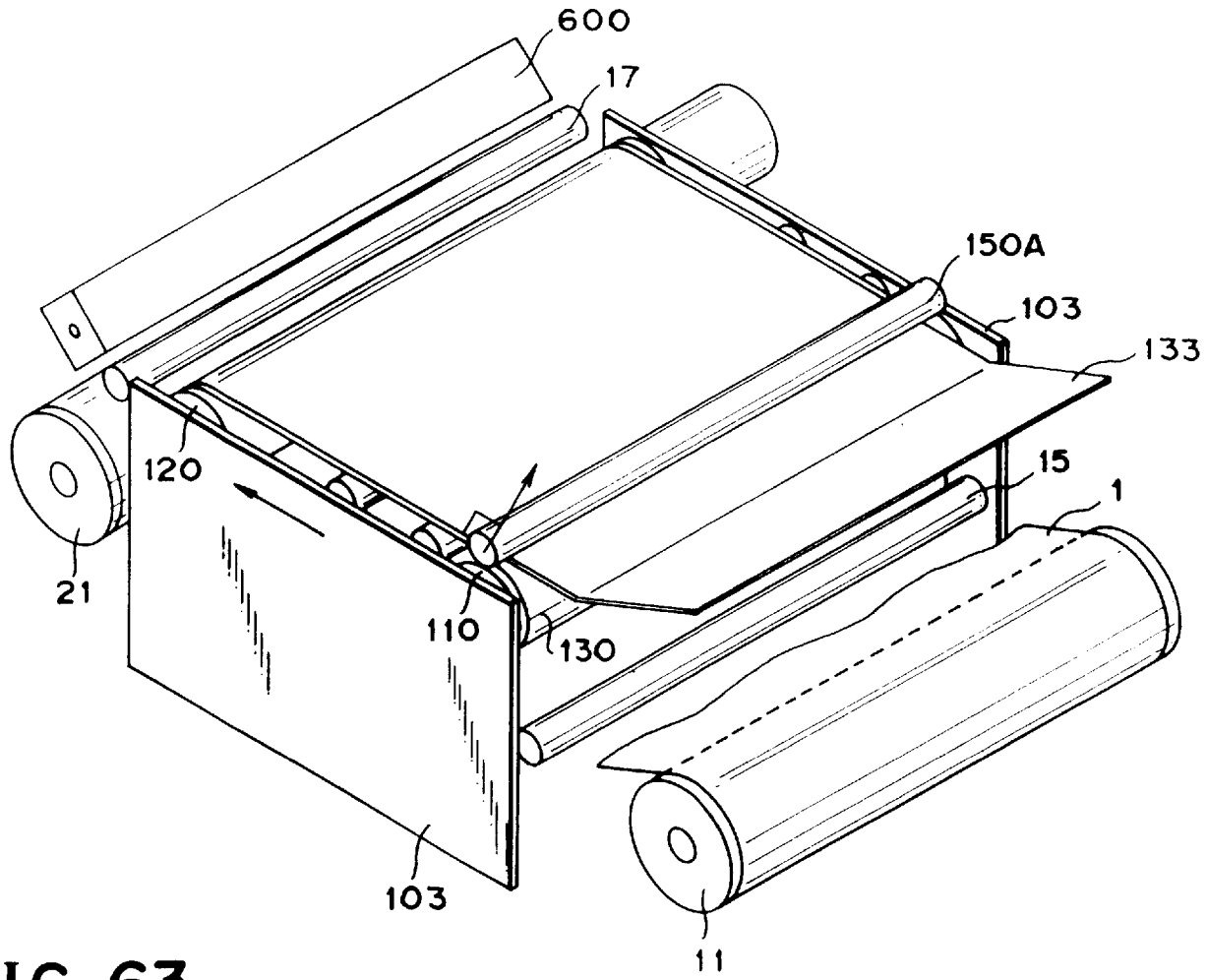
FIG. 63 is a perspective view of a textile printing apparatus including a cloth labelling roller in accordance with another modified embodiment of the present invention.

FIG. 62 is a schematic sectional view of a textile printing apparatus constructed in accordance with the modified embodiment, and FIG. 63 is a perspective view of the textile printing apparatus shown in FIG. 62. Same or similar components shown in the drawings as those in the preceding embodiment are represented by same reference numerals, and repeated description on these components is herein omitted for the purpose of simplification.

As a cloth 1 is conveyed from an unwinding roller 11 via intermediate rollers 13 and 15 during a normal printing operation, a cloth labelling roller 150A is used for allowing the cloth 1 to adhere to a conveying belt 130 by thrusting the cloth 1 against the conveying belt 130. As described above with reference to FIG. 3 and others, adhesive fitting of the cloth 1 to the conveying belt 130 is attributable to the fact that a tacky sheet 133 is preliminarily placed on the conveying belt 130, and subsequently, the cloth 1 is adhesively fitted to the tacky sheet 133 on the conveying belt 130.

As the cloth is repeatedly adhesively connected to and disconnected from the tacky sheet during conveyance of the cloth, properties of adhesiveness of the tacky sheet are increasingly deteriorated. For this reason, the tacky sheet is exchanged with a new one every time a predetermined period of time elapses.

Figure 61:
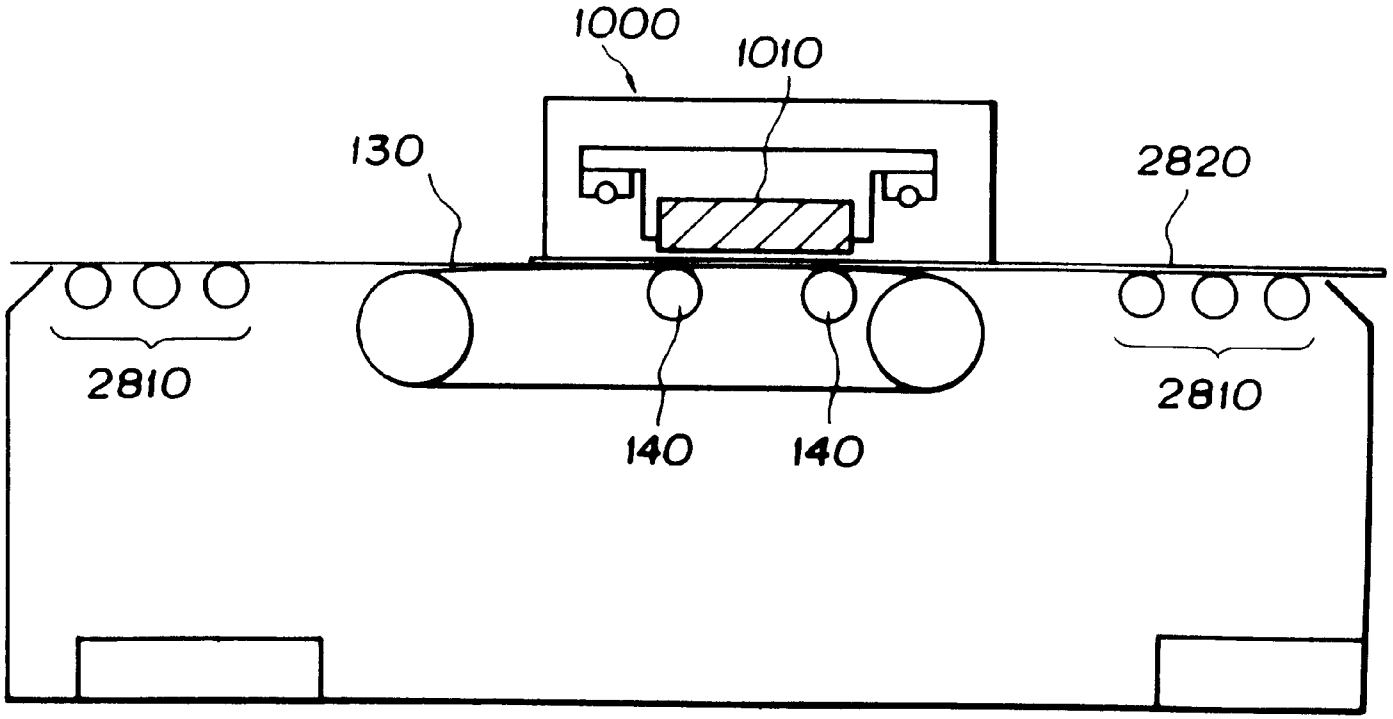
FIG. 61 is a side view showing an embodiment wherein images are printed on a plate-like material in the textile printing apparatus.

At the time of exchanging the tacky sheet, a new tacky sheet 133 is inserted into the gap between the cloth labelling roller 150 and the conveying belt 130 placed on a conveying roller 110 in a conveying section 100 in the same direction as the conveying direction of the cloth 1, i.e., in the horizontal direction as shown in FIG. 60 and FIG. 61. Thereafter, the tacky sheet 133 is adhesively fitted to the conveying belt 130 by thrusting the tacky sheet 133 against the conveying belt 130 by the cloth labelling roller 150A. It should be noted that one surface of the tacky sheet 133 adapted to come in contact with the cloth labelling roller 150A during conveyance of the cloth 1 is adhesively fitted to a sheet of paper, while other tacky surface of the tacky sheet 133 to be adhesively fitted to the conveying belt 130 is covered with an adequate peelable material.

While the tacky sheet 133 is adhesively fitted to the conveying belt 110, the space located upstream of the cloth labelling roller 150A (i.e., the right-hand space as seen in FIG. 62) is not located within the range defined by a cloth conveying section, a printer section 1000 and printer boards 1300 for supporting the printer section 1000 thereon. Consequently, insertion of the tacky sheet 133 into the cloth conveying section can easily be achieved. In addition, since the cloth labelling roller 150A is disposed on a plane extending at a right angle relative to the cloth conveying direction (i.e., in the direction represented by a common tangential line in FIG. 62), insertion of the tacky sheet 133 into the cloth conveying section can more easily be achieved.

In the modified embodiment, the printer section 1000 is held immovable relative to the conveying section (i.e., the housing side of the textile printing apparatus). Otherwise, when the textile printing apparatus is constructed such that the printer section 1000 can be displaced in the leftward direction as seen in FIG. 62, insertion of the tacky sheet 133 into the conveying section can easily be achieved by displacing the printer section 1000 in that way when the tacky sheet 133 is inserted into the conveying section, even though the cloth labelling roller 150A is covered with the printer section 1000 in the normal state.

In addition, since the one surface of the tacky sheet 133 is protectively covered with a sheet of paper as mentioned above when the tacky sheet 133 is adhesively fitted to the conveying belt 130, there does not arise any particular necessity for taking account of a material for the adhesive labelling roller 150A. Alternatively, when the surface of the cloth labelling roller 150A is coated with, e.g., a fluororesine, conveyance of the cloth 1 is not largely affected by the coated layer of the cloth labelling roller 150A after the latter comes in contact with the tacky surface of the tacky sheet 133 because the cloth labelling roller 150A in not adhesively fitted to the tacky surface. Thus, it is not necessary that the one surface of the tacky sheet 133 is protectively covered with a sheet of paper as mentioned above. Incidentally, the fluororesin is typically exemplified by polytetrafluroroethylene, perfluororalkoxy fluororesin, tetrafluoroethyenehexafluoropolypropylene copolymer, ethylenetetrafluoroethylene copolymer, vinylidene fluoride, polychlorotrifluoroethylene and vinyl fluoride.

According to each of the aforementioned embodiments, the textile printing apparatus is constructed such that the labelling roller is exposed to the outside at the position located outside of the printer section. With this construction, it becomes easy to insert the tacky sheet into the gap between the labelling roller and the conveying roller, and moreover, the labelling roller can serve also as a tacky sheet labelling roller.

In addition, since the surface of the labelling roller is coated with a fluorine resin, the labelling roller exhibits excellent properties of low frictionality, elongated running life, high cleanability and improved peelability.

In the case that the labelling roller is disposed on a plane extending at a right angle relative to the conveying direction of the cloth, since a conveyance path for the cloth can be constructed in the form of a plane having no curved part, it is possible to convey not only the cloth but also a paper, a steel sheet or a similar material having high rigidity.

(4) An HS station

With respect to an image forming apparatus including a plurality of ink jet heads each having a number of ink ejecting orifices arranged therein, to prevent fluctuation in density from appearing over a formed image due to fluctuation in a quantity of ink ejected from each ink ejecting orifice, there sometimes arises an occasion that a density fluctuation correcting technology that is called head shading (hereinafter referred to simply as HS) is applied to the image forming apparatus. HS is such that a test pattern is formed on a printing medium, fluctuation in a quantity of ejected ink is measured by reading the test pattern, data for correcting the foregoing fluctuation are obtained, and thereafter, a driving signal for forming an image is corrected per each ink ejecting orifice or per plural ink ejecting nozzles based on the thus obtained date. In some cases, automatic head shading (hereinafter referred to simply as AHS) is applied to the image forming apparatus. AHS is such that forming of the test pattern or obtaining of the data for correcting the fluctuation in a quantity of ejected ink is automated.

When HS is applied to the image forming apparatus constructed in accordance with the aforementioned embodiment, it is thinkable that the printer section is once escapably displaced from the image forming apparatus, a sheet-like printing medium for forming a test pattern thereon (hereinafter referred to as HS sheet) is adhesively placed on the conveying belt, the printer section is returned to the original position to initiate the HS operation, and subsequently, the test pattern is formed on the HS sheet. In addition, it is thinkable that after completion of the HS operation, the HS sheet is conveyed to a predetermined position where the HS sheet can easily be peeled from the conveying belt, and subsequently, it is practically peeled from the conveying belt or after the printer section is escapably displaced from the image forming apparatus, the HS sheet is peeled from the conveying belt.

In the aforementioned embodiment, however, since the image forming apparatus is constructed such that the printer section 1000 can slidably be displaced thereon in order to perform maintenance services for the conveying section 100, HS treatment is conducted by effectively utilizing the space defined on completion of the slidable displacement of the printer section 1000. Otherwise, the image forming apparatus may be constructed such that an operational efficiency of the image forming apparatus can be improved, and moreover, an accuracy for forming the test pattern and an accuracy for reading the thus formed test pattern can be improved by executing AHS treatment.

Figure 14:
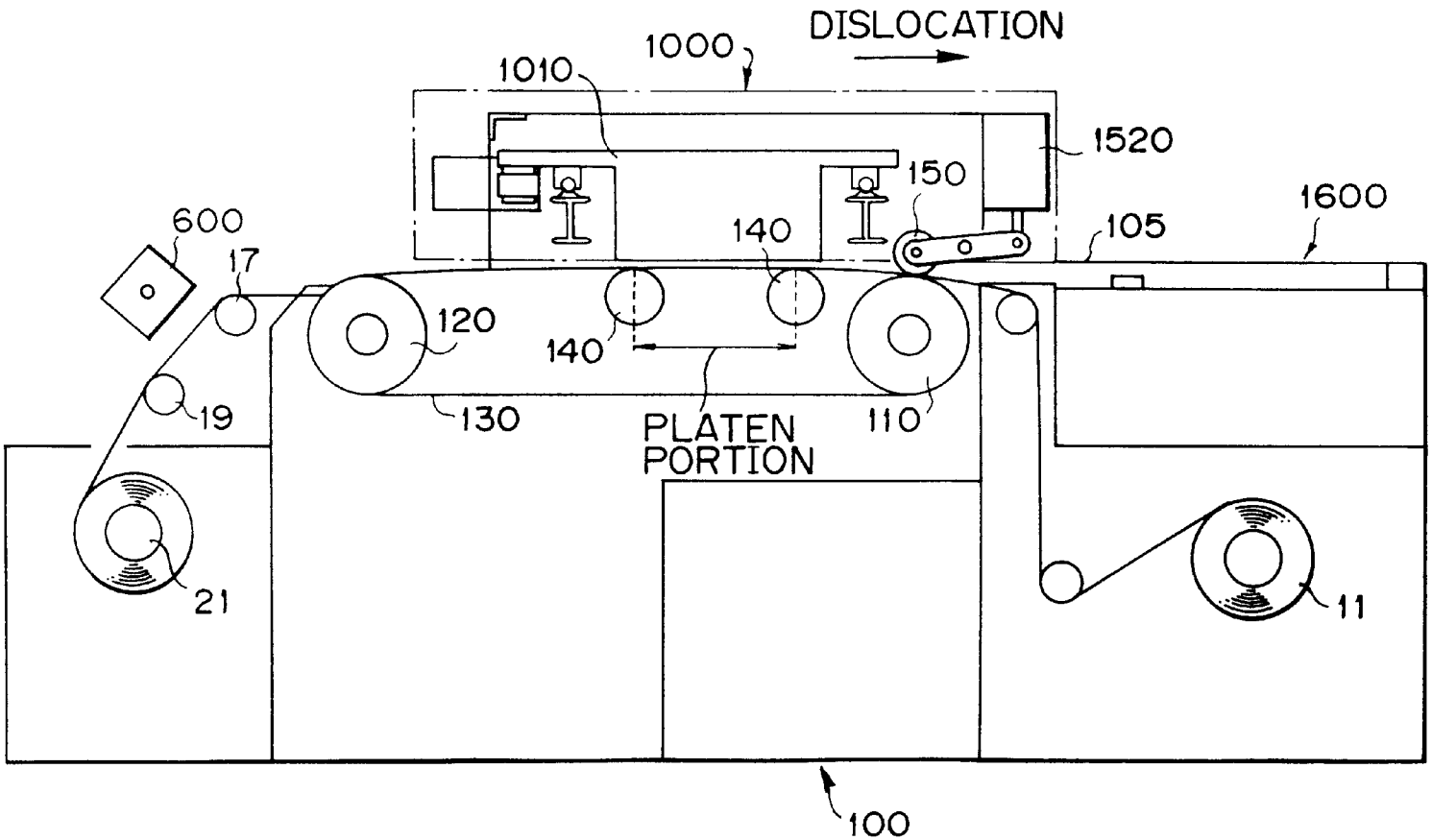
FIG. 14 is a schematic sectional side view showing the structure of a textile printing apparatus including a head shading (HS) station.
Figure 17:
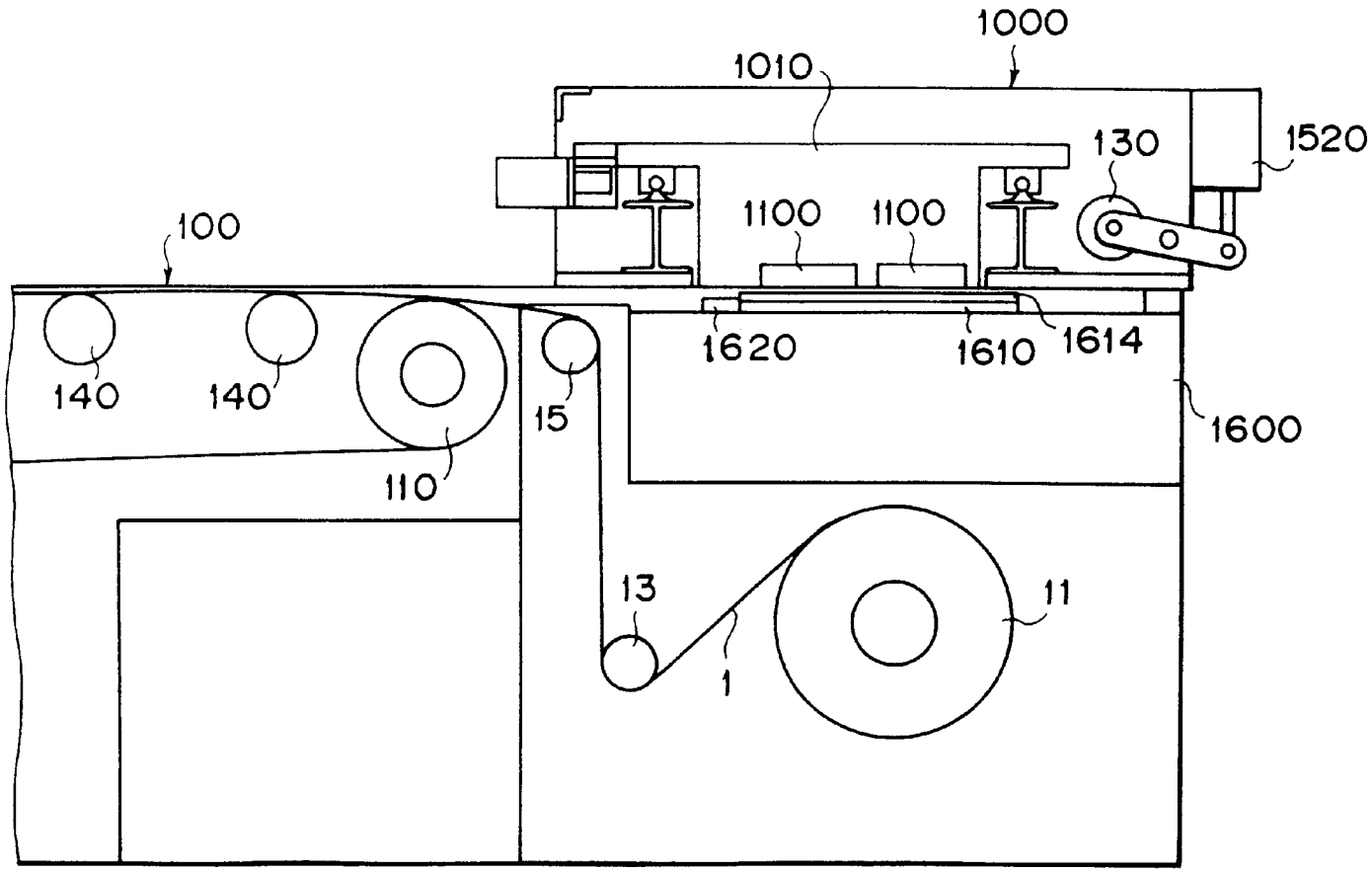
FIG. 17 is a schematic sectional side view showing the state that the printer section is located on the HS station.

To realize the aforementioned construction, an HS station (section) 1600 is mounted above an unwinding roller 11 for printing a test pattern when an HS treatment mode is executed, as shown in FIG. 14. Incidentally, the HS treatment may be executed by utilizing the time when a maintenance service is conducted for the conveying section or it may be conducted in an adequate manner. The printer section 1000 is horizontally displaced along slide rails 105 from the position to be occupied at the time of a normal printing operation (located above the conveying belt 130) toward the HS station 1600. At this time, as shown in FIG. 17, a labelling roller 150 disposed in the printer section 1000 is escapably displaced by actuating a pneumatic cylinder 1520, in order to assure that it does not interfere with the HS station 1600.

Subsequently, the position to be occupied by the printer section 1000 relative to the HS station 1600 is determined with the aid of stoppers 1605 disposed at the extreme ends of the guide rails 105. The printer section 1000 may be displaced to an AHS station at an operator's discretion after it is released from the normal printing position or it may be displaced by activating driving means such as a pneumatic cylinder, a hydraulic cylinder, an electric motor or the like.

Figure 15A:
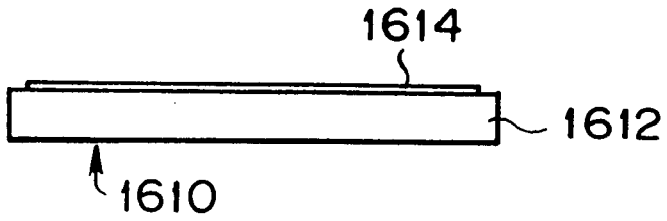
FIG. 15A and FIG. 15B are a side view and a plan view showing by way of example the structure of an HS sheet required for forming an HS test pattern, respectively.
Figure 15B:
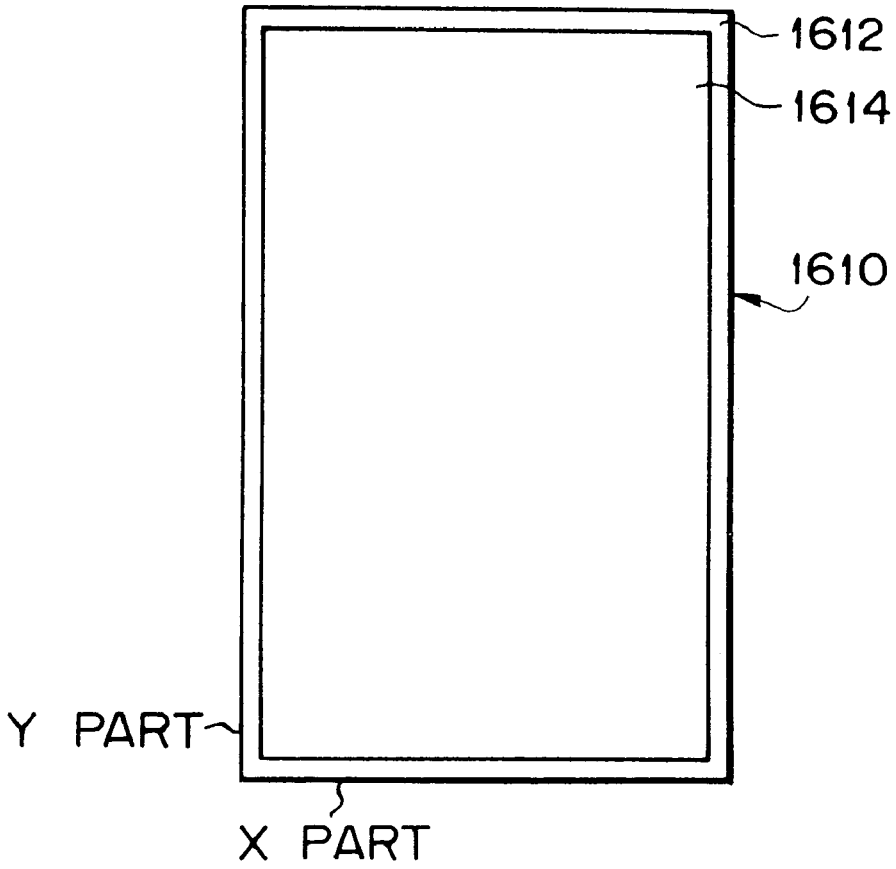

For example, as shown in FIG. 15A and FIG. 15B, the HS sheet used in head shading is prepared by adhesively placing a printing sheet 1614 made of a material similar to the cloth 1 on a flat labelling plate 1612 made of a metallic material, a synthetic resin or the like without an occurrence of floating from the labelling plate 1612 by using a double-sided tape, a sprayed glue, an adhesive or a similar material.

Figure 16:
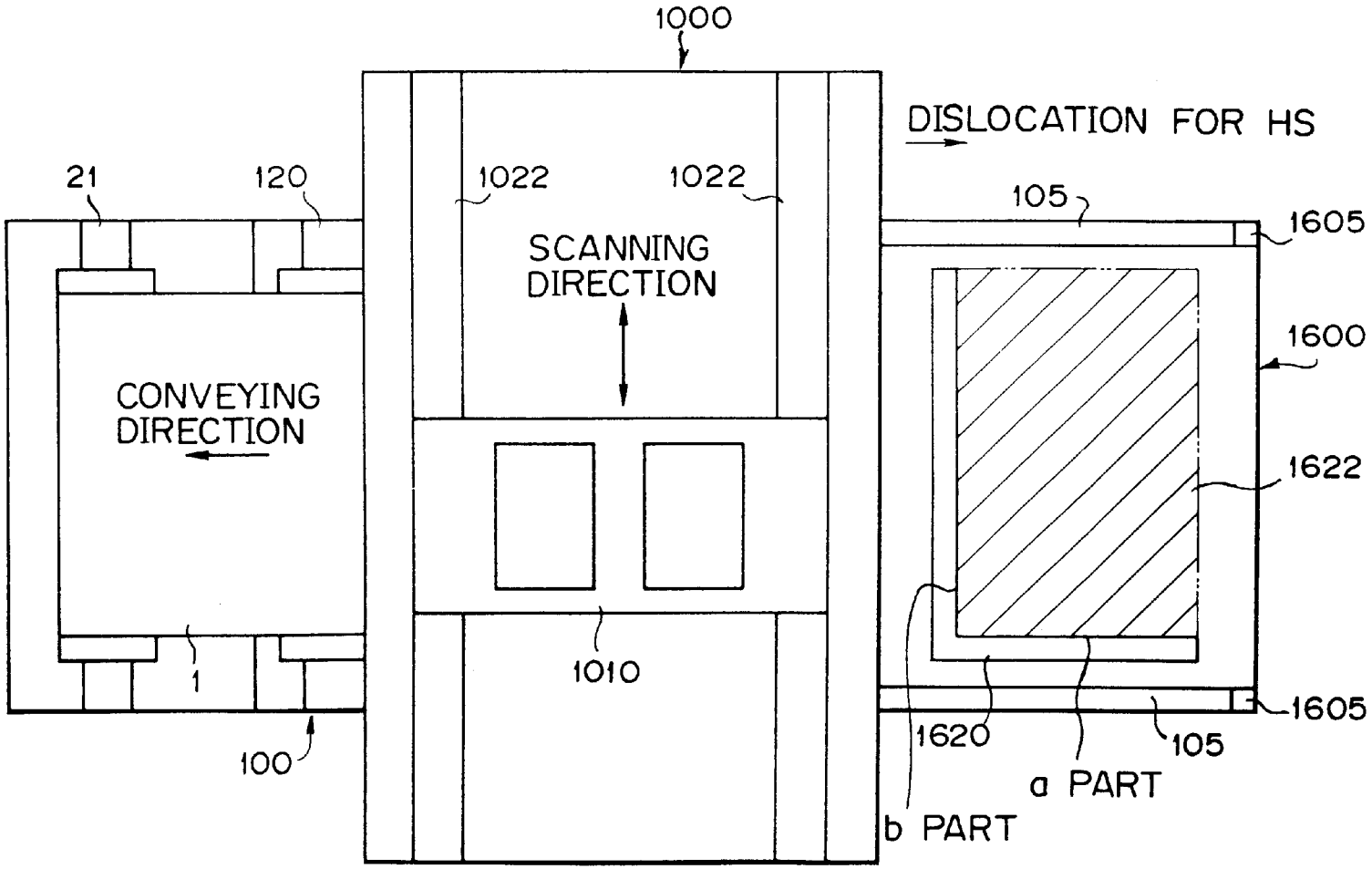
FIG. 16 is a schematic plan view showing the structure of a textile printing apparatus including an HS station.

On the other hand, as shown in FIG. 16 that is a schematic plan view of the image forming apparatus, the HS station 1600 includes an L-shaped locating guide 1620 for determining the position to be occupied by the HS sheet 1610. After the HS sheet 1610 is put on a placement portion 1622 of the printer section 1000 while the printing sheet 1614 is placed on the upper surface of the labelling plate 1612 in such a manner that an a part of the locating guide 1620 comes in contact with a X part of the HS sheet 1610 and a b part of the locating guide 1620 comes in contact with a Y part of the HS sheet 1610, the printer section 1000 is displaced toward the HS station 1600 in the above-described manner (see FIG. 17). Here, it is assumed that the locating portion 1622 is machined at a high accuracy to exhibit excellent flatness. The height of the locating portion 1622 is determined such that the gap between the printing heads 1100 and the printing sheet 1614 takes a predetermined value. In addition, since the height of the printer section 1000 is restrictively defined by the guide rails 105, the adequate positional relationship between the printing heads 1100 and the printing sheet 1614 is determined merely by displacing the printer section 1000 in the horizontal direction until the printer section 1000 collides against the stoppers 1605.

When preparation for the aforementioned HS mode is completely made, the carriage 1010 is scanned in the entirely same manner as the normal printing operation to be performed, whereby a test pattern is printed on the printing sheet 1614 by activating the printing heads 1100. After the test pattern is completely formed, the printer section 1000 is returned from the position occupied by the HS station 1600 to the normal printing position, the HS sheet 1610 is taken out of the HS station 1600, and subsequently, HS is executed for the HS sheet 1610 by using a system as shown in FIG. 18.

Figure 18:
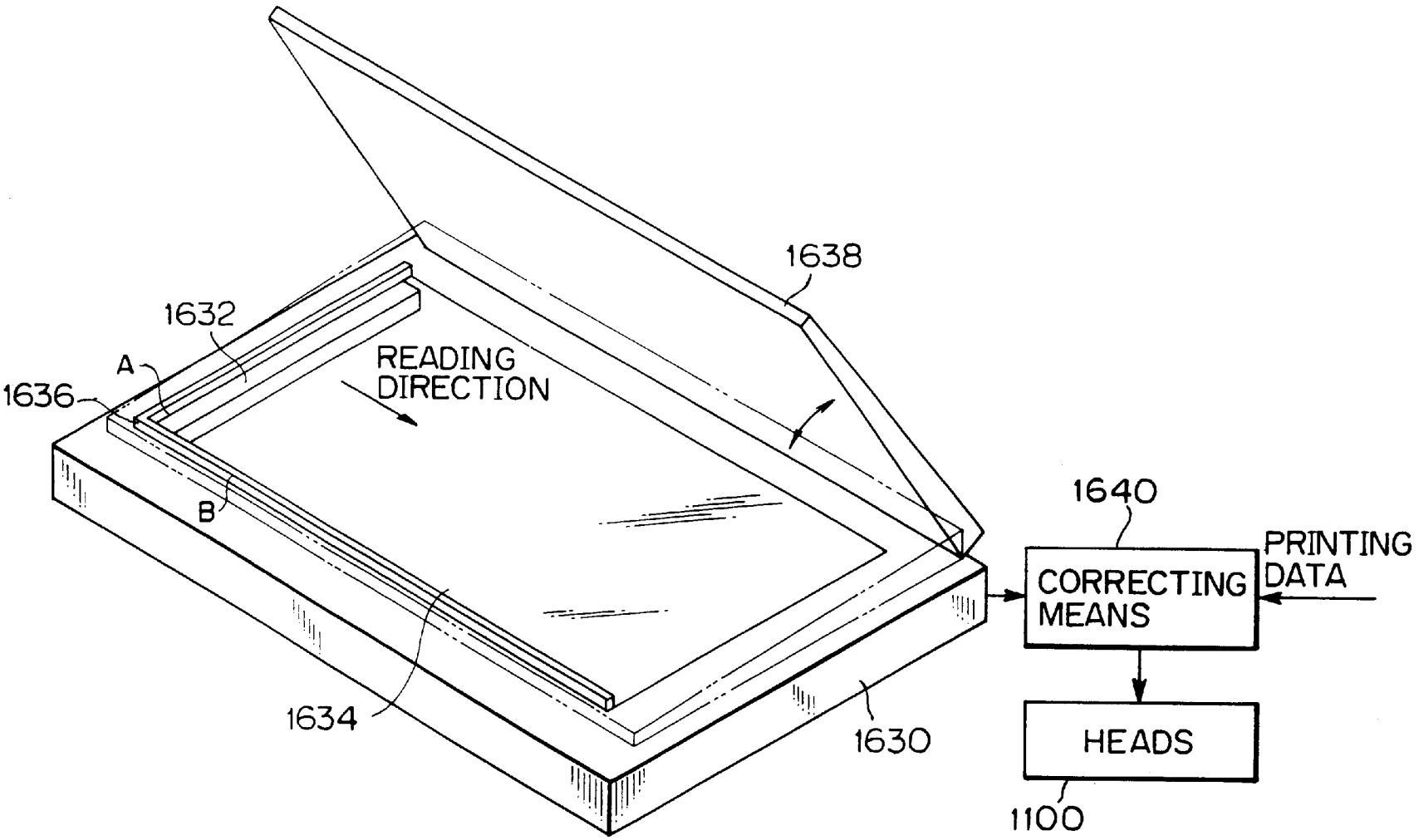
FIG. 18 is a schematic perspective view showing by way of example the structure of an HS station including an optical reading system for optically reading a test pattern.

Referring to FIG. 18, a line sensor 1632 having, e.g., CCD used therefor is disposed for a reader 1630 serving as reading means, and an HS pattern is read by the line sensor 1632. To this end, the HS sheet 1610 is placed on a platen glass 1634 while holding the printing sheet 1610 to serve as a lower surface in such a manner that a locating part A of a locating guide 1636 disposed on the platen glass 1634 comes in contact with a X part of the HS sheet 1610 and a locating part B of the locating guide 1636 comes in contact with a Y part of the HS sheet 1610. A level of close contact state arising between the HS sheet 1610 and the platen glass 1634 is improbably elevated by a retaining plate 1636, and the test pattern is read by allowing the line sensor 1632 to perform scanning.

After completion of the reading operation, correcting data for respective ink ejecting nozzles are obtained based on the results derived from the reading operation with the aid of correcting means 1640 including CPU constructed in the form of a microcomputer, ROM having desired data stored therein, RAM for developing the correcting data and associated components. For example, a system disclosed in an official gazette of Japanese Patent Application Laying-Open No. 4-39042 filed by an applicant common to the present invention may be substituted for the correcting means 1640. The printing head 1100 is driven after printing data are corrected based on the correcting data.

According to this embodiment, when a test pattern is to be printed, it is sufficient that the printer section 1000 is displaced in the horizontal direction after the HS sheet 1610 is placed on the HS station 1600. Thus, the image forming apparatus can be used at a high operational efficiency. In addition, since the HS station 1600 is arranged at the position away from the conveyance path of the cloth 1, HS treatment can be executed without any necessity for removing the cloth 1 from the conveying section 100 for achieving a normal printing operation with the cloth 1. Consequently, when a printing operation is restarted, continuance of the printing operation can be maintained without an occurrence of malfunctions that printing patterns overlap each other and part of a printing pattern fails to be printed. Further, since position determination can easily be made not only during a printing operation but also during a reading operation by using an exclusively available HS sheet 1610, correcting data can be obtained at a high accuracy. Additionally, since the HS station 1600 is arranged above the unwinding portion and below the printer section 1000, the space occupied by the image forming apparatus can effectively be utilized.

Figure 19:
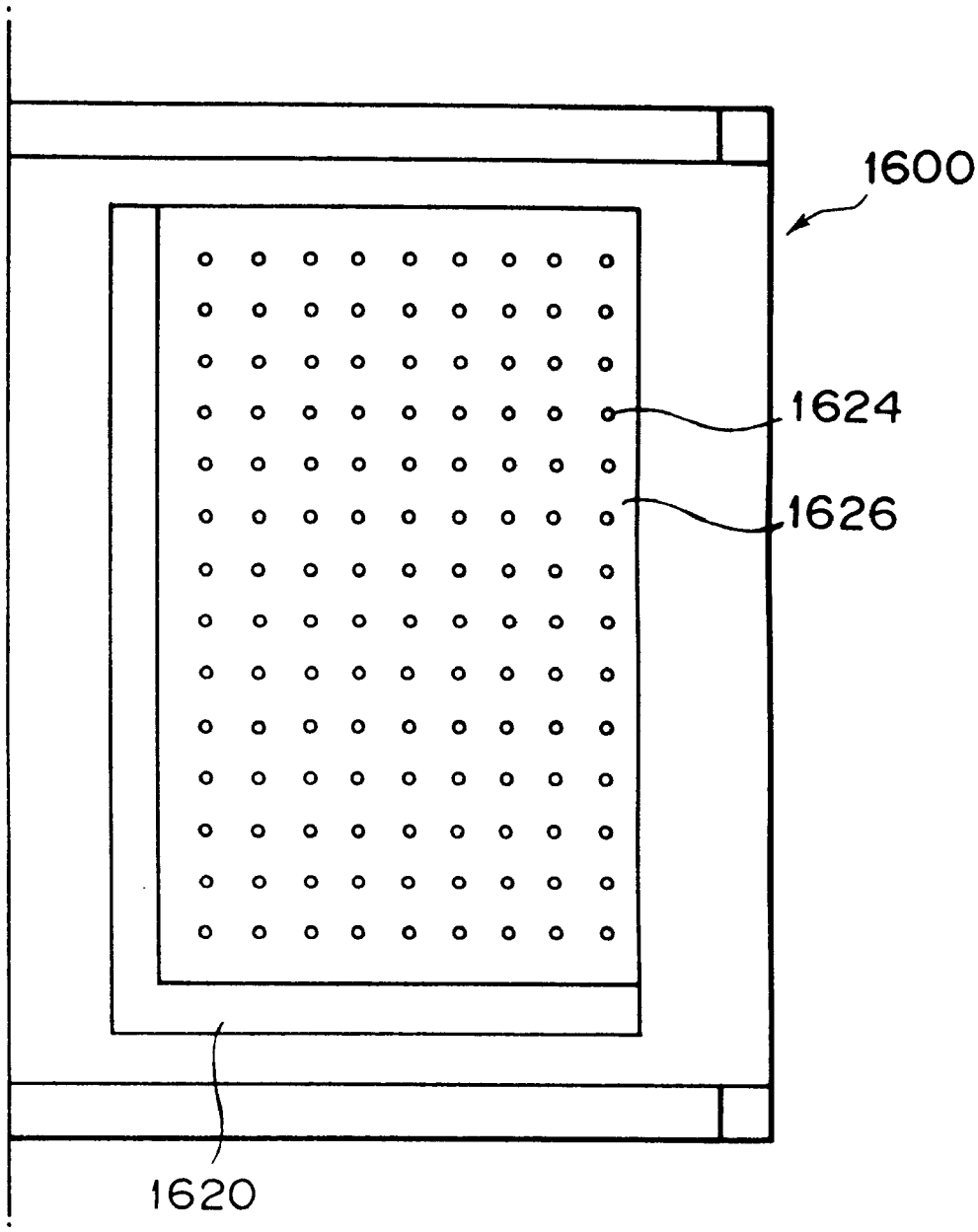
FIG. 19 is a plan view showing by way of example the structure of an HS sheet placing portion to be disposed on the HS station.

It is acceptable that a film sheet molded of a plastic material or the like and a plate-like member like a flat rubber sheet of which surface is ground without any possibility of allowing the printing sheet 1614 to floating therefrom are employed for the labelling plate 1612 to be placed on the printing sheet 1614. In this case, to assure that the surface of the HS sheet 1610 exhibits a wavy contour, it is also acceptable that the HS sheet 1610 is placed on a placement portion 1626 having a plurality of suction holes 1624 formed therethrough so as to allow air to be evacuated through the suction holes 1624 to bring the HS sheet 1610 in tight contact with the placement portion 1626, as shown in FIG. 19. In the case that the printing sheet 1614 itself has rigidity to some extent or in the case that a suction mechanism is arranged for the placement portion 1626 for utilizing air evacuation, it is also acceptable that a test pattern is formed on the printing sheet 1614 without any use of a labelling plate, provided that improper ruggedness is not formed on the printing sheet 1614.

Figure 20A:
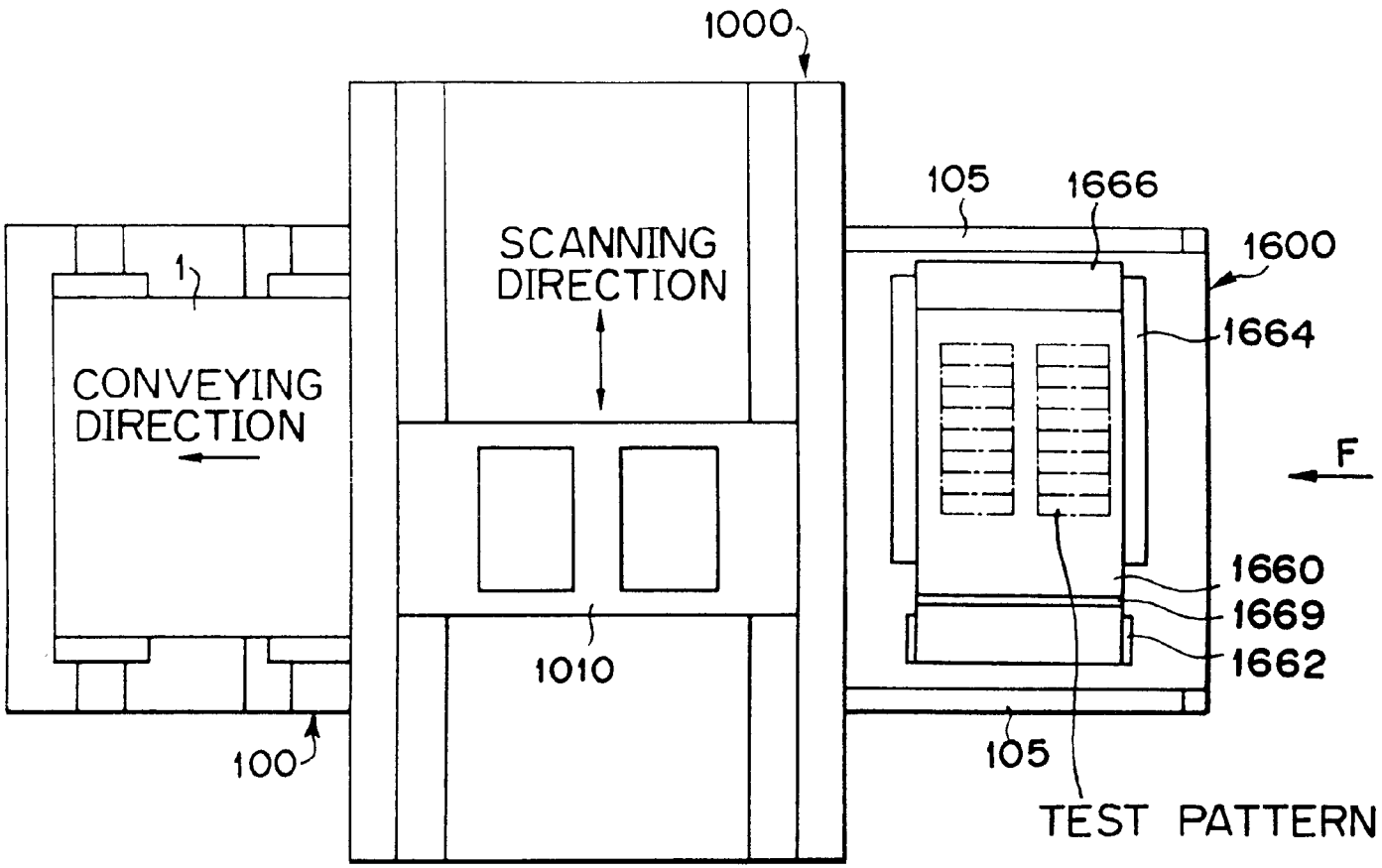
FIG. 20A is a schematic plan view showing by way of example the structure of an HS station constructed in accordance with another embodiment of the present invention.
Figure 20B:
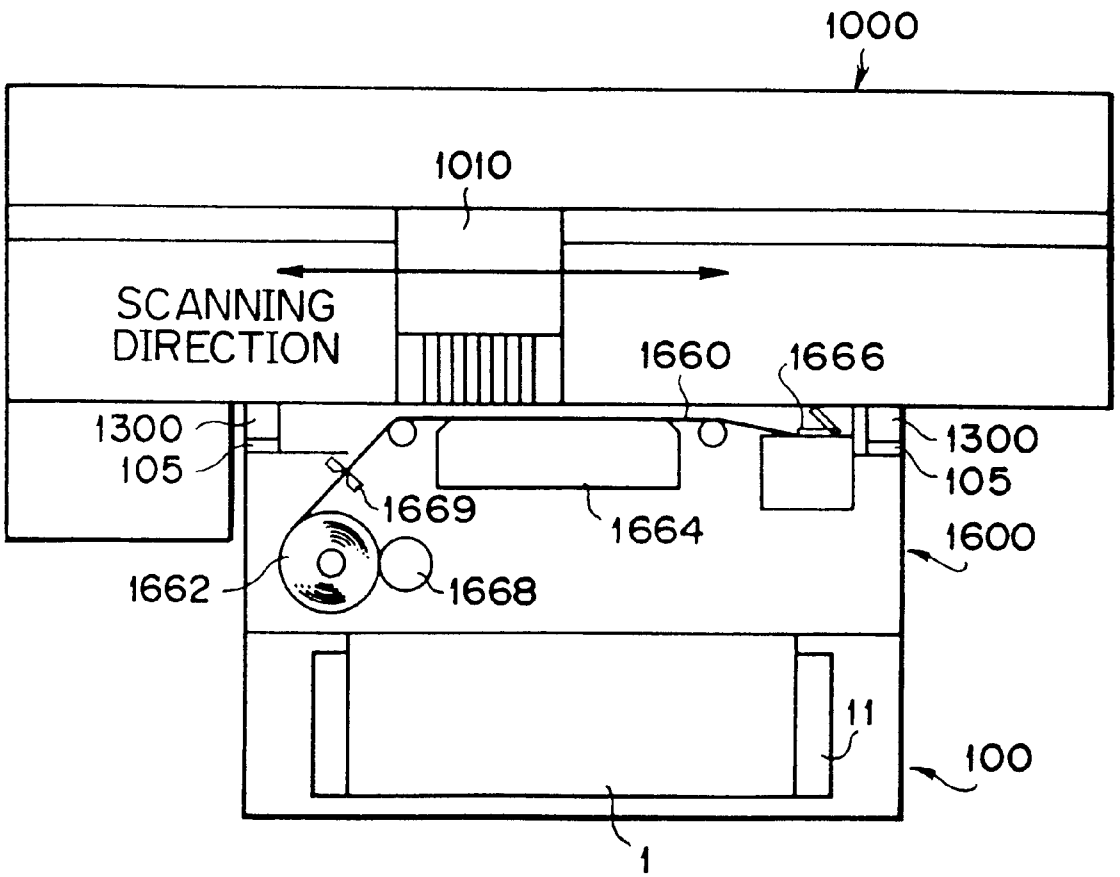
FIG. 20B is a view of the HS station as viewed in the F arrow-marked direction in FIG. 20A.

FIG. 20A and FIG. 20B show by way of example the structure of an image forming apparatus including an HS station constructed in accordance with a modified embodiment wherein an HS sheet is not used for the image forming apparatus but a continuous sheet-like printing medium, e.g., a roll-like printing medium is used for successively forming test patterns thereon, respectively. FIG. 20A is a schematic plan view of the image forming apparatus, and FIG. 20B is a side view of the image forming apparatus as viewed in the F arrow-marked direction in FIG. 20A.

In this modified embodiment, to make preparation for an HS mode, the foremost end part of a test pattern printing medium 1660 is drawn from an unwinding roll 1662 with operator's hands, it passes on an HS platen 1664, and thereafter, it is clamped by a clipper 1666, causing the printing medium 1660 to be immovably held by the clipper 1666. To prevent the printing medium 1660 from being loosely slackened, a brake 1668 is disposed adjacent to the unwinding roll 1662. In addition, to prevent the printing medium 1660 from floating from the HS platen 1664, it is brought in tight contact with the HS platen 1664 by utilizing air evacuation or static electricity.

Rolls and associated components are arranged above an unwinding portion inclusive of the unwinding roll 1662 in the same manner as the case shown in FIG. 14 to FIG. 19. After the printing medium 1660 is placed on the platen 1664, the printer section 1000 is displaced to an HS station 1600 to print a test pattern on the printing medium 1660 in the same manner as mentioned above. After completion of the printing operation, the printing section 1000 is returned from the position occupied thereby on the HS station 1600 to the normal printing position, part of the printing medium 1660 having a test pattern formed thereon is cut from the roll-like printing medium 1660 by actuating a cutter 1669, and subsequently, a cut sheet of printing medium 1660 is placed on the reading system as explained above with reference to FIG. 18 to obtain correcting data.

According to this modified embodiment, in addition to advantageous effects of the improvement of the operational efficiency and the effective utilization of the space occupied by the image forming apparatus as mentioned above with respect to the embodiment shown in FIG. 14 to FIG. 19, another advantageous effect can be obtained such that there is no need of preparing an HS sheet every time a test pattern is formed on the recording medium, resulting in an operational efficiency of the HS treatment or the like being improved further, because the test pattern recording medium is prepared in the form of a roll-like paper, and moreover, a plurality of HS sheets are storably received in a certain container (not shown).

Figure 21:
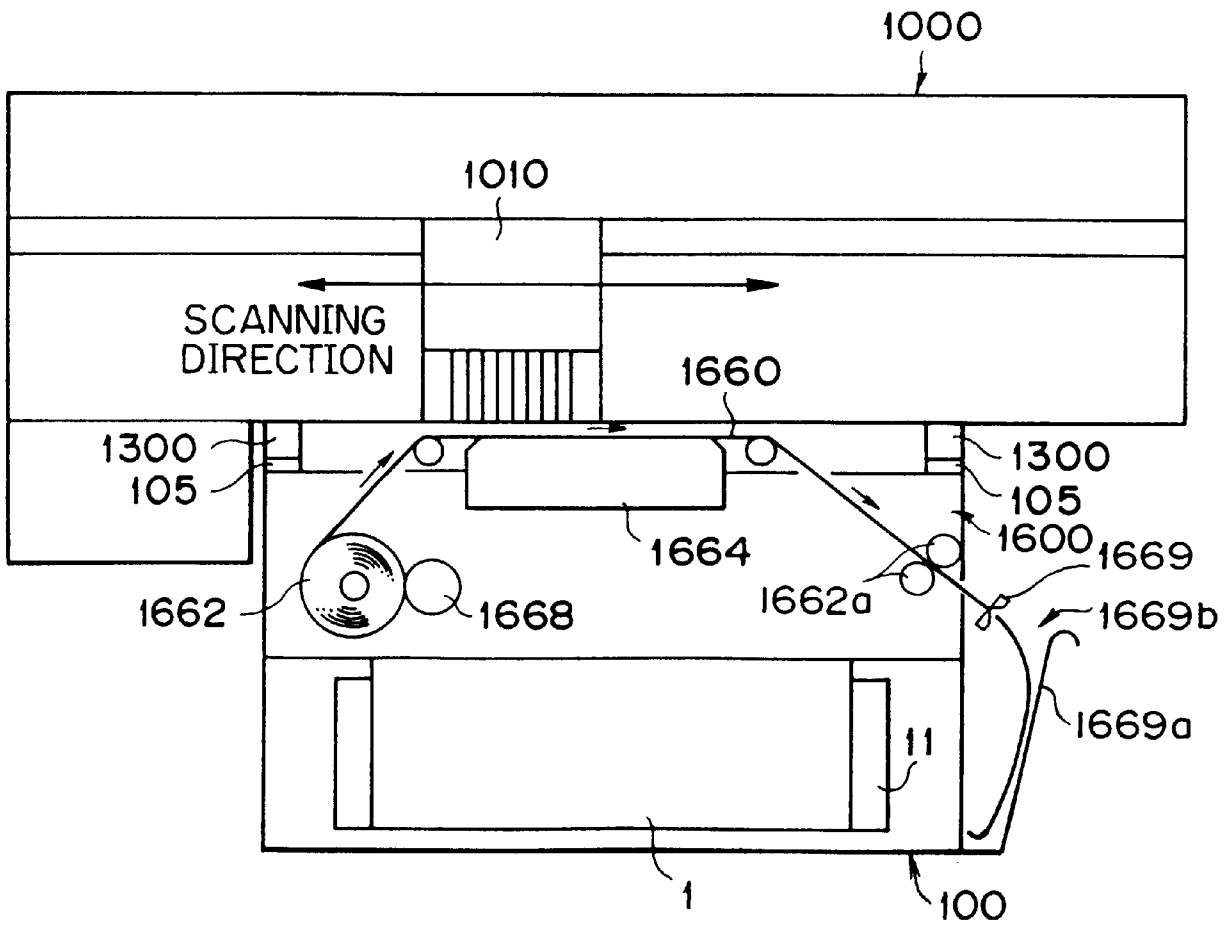
FIG. 21 is a schematic fragmentary side view showing the structure of an HS station constructed in accordance with a modified embodiment of the present invention.

FIG. 21 shows by way of example the structure of an image forming apparatus including an HS station constructed in accordance with other modified embodiment wherein the HS station includes an unit for automatically conveying and discharging a roll-like printing medium for successively forming a test pattern thereon.

In contrast with the case shown in FIG. 20A and FIG. 20B, in this modified embodiment, to make preparation for an HS mode, a test pattern printing medium 1600 is automatically conveyed from an unwinding roll 1662 to an opposing pair of discharging rollers 1662*a* via an HS platen 1664. The discharging rollers 1662*a* are rotationally driven to convey the printing medium 1600 at a predetermined distance by activating a driving system (not shown). The structure of other components, i.e., a brake 1668 and the HS platen 1664 is same to that shown in FIG. 20A and FIG. 20B.

The fact that rolls and associated components for a conveying unit are arranged above an unwinding portion inclusive of the unwinding roll 1662 is same to that shown in FIG. 14 to FIG. 19.

After the printing medium 1660 is automatically conveyed from the unwinding roll 1662, a test pattern is printed on part of the printing medium 1660, and thereafter, the foregoing part of the printing medium 1660 having the test pattern formed thereon is conveyed to a discharging tray 1669*a* so that it is cut from the roll-like printing medium 1660 by actuating a cutter 1669 disposed at a discharging portion 1669*b*. A cut sheet of printing medium 1660 received in the discharging tray 1669*a* is placed on the reading system as mentioned above with reference to FIG. 18 to obtain correcting data.

According to this modified embodiment, it is not necessary that the printing medium extends through the HS station from the unwinding roll to the discharging rollers, because after the foremost end part of the printing medium is initially drawn to the discharging rollers, the printing medium is automatically conveyed and discharged to the discharging tray via the cutter and the discharging rollers. In other words, test patterns are successively received in the discharging portion 1669*b* by activating an HS mode without any necessity for a series of steps of displacing the printer section 1000 to the HS station 1600 after the printing medium 1660 extends through the HS station 1600, printing a test pattern on part of the printing medium 1660, returning the printer section 1000 to the original position, and then taking the foregoing part of the printing medium 1660 having the test pattern printed thereon out of the HS station 1600. Consequently, an operational efficiency of the HS treatment and others can be improved further.

Figure 22:
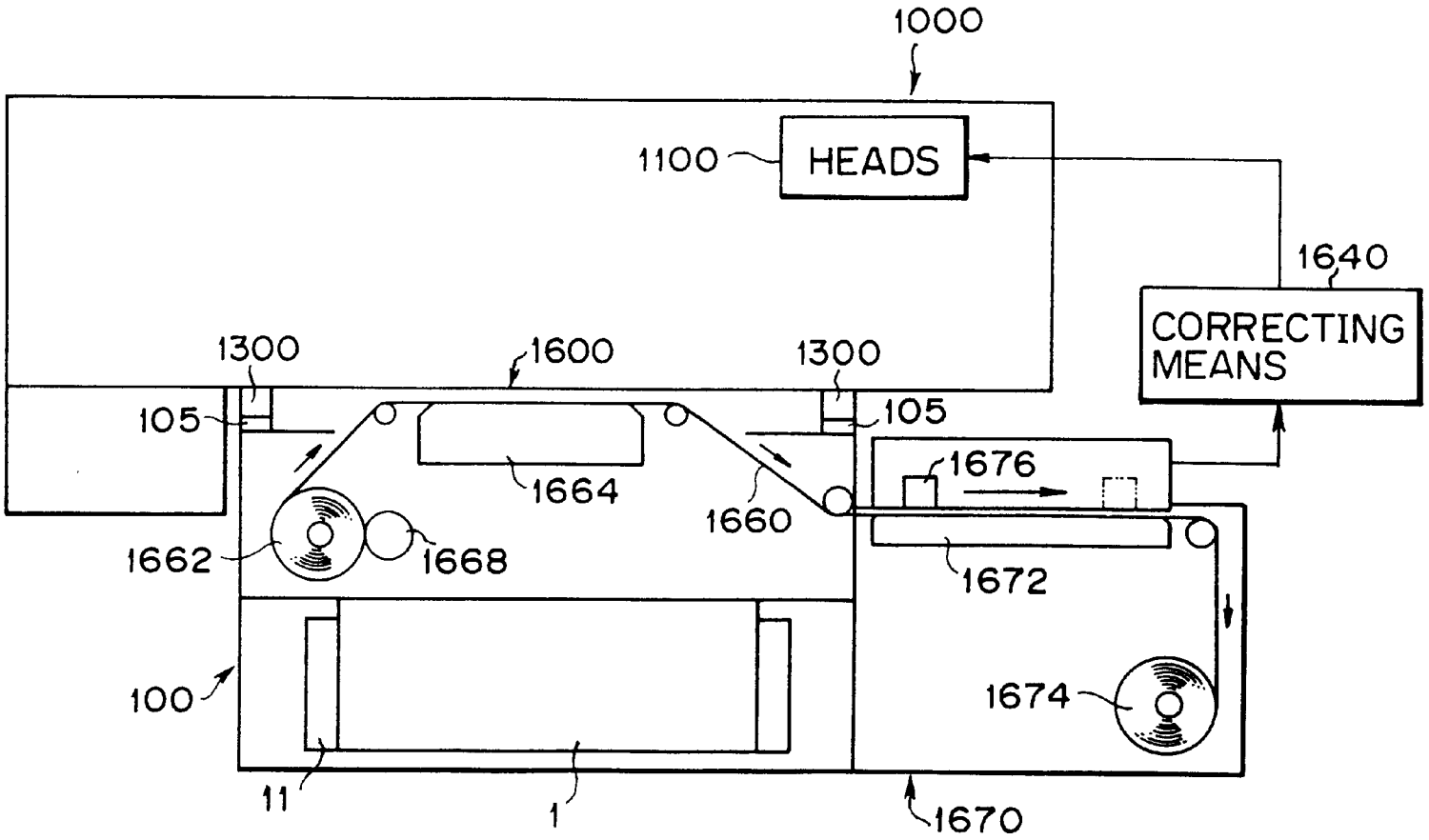
FIG. 22 is a schematic fragmentary side view showing the structure of an HS station constructed in accordance with another modified embodiment of the present invention.

FIG. 22 shows by way of example the structure of an image forming apparatus including an HS station and an automatic head shading mechanism (hereinafter referred to simply as AHS mechanism) constructed in accordance with another modified embodiment wherein the AHS mechanism assures that a series of steps of test pattern forming, pattern reading, data processing and data transferring to ink jet heads are automatically achieved.

Also in this modified embodiment, an HS station 1600 is arranged above an unwinding portion of a conveying section 100. In addition, an HS reading section 1670 is arranged sideward of the unwinding portion of the conveying section 100. A test pattern forming portion can be constructed in the substantially same manner as that in the preceding embodiment shown in FIG. 20 and FIG. 21, and a printing medium 1660 is conveyed from an HS unwinding roll 1662 to a winding roll 1674 via an HS platen 1664 of the reading portion 1670.

When the image forming apparatus operates in an AHS mode, a printer section 1000 is displaced to the HS station 1600 along slide rails 105. The displacement of the printer section 1000 can be achieved by actuating a pneumatic cylinder or the like. A carriage 1010 prints an HS pattern on the printing medium 1660 placed on the HS platen 1664. The printing medium 1660 is brought in tight contact with the HS platen 1664 by utilizing air evacuation or static electricity so that a flat plane is formed on the HS platen 1664.

After the HS pattern is printed on the printing medium 1660, part of the printing medium 1660 having the HS pattern formed thereon is conveyed to the reading platen 1670 disposed in the HS reading section 1670 on the downstream side. The printing medium 1660 placed on the reading platen 1670 is brought in tight contact with the reading platen 1670 in the same manner as the HS platen 1664, and subsequently, the HS pattern is read by a line sensor 1676. The read data are transferred to ink jet heads 1100 via correcting means 1640. Thereafter, the printer section 1000 is returned to the normal printing position.

Also in this modified embodiment, the same advantageous effects as those in the preceding embodiment shown in FIG. 20 and FIG. 21 are obtainable. In addition, since forming and reading of a test pattern are automated, head shading can be achieved merely by activating the HS station 1600 in an HS mode.

It should be noted that each of the embodiments as described above with reference to FIG. 14 to FIG. 22 is practiced corresponding to the case that the image forming apparatus is constructed such that the printer section 1000 is slidably displaced relative to the conveying section 100. However, in the case that the image forming apparatus is constructed such that the conveying section 100 is slidably displaced relative to the printer section 1000 as shown in FIG. 7, it is acceptable that the HS station can slidably be displaced and the position of the HS station relative to the printer section 1000 but not relative to the conveying section can be determined.

(5) A position where a drying heater is arranged and other items.

Next, description will be made below with respect to the position where a drying heater 600 shown in FIG. 3 and others is arranged.

Among a plurality of steps for executing printing treatment, a step of drying ink shot onto a cloth is an importance step for the textile printing apparatus constructed in accordance with the aforementioned embodiment. This is because on completion of a printing operation, the cloth 1 (see FIG. 3) is successively wound about the winding roll 21 (see FIG. 3), but in the case that the cloth 1 is not sufficiently dried, there arises a malfunction that ink remaining on the cloth 1 is dislocated to the rear surface side of other cloth, and moreover, there arises another malfunction that a printed image is injured or deformed when the cloth 1 wound about the winding roll 21 after completion of the printing operation is handled further.

The inventors conducted a variety of examinations and discussions, and as a result derived from the examinations and discussions, they discovered that it was necessary that while the cloth was maintained in the uniformly dried state after completion of the printing operation, color exhibiting treatment was conducted for the cloth in order to express a fine color tone specific to ink jet textile printing with excellent reproductibility. This is because it is considered that the foregoing necessity is attributable to the fact that moisture remaining in the cloth has significant effect on a process of dyeing and fixing in association with a color exhibiting step.

According to this embodiment, in addition to the practical realization of the drying heater to be used in consideration of the foregoing object, there is provided a drying heater which is constructed such that a drying operation can be performed at a high efficiency when a plurality of ink jet heads each having a long length are used, and moreover, the dried state can be uniformalized.

Figure 23:
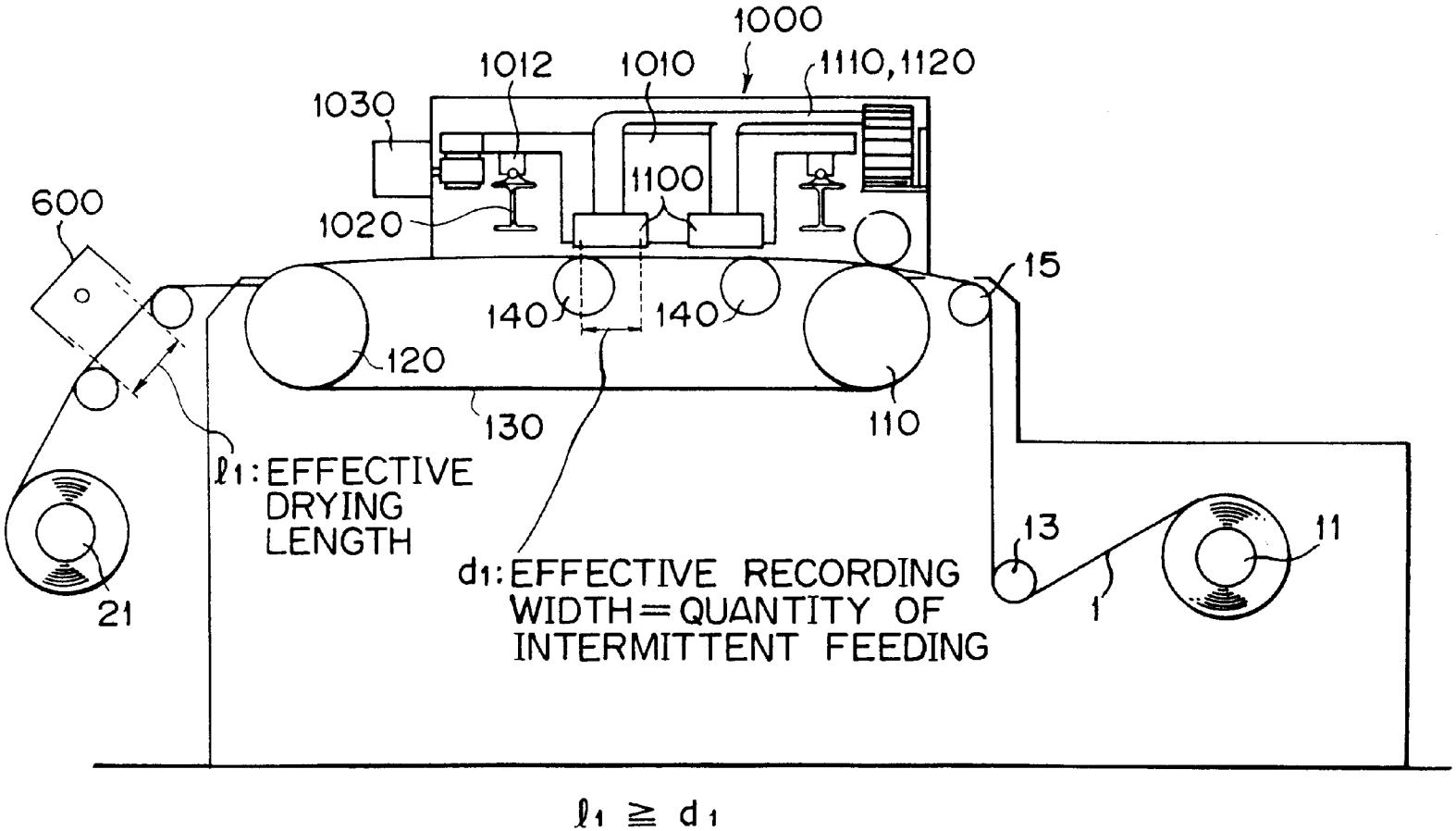
FIG. 23 is a schematic sectional side view showing the structure of a textile printing apparatus including a stationary heater in accordance with further embodiment of the present invention.

FIG. 23 is a schematic sectional view which illustratively shows the structure of the drying heater 600 constructed in according to this embodiment.

Referring to FIG. 23, the cloth 1 is conveyed below two ink jet heads 1100, and as it is conveyed further by a conveying belt 130, it is separated from the conveying belt 130 on the downstream side of the conveyance path. Thereafter, while the cloth 1 is conveyed toward the winding roller 21, it is dried by the drying heater 600 to promotively dry ink remaining in the cloth 1.

The structure of the textile printing apparatus shown in FIG. 23 is such that an effective drying length $l_1$ of the drying heater 600 as measured along the conveying path of the cloth 1 is equal to an effective recording width of each ink jet head 1100 (i.e., a width of plural arrays of ink ejecting orifices arranged one after another in the conveying direction), and moreover, it is equal to or larger than a quantity $d_1$ of intermittent feeding of the cloth 1 as represented by an inequality of $l_1 \geqq d_1$.

With this construction, regardless of the position where the drying heater 600 is disposed on the conveyance path, the range having the width $d_1$ on the cloth 1 simultaneously printed with ink (i.e., one line having the width $d_1$) can be stopped within the effective drying length of the drying heater 600 without fail while the cloth 1 is intermittently fed at a distance equal to the same length as the effective drying length $l_1$. Thus, there does not arise a malfunction that part of the cloth 1 is not dried by the drying heater 600.

Figure 24:
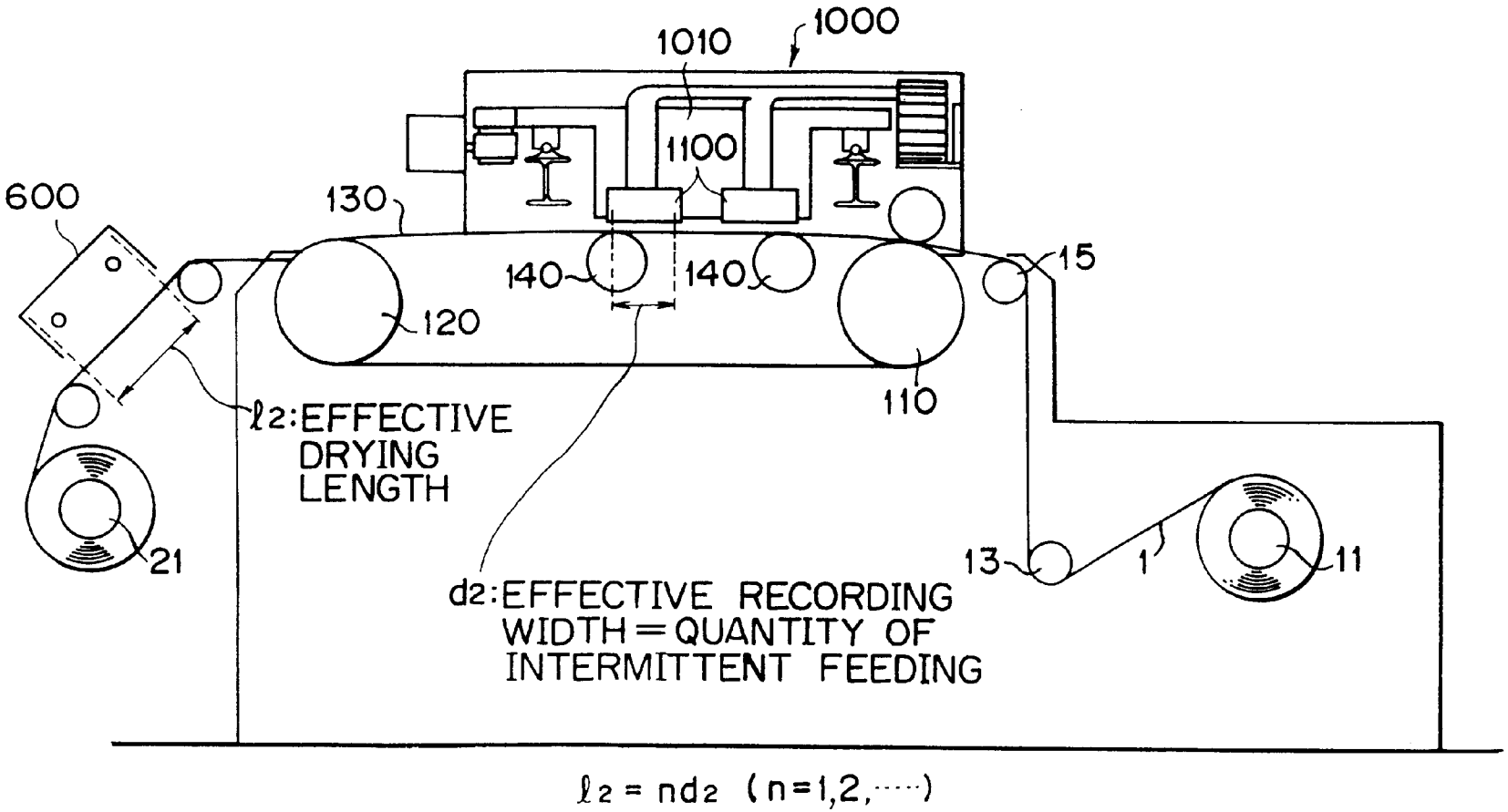
FIG. 24 is a schematic sectional side view showing the structure of a textile printing apparatus including a stationary heater in accordance with a modified embodiment of the present invention.

FIG. 24 is a schematic sectional view which illustratively shows other structure of the drying heater 600 constructed in accordance with a modified embodiment.

The structure of the textile printing apparatus shown in the drawing is such that an effective drying length $l_2$ of the drying heater 600 is equal to an effective recording width defined by the ink jet heads 1100, and moreover, it is equal to a value as large as integral times of a quantity $d_2$ of intermittent feeding of the cloth 1 represented by an equation of $l_2=nd_2$ (n=1, 2, - - - ).

With this construction, regardless of the position where the drying heater 600 is disposed on the conveyance path, the time required for completely drying part of the cloth 1 defined by the width $d_2$ on the cloth 1 simultaneously printed with ink is always kept same. Thus, the drying time required for drying the cloth 1 can be uniformalized.

Figure 25:
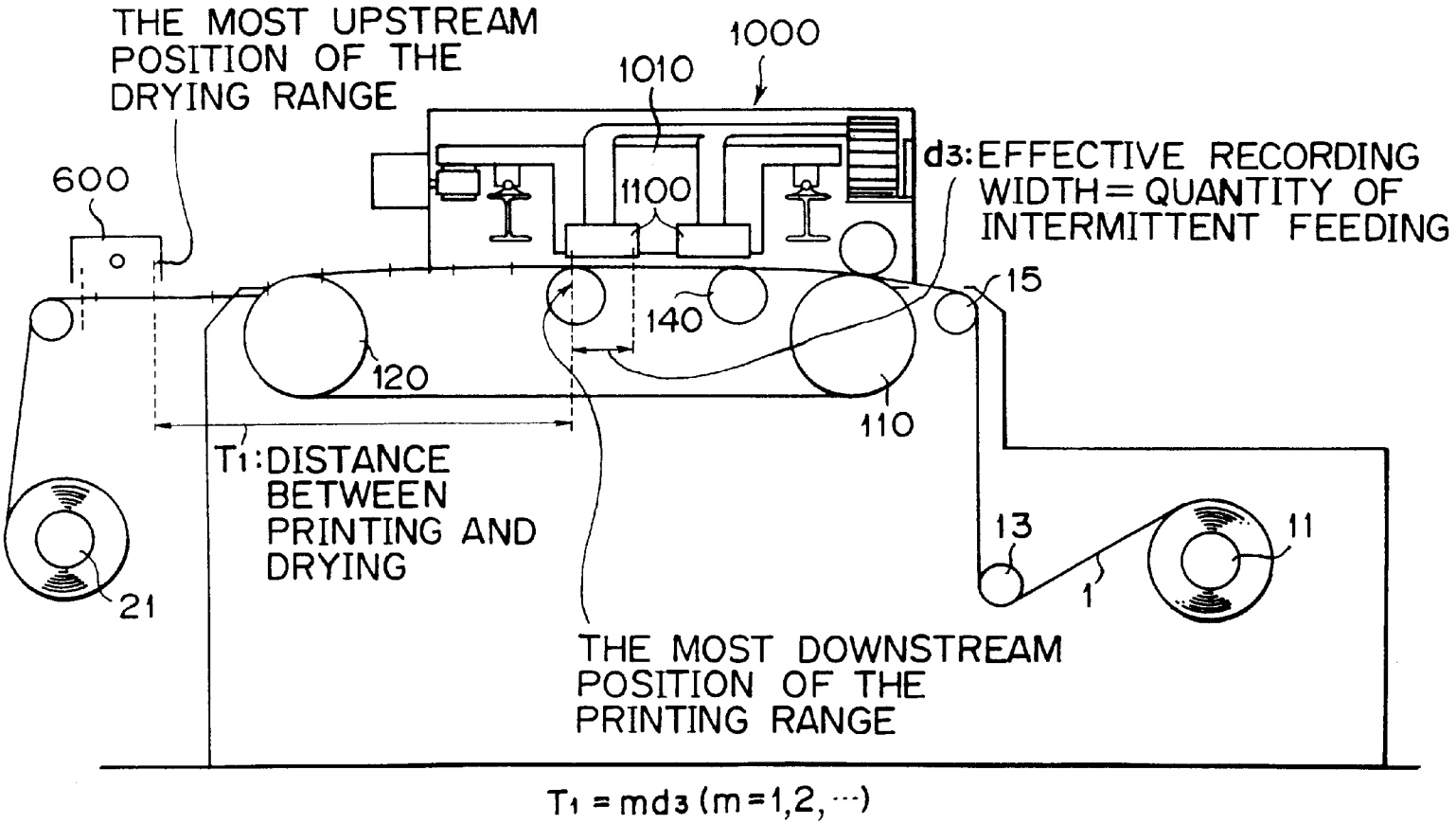
FIG. 25 is a schematic sectional side view showing the structure of a textile printing apparatus including a stationary heater in accordance with another modified embodiment of the present invention.

FIG. 25 is a schematic sectional view which illustratively shows another structure of the drying heater 600 constructed in accordance with other modified embodiment.

The structure of the textile printing apparatus shown in the drawing is such that in addition to the structure shown in FIG. 23 or FIG. 24, a distance $T_1$ as measured from the most downstream position of the printing range to the most upstream position of the drying range is equal to a value as large as integral times of a quantity $d_3$ of intermittent feeding of the cloth 1 represented by an equation of $T_1=md_3$ (m=1, 2, - - - ).

With this construction, since part of the cloth 1 defined by the width $d_3$ on the cloth 1 simultaneously printed by the ink jet head 1100 on the downstream side is always dried at all times, the time required from printing to drying of the cloth 1 within the range defined by $T_1$ and $d_3$ can be uniformalized under same drying conditions.

Figure 26:
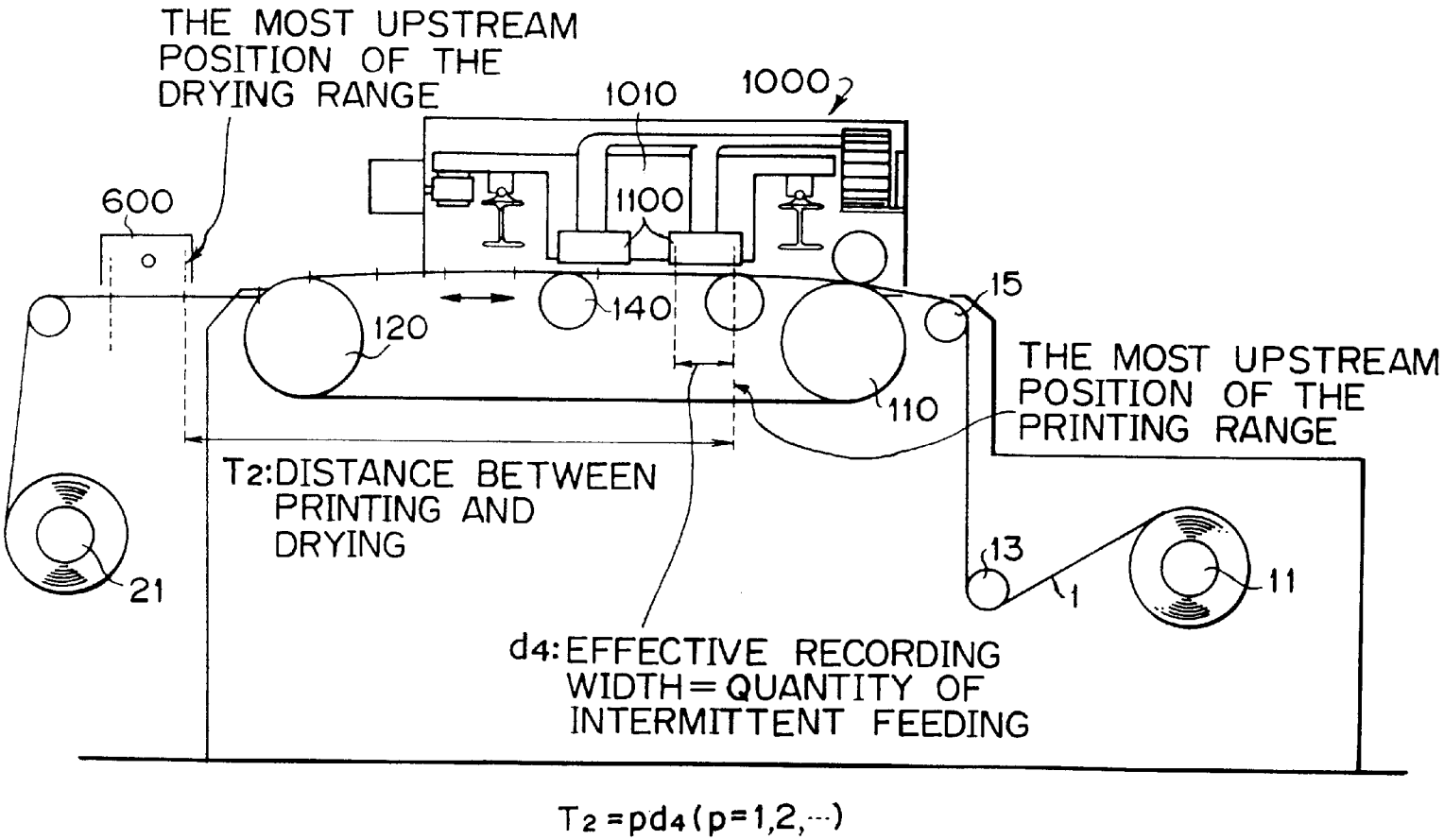
FIG. 26 is a schematic sectional side view showing the structure of a textile printing apparatus including a stationary heater in accordance with further modified embodiment of the present invention.

FIG. 26 is a schematic sectional view which illustratively shows another structure of the drying heater 600 constructed in accordance with another modified embodiment.

The structure of the textile printing apparatus shown in the drawing is same to that shown in FIG. 25. In the shown case, in addition to the structure shown in FIG. 23 or FIG. 24, a distance $T_2$ as measured from the most upstream position of the printing range to the most upstream position of the effective drying range of the drying heater 600 is equal to a value as large as integral times of a quantity $d_4$ of intermittent feeding of the cloth 1 represented by an equation of $T_2=pd_4$ (p=1, 2, - - - ).

Also with this construction, the same advantageous effects as those shown in FIG. 25 can be obtained. In the shown case, however, the aforementioned advantageous effects can be maintained at least within the range where a printing operation is achieved by the ink jet head 1100 on the upstream side.

Incidentally, the integrals n, m and p employed for the structure of the textile printing apparatus shown in FIG. 25 and FIG. 26 are values each of which is selected for designing the textile printing apparatus, respectively.

In each of the aforementioned embodiments, description has been made on the assumption that a quantity of intermittent feeding of the cloth 1 is equal to an effective printing width of each ink jet head. However, it is obvious that the above description is equally applicable to each textile printing apparatus even though the quantity of intermittent feeding of the cloth 1 is set to 1/k of the effective printing width (k=2, 3, 4, - - - ).

As is apparent from the above description, when the structure of the drying heater constructed in each of the aforementioned embodiments is employed for the textile printing apparatus, each drying operation can adequately and excellently be achieved. Especially, in the case that ink jet heads each having a long printing section are used for the textile printing apparatus, each drying operation can uniformly be achieved at a high efficiency. In addition, especially, in the case that a cloth is employed as a printing medium, a colored image having excellent reproducibility can be obtained by practicing steps of color exhibiting and fixing subsequent to the drying step.

In the case that the textile printing apparatus is constructed such that an ink jet head unit can be dislocated relative to the conveying system, it is acceptable that the drying heater can be dislocated in association with the dislocation of the ink jet head unit as will be described later.

(6) Structure of a conveying section

Figure 27:
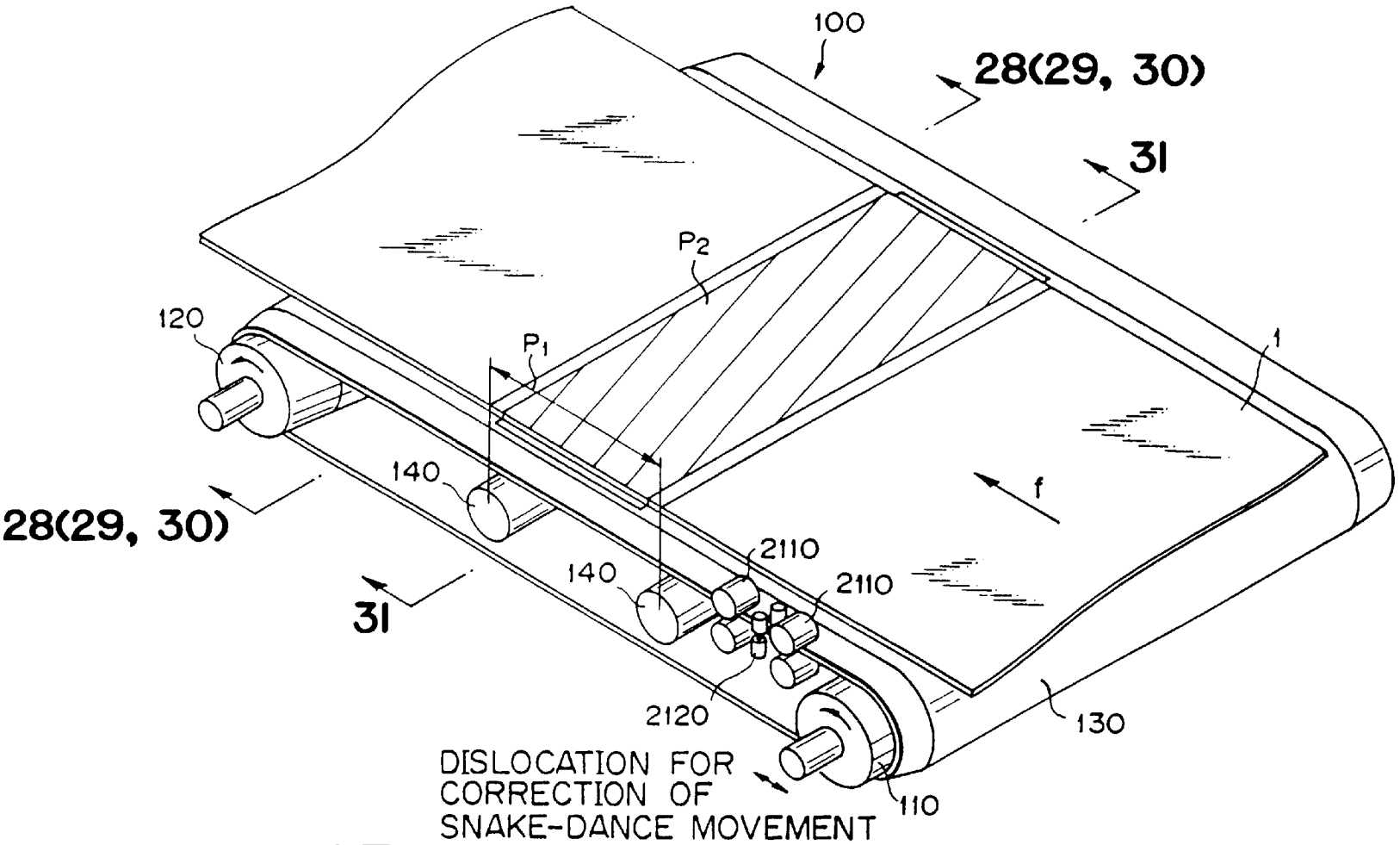
FIG. 27 is a partially exploded enlarged schematic perspective view showing the structure of a conveying section for the textile printing apparatus.
Figure 28:
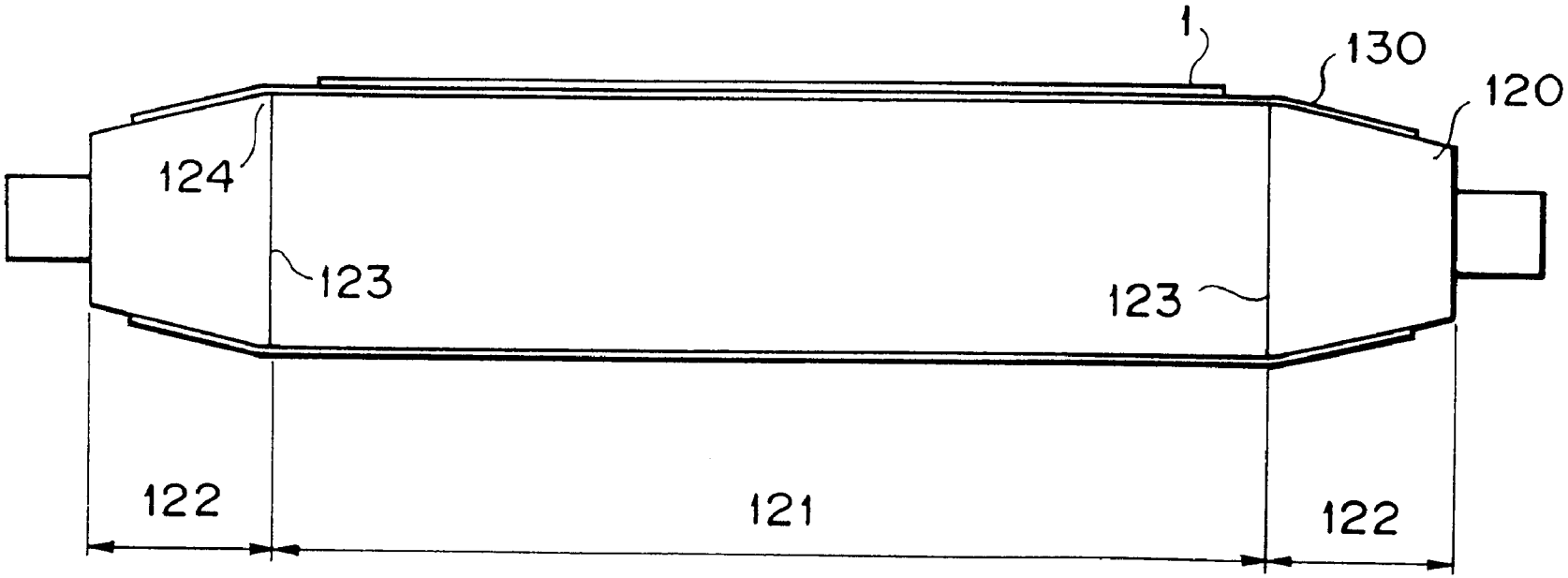
FIG. 28 is a cross-sectional view showing the conveying section taken along line 28—28 in FIG. 27.
Figure 29:
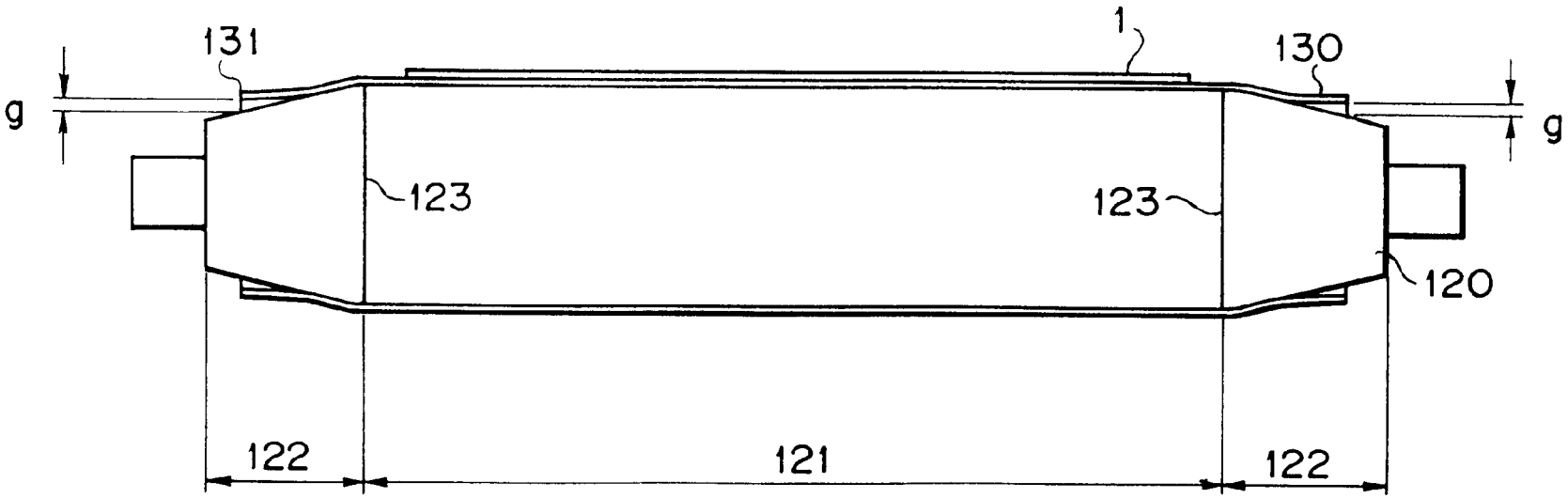
FIG. 29 is other cross-sectional view showing the conveying section taken along line 29—29 in FIG. 27.
Figure 30:
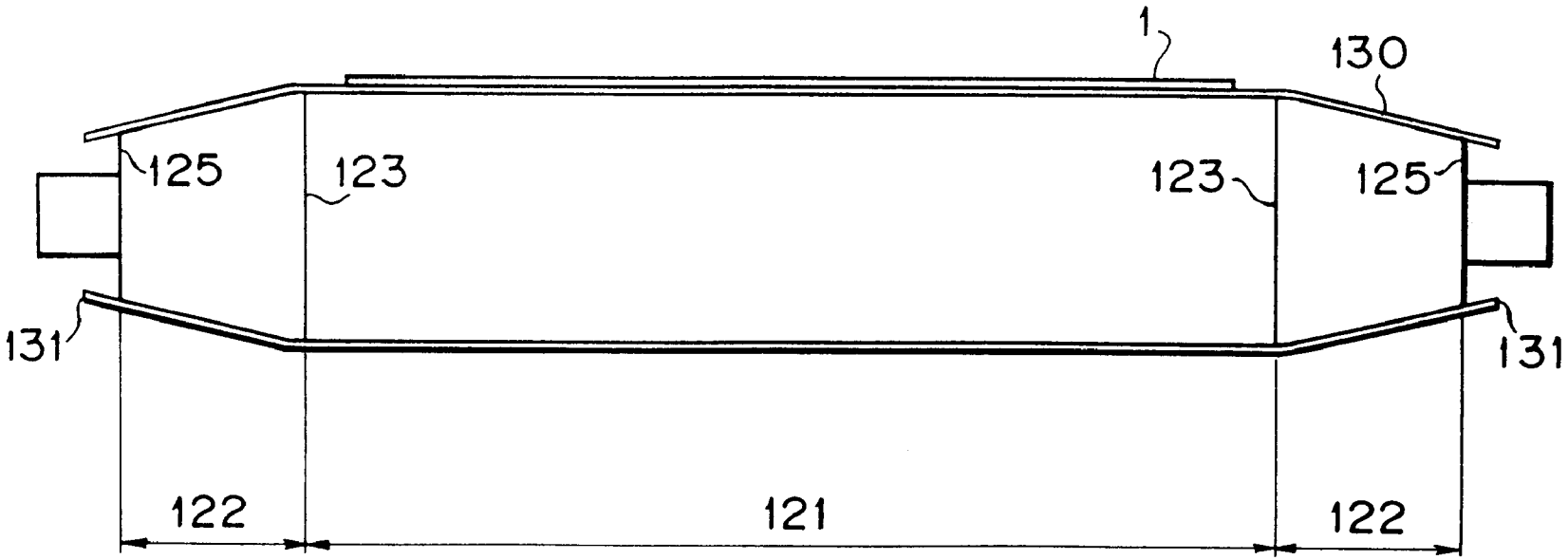
FIG. 30 is another cross-sectional view showing the conveying section taken along line 30—30 in FIG. 27.
Figure 31:
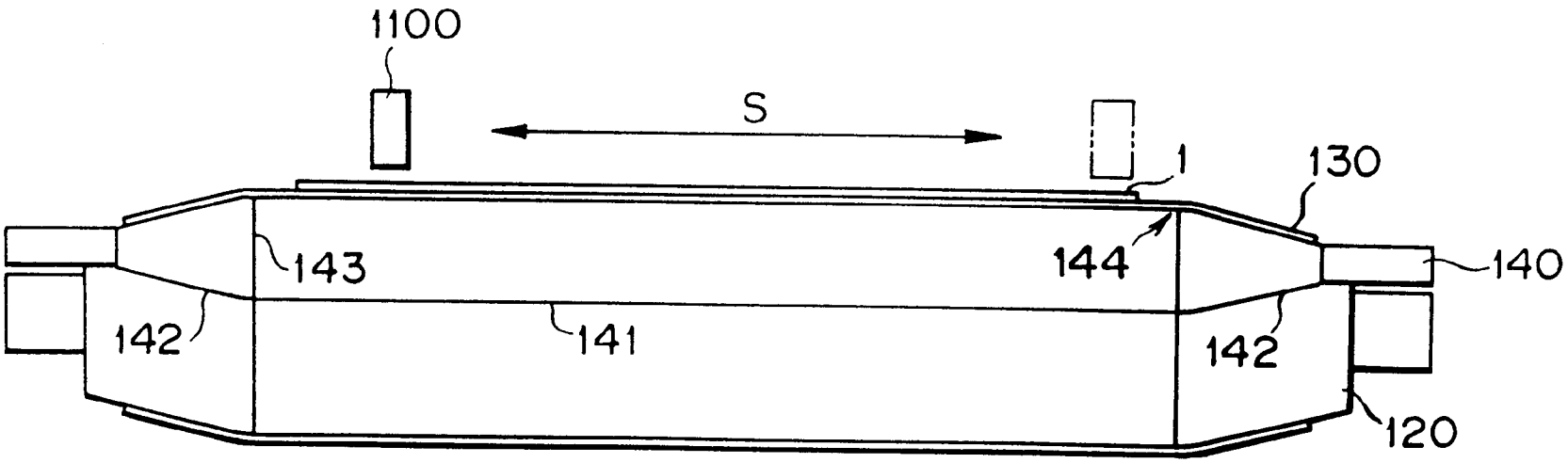
FIG. 31 is a cross-sectional view showing the conveying section taken along line 31—31 in FIG. 27.

FIG. 27 is a partially exploded fragmentary enlarged perspective view of a conveying section for the textile printing apparatus, FIG. 28 to FIG. 30 are sectional views each taken along line 28(29, 30)—28(29, 30) in FIG. 27 to show the structure of the conveying section, respectively, and FIG. 31 is a sectional view of the conveying section taken along line 31—31 in FIG. 27.

With respect to conveying rollers 110 and 120 having a conveying belt 110 recirculatively extending therebetween, the conveying roller 120 disposed on the downstream side as viewed in the f arrow-marked direction is a driving roller adapted to be rotationally driven by a motor (not shown) (hereinafter referred to a driving roller 120), and the conveying roller 110 disposed on the upstream side is a follower roller (hereinafter referred to as a follower roller 110). Adjustment of an intensity of tension to be applied to the conveying belt 130 and correction of snake-dance movement of the conveying belt 130 can be executed by slight dislocation of the follower roller 110 in the conveying direction f. A pair of platen rollers 140 disposed between the follower roller 110 and the driving roller 120 are intended to apply an adequate intensity of tension to the conveying belt 130 to provide the latter with flatness between both the platen rollers 140. A flat plane forming portion $P_1$ is located between both the platen rollers 140, and a platen portion $P_2$ is located inside of the flat plane forming portion $P_1$ on the conveying belt 130 to serve as a printing range. In addition, end part detecting sensors 2120 such as optical sensors or the like for detecting the end part of the conveying belt 130 to correct the snake-dance movement of the latter and a plurality of retaining rollers 2110 located in the vicinity of the end part detecting sensors 2120 for retaining the end part of the conveying belt 130 in the clamped state are disposed between the platen portion $P_2$ and the follower roller 110.

The driving roller 120 is designed in the tapered crown-like configuration in such a manner that it has a same diameter at least within the range where the cloth 1 serving as a printing medium is conveyed, i.e., the range exclusive of the opposite end parts thereof as viewed in the transverse direction, and the opposite end parts of the driving roller 120 are dimensioned to have a gradually reduced diameter. Specifically, as shown in FIG. 28, the driving roller 120 includes a straight portion 121 at the central part and crown portions 122 at the opposite end parts thereof, and part of the driving roller 120 in the vicinity of a boundary 123 between the straight portion 121 and the crown portion 122 exhibits a slightly curved portion 124. As shown in FIG. 28, since the conveying belt 130 is conveyed mainly by the straight portion 121 of the driving roller 120 while coming in close contact with the crown portions 122 of the latter, it can be driven at a high accuracy without any particular influence induced by the crown portions 122. There sometimes arises an occasion that a gap g is formed between the conveying belt 130 and the end part of the driving roller 120 die to floating (parting) of a belt end part 131 away from the crown portion 122 depending on an intensity of tension applied to the conveying belt 130 because of slight displacement of the follower roller 110, as shown in FIG. 29. Also in this case, the conveying belt 130 is wound around the straight portion 121 of the driving roller 120 while coming in close contact with the same. The gap 3 is determined depending on a natural length of the crown portion 122 of the driving roller 120. In addition, as shown in FIG. 30, part of the conveying belt 130 may extend outside of a roller end part 125 of the driving roller 120 in the axial direction. Incidentally, description has been made above with respect to the driving roller 120, but it should be noted that the follower roller 110 is contoured in the same manner as the driving roller 120. For example, in the case that the conveying belt 130 is dimensioned to have a total length of 3100 mm and the straight portion 121 of the driving roller 120 is dimensioned to have a diameter of 260 mm, it is recommendable that the roller end part 125 of the driving roller 120 is dimensioned to have a diameter smaller than that of the straight portion 121 by a quantity of 0.5%.

As is apparent from FIG. 31, each platen roller 140 includes a straight portion 141 and crown portions 142 in the same manner as the follower roller 110 and the driving roller 120. In addition, a slightly curved portion 144 is formed in the vicinity of a boundary 143 between the straight portion 141 and the crown portion 142.

The reason why the follower roller 110, the driving roller 120 and each platen roller 140 are contoured in that way consists in suppressing the floating (turning-up) of the opposite end parts of the conveying belt 130 as viewed in the transverse direction away from the crown portions of the respective rollers as far as possible. Incidentally, description has been made above mainly with respect to the driving roller 120 but things are same with the platen rollers 140.

To correct the snake-dance of the endless wide conveying belt 130 made of a metallic material, it is necessary to change an intensity of tension applied to the conveying roller 130 in the transverse direction by slightly displacing the follower roller 110. When each of the driving roller 120 and the follower roller 110 is dimensioned to have a same diameter across the whole width of the conveying belt 130, an excessively high intensity of tension is applied to the opposite ends of the conveying belt 130 compared with the central part of the same. When the intensity of tension applied to the opposite ends of the conveying belt 130 exceeds an elastic limit specific to the conveying belt 130, there arises an occasion that plastic deformation occurs with the conveying belt 130. This leads to the result that the circumferential length of the conveying belt 130 as measured along the opposite ends of the conveying belt 130 becomes larger than that as measured along the central part of the same, causing the opposite ends of the conveying belt 130 to be turned up away from the opposite ends of the respective conveying rollers. As the tension is continuously applied to the opposite ends of the conveying belt 130 in that way for a long time, the foregoing turning-up of the conveying belt 130 progressively expands toward the central part of the conveying belt 130, resulting in the plastic deformation range being widened. Once the turning-up of the conveying belt 130 away from the opposite ends of the respective conveying rollers occurs, there arises a problem that the lower end of each ink jet head collides with the opposite end parts of the conveying belt 130 as the carriage is scanned. In addition, as the plastic deformation range is widened, there arise another problems that durability of the conveying belt 130 is degraded, and the snake-dance movement of the conveying belt 130 can not be corrected merely by slightly displacing the respective conveying rollers at a predetermined distance.

However, since each of the conveying roller 120 and the follower roller 110 includes crown portions at the opposite end parts thereof as viewed in the transverse direction as mentioned above, the position where an intensity of tension applied to the conveying belt 130 is maximized does not coincide with the belt end part 131 of the conveying belt 130 but it coincides with the central part of the conveying belt 130 as viewed in the transverse direction. As a result, the expansion of the conveying belt 130 from the belt end part 131 toward the central part of the conveying belt 130, i.e., the strain appearing in the conveying belt 130 within the foregoing range varies slowly. This tendency is equally recognized within the range located between both the platen rollers 140. Consequently, the extent of turning-up of the conveying belt 130 away from the opposite ends of the respective conveying rollers can be suppressed to a low level. The larger the foregoing suppressing effect, the longer the distance as measured from the boundary between the straight portion and the crown portion of each conveying roller to the belt end part 131 of the conveying belt 130. In the case that the belt end part 131 is located outside of the roller end part 125 as shown in FIG. 30, the high suppressing effect can likewise be obtained.

When the follower roller 110, the driving roller 120 and the platen rollers 140 contoured in the above-described manner are used for the textile printing apparatus, plastic deformation of the conveying belt 130 starts from the boundary between the straight portion and the crown portion of each roller, causing the plastically deformed range to be surrounded by the elastic range on the conveying belt 130. Thus, the progressive expansion of the plastically deformed range can be suppressed, and moreover, the running life of the conveying belt 130 can be elongated.

As a result derived from the suppression of the turning-up of the conveying belt away from the opposite ends of the respective conveying rollers in that way, there does not arise a malfunction that the lower end of each ink jet head collides with the opposite ends of the conveying belt 130. In other words, since the conveying belt 130, i.e., the printing medium and the carriage come near to each other more and more by increasingly reducing the gap therebetween, a printing accuracy of the textile printing apparatus can be improved.

Figure 32:
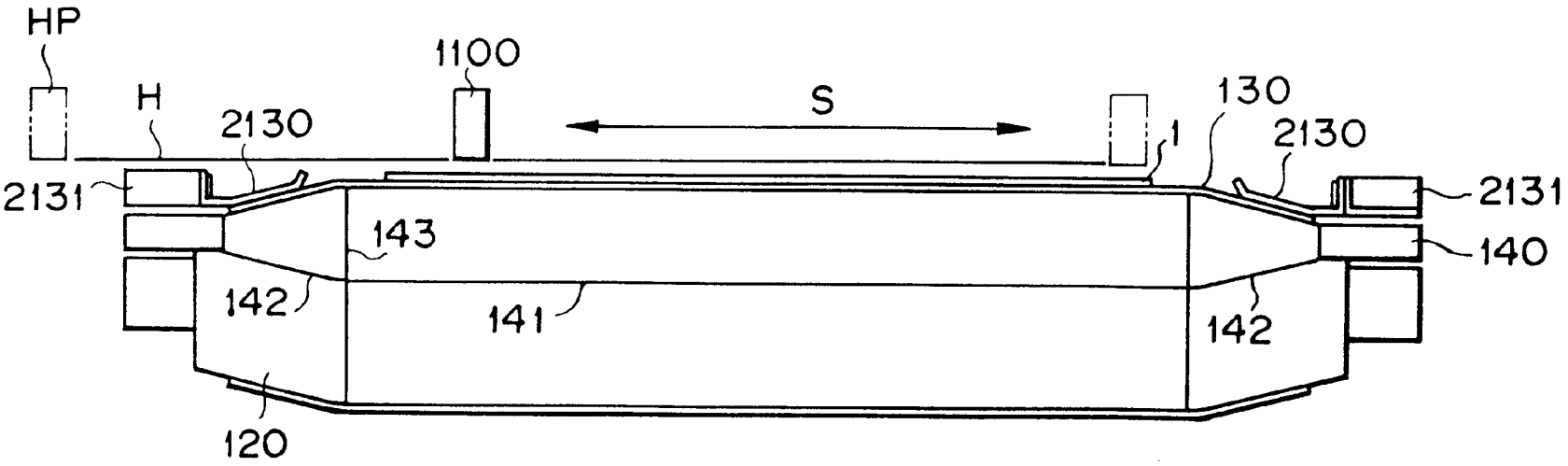
FIG. 32 is another cross-sectional view of the conveying section showing an embodiment wherein a plurality of sheet-like slidable members are arranged for the conveying section.
Figure 33:
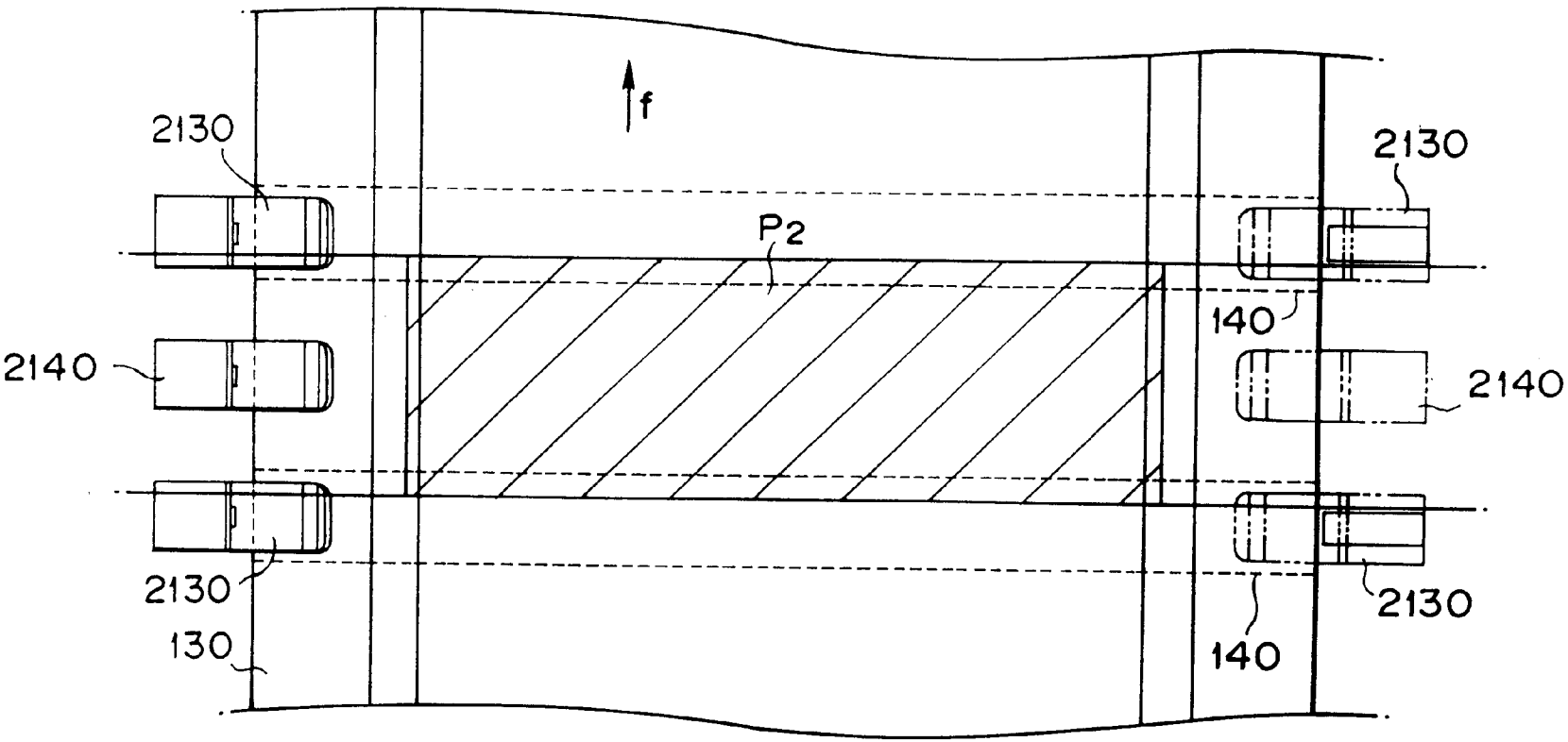
FIG. 33 is a plan view of the conveying section showing a modified embodiment wherein a plurality of sheet-like slidable members are arranged for the conveying section.

FIG. 32 and FIG. 33 show by way of example the arrangement of a plurality of sheet plate-like slidable displacement members 2130 located at the opposite ends of the conveying belt 130 in order to effectively suppress the turning-up of the conveying belt 130 away from the opposite ends of the respective conveying rollers within the carriage scanning range. The slidable displacement members 2130 are fixedly secured to support members 2131 disposed at the opposite ends of the platen rollers 140 as viewed in the transverse direction while they are arranged along the crown portions 142 of the platen rollers 140 in order to suppress the foregoing turning-up of the conveying belt 130 by bringing the slidable displacement members 2130 in slidable contact with the upper surfaces of the opposite end parts of the conveying belt 130. In addition, intermediate slidable displacement members 2140 similar to the slidable displacement members 2130 are supported by the support members 2141 at the opposite ends of the conveying belt 130 while they are located at the intermediate positions between both the platen rollers 140. Each of the slidable displacement members 2130 and 2140 includes an upwardly bent corner portion at the foremost end thereof in order to prevent the surface of the conveying belt 130 from being injured or scratched by the respective slidable displacement members 2130 and 2140. The slidable displacement members 2130 and 2140 are arranged such that their upper ends are positionally coincident with the surface of the cloth 1 serving as a printing medium, and moreover, they are always located at least below the lowermost position H of the ink jet head 1100. With such construction, there does not arise a malfunction that the printer head 1100 interferes with the upper ends of the slidable displacement members 2130 and 2140 when it is displaced to a home position HP.

As long as the aforementioned turning-up of the conveying belt 130 is effectively suppressed within the carriage scanning range with the aid of the slidable displacement members 2130 and 2140, the interference of the carriage or the ink jet heads with the opposite ends of the conveying belt can effectively be avoided. In other words, the conveying belt, i.e., the printing medium and the carriage can come near to each other more and more by increasingly reducing the gap therebetween, resulting in a printing accuracy of the textile printing apparatus being improved.

Figure 34A:
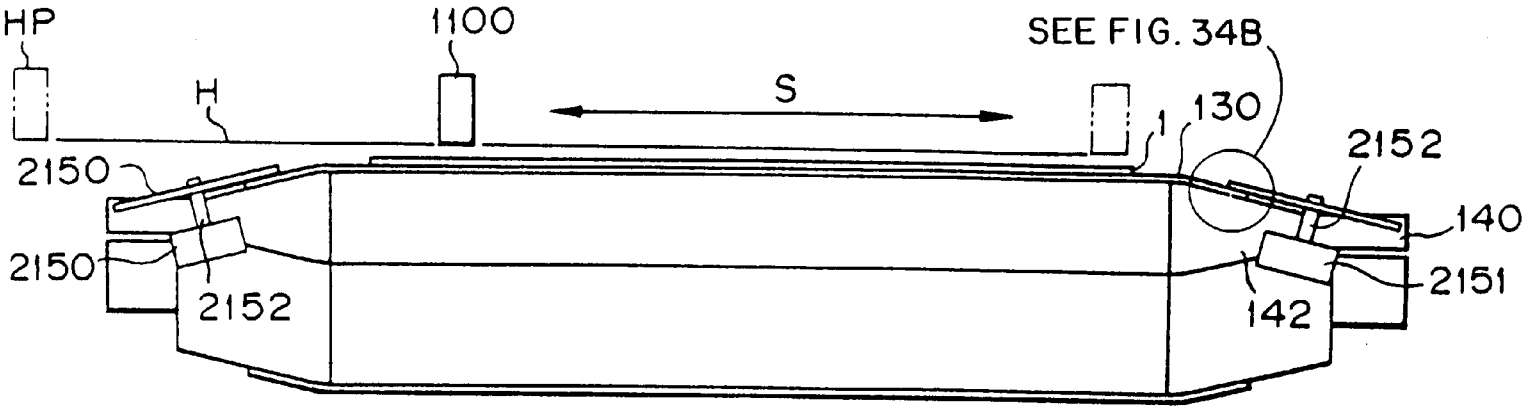
FIG. 34A is a cross-sectional view of the conveying section showing other modified embodiment wherein a plurality of sheet-like slidable members are arranged for the conveying section.
Figure 34B:
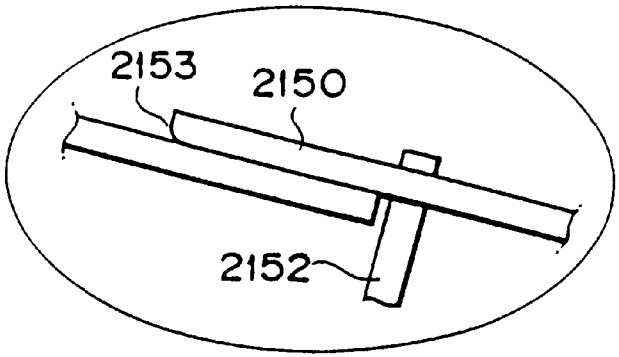
FIG. 34B is an enlarged view of a section of FIG. 34A.
Figure 35:
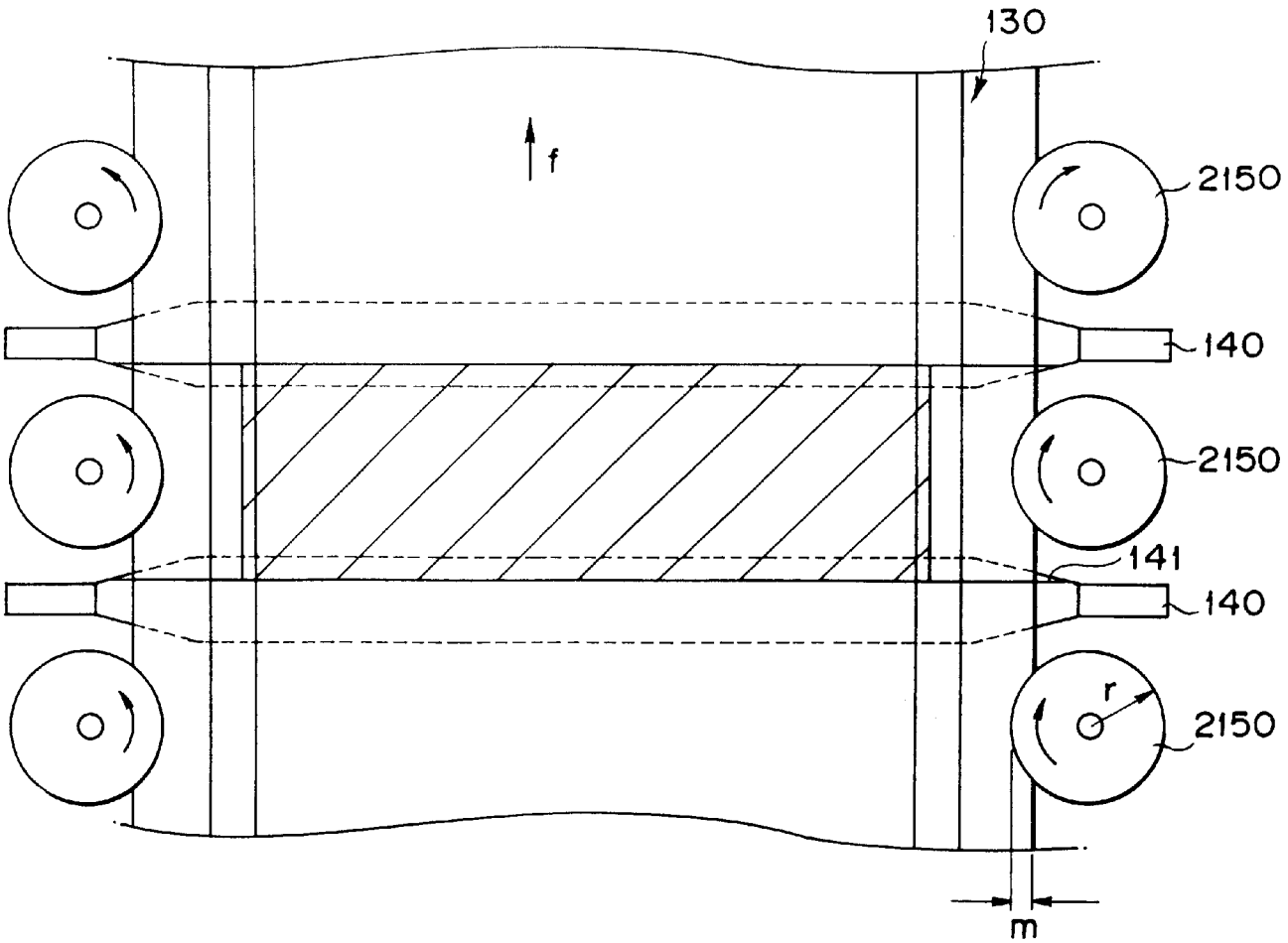
FIG. 35 is a plan view showing another embodiment wherein a plurality of sheet-like slidable members are arranged for the conveying section.

FIG. 34 and FIG. 35 show an embodiment modified from the preceding embodiment shown in FIG. 32 and FIG. 33 wherein a plurality of circular sheet-like followable retaining plates 2150 are substituted for the slidable displacement members 2130 and 2140. The followable retaining plates 2150 are arranged not only between a pair of platen rollers 140 but also on the upstream side and the downstream side of the platen rollers 140, and each followable retaining plate 2150 includes a supporting member 2151 which is rotatably disposed to rotate about a rotational shaft 2152. As is best seen in FIG. 34, the followable retaining plate 2150 is inclined corresponding to the tapering of a crown portion 141 of each platen roller 140, and the lower surface of the followable retaining plate 2150 comes in contact with the upper surface of the conveying belt 130 at the opposite ends of the latter. With this construction, each of the opposite end parts of the conveying belt 130 extends along the crown portion 141 of the platen roller 140. Otherwise, the followable retaining plates 2150 may be arranged in the depressing state in such a manner that the circumferential length of the conveying belt 130 as measured along the belt end 131 of the conveying belt 130 coincides with a free length of the same. It should be noted that the peripheral part of the followable retaining plate 2150 is machined in the form of a curved portion 2153 on the lower surface side for retaining the conveying belt 130 therewith without any possibility of injuring or scratching the conveying belt 130. It is desirable from the viewpoint of protection of the conveying belt 130 that a length m as measured within the range where the followable retaining plate 2150 comes in contact with the conveying belt 130 is set to a half or less of a radius r of the followable retaining plate 2150 in order to reduce the slidable contact area of the followable retaining plate 2150 with the conveying belt 130 as far as possible. It of course is obvious that each followable retaining plate 2150 is arranged such that its upper end has a height substantially coincident with that of the cloth 1 serving as a printing medium, and it is always located at least below a lowest position H of each ink jet head 1100 so as to assure that any interference does not occur when the ink jet heads 1100 are displaced to the home position HP.

In this modified embodiment, the followable retaining plates 2150 each adapted to followably rotated as the conveying belt 130 is recirculatively driven can exhibit the same advantageous effects as those obtainable from the aforementioned slidable displacement members, and moreover, they can prevent undesirable wearing of the conveying belt 130 more reliably than the case that the slidable displacement members are employed for the conveying belt 130, resulting in the durability of the conveying belt 130 being improved without any occurrence of a malfunction that the carriage or the ink jet heads interfere with the opposite ends of the conveying belt 130. In other words, the conveying belt 130, i.e., the printing medium and the carriage can come near to each other more and more by increasingly reducing the gap therebetween. Thus, a printing accuracy of the textile printing apparatus can be improved.

Each of the slidable displacement members and the followable retaining plates shown in FIG. 32 to FIG. 35 does not include any component located above the lowermost end position of each ink jet head. Thus, since there does not arise a necessity for taking account of interference with head holders, each head holder can be composed of a single component. Since each head holder can be designed and constructed in the flat plate-shaped configuration, in the case that ink jet heads are mounted on the textile printing apparatus with multi-staged structure, a pitch between adjacent stages can be determined with a high accuracy. Further, a pitch between adjacent stages can freely be changed as desired regardless of the presence or the absence of retaining members.

In each of the aforementioned embodiments, the slidable displacement members or the followable retaining plates are arranged as belt turning-up preventing members in the case that rollers each including crown portions are employed for the follower roller 110, the driving roller 120 and the platen rollers 140. However, it of course is obvious that slidable displacement members or followable retaining plates of the foregoing type are effectively employed for the conveying belt also in the case that straight rollers are substituted for the rollers each having crown portions.

Figure 36:
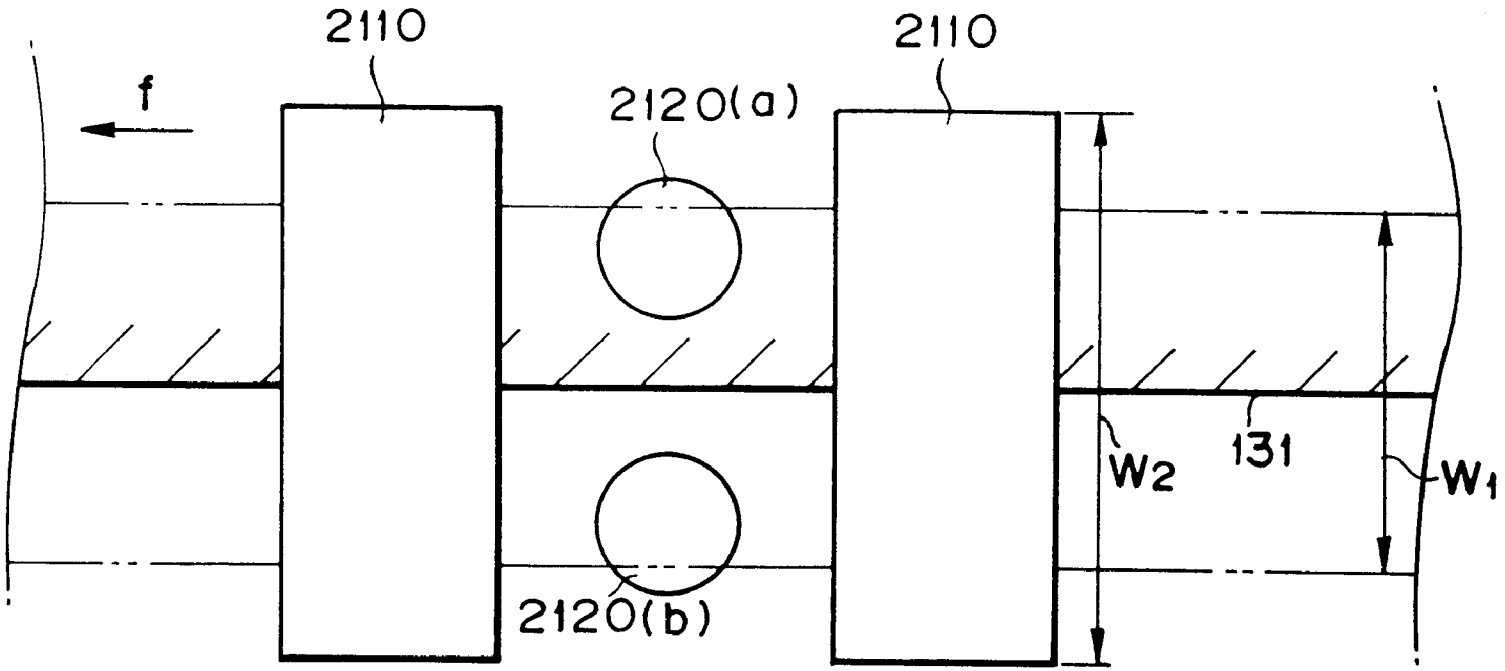
FIG. 36 is a fragmentary enlarged plan view showing the arrangement of an end part detecting sensor and associated components.
Figure 37:
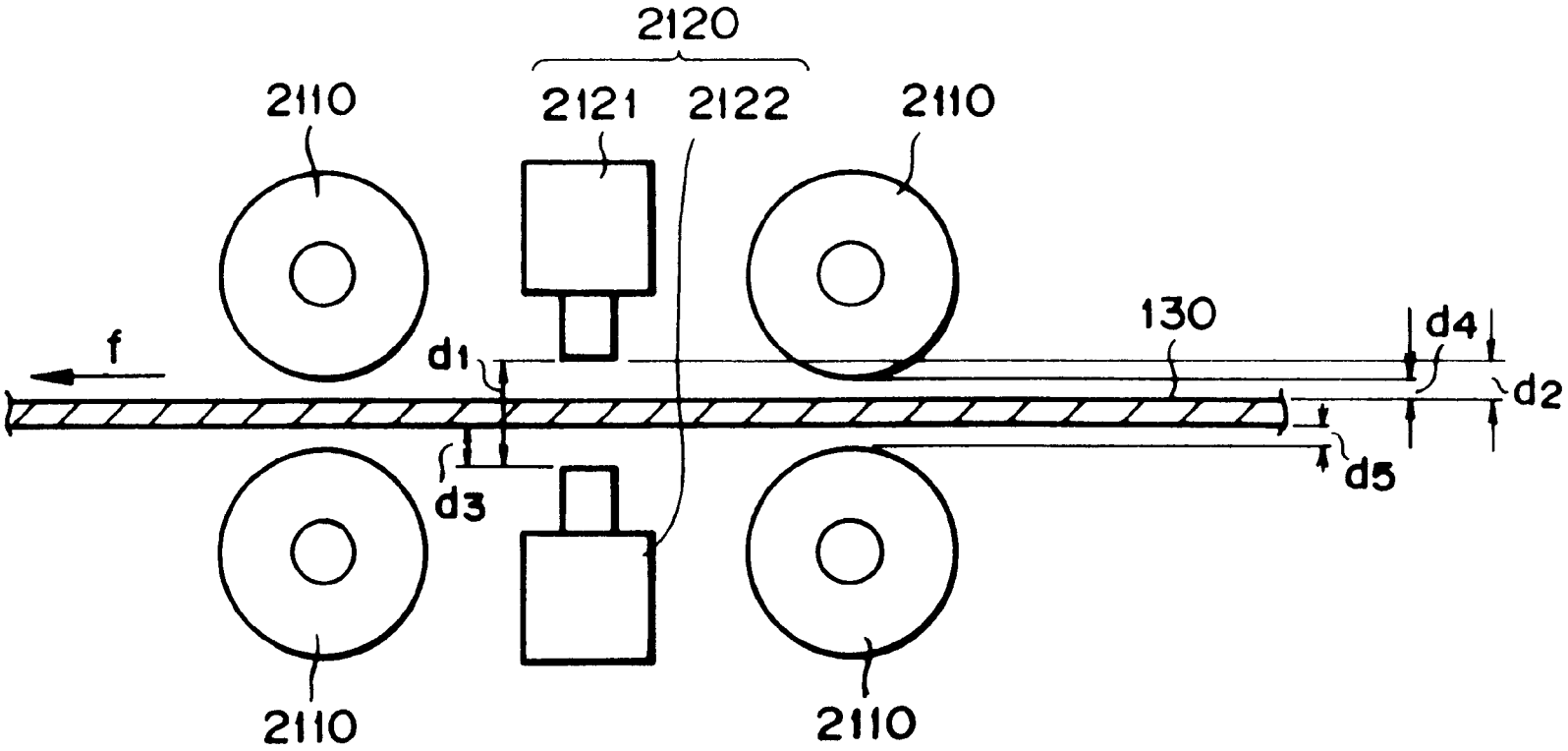
FIG. 37 is a side view showing the arrangement of the end part detecting sensor and associated components shown in FIG. 36.

FIG. 36 and FIG. 37 show the positional relationship between an end part detecting sensors 2120 and a plurality of retaining rollers 2110 as described above with reference to FIG. 27, respectively. The end part detecting sensor 2120 constructed in the form of an optical sensor is composed of a light sending portion 2121 located above the conveying belt 130 and a light receiving portion 2122 located opposite to the light sending portion 2121. Each of the light sending portion 2121 and the light receiving portion 2122 includes a pair of light sending and receiving portions located inside and outside of the belt end with a predetermined sensor gap $d_1$ therebetween as represented by reference numerals 2120(*a*) and 2120(*b*) in FIG. 36 on the assumption that the conveying belt 130 is recirculatively driven without an occurrence of snake-dance movement. Specifically, the light sending portion 2121 is disposed above the upper surface of the conveying belt 130 with a predetermined sensor height $d_2$, while the light receiving portion 2122 is disposed below the lower surface of the conveying belt 130 with a predetermined gap $d_3$. On the other hand, two sensor retaining rollers 2110 are disposed on the upstream side of the end part detecting sensor 2120, and another two sensor retaining rollers 2110 are disposed on the downstream side of the same. On the assumption that the conveying belt 130 is normally driven, the sensor retaining rollers 2110 are located such that a gap $d_4$ is maintained between the upper sensor retaining roller 2110 and the upper surface of the conveying belt 130 and a gap $d_5$ is maintained between the lower sensor retaining roller 2110 and the lower surface of the conveying belt 130. The gap $d_4$ as measured from the upper surface of the conveying belt 130 is dimensioned to be smaller than the sensor height $d_2$, and the gap $d_5$ as measured from the lower surface of the conveying belt 130 is dimensioned to be smaller than the gap $d_3$. Incidentally, it is acceptable that the gaps $d_4$ and $d_5$ between the conveying belt 130 and the sensor retaining rollers 2110 are reduced to a level of zero so that the sensor retaining rollers 2110 are normally brought in contact with the conveying belt 130. The end part detecting sensor 2120 should not be limited to an optical sensor but it may be a sensor operable using, e.g., supersonic. As shown in FIG. 36, the end part detecting sensor 2120 can detect whether or not an end edge of the conveying belt 130 is located between both the sensor positions represented by reference numerals 2120(*a*) and 2120(*b*). Thus, the snake-dance movement of the conveying belt 130 can be suppressed based on the results derived from the detection conducted by the end part detecting sensor 2120. Provided that the snake-dance movement of the conveying belt 130 is suppressed based on the sensor detection data, the range where the conveying belt 130 is driven with snake-dance movement is restricted within the range defined by $W_1$. A width $W_2$ of each sensor retaining roller 2110 as measured in the transverse direction is dimensioned to be larger than the width $W_1$ of the snake-dance movement range, whereby an occurrence of turning-up of the conveying belt 130 away from the opposite ends of the respective conveying rollers can be prevented at all times.

Here, the reason why the sensor retaining rollers 2110 are disposed in that way consists in preventing the opposite end parts 131 of the conveying belt 130 from being turned up away from the opposite ends of the respective conveying rollers, preventing the conveying belt 130 from interfering with the end part detecting sensor 2120, and exactly detecting the position of the end part 131 of the conveying belt 130. When the position of the end part 131 of the conveying belt 130 is exactly detected, the time when an operation for correcting the snake-dance movement of the conveying belt 130 is to be started and the time when the foregoing correcting operation is to be stopped can exactly be detected. This leads to the result that a quantity of snake-dance movement of the conveying belt 130, i.e., a quantity of snake-dance movement of the printing medium can be minimized, and moreover, a quality of printed image can be improved by suppressing line offset due to the snake-dance movement of each printed article.

Figure 38:
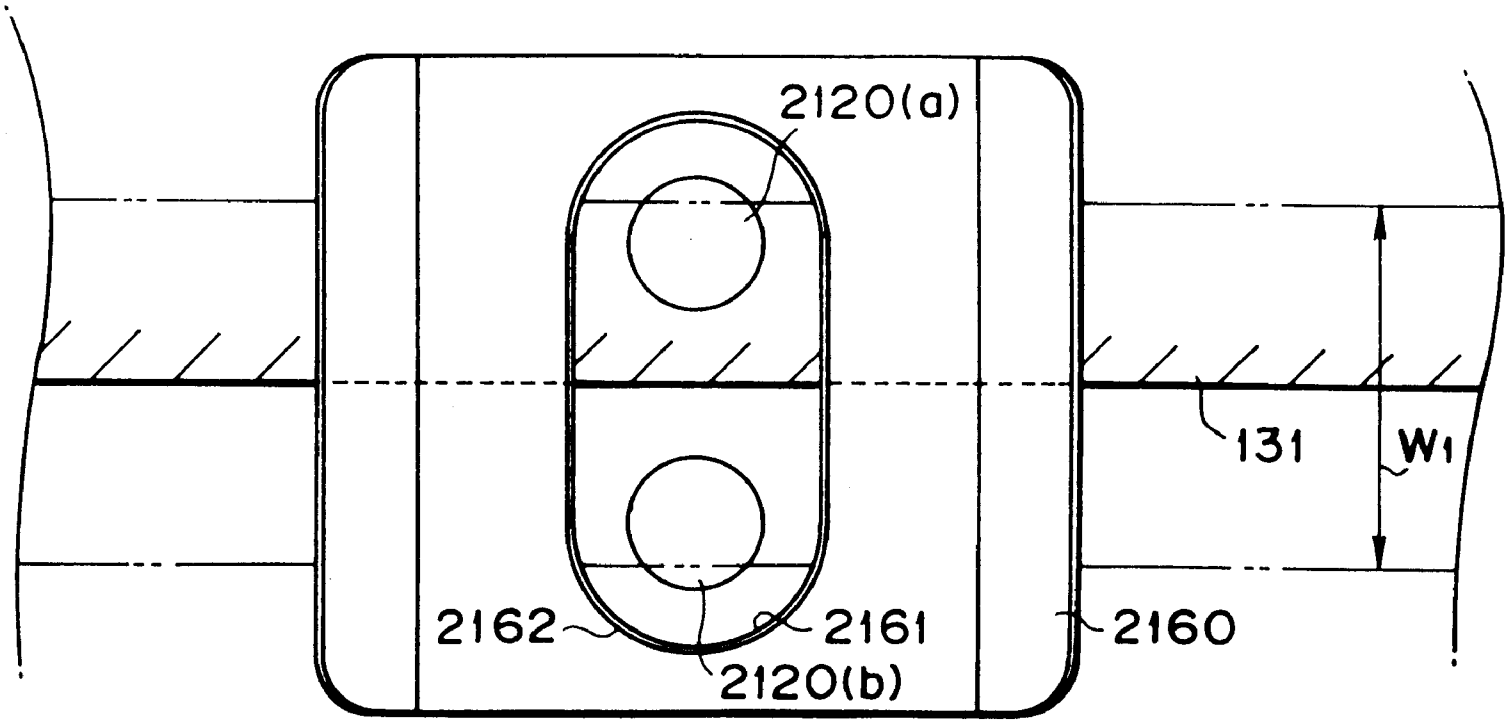
FIG. 38 is another fragmentary enlarged plan view showing the arrangement of an end part detecting sensor and associated components.
Figure 39:
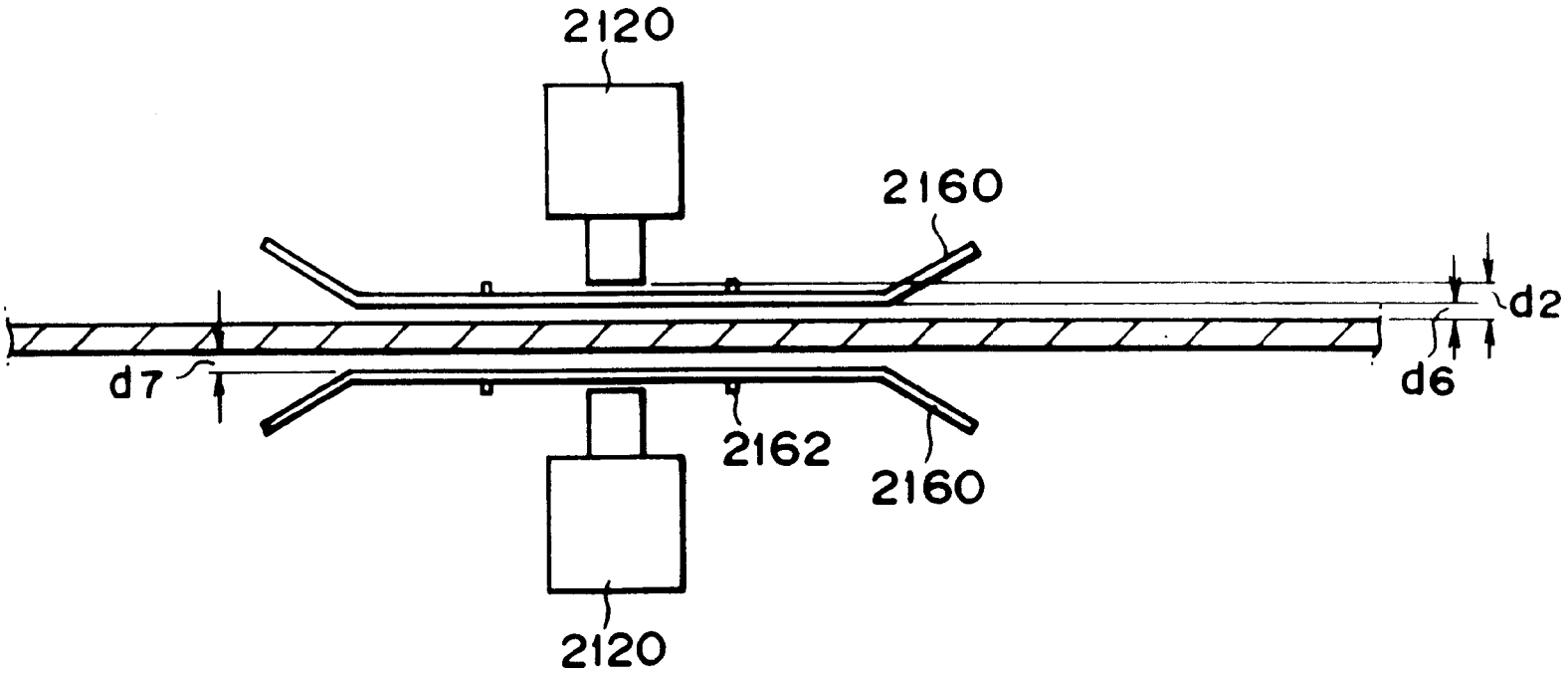
FIG. 39 is a side view showing the arrangement of the end part detecting sensor and associated components shown in FIG. 38.

FIG. 38 and FIG. 39 show by way of example the arrangement of an opposing pair of stationary retaining plates 2160 in place of the aforementioned sensor retaining rollers 2110, respectively. The retaining plates 2160 are arranged in such a manner as to hold the conveying belt 130 therebetween in the clamped state between an opposing pair of end part detecting sensors 2120, and elongated holes 2161 are formed through both the retaining plates 2160 so as to allow a sensor signal to path therethrough. To prevent the conveying belt 130 from being injured or scratched due to contact of the conveying belt 130 with sharp edges of the elongated holes 2161, the edge parts of the elongated holes 2161 are folded back in the opposite direction relative to the conveying belt 130 to form folded portions 2162 by operating a press machine or the like, and bent parts slantwise extending away from the conveying belt 130 are formed on the opposite sides of the retaining plates 2160 as viewed in the conveying direction. The retaining plates 2160 each contoured in that way are arranged such that a gap $d_6$ is formed between the upper end part detecting sensor 2120 and the upper surface of the conveying belt 130 and a gap $d_7$ is formed between the lower end part detecting sensor 2120 and the lower surface of the conveying belt 130. With such construction, the gap $d_6$ and the gap $d_7$ define a maximum quantity of turning-up of the conveying belt 130 away from the opposite ends of the respective conveying rollers, whereby the opposite end parts 131 of the conveying belt 130 are restrictively held within the range defined by both the gaps $d_6$ and $d_7$. It should be noted that advantageous effects obtainable from these retaining plates 2160 are substantially same to those obtainable from the sensor retaining rollers 2110 as mentioned above.

Figure 40:
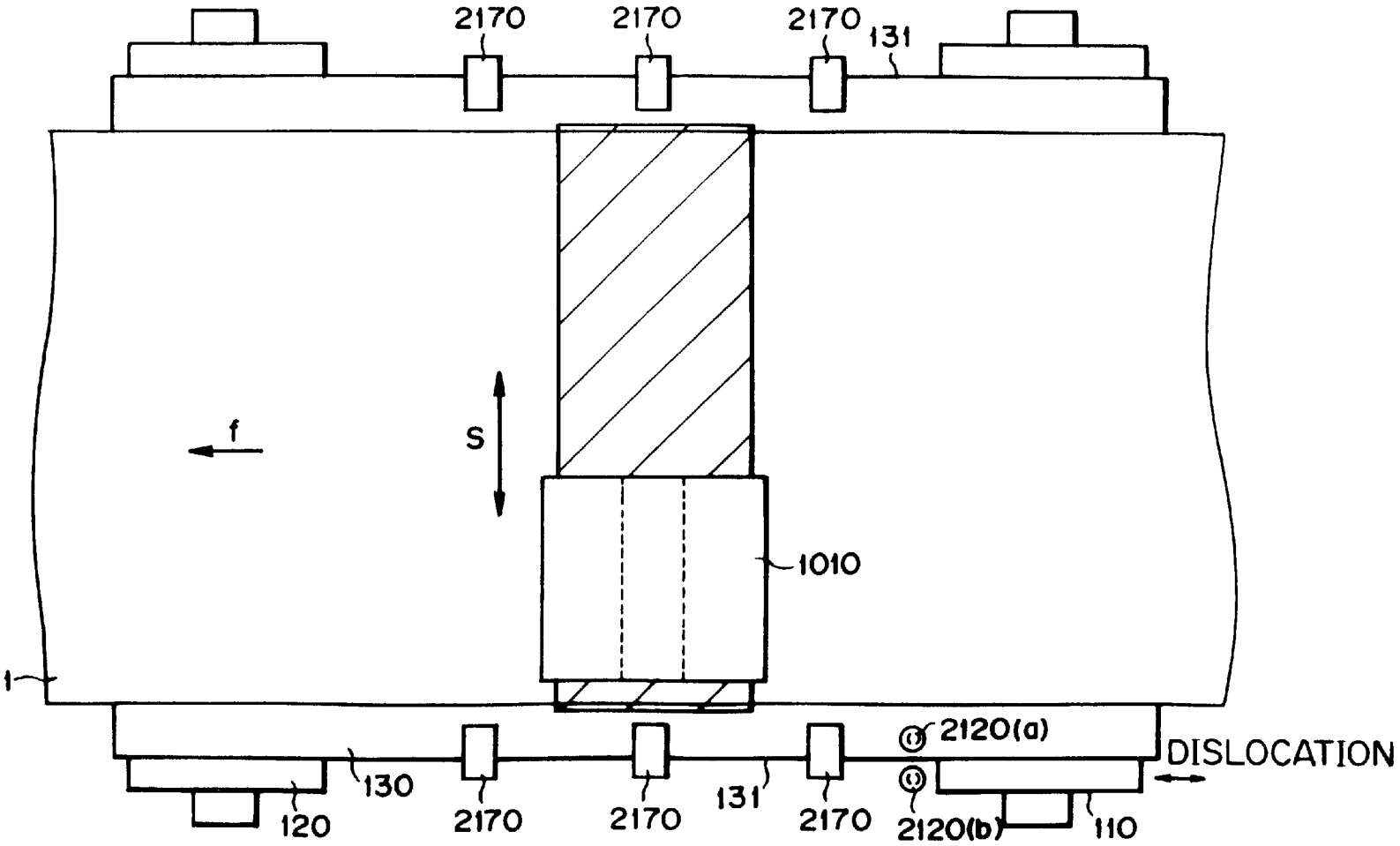
FIG. 40 is a plan view showing an embodiment wherein a plurality of retaining rollers are arranged for the textile printing apparatus.
Figure 41:
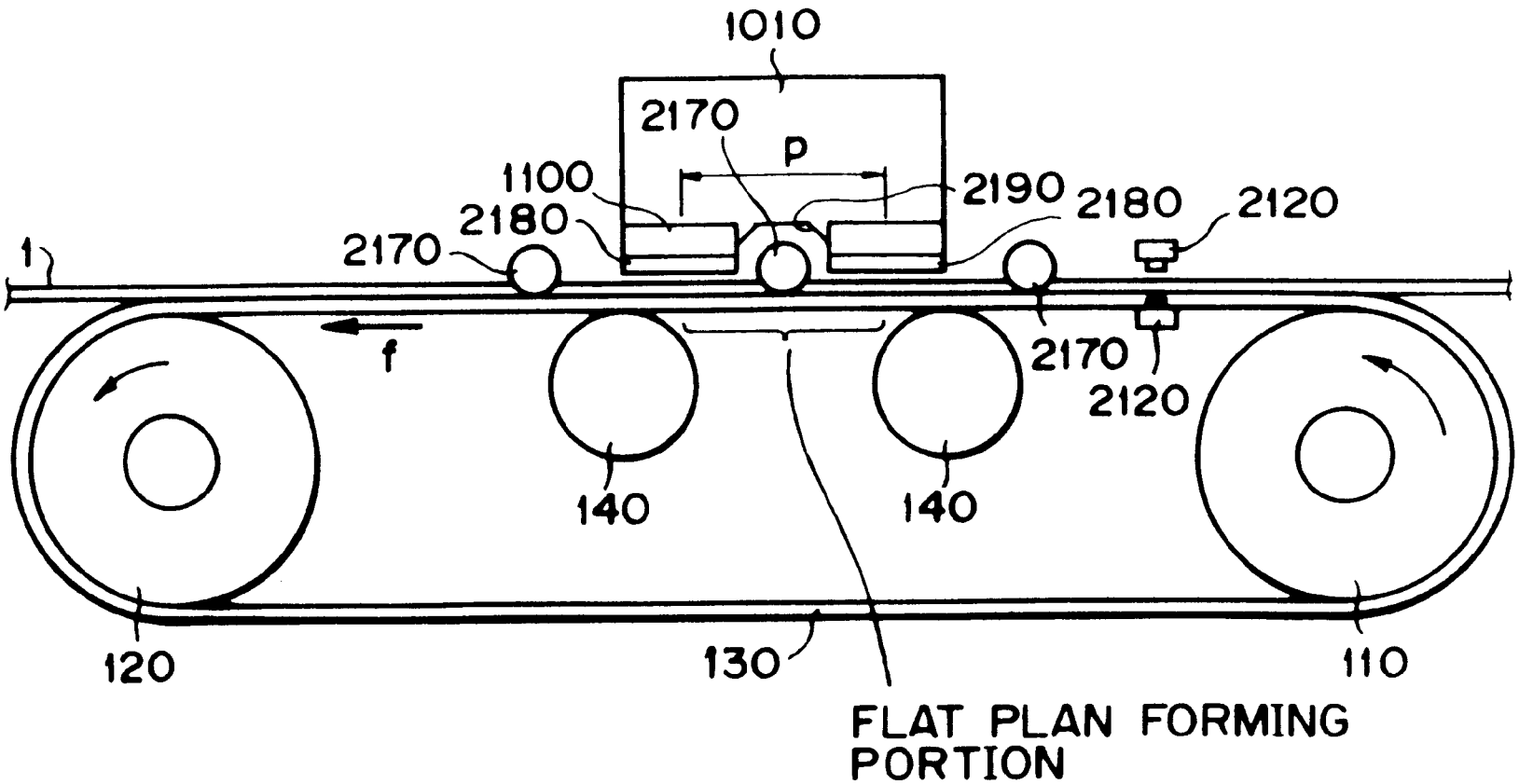
FIG. 41 is a side view showing a modified embodiment wherein a plurality of retaining rollers are arranged for the textile printing apparatus.
Figure 42:
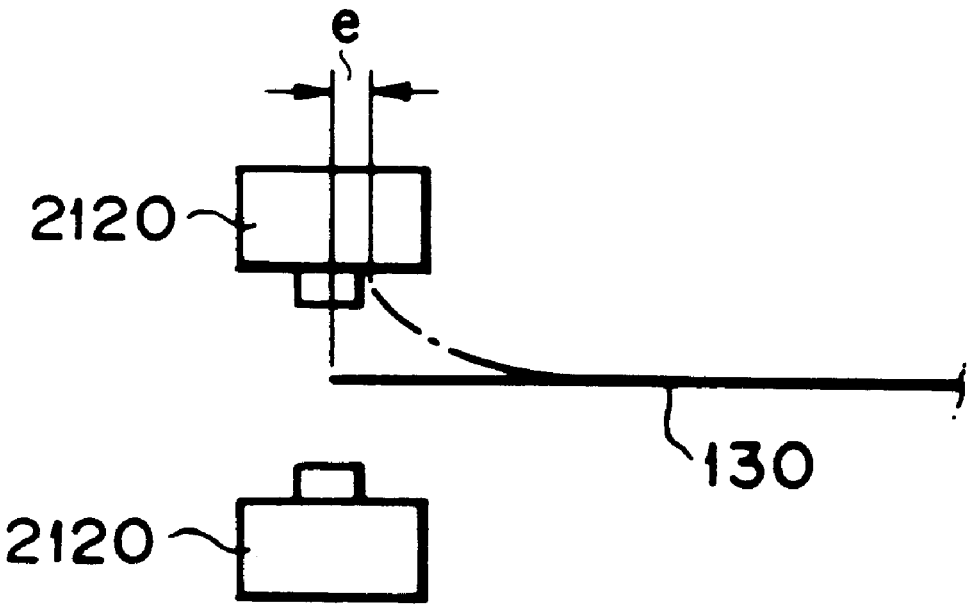
FIG. 42 is a fragmentary enlarged view showing another modified embodiment wherein a plurality of retaining rollers are arranged for the textile printing apparatus.

FIG. 40 to FIG. 42 show by way of example the arrangement of a plurality of retaining rollers 2170 each serving as a belt end turning-up suppressing member, respectively. the retaining rollers 2170 are arranged in such a manner as to come in contact with the upper surface of the conveying belt 130 which is recirculatively driven within the carriage scanning range. In the shown embodiment, straight rollers are employed for the follower roller 110, the driving roller 120 and the platen rollers 140.

Owing to the arrangement of the retaining rollers 2170 in that way, an occurrence of infringement of head holders 2180 for the ink jet heads 1100 and the carriage 1010 with the conveying belt 130 can reliably be prevented. However, it is necessary that the retaining rollers 2170 arranged between both the platen rollers 140 interfere with the head holders 2180 and the carriage 1010. In view of the foregoing necessity, a head holder 2180 is disposed for each of the ink jet heads 1100 attached to the carriage 1010 with two-staged structure, and a recess 2190 is formed between both the printer heads 1100. In this embodiment, since two retaining rollers 2170 are arranged between the ink jet heads 1100 attached to the carriage 1010 at two stages, an inconvenience is such that a head pitch p between both the ink jet heads 1100 can not freely be changed to another one.

In this embodiment, no sensor retaining roller is disposed for the conveying system. For this reason, when the belt end parts are turned up away from the opposite ends of the respective conveying rollers as shown in FIG. 42, there arise inconveniences that the conveying belt 130 interferes with the end part detecting sensor 2120, and moreover, the position of each of the opposite end parts of the conveying belt 130 can not exactly be detected due to appearance of an error e at the belt end position.

Figure 43A:
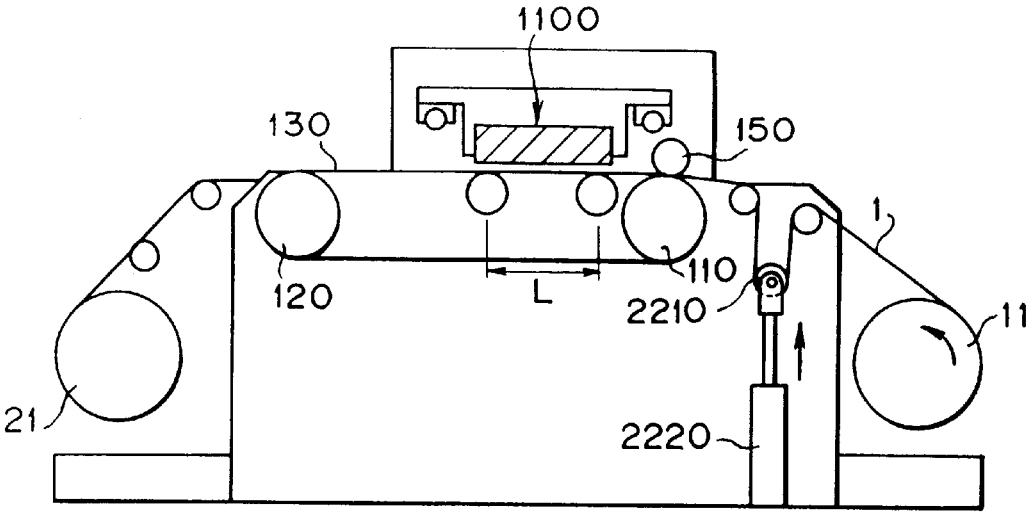
FIG. 43A and FIG. 43B are side views showing an embodiment wherein a tension roller is arranged in a conveying system respectively.
Figure 43B:
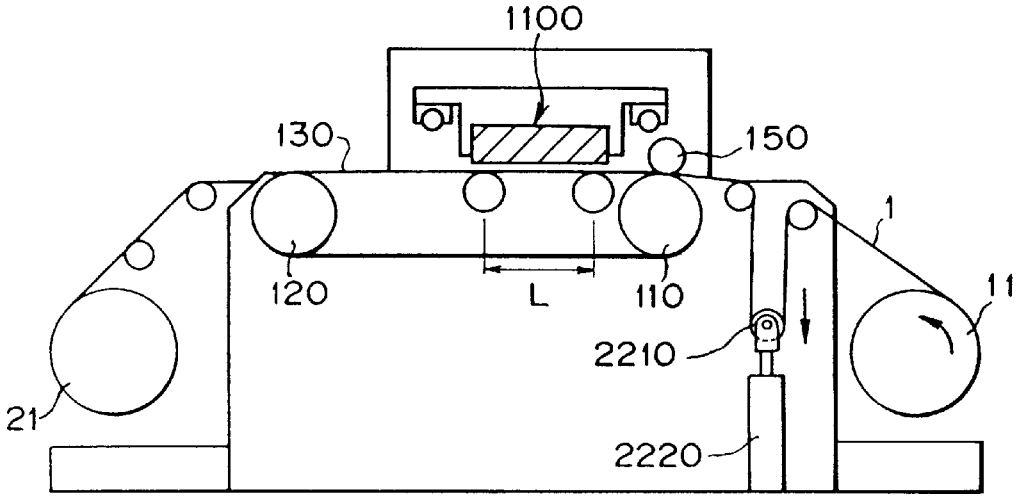

FIG. 43A and FIG. 43B show by way of example the arrangement of a tension roller 2210 in the conveying system, respectively. In the shown embodiment, a printing medium 1, i.e., a cloth is unwound from an unwinding roller 11, it is adhesively placed on the conveying belt 130 with the aid of the labelling roller 150, it is conveyed between the flat plane defined by both the platen rollers 140 and the ink jet heads 1100, and thereafter, it is wound about a winding roller 21. In this case, since the printing medium 1 is intermittently fed at a distance (i.e., by a quantity L of intermittent feeding) corresponding to the printing width of the ink jet heads 1100, the unwinding roller 11 should repeat quick rotating and quick stopping. In this embodiment, to prevent the unwinding roller 11 from repeating quick rotating and quick stopping in that way, the tension roller 2210 is arranged between the unwinding roller 11 and the labelling roller 150.

As is apparent from the drawing, the tension roller 2210 is vertically displaceably disposed at the uppermost end of a rod projecting outside of a pneumatic cylinder 2220 in order to compensate a quantity of feeding of the printing medium 1 every time the printing medium 1 is intermittently fed, and moreover, absorb an extra quantity of the printing medium 1 unwound from the unwinding roller 11 during each printing operation (i.e., during stoppage of conveyance of the printing medium 1). Specifically, in the shown embodiment, since the printing medium 1 is always unwound from the unwinding roller 11 at a constant speed, the tension roller 2210 is downwardly displaced during stoppage of each printing operation (i.e., during stoppage of conveyance of the printing medium 1) in order to absorb a slackened part of the printing medium 1 unwound from the unwinding roller 11 at a distance corresponding to the printing width, as shown in FIG. 43B. On the other hand, when the printing medium 1 is intermittently fed, the tension roller 2210 is displaced in the upward direction in such a manner as to follow the intermittent feeding of the printing medium 1. With this construction, it is sufficient that the unwinding roller 11 is always rotated at a constant speed without any necessity for quick stopping as well as quick rotating. Thus, since the vibration caused when the unwinding roller 11 is rotated at an irregular rotational speed is not transmitted to the printer section, a quality of printed image can be improved. Since the arrangement of the tension roller 2210 in that way assures that an intensity of tension applied to the printing medium 1 is kept substantially constant, the adhesive placement of the printing medium 1 on the conveying belt 130 can uniformly be achieved. In this embodiment, since the ink jet heads 1100 are mounted on the carriage at a single stage, a quantity L of intermittent feeding of the printing medium 1 is substantially coincident with the distance between a pair of platen rollers 140. However, in the case that the ink jet heads 1100 are mounted on the carriage at two stages or three or more stages in the same manner as each of the aforementioned embodiments, a quantity of intermittent feeding of the printing medium 1 is naturally different from the distance between both the platen rollers. Although the tension roller is arranged on the unwinding roller side in the shown embodiment, it of course is obvious that another tension roller may be arranged on the winding roller side in order to prevent an occurrence of quick stopping and quick rotating of the winding roller.

Figure 44:
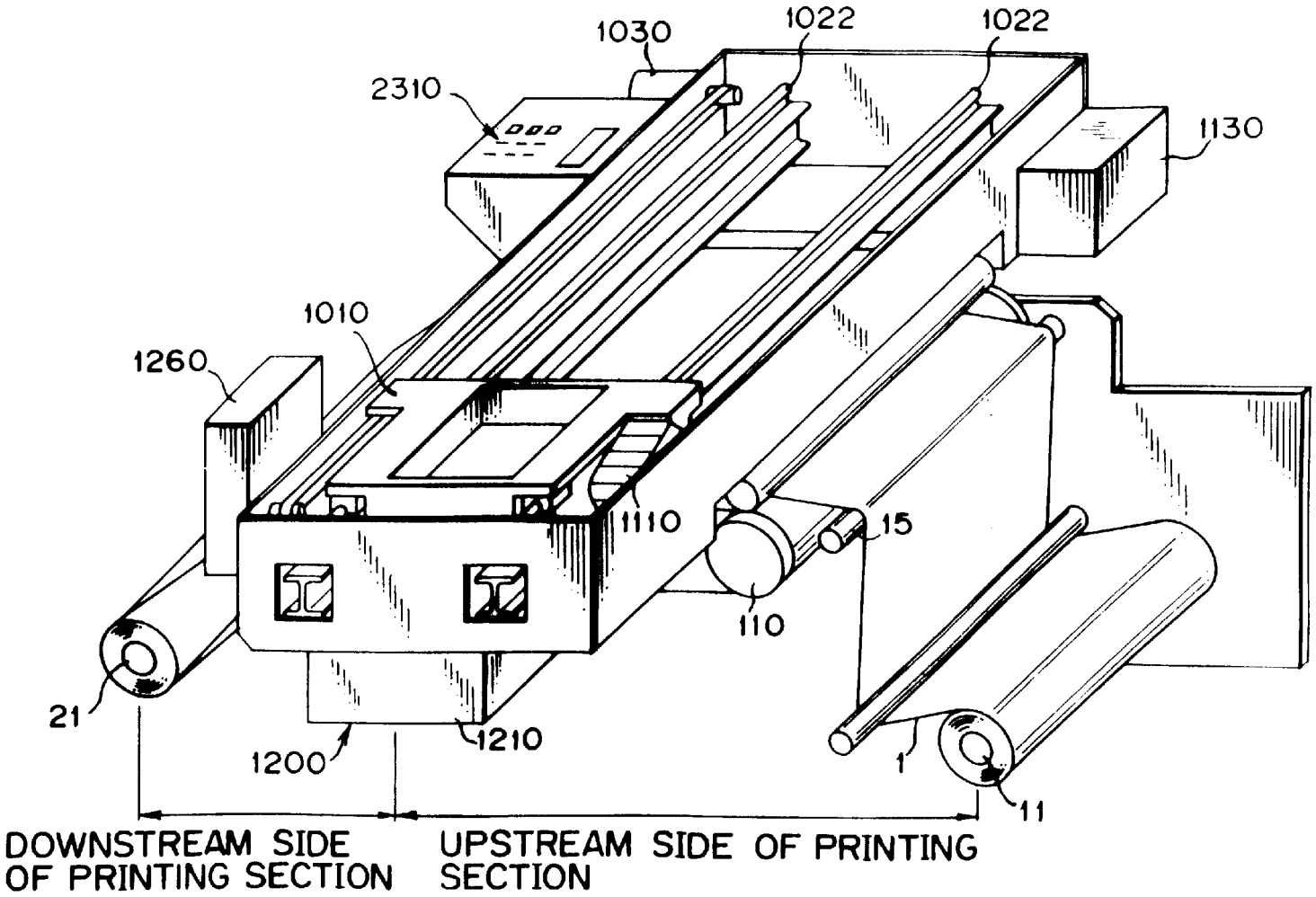
FIG. 44 is a perspective view showing by way of example the arrangement of an operation panel.

(7) Operation of the image forming apparatus and a maintenance service to be performed for the image forming apparatus FIG. 44 shows by way of example the arrangement of an operation panel for the ink jet type image forming apparatus constructed in the above-described manner to serve as a textile printing apparatus. It should be noted that same components as those shown in FIG. 4 are represented by same reference numerals and repeated description on these components is herein omitted for the purpose of simplification.

As shown in FIG. 44, the operation panel 2310 for instructing that the ink jet type textile printing apparatus performs a printing operation is arranged sideward of the conveying belt 130 on the downstream side of the printer section. With this arrangement, since the printing medium 1 is conveyed toward the operation panel 2310 after completion of the printing operation, a quality of printed image can visually be confirmed without delay. For example, when an image is printed on the printing medium 1 on the trial basis, a quality of printed sample can visually be confirmed immediately after a printing command is issued from the operation panel 2310. In addition, an incorrectly printed image can be detected during handling of the operation panel 2310, and at this time, the operation of the textile printing apparatus can immediately be stopped so as to enable a maintenance service to be performed for the textile printing apparatus. This leads to the result that a possibility of incorrectly printing an image can largely be reduced. Since the printing medium is conveyed in the substantially horizontal direction after completion of each printing operation, if the operation panel is located on the upstream side of the printer section, there arises an inconvenience that the current state of printed image can not visually be confirmed during the handling of the operation panel because a frame of the printer section becomes a kind of obstacle for visual observation.

With respect to the textile printing apparatus as described above, ink is ejected from the ink jet heads in the perpendicular direction (i.e., in the downward direction orienting toward the ground surface). Thus, in the case that respective ink ejecting orifices are inspected when incorrect printing is achieved such that ink fails to be ejected therefrom or white stripes appear on a printed image, the ink jet heads should be observed by an inspector from below. At this time, there probably appears a problem that ink droplets fall down from the ink ejecting orifices into the inspector's eyes.

FIG. 45 to FIG. 49 show by way example the structure of a textile printing apparatus constructed to solve the foregoing problem, respectively. It should be noted that same components as those shown in FIG. 3 and FIG. 4 are represented by same reference numerals and repeated description on these components is herein omitted for the purpose of simplification.

Figure 45:
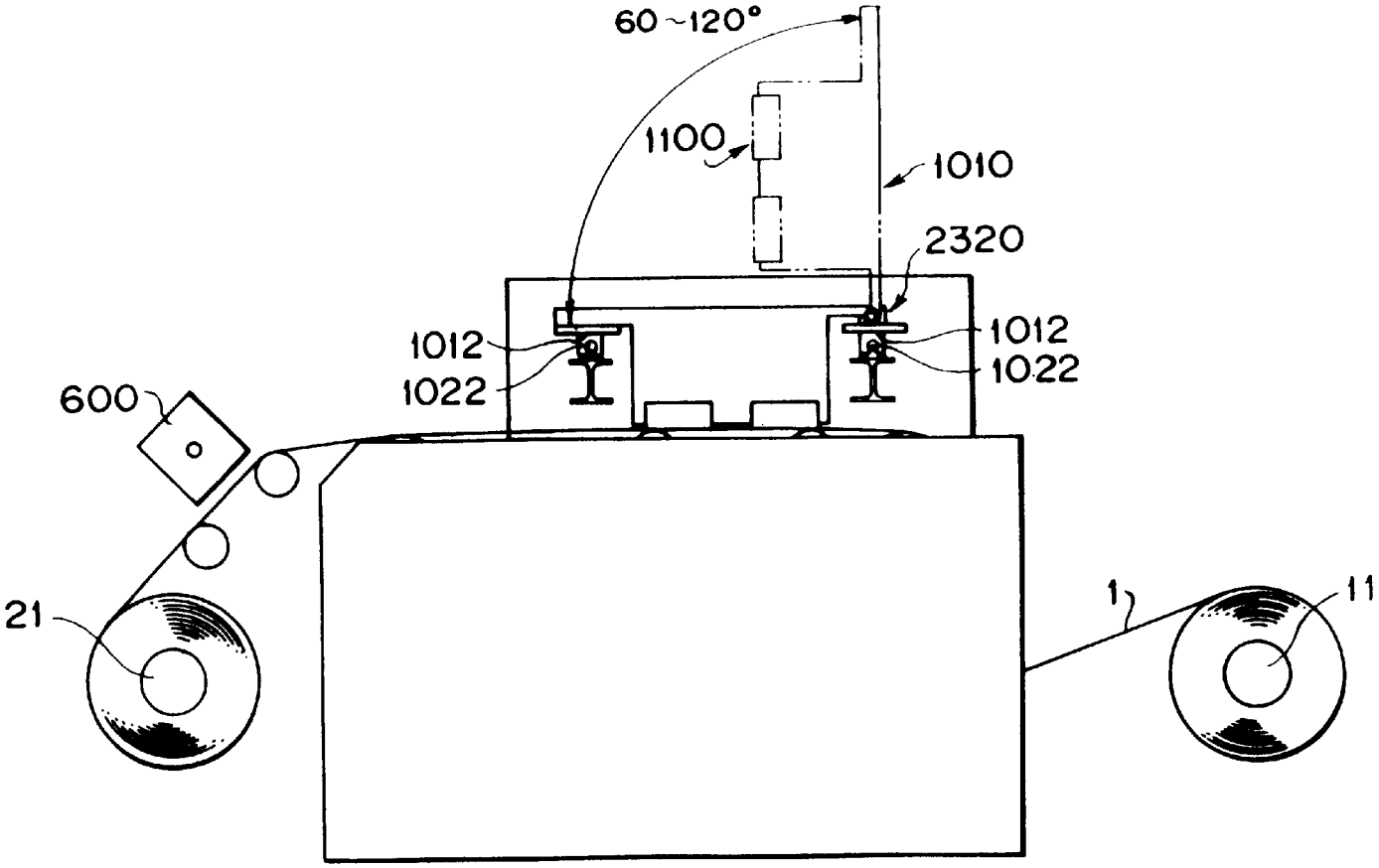
FIG. 45 is a side view showing an embodiment wherein a carriage is turnably arranged to turn in the textile printing apparatus.
Figure 46:
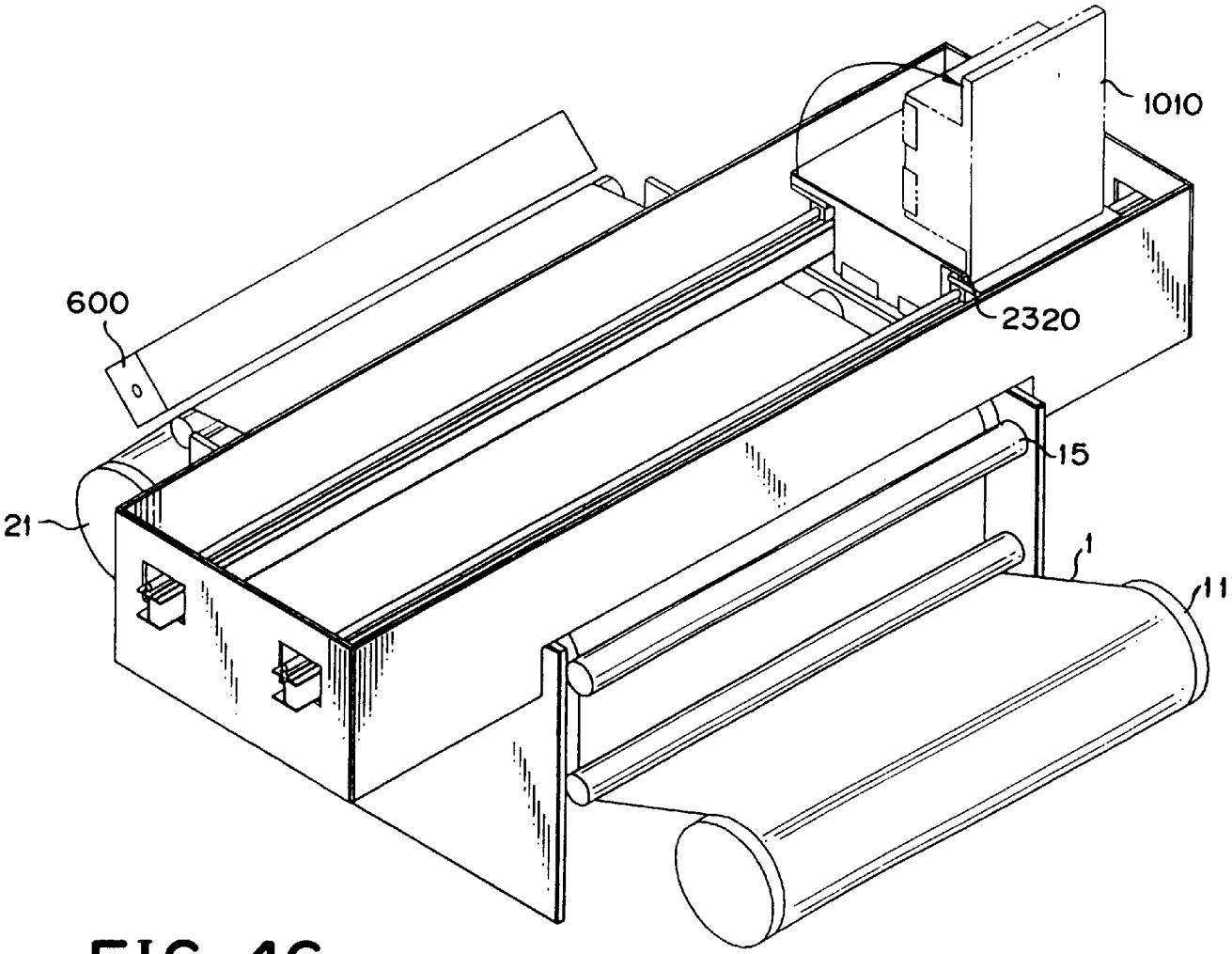
FIG. 46 is a perspective view of the carriage shown in FIG. 45.

FIG. 45 and FIG. 46 illustratively show an embodiment wherein a carriage 1010 having ink jet heads 1100 mounted thereon is turnably arranged so as to enable an inspector to easily observe ink ejecting orifices with his own eyes, respectively. Specifically, the carriage 1010 is mounted via sliders 1012 on two slide rails 1022 each extending in the main scanning direction. One of the sliders 1012 includes a hinge portion 2320 which permits the slider 1012 and the carriage 1012 to turn about an axis extending in the main scanning direction to serve as a center for the turning movement, and the other slider 1012 can be disconnected from the slide rail 1022 together with the carriage 1010. With this construction, the carriage 1010 can be turned with the hinge portion 2320 as a center within the range of, e.g., 45 to 120 degrees so that the respective ink ejecting orifices can easily be observed with inspector's eyes, and moreover, a cleaning operation can easily be performed for the ink ejecting orifices.

Figure 47:
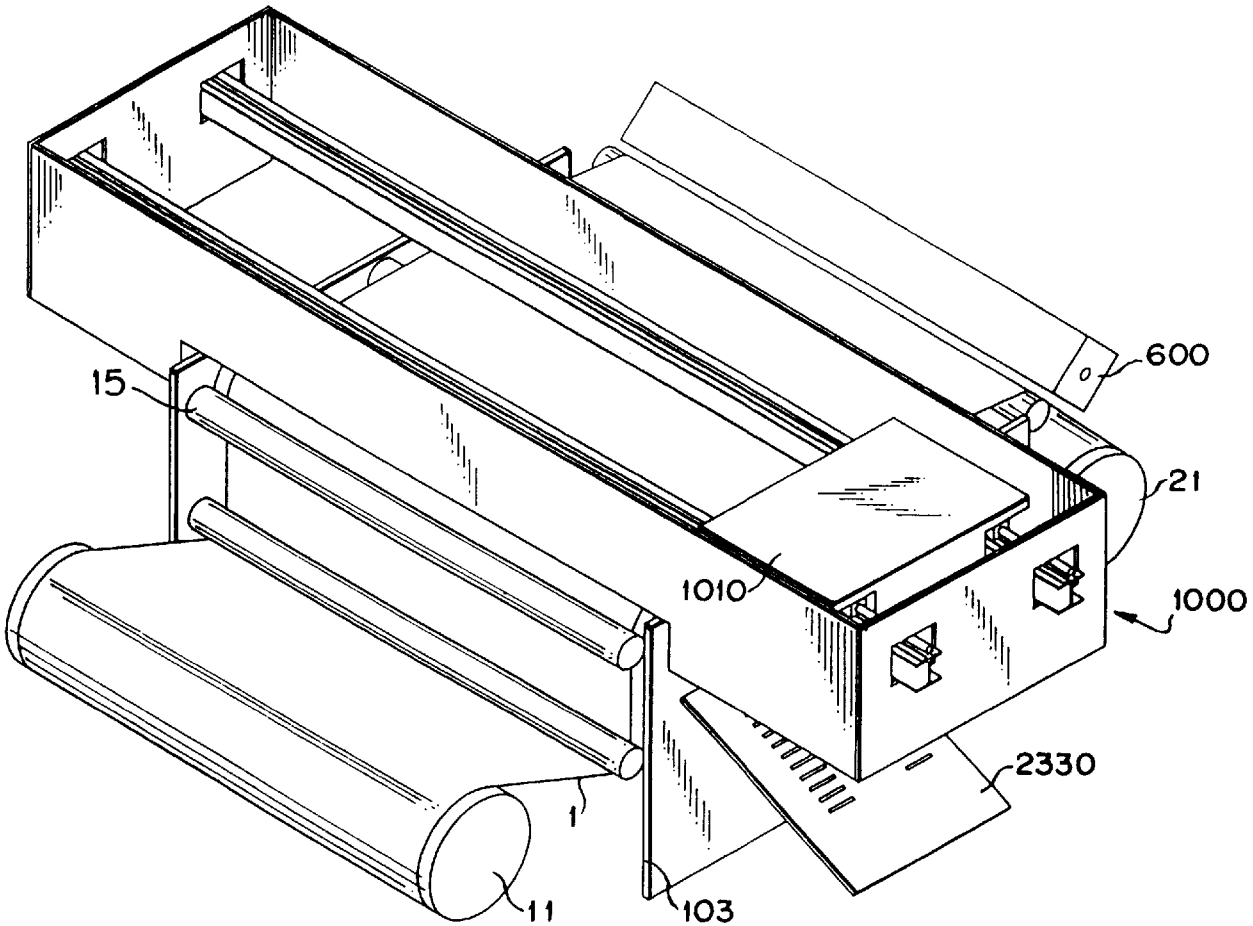
FIG. 47 is a perspective view showing an embodiment wherein a mirror is arranged in the textile printing apparatus so as to enable respective ink ejecting nozzles to be visually observed by an operator.
Figure 48:
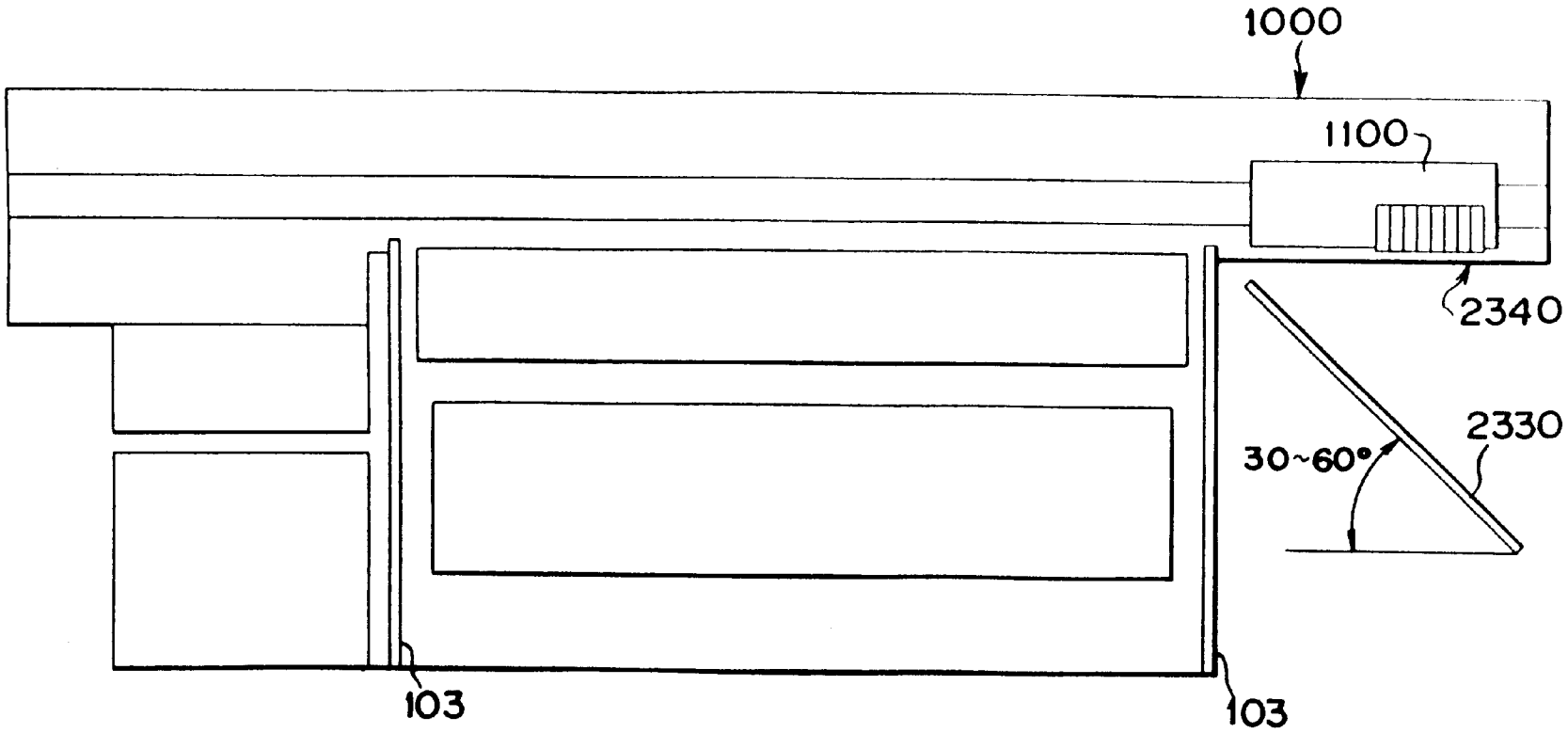
FIG. 48 is a side view showing a modified embodiment wherein a mirror is arranged in the textile printing apparatus so as to enable respective ink ejecting nozzles to be visually observed by an operator.

FIG. 47 and FIG. 48 illustratively show an embodiment wherein a mirror 2330 is arranged below the printer section 1000 so as to enable respective ink ejecting orifices to be observed with inspector's eyes, respectively. In this embodiment, the length of the printer section 1000 as viewed in the main scanning direction is dimensioned to be larger than the width of the conveying section measured between an opposing pair of side plates 103. As is best seen in FIG. 48, an opening portion 2340 is formed through the lower surface of a printer frame of the printer section 1000 extending outside of the side plate 103 on the right-hand side, and the mirror 2330 is slantwise arranged below the opening portion 2340. Incidentally, it is sufficient that the inclination of the mirror 2330 relative to the horizontal direction is adjustably set to an angle ranging from, e.g., 30 to 60 degrees so as to assure that the respective ink ejecting orifices can easily be observed with inspector's eyes via the mirror 2330.

Figure 49:
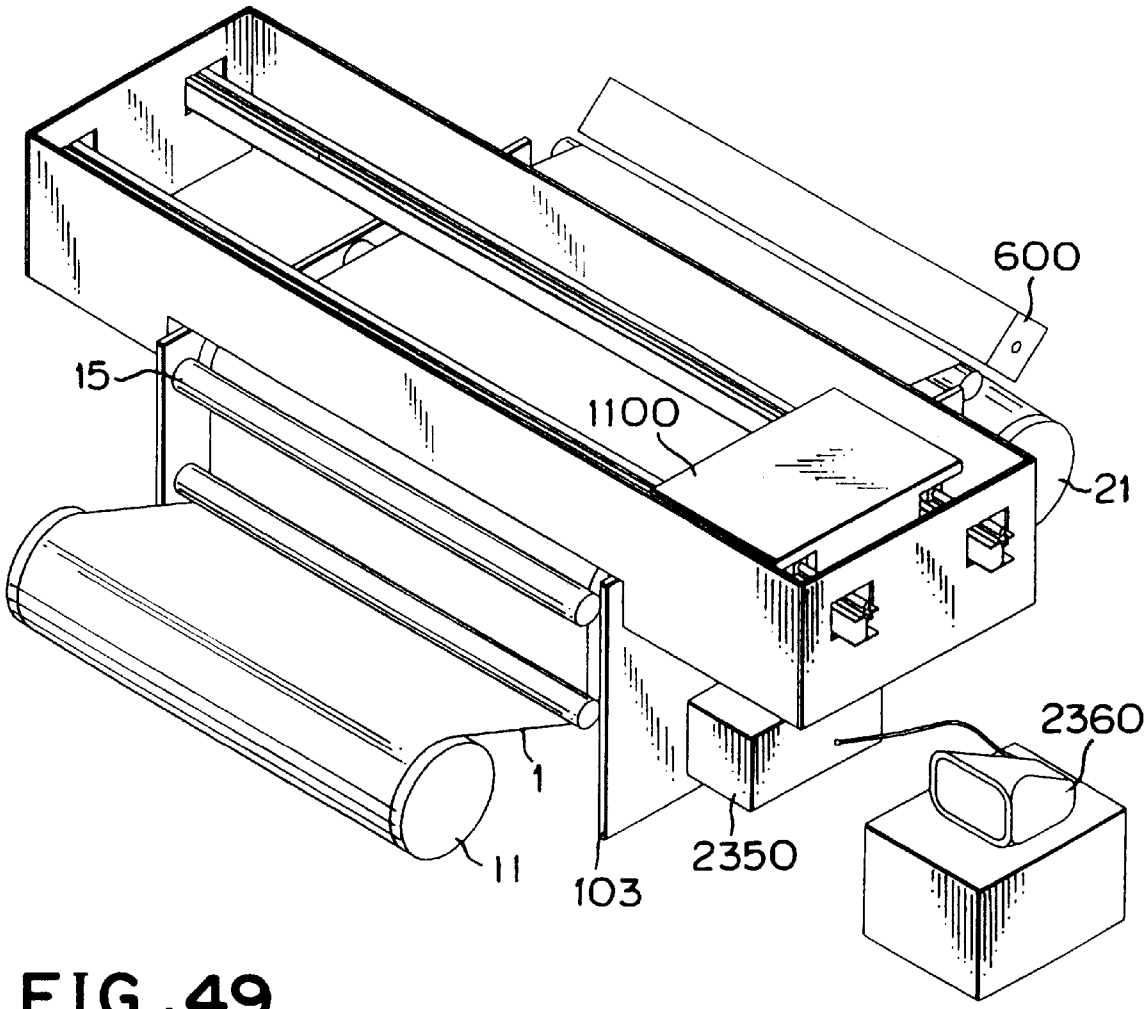
FIG. 49 is a perspective view showing another modified embodiment wherein a television camera is arranged in the textile printing apparatus so as to enable respective ink ejecting nozzles to be visually observed by an operator.

Next, FIG. 49 illustratively shows an embodiment wherein a television camera 2350 is substituted for the mirror 2330 in the preceding embodiment. In this embodiment, respective ink ejecting orifices in an ink jet head 1100 mounted on the carriage 1010 can visually be observed by anyone via a television monitor 2360 electrically connected to the television camera 2350.

In the case that the respective ink ejecting nozzles in the ink jet head 1100 are indirectly visually observed with the aid of the mirror 2330 or the television camera 2350 as mentioned above, there does not arise a necessity for observing the ink jet head 1100 from below, resulting in each inspecting operation being achieved with excellent safety.

(8) A head gap adjusting mechanism

With respect to the ink jet type textile printing apparatus, it is preferable to keep a gap, i.e., a head gap between respective ink ejecting orifices in the ink jet head and the printing medium 1 at a constant without regard to the thickness of the printing medium 1. A quality of printed image can be improved by equipping the image forming apparatus with means for adjusting the head gap between the ink jet head and the platen portion. A mechanism for adjusting the head gap will be described below.

FIG. 50 to FIG. 54 show by way of example the structure of a mechanism for adjusting the head gap by displacing platen rollers in the upward/downward direction, respectively.

Figure 50:
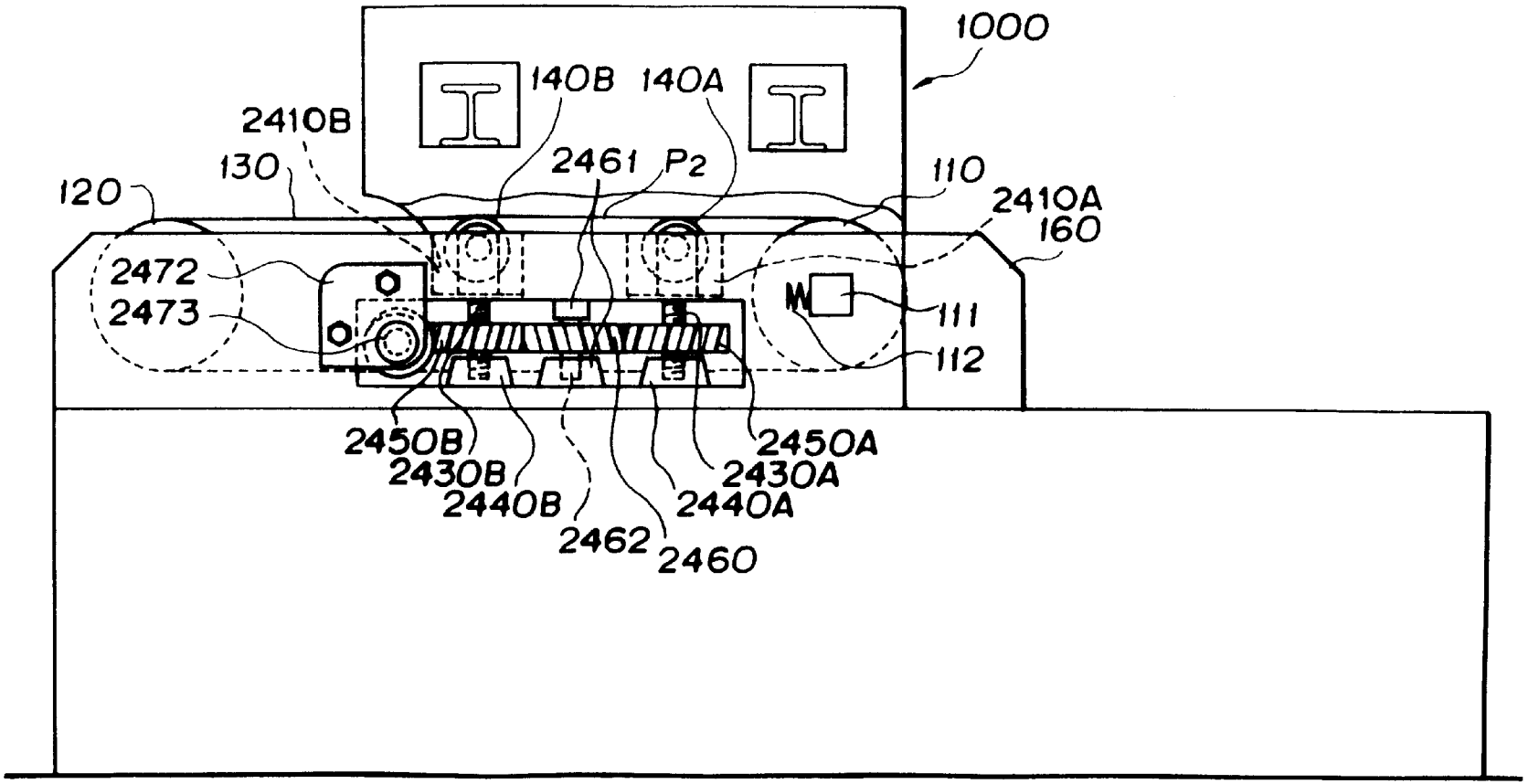
FIG. 50 is a schematic side view showing an embodiment wherein a head gap adjusting mechanism is arranged in the textile printing apparatus.
Figure 51:
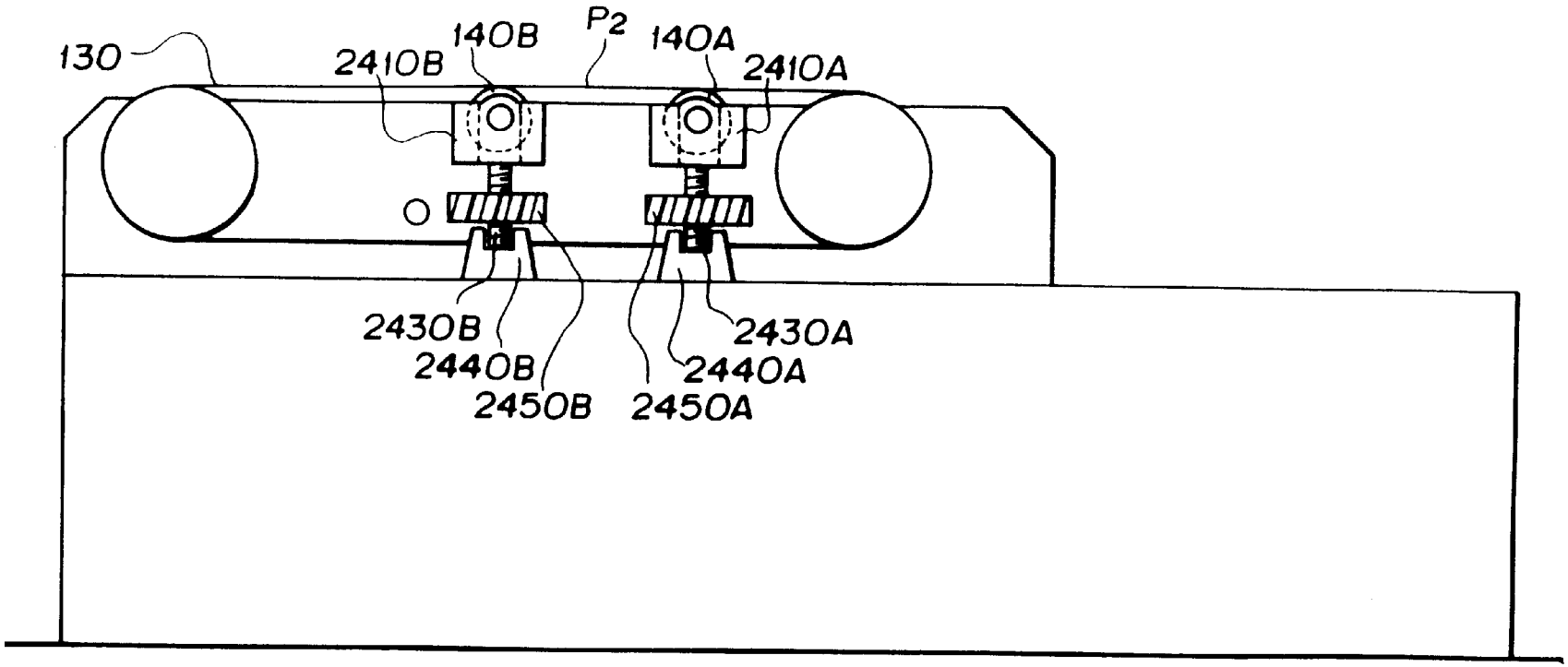
FIG. 51 is a sectional side view of the head gap adjusting mechanism, showing how an initial gap is determined in a platen portion.
Figure 52:
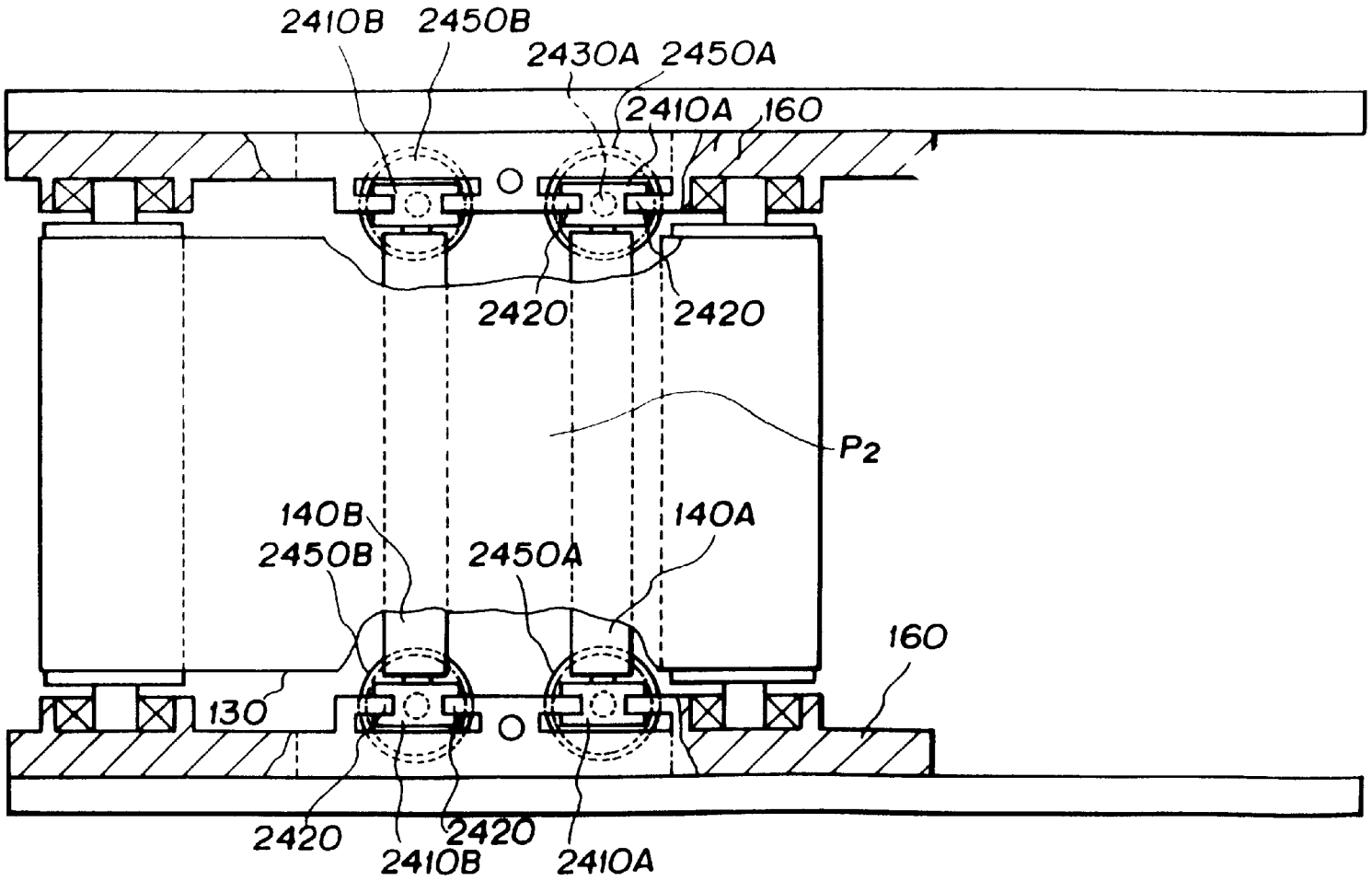
FIG. 52 is a plan view of the head gap adjusting mechanism shown in FIG. 51.
Figure 53:
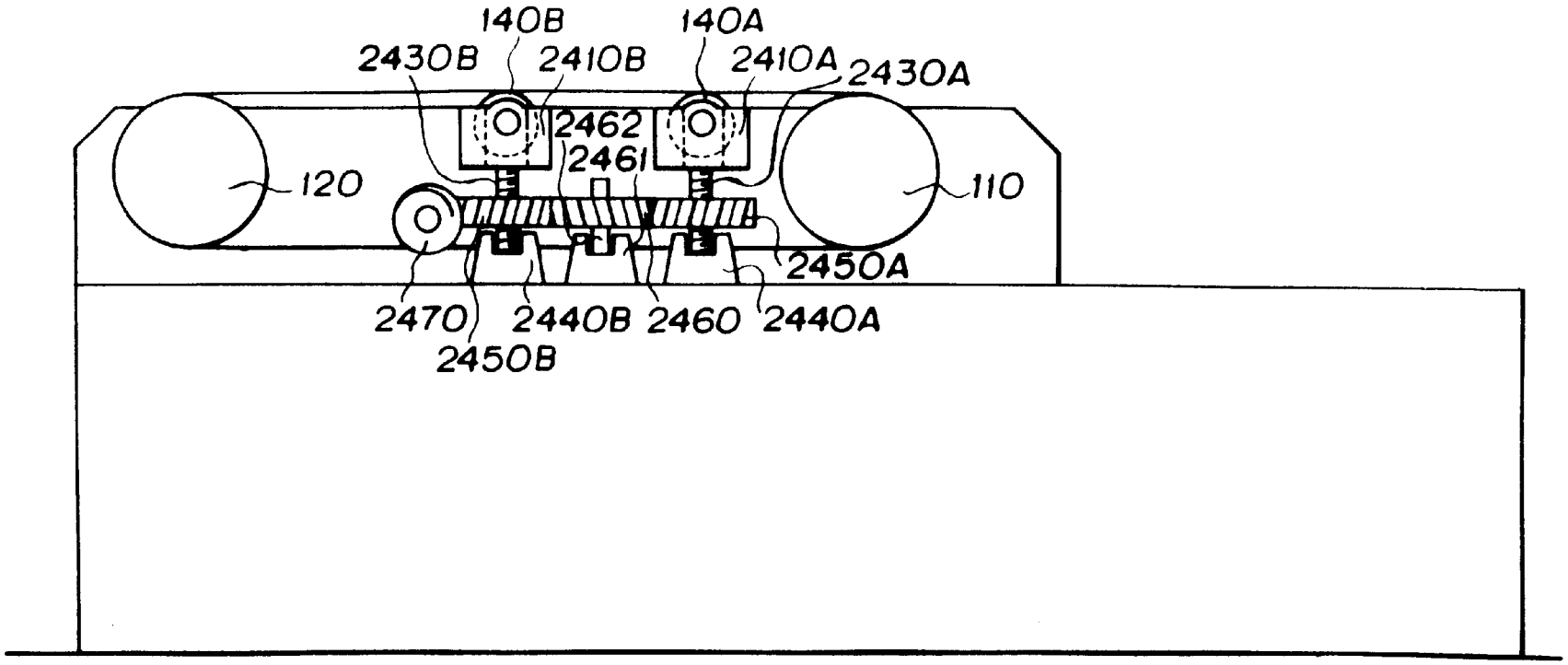
FIG. 53 is a sectional view of the head gap adjusting mechanism, showing how platen rollers are displaced in the upward/downward direction for adjusting the head gap.
Figure 54:
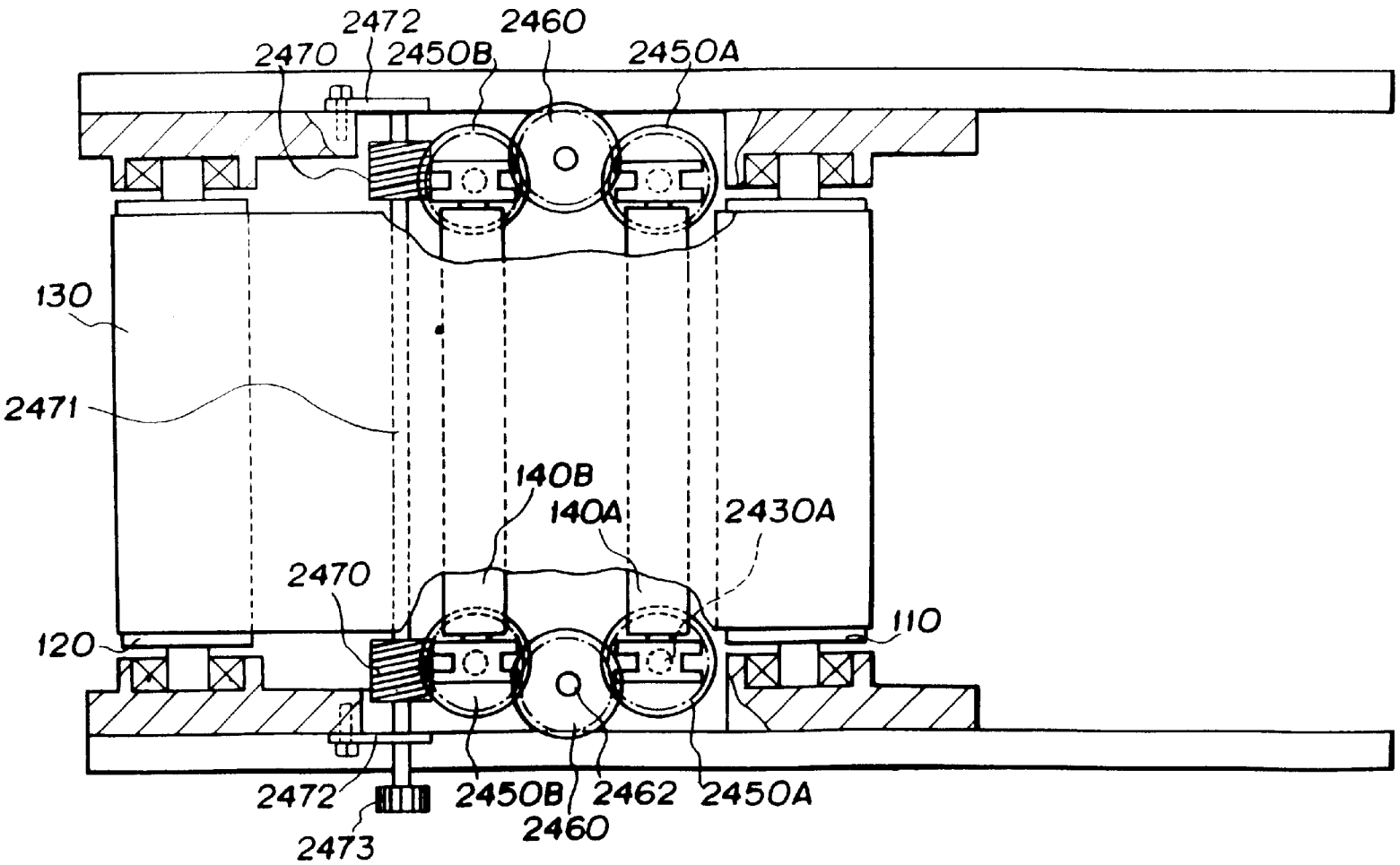
FIG. 54 is a plan view of the head gap adjusting mechanism shown in FIG. 53.

FIG. 50 is a schematic view which shows appearance of the gap adjusting mechanism. A characterizing feature of this gap adjusting mechanism consists in that the head gap is adequately adjusted by displacing a pair of platen rollers 140 disposed below the printer section 1000 in the upward/downward direction, causing a platen portion $P_2$ of the conveying belt 130 defined between the follower roller 110 and a driving roller 120 to be displaced in the upward/downward direction. FIG. 51 to FIG. 54 show the structure of the gap adjusting mechanism while illustration of the printer section is omitted, respectively. FIG. 51 shows by way of sectional side view the structure of the gap adjusting mechanism when an initial height of each of the platen rollers 140 is adjusted, and FIG. 52 is a partially exploded plan view of the gap adjusting mechanism shown in FIG. 51. Similarly, FIG. 53 shows by way of sectional side view the structure of the gap adjusting mechanism when the head gap appearing between both the platen rollers is adjusted corresponding to the thickness of a cloth prior to each printing operation, and FIG. 54 is a partially exploded plan view of the gap adjusting mechanism shown in FIG. 53. It should be noted that description will be made below on the assumption that A is located behind reference numeral assigned to each of the platen roller and members constituting the gap adjusting mechanism on the upstream side (i.e., on the follower shaft side), and B is located behind reference numeral assigned in that way on the downstream side (i.e., on the driving roller side) for the convenience of description.

As shown mainly in FIG. 51 and FIG. 52, the opposite ends of platen rollers 140A and 140B are displaceably supported by platen roller bearings 2410A and 2410B. Each of the platen roller bearings 2410A and 2410B is displaceably supported to move in the upward/downward direction while the position of each platen roller bearing as viewed not only in the axial direction of each platen roller but also in the direction orienting at a right angle relative to the axial direction is immovably restricted by a bearing holder 2420, and the lower side of each platen roller bearing is immovably held such that upward/downward movement shafts 2430A and 2430B are not rotated relative to the platen roller bearings 2410A and 2410B. The lower end parts of the upward/downward movement shafts 2430A and 2430B are displaceably supported in such a manner as to move in the upward/downward direction with the aid of upward/downward movement holders 2440A and 2440B. In addition, helical gears 2450A and 2450B are threadably fitted onto the upward/downward movement shafts 2430A and 2430B at the intermediate positions of the latter in such a manner that male threads formed around the outer peripheral surface each of the upward/downward movement shafts 2430A and 2430B are threadably engaged with female threads formed around the inner peripheral surface of each of the helical gears 2450A and 2450B. The helical gears 2450A and 2450B are rotatably supported while their positions as viewed in the vertical direction are restricted, whereby as the helical gears 2450A and 2450B are rotated, the upward/downward movement shafts 2430A and 2430B are displaced in the upward/downward direction. It should be noted that FIG. 51 and FIG. 53 show the case that the platen roller bearings 2410A and 2410B are lowered to reach their lowest positions, and the head gap between the platen portion $P_2$ and the ink jet head is located at the position where it has a widest area (i.e., the position where a straight line extends between the upper surface of the follower roller 110 and the upper surface of the driving roller 120). The mechanism for separately displacing the opposite ends of the platen rollers 140A and 140B is inevitably required for arranging the platen rollers 140A and 140B. After the platen rollers 140A and 140B are arranged in that way, four helical gears 2450A and 2450B are rotated, causing the platen roller bearings 2410A and 2410B to be displaced in the upward/downward direction while maintaining the parallel state relative to the ink jet head of the printer section 1000. In this embodiment, while the helical gears 2450A and 2450B are operatively associated with each other, the head gap adjusting mechanism causes the whole platen rollers 140A and 140B to be displaced in the upward/downward direction.

An operative associating mechanism is composed of helical gears 2460 meshing with the helical gears 2450A and 2450B disposed at the opposite ends of the platen rollers 140A and 140B and a pair of worm gears meshing with the helical gears 2450B disposed at the opposite ends of one of the platen rollers, i.e., the platen roller 140B (located on the downstream side in the shown embodiment). Each of the helical gears 2460 is firmly fitted onto a shaft 2462 of which opposite ends are rotatably supported by helical gear bearings 2416 disposed between the upward/downward movement holders 2440 at the opposite ends of the platen rollers 140A and 140B. On the other hand, the worm gears 2470 are firmly fitted onto a worm gear shaft 2471 extending in parallel with the platen roller 140B, and the worm gear shaft 2471 is rotatably supported by bearing plates 2472 secured to conveying belt supporting side plates 160 at the opposite ends thereof. One end part of the worm gear shaft 2473 extends through the bearing plate 2472, and a handle 2473 is affixed to the one end part of the worm gear shaft extending outside of the bearing plate 2472. With respect to the operative associating mechanism constructed in the above-described manner, as the handle 2473 is rotated to rotate the worm gears 2470, the helical gears 2460 meshing with the worm gears 2470 are rotated, and the rotation of the helical gears 2450B is transmitted to the other helical gears 2450A via the helical gears 2460. In other words, as the handle 2473 is rotated, the helical gears 2450A and the helical gears 2450B are simultaneously rotated in the same direction, whereby the platen rollers 140A and 140B can be displaced in the upward/downward direction while maintaining the parallel state relative to the printer section (not shown). It should be noted that a belt tension spring 112 is disposed for the follower roller 110 for normally biasing bearings 111 for the follower roller 110 in the opposite direction to the driving roller 120 as shown in FIG. 50. With this construction, since the follower roller 110 is followably displaced in such a manner as to keep an intensity of tension applied to the conveying belt 130 constant after the head gap is adequately adjusted, the intensity of tension applied to the conveying belt 130 can be kept constant.

The helical gears 2460 and the worm gears 2470 are detachably arranged in the operative associating mechanism. First, the parallel state of the platen rollers 140 is adjusted by rotating the helical gears 2450A and 2450B for separately displacing the four ends of the platen rollers 140A and 140B in the upward/downward direction, and thereafter, while the foregoing state is maintained, the helical gears 2460 and the worm gears 2470 are arranged to constitute the operative associating mechanism.

An advantageous effect of the head gap adjusting mechanism constructed in accordance with the foregoing embodiment consists in that the platen rollers 140A and 140B can easily be displaced in parallel with each other in the upward/downward direction by utilizing the helical gears 2450A and 2450B after the parallel state of the platen rollers 140A and 140B is adequately adjusted, immovably holding the helical gears 2450A and 2450B in operative association with the worm gears 2460 while maintaining the parallel state of the platen rollers 140A and 140B, and subsequently, bringing them in operative association with the worm gears 2470 and the worm gear shaft 2471. In the above embodiment, the head gap can be easily adjusted by simple structure.

Figure 55:
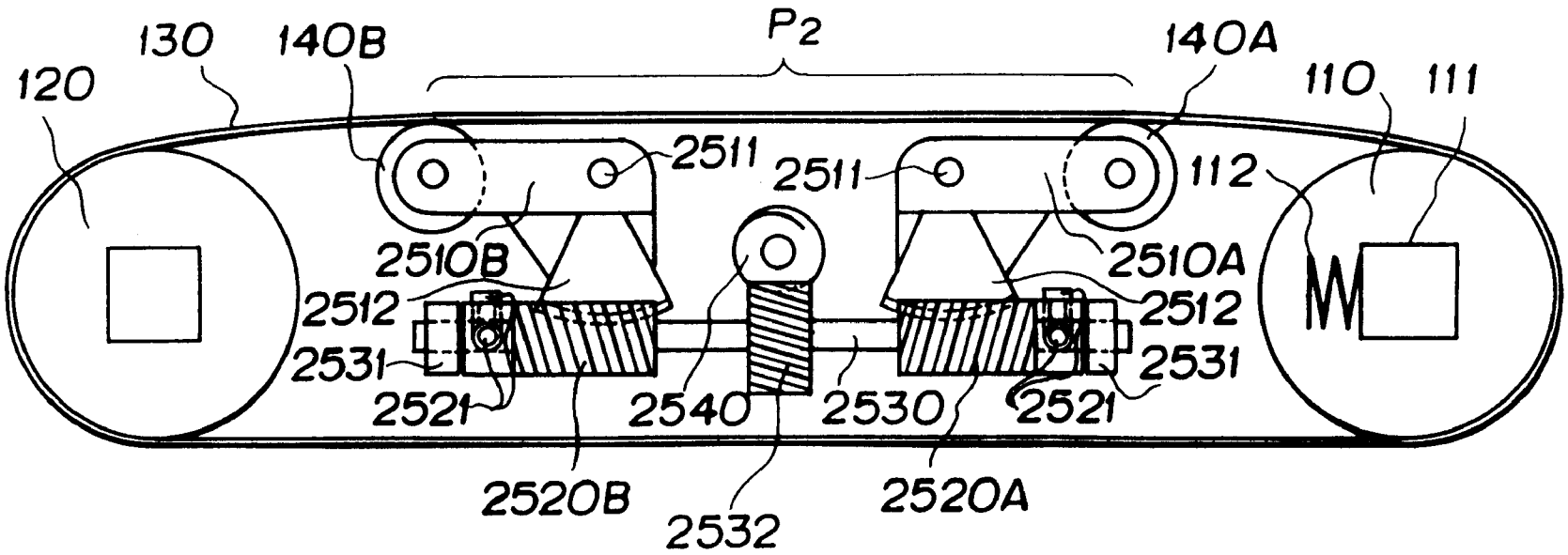
FIG. 55 is a schematic sectional side view showing a modified embodiment wherein a head gap adjusting mechanism is arranged in the textile printing apparatus.
Figure 56:
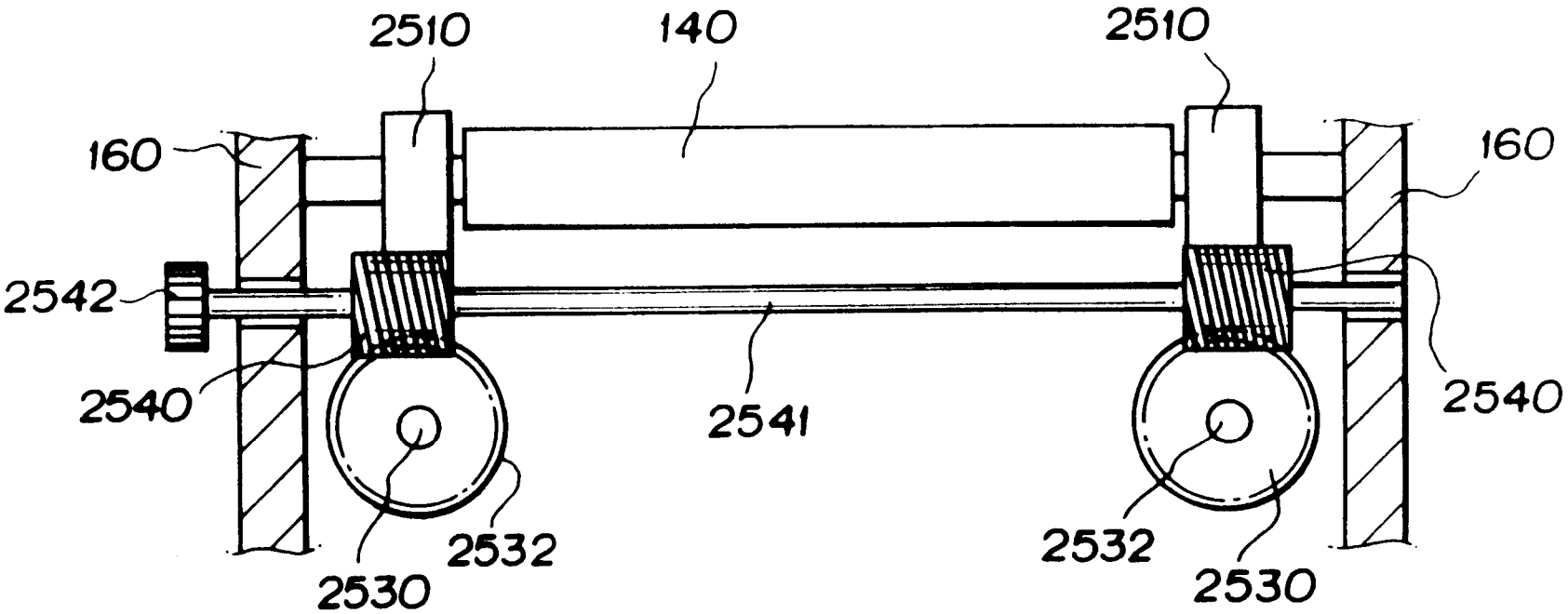
FIG. 56 is a schematic sectional front view showing another modified embodiment wherein a head gap adjusting mechanism is arranged in the textile printing apparatus.

FIG. 55 and FIG. 56 show other embodiment wherein a head gap adjusting mechanism is operatively associated with a mechanism for displacing platen rollers in the upward/downward direction, respectively. FIG. 56 is a sectional view of the head gap adjusting mechanism taken in the axial direction of a worm gear shaft 2541 to be described later. Also in this embodiment, description will be made below on the assumption that A is placed behind reference numerals representing platen rollers and components constituting the gap adjusting mechanism on the upstream side and B is placed behind reference numerals the same on the downstream side.

As shown in the drawings, the opposite ends of the platen rollers 140A and 140B are rotatably supported by bearings 2510A and 2510B. The bearings 2510A and 2510B are turnably supported by the plates 160 with fulcrums 2511 as centers, and each fulcrum 2511 is offset inward of each roller shaft in the direction at a right angle relative the axis of the roller shaft. Each of the bearings 2510A and 2510B is downwardly expanded in the sector-shaped contour with the fulcrum 2511 as a center and includes a worm wheel portion 2512 of which lower peripheral edge is machined to form a plurality of male threads. The worm wheel portion 2512 is turned together with a main body of each bearing. Worm gears 2520A and 2520B each having a plurality of reverse male threads formed thereon are disposed below the worm wheel portions 2512 while meshing with the male threads of the worm wheel portions 2512. The worm gears 2520A and 2520B are rotatably supported by two shafts 2530 disposed at the opposite ends of the platen rollers 140A and 140B while extending at a right angle relative to each roller shaft. Each of the shafts 2530 is rotatably supported by bearings 2531 disposed at the opposite ends thereof, and a worm wheel 2532 for bringing two shafts 2530 in operative association with each other is firmly mounted at the central part of each shaft 2530. In addition, worm gear fixing screws 2521 are threadably fitted into the worm gears 2520A and 2520B so that the worm gears 2520A and 2520B are integrated with the shafts 2530 extending therethrough, by tightening the worm fixing screws 2521. On the other hand, worm gears 2540 mesh with the worm wheels 2532, and each of the worm gears 2540 is firmly supported by a worm gear shaft 2541 which in turn is rotatably supported by the side plates 160. The left-hand end part of the worm gear shaft 254 is projected outside of the side plate 160, and a handle 2542 is affixed to the left-hand end of the worm gear shaft 2541.

When the platen rollers 140A and 140B are initially caused to extend in parallel with each other with the aid of the aforementioned mechanism, the worm gear fixing screws 2521 are preliminary untightened so that the worm gears 2520A and 2520B are held to be freely rotatable relative to the shafts 2530. When the worm gears 2520A and 2520B are rotated while the foregoing state is maintained, the bearings 2510A and 2510B are turned with the fulcrums 2511 as centers, causing the opposite ends of the platen rollers 140A and 140B to be displaced in the upward/downward direction. Since the worm gears 2520A and 2520B include a plurality of male threads extending reversely relative to each other, when they are rotated in the same direction, the bearings 2510A and 2510B are turned in the reverse direction relative to each other so that the platen rollers 140A and 140B are displaced in the same direction. Provided that the bearings 2510A and 2510B are not designed to exhibit a symmetrical contour as shown in FIG. 55 but they are designed to exhibit a same contour, it of course is obvious that there does not arise a necessity for machining the worm gears 2510A and 2510B including a plurality of male threads extending reversely relative to each other. In such manner, the parallel state of the platen rollers 140A and 140B relative to the printer section is adequately adjusted, and subsequently, while the foregoing state is maintained, the worm gear fixing screws 2521 are tightened so as to allow the worm gears 2520A and 2520B to be fixedly secured to the shafts 2530. As long as this state is maintained, four worm gears 2520A and 2520B are operatively associated with each other via the shafts 2530, the worm wheels 2532, the worm gears 2540 and the worm gears 2540. Thus, as the handle 2542 is rotated with an operator's hand, the worm gears 2520A and 2520B are rotated in the same direction, and the platen rollers 140A and 140B are simultaneously displaced in the upward/downward direction while maintaining the parallel state relative to each other. As shown in FIG. 55, a belt tension spring 112 for normally biasing a bearing 111 for the follower roller 110 in the opposite direction to the driving roller 120 is disposed in the follower roller 110, and after the head gap is adequately adjusted, the follower roller 110 is followably displaced in such a manner as to keep an intensity of tension applied to the conveying belt 130 constant in the same manner as the preceding embodiment.

Figure 57A:
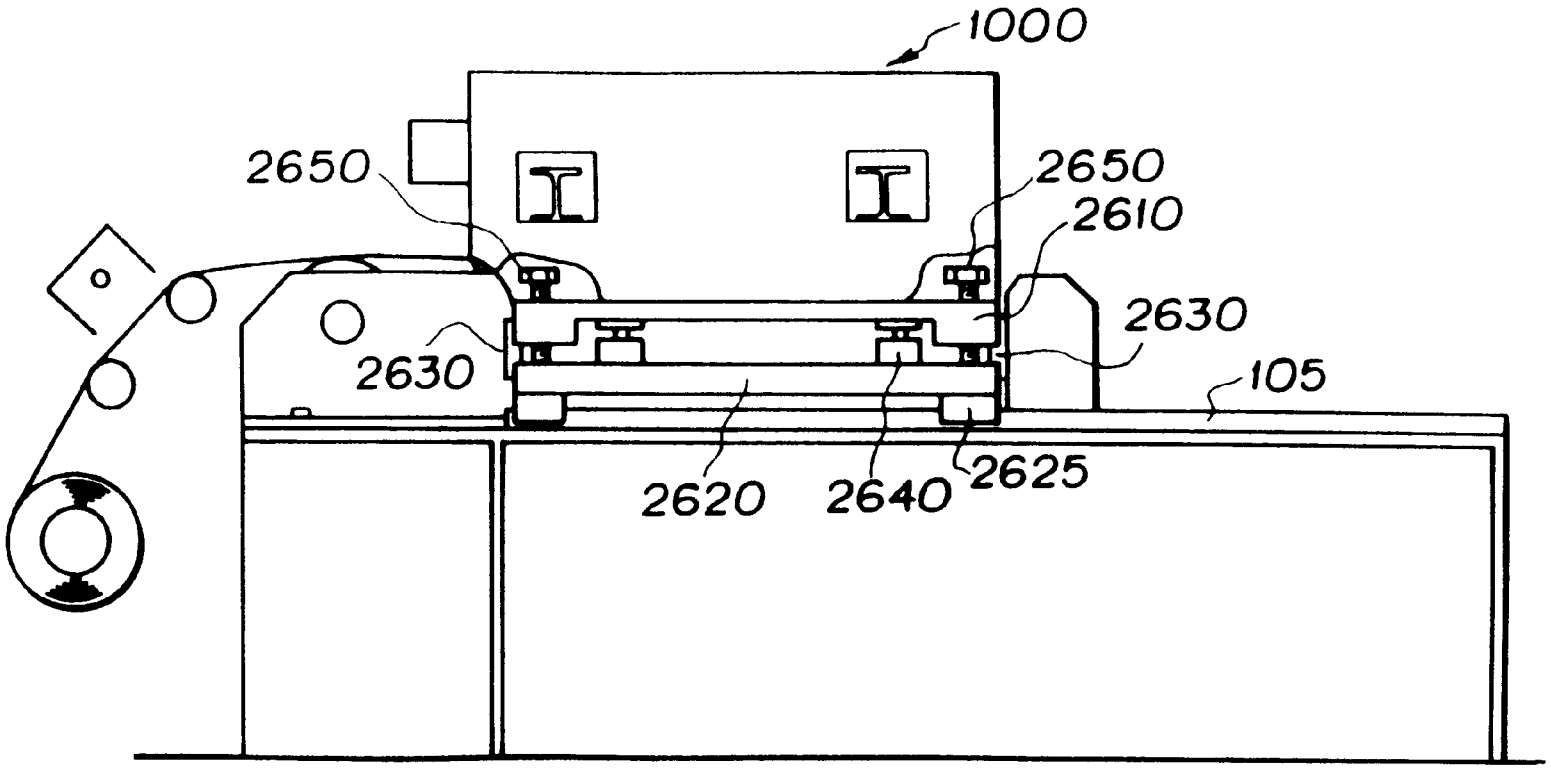
FIG. 57A and FIG. 57B are side views showing a further embodiment wherein a head gap adjusting mechanism is arranged for the textile printing apparatus, respectively.
Figure 57B:
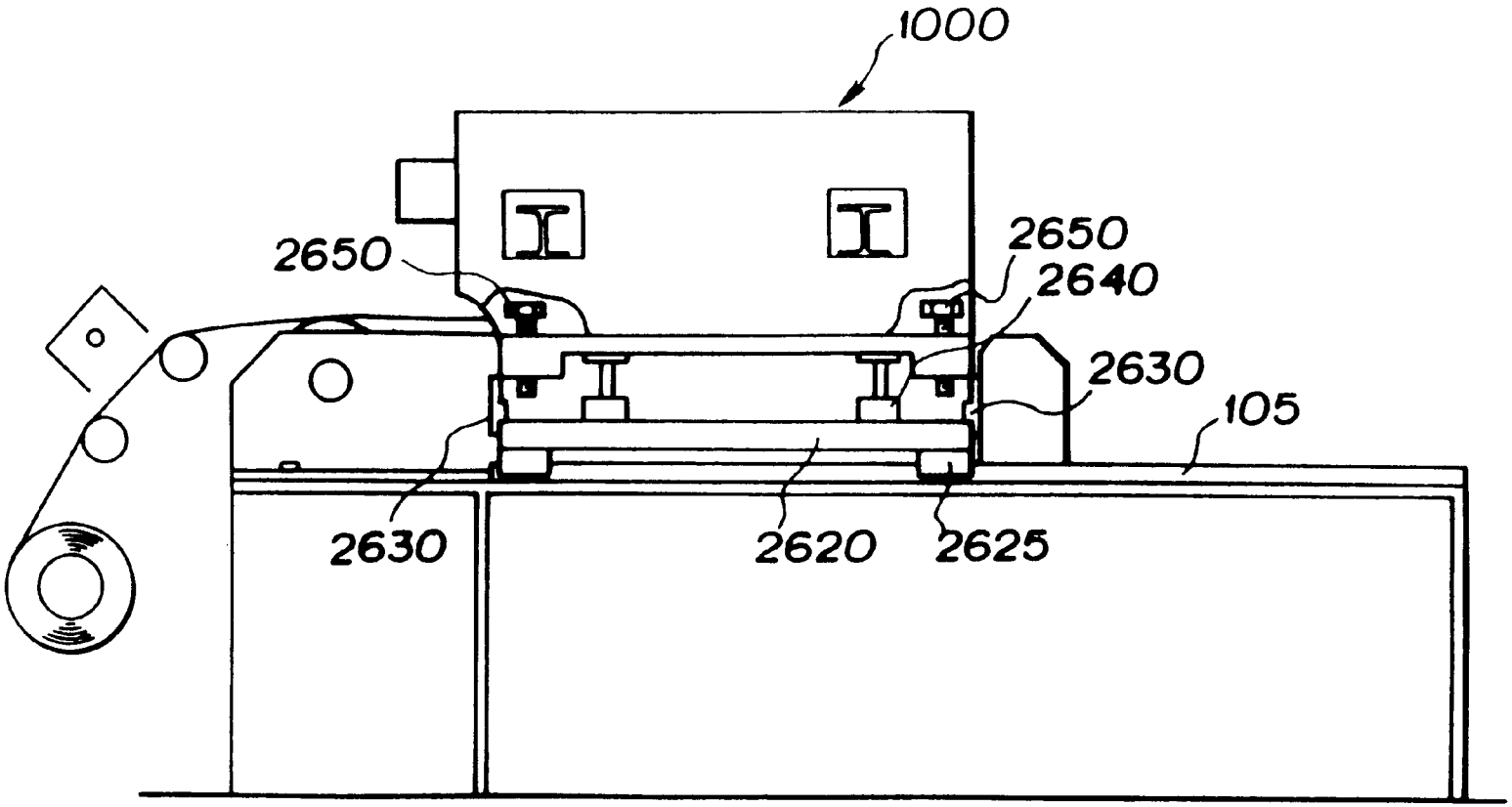

FIG. 57A and FIG. 57B show the structure of a head gap adjusting mechanism constructed in accordance with another embodiment, respectively. In this embodiment, a head gap is adjusted as desired by displacing a printer section 1000 in the upward/downward direction. However, it is necessary that a mechanism for adjusting the parallel state of the platen rollers 140 relative to each other by individually displacing the opposite ends of the platen rollers 140 in the upward/downward direction when this adjusting mechanism is installed for the printer section 1000 is separately arranged for this adjusting mechanism.

In this embodiment, the printer section 1000 includes an upper platen platform 2610 and a lower platen platform 2620 with two-staged structure. While the displacement of the upper printer platform 2610 is guided by guide members 2630, the upper printer platform 2610 can be displaced away from and toward the lower printer platform 2620 in the upward/downward direction. A plurality of jacks 2640 are arranged between the upper printer platform 2610 and the lower printer platform 2620. In addition, height adjusting screws 2650 are disposed at four corners of the upper printer platform 2610. The height adjusting screws 2650 threadably extend through the upper printer platform 2610 at the four corners of the latter so as to enable the position of the upper printer platform 2610 as viewed in the upward/downward direction to be adjusted by displacing the upper printer platform 2610 in the upward/downward direction. Thus, the height of the lower printer platform 2620 and the height of the upper printer platform 2610 can be adjusted depending on the position of each height adjusting screw 2650. On the other hand, each jack 2640 is constructed in the form of, e.g., a pneumatic cylinder having a stroke larger than the height adjusting range of each height adjusting screw 2650. The lower printer platform 2620 is mounted on slide rails 105 via a plurality of sliders 2625 affixed to the lower surface thereof, whereby the printer section 1000 can slidably be displaced in the leftward/rightward direction in the same manner as the embodiment as shown in FIG. 6.

With respect to the head gap adjusting mechanism constructed in that way, first, the printer section 1000 is displaced in the upward direction by actuating the respective jacks 2640. While this state is maintained, the height of each height adjusting screw 2650 is finely adjusted. Since the dead weight of the printer section 1000 is applied to each height adjusting screw 2650 while the foregoing state is maintained, head gap adjusting can easily be achieved. It is preferable that the height of each height adjusting screw 2650 can be adjusted with reference to the number of revolutions of each height adjusting screw 2650 or calibrations formed on each height adjusting screw 2650 to visually recognize the position of the height adjusting screw 2650 as measured in the upward/downward direction in such a manner that the height of each height adjusting screw 2650 as measured at the four corners of the upper printer platform 2610 is adjusted to assume a same value. It is acceptable that an operative associating mechanism for rotating four height adjusting screws 2650 in operative association with each other is arranged for the printing section 1000. Subsequently, the head gap is adjusted as desired by lowering the upper printer platform 2610 having the printer section 1000 mounted thereon on the lower printer platform 2620 by actuating the respective jacks 2640.

Since each height adjusting screw 2650 can finely be adjusted while the dead weight of the printer section 1000 is not applied to the height adjusting screws 2650, the head gap adjusting mechanism constructed in accordance with this embodiment assures that each height adjusting screw 2650 can be adjusted with a low intensity of handling force, and each adjusting operation can easily be performed without any occurrence of wearing of components in the adjusting mechanism while stably maintaining a gap adjusting accuracy. In addition, since the raising/lowering mechanism for the printer section 1000 having a heavy weight and the height adjusting mechanism are separately arranged in the textile printing apparatus, the head gap of the printer section 1000 can finely be adjusted at a high accuracy with simple structure.

It should of course be understood that the aforementioned mechanism for exchanging the conveying belt with another one may be incorporated in the mechanism for adjusting the displacement of the head gap in the upward/downward direction as mentioned above or as will be described later.

(9) Another head gap adjusting mechanism to be actuated with the aid of a sliding mechanism For example, as shown in FIG. 6, the ink jet type textile printing apparatus as described above makes it possible to slidably displace the printer section 1000 along the slide rails 105, and moreover, simply displace the printer section 1000 away from the conveying section 100 and displace the former toward the latter. In this article, description will be made below with respect to the head gap adjusting mechanism for easily adjusting the head gap between the printer section and the conveying section in operative association with the image forming apparatus capable of displacing the printer section and the conveying section relative to each other via the guide members. Although the head gap adjusting mechanism can be applied to an image forming apparatus such as an image output terminal unit for an information processing unit such as an ordinary ink jet printer, a computer or the like, a copying machine, a facsimile unit or the like, description will be made below with respect to an embodiment wherein an ink jet type textile printing apparatus serves as an image forming apparatus, and same components as those for the image forming apparatus are represented by same reference numeral. Repeated description on these components is herein omitted for the purpose of simplification.

FIG. 58 and FIG. 59 show by way of example the structure of a head gap adjusting mechanism adapted to be operated with the aid of a sliding mechanism, respectively. As shown in the drawings, a printer section 1000 including ink jet heads 1010 is arranged above a platen portion $P_2$ defined by a pair of platen rollers 140 for recirculatively drive a conveying belt 130 in cooperation with a follower roller 110 and a driving roller 120. In this embodiment, two slide rails 2710 each serving as a guide member for supporting the printer section 1000 are inclined away from the platen portion $P_2$ of the conveying belt 130 in order to adjust a head gap between the printer section 1000 and the conveying belt 130. Specifically, the slide rails 2710 are placed on an opposing pair of side plates 2715 of which upper ends are inclined relative to the horizontal direction, and the lower surface of a printer platform 2720 for supporting the printer section 1000 is likewise inclined along the slide rail 2710, whereby the printer section 1000 can slidably be displaced along the slide rails 2710 via a plurality of sliders 2725 secured to the lower surface of the printer platform 2720. While this state is maintained, an ink ejecting plane of the printer section 1000 extends in parallel with the platen portion $P_2$ of the conveying belt 130. Thus, as the printer section 1000 is slidably displaced along the slide rails 2710 each serving as guiding means, the head gap defined between the ink ejecting plane and the platen portion $P_2$ varies while the ink ejecting plane and the platen portion $P_2$ are held in the parallel state.

In this embodiment, a mechanism for slidably displacing the printer section 1000 to adjust the head gap includes a pneumatic cylinder 2730 and a head gap setting block 2740. The pneumatic cylinder 2730 is mounted on each of the side plates 2715 or one of the side plates 2715 while extending in parallel with the slide rail 2710, and the foremost end of a rod 2731 projecting outside of the pneumatic cylinder 2730 is operatively connected to a joint member 2721 secured to the lower surface of the printer platform 2720. Thus, as the pneumatic cylinder 2730 is actuated, the printer section 1000 is slidably displaced along the slide rails 2710. In this embodiment, the pneumatic cylinder 2720 is arranged on the lower side of the inclined slide rails 2710 in such a manner as to slantwise push up the printer section 1000. Alternatively, the pneumatic cylinder 2730 may be arranged in such a manner as to slantwise pull up the printer section 1000. On the other hand, the head gap setting block 2740 adapted to slidably move on the slide rail 2710 can stepwise adjust the engagement position where it is engaged with a location adjusting member 2741 disposed in vicinity of the lower end of each slide rail 2710 while facing to the head gap setting block 2740 and the foregoing position can firmly be determined by threadably tightening a fixing screw. Thus, the position of the printer platform 2720 can be determined by bringing the gap setting block 2740 in contact with the lower end of the printer 2720 as viewed in the slantwise downward direction. A single gap adjustment indicating mark 2743 is formed on the side surface of the head gap setting block 2740, while a plurality of gap adjustment indicating marks 2743 are formed on the side surface of the location adjusting member 2741. Stoppers 2711 are disposed at the opposite ends of each slide tail 2710 in order to inhibitively restrict any excessive displacement of the printer platform 2720.

When the head gap is adjusted with the aid of the aforementioned mechanism, first, the pneumatic cylinder 2730 is actuated to slantwise displace the printer section 1000 along the slide rails 2710 in the upward direction. While the foregoing state is maintained, the head gap setting block 2740 is immovably held at a predetermined position on the slide rail 2710. Subsequently, as the pneumatic cylinder 2730 is actuated in the reverse direction, the printer section 1000 is slantwise displaced along the slide rails 2710 in the downward direction, causing the lower end of the printer platform 2720 to collides against the head gap setting block 2740. At this time, it is preferable that the position of the printer section 1000 is firmly determined while the printer section is normally slantwise biased in the downward direction by actuating the pneumatic cylinder 2730 as desired. It of course is obvious that the pneumatic cylinder 2730 can be used also in the case that the printer section 1000 is displaced on the slide rails 2710 so as to allow it to be displaced away from and toward the conveying section 100.

With respect to the head gap adjusting mechanism constructed in the above-described manner, as shown in FIG. 58, when the head gap setting block 2640 is displaced to reach the upper most end, the head gap is maximized as represented by $HG_{max}$. On the contrary, as shown in FIG. 59, when the head gap setting block 2740 is displaced to reach the lowermost end, the head gap is minimized as represented by $HG_{min}$. It is sufficient that the range set for the maximum head gap $HG_{max}$ and the head gap $HG_{min}$ is dimensioned to have a size ranging from about 0.5 to 6 mm. Since the positions of the ink jet heads 1010 as viewed in the conveying direction are deviated from their initial positions after the head gap is adjusted in that way, it is necessary that the length of the platen portion $P_2$ is preliminarily elongated by a distance determined depending on the manner for arranging the ink jet heads 1010 in the printer section 1000. Therefore, in the case that the size of the head gap is to be changed by a quantity of 6 mm on the assumption that the printer section 1000 is displaced by a distance of 60 mm in the conveying direction, it is recommendable that the slide rails 2710 are inclined by an angle of about 5.7 degrees. In the circumstances as mentioned above, the positions of the ink jet heads 1010 vary as a result derived from the adjustment of the head gap. In the case that the position of starting of a printing operation is finely affected by a cut sheet of printing medium on which an image is to be printed, it is recommendable that the signal outputted from a sensor for detecting one end of the printing medium is brought in association with the information instructing the position of the ink jet heads 1010. In addition, in the case that the range defined by the position of the heater 600 is set to a length equal to integral times of a quantity of intermittent feeding of the printing medium, the position of the heater 600 is largely affected by the variation of the printing position. To cope with the foregoing malfunction, it is recommendable that the length of the heater 600 as measured in the conveying direction is elongated by a distance sufficient to absorb a quantity of displacement of each ink jet head. Otherwise, it is recommendable that the heater 600 can be displaced corresponding to the positions of the ink jet heads.

The head gap adjusting mechanism constructed in that way assures in cooperation with the mechanism for displacing the printer section 1000 away from the conveying section 100 and displacing the former toward the latter that the head gap can easily be adjusted at a high accuracy with simple structure. Since the printer section 1000 is stably mounted on the slide rails 2710 also during the adjustment of the head gap at all times, an excessive intensity of force is not applied to the printer frame, and moreover, the head gap can adequately be adjusted as desired without any reduction of the accuracy thereof no matter how the rigidity of the printer frame is lowered. In this embodiment, since position determining means and driving means are separately arranged, the head gap can easily be adjusted at a high accuracy with simple structure. It of course is obvious that displaceable driving means capable of determining the position of the printer section at a high accuracy without any necessity for the aforementioned head gap setting block may be substituted for the pneumatic cylinder.

FIG. 60 shows the structure of a head gap adjusting mechanism constructed in accordance with a modified embodiment. In this modified embodiment, the fundamental structure of the head gap adjusting mechanism is substantially same to that in the preceding embodiment, and a characterizing feature of this modified embodiment consists in that inclination of the printer head 1010 and the platen portion $P_2$ of the conveying belt 130 is substituted for the inclination of the slide rails 2710. Incidentally, same components as those in FIG. 58 and FIG. 59 and repeated description on these components is herein omitted for the purpose of simplification.

In this modified embodiment, a mode operation of the head gap adjusting mechanism is basically identical with that in the preceding embodiment. In this modified embodiment, however, it is sufficient that the printer head 1000 is displaced along horizontally extending rails 2710 without a necessity not only for a high intensity of force required for the displacement of the printer section 1000 but also for a high intensity of driving force required for recirculatively driving the conveying belt 130. Further, there does not arise a malfunction that the printer section 1000 is slantwise slidably displace along the slide rails 2710 in the downward direction even when air is discharged from the pneumatic cylinder 2730 during an operation performed for changing the head gap to another one. Since the dead weight of the printer section 1000 is not applied to the head gap setting block 2740, it is not always necessary that the head gap setting block 2720 is brought in engagement with the location adjusting member 2741, and moreover, there does not arise a malfunction that the position of the head gap setting block 2740 relative to the location adjusting member 2741 is unstably determined due to a shortage in strength of the head gap setting block 2740. Although the printer head 1000 and the conveying belt 130 are inclined in the above-described manner, it of course is obvious that one or both of the side plates can be disconnected from a housing of the textile printing apparatus so as to enable the conveying belt 130 to be exchanged with another one, and moreover, the printer section 1000 is displaced outside of the conveying section 100 to reach a predetermined position where an AHS pattern can be printed on the printing medium.

(10) An observing mechanism for visually observing a printed image immediately after an image is printed on the printing medium Next, description will be made below with respect to an embodiment wherein an image forming apparatus includes means for visually observe a high quality of printed image immediately after an image is printed on a printing medium.

FIG. 64 is a sectional view which schematically shows the structure of the image forming apparatus. The fundamental structure of the image forming apparatus is substantially coincident with that of the image forming apparatus as disclosed in each of the aforementioned embodiments, and same or similar components to those in each of the aforementioned embodiments are represented by same reference numerals. Thus, repeated description on these components is herein omitted for the purpose of simplification. In this embodiment, the image forming apparatus serves as a so-called textile printing apparatus.

In FIG. 64, reference numeral 1 designates a cloth usable as a printing medium. As an unwinding roller 11 is rotated, this cloth 1 is unwound from the unwinding roller 11, it is conveyed in the substantially horizontal direction via intermediate rollers 13 and 15 with the aid of a conveying section 100 arranged opposite to a printer section 1000, and thereafter, it is wound around a winding roller 21 via a feeding roller 17 and an intermediate roller 21 each serving as extension path forming means.

The conveying section 100 is substantially composed of a follower roller 110 disposed upstream of the printing section 1000 on a cloth conveying path, a driving roller 120 disposed downstream of the printing section 1000 on the cloth conveying path, a driving mechanism (not shown) for rotationally driving the driving roller 120, a conveying belt 130 prepared in the form of an endless belt recirculatively extending between the follower roller 110 and the driving roller 120 with a predetermined intensity of tension applied thereto, and a pair of platen rollers 140 for expansively holding the conveying belt 130 within the predetermined range with an adequate intensity of tension applied to the latter in order to maintain the upper surface of the cloth 1 in the flattened state when each printing operation is performed in the printer section 1000.

Figures 64A, 64B:
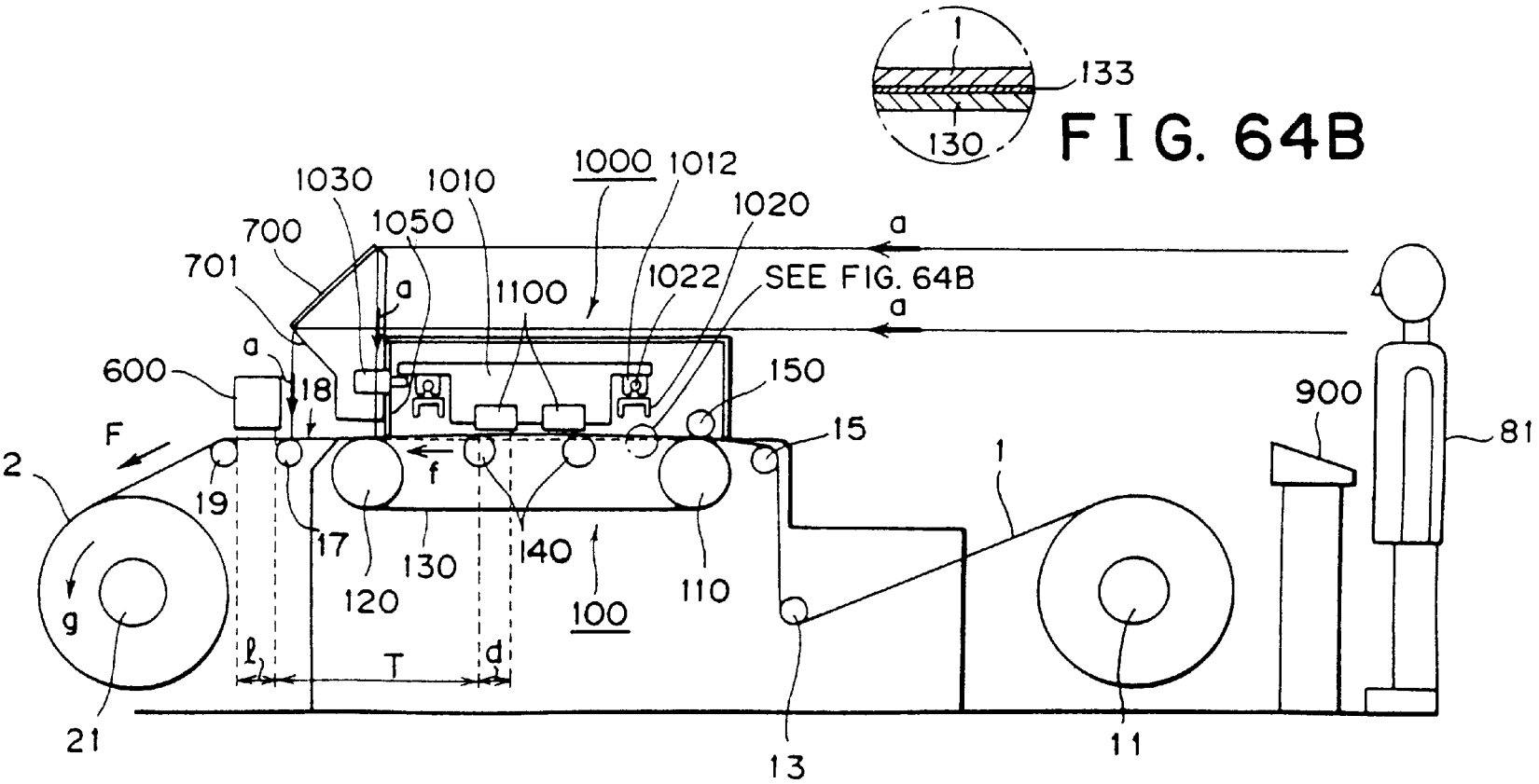
FIG. 64A is a schematic sectional view showing an embodiment wherein means for visually observing printed images immediately after images are printed on a printing medium is arranged in the textile printing apparatus.
FIG. 64B is an enlarged view of a section of FIG. 64A.

In this embodiment, a conveying belt made of a metallic material as disclosed in Japanese Patent Application Laying-Open No. 5-212851 is employed for the conveying belt 130, and a tacky layer 133 is adhesively placed on the conveying belt 130 as shown on an enlarged scale in FIG. 64B. As the conveying belt 130 is recirculatively driven, the cloth 1 is adhesively attached to the conveying belt 130 via the tacky layer 133 with the aid of a labelling roller 150, whereby flatness of the cloth 1 is assured during the printing operation by utilizing the flattened state of the conveying belt 130.

As the cloth 1 is conveyed while reliably maintaining the flattened state as mentioned above, a printing agent is applied to the cloth 1 within the range between both the platen rollers 140 by activating the printer section 1000. Subsequently, as the cloth 1 is fed further by the driving mechanism (not shown) in cooperation with a feeding roller 17 in the f arrow-marked auxiliary scanning direction (i.e., in the printing medium conveying direction), the cloth 1 is peeled from the tacky layer 133 of the conveying belt 130 at the position coincident with the driving roller 120 by the action of a tensile force F applied to the cloth 1 as a winding roller 21 is intermittently rotationally driven in the g arrow-marked direction.

On completion of the peeling of the cloth 1 from the conveying belt 130, printed parts on the upper surface of the cloth 1 are adequately dried by activating a drying unit 600, and thereafter, the dried cloth 1 is wound around the winding roller 21.

In this connection, a proposal has been already made by an applicant common to the present invention with respect to a position where the drying unit 600 is mounted in the vicinity of the printer section 1000 and other items as disclosed in the aforementioned embodiments. In this embodiment, the position of the drying unit 600 and a width of the latter are determined in the following manner.

Specifically, as shown in FIG. 64A, an effective drying length 1 of the drying unit 600 as measured along the belt conveying path is coincident with to an effective printing width defined by a plurality of ink jet heads to be described later (i.e., a width of arrangement of ink ejecting orifices as measured in the conveying direction), and moreover, it is dimensioned to be equal to or larger than a quantity d of intermittent feeding of the cloth 1 as represented by an inequality of $l \geqq d$. With such construction, regardless of the position where the drying unit 600 is mounted on the belt conveying path, the range where images are simultaneously printed on the cloth 1 with a width d can be stopped within the effective drying length of the drying unit 600 during intermittent feeding of the cloth 1 by a same length without fail. Thus, there does not arise a malfunction that some part of the printed cloth 1 fails to be dried by the drying unit 600. As shown in FIG. 64A, a distance T as measured on the conveying path from the most downstream position in the printing range to the most upstream position in the drying range can be dimensioned to assume a value obtained by multiplying the intermittent feeding quantity d by an even number of times as represented by an equation of $T=nd$ ($n=1, 2, - - -$). With this construction, since the range where images are simultaneously printed on the cloth 1 by activating the ink jet head 1100 on the downstream side is always dried at the same time, the time as counted from a printing operation till a drying operation performed in the foregoing range can be uniformalized, and moreover, drying conditions can be equalized for the respective images.

The tensile force F plays an important role for peeling the cloth 1 from the conveying belt 130. Specifically, in the case that an intensity of tacky force higher than that of the tensile force F is existent along the conveying belt 130, there is a possibility that part of the cloth 1 is drawn in the space between the feeding roller 17 and the conveying belt 130 as it is adhesively attached to the conveying belt 130 as shown in FIG. 65.

Figure 65:
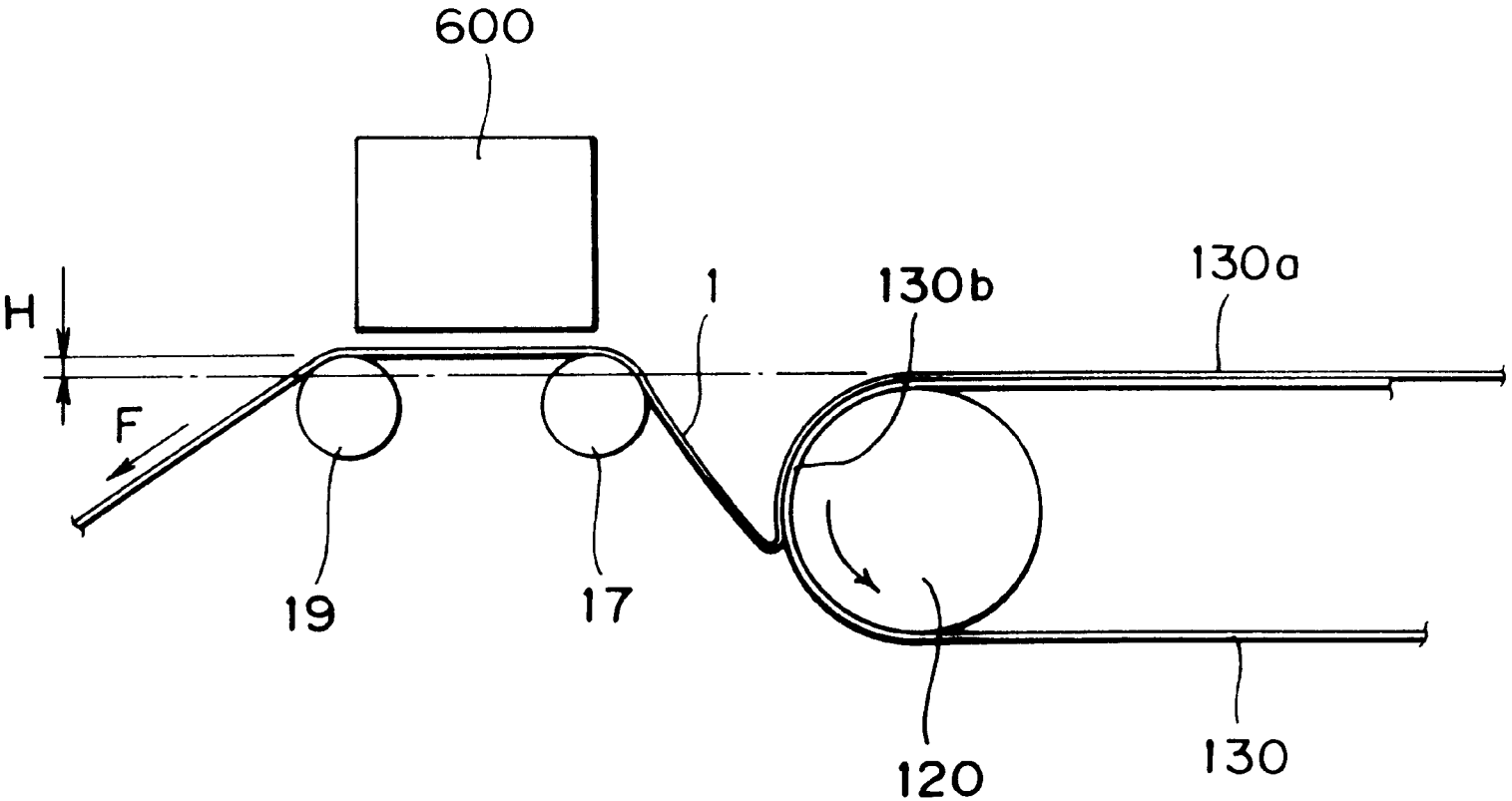
FIG. 65 is a fragmentary enlarged sectional view of the textile printing apparatus shown in FIG. 64A, showing that a printing medium is dragged toward the conveying belt side.

As is apparent from FIG. 65, a height H of the feeding roller 17 as measured from the upper surface of the conveying belt 130 is determined to be slightly higher than that of a conveying plane 130*a* of the conveying belt 130. This is intended so as to allow the tensile force F induced by the winding roller 21 to act on the cloth 1 in such a manner that the cloth 1 can reliably be peeled from the conveying belt 130.

It is acceptable that the height H of the feeding roller 17 is set to a level of zero depending on an intensity of tacky force of the conveying belt 130. On the contrary, when both of the feeding roller 17 and the intermediate roller 19 are arranged at the positions lower than the conveying plane 130*a* of the conveying belt 130, the tensile force F acts on the cloth 1 in such a manner that part of the cloth 1 is thrusted against an arc-like portion 130*b* of the conveying belt 130, resulting in the dragging of the cloth 1 being promoted. For this reason, the arrangement of the feeding roller 17 and the intermediate roller 19 in that way should be avoided.

Figure 66:
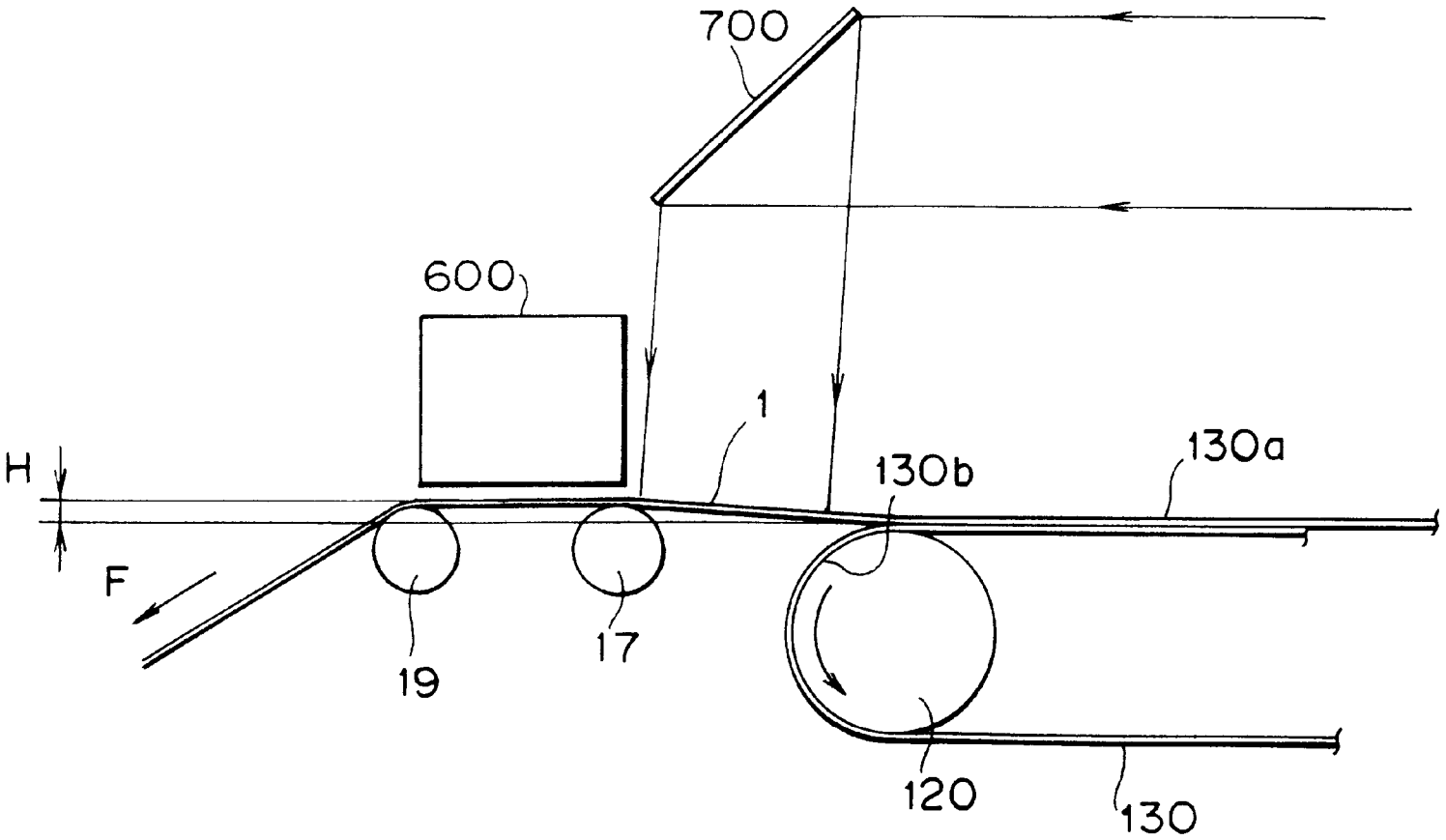
FIG. 66 is a fragmentary enlarged sectional view of the textile printing apparatus shown in FIG. 64A, showing the relationship between conveying means and extension path forming means.

Further description will be made below with respect to how the feeding roller 17 and the intermediate roller 19 each serving as extension path forming means are constructed. FIG. 66 is a schematic fragmentary sectional view which especially shows the relationship between the conveying plane defined by the conveying means and the conveying plane defined by the extension path forming means on an enlarged scale. In this embodiment, the conveying plane defined by the feeding roller 17 and the intermediate roller 19 is elevated from the conveying plane 130*a* of the conveying belt by a quantity of H, whereby an extension path between the feeding roller 17 and the conveying belt 130 slantwise extends in the upward direction. With this construction, there does not arise a malfunction that the tensile force F acts on the cloth 1 in such a manner that part of the cloth 1 is thrusted against the arc-like portion 130*b* of the conveying belt 130. Thus, the dragging of the cloth 1 toward the arc-like portion 130*b* can reliably be prevented, and moreover, the tensile force F can be utilized for peeling the cloth 1 from the conveying belt 130.

The inclination angle of the inclined extension path formed by the feeding roller 17 serving as extension path forming means is adequately determined corresponding to an intensity of tacky force existent on the tacky layer of the conveying plane 130*a* of the conveying belt 130. The inclination angle of the extension path relative to the conveying plane 130*a* is set to 45 degrees or less, preferably 5 degrees or less.

In the case that the tacky force of the tacky layer varies as time elapses, it of course is obvious that the inclination angle of the extension path may adequately be changed.

Figure 67:
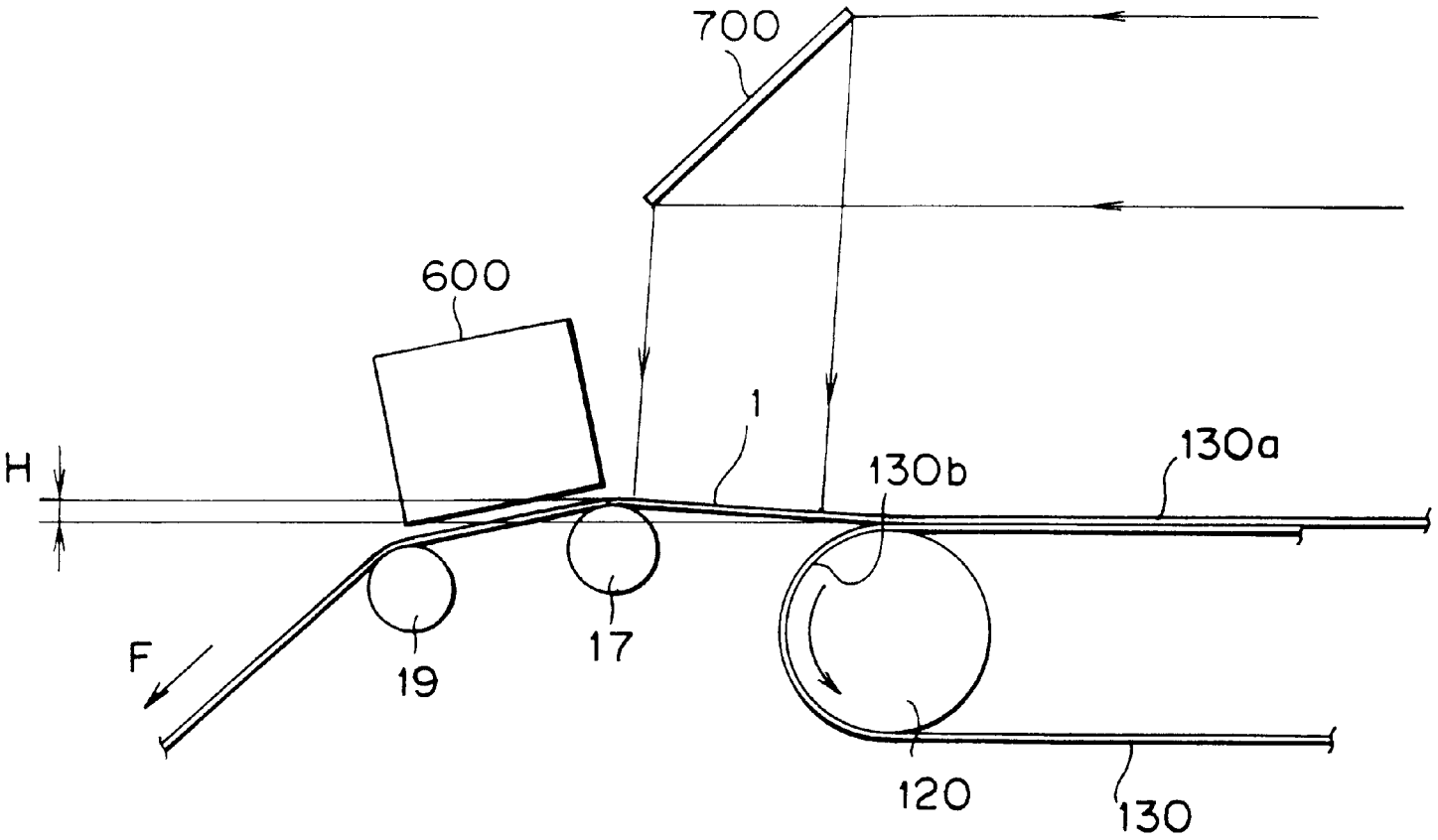
FIG. 67 is a fragmentary enlarged sectional view of the textile printing apparatus showing another structure of the extension path forming means shown in FIG. 66.

FIG. 67 is a fragmentary enlarged sectional view which schematically shows the structure of an extension path forming means different from that shown in FIG. 66. As shown in FIG. 67, it is possible to form a conveying plane higher than the conveying plane 130*a* of the conveying belt 130 by a quantity of H merely by using the feeding roller 17. With such structure, the uppermost point of the feeding roller 17 becomes a summit, and it is necessary that the attitude of a drying unit 600 is changed corresponding to the slightly inclined conveying plane between the feeding roller 17 and the intermediate roller 19.

In this embodiment, as shown in FIG. 64, a mirror 700 serving as observing means is disposed at the position located above the extension path 18 via a support platform 701 secured to a printer frame 1050, and the extension path 18 extends downstream of the feeding roller 17 as viewed in the conveying direction of the conveying belt 130. Thus, an operator 81 standing upright by a handling section 900 can visually observe the printed state of the cloth 1 passing past the extension path as a reflected image appearing on the mirror 700 as represented by a plurality of a arrow-like marks. Therefore, the printed state of the printing medium immediately after images are printed on the printing medium can visually be observed by the operator 81 standing upright by the handling section 900 at all times. This makes it possible to quickly cope with an occurrence of malfunctions such as incorrect printing and others.

The reason why the operation board 900 is disposed on the upstream side of the conveying path consists in that operations as noted below can preferably be executed at the same position by the operator 81 who stands upright by the handling section 900 as shown in the drawing. Specifically, in addition to an operation for locating the cloth 1 unwound from the unwinding roll 11 in alignment with the conveying means 100, an operation for checking whether or not the cloth 1 is correctly adhesively placed on the conveying belt 130 by the labelling roller 150 without any appearance of wrinkles or the like over the upper surface of the cloth 1, and an operation for jointing the foremost end of a new cloth 1, i.e., a new printing medium unwound from the unwinding roll 11 to the rearmost end of the precedingly supplied cloth 1 so as to continuously perform a printing operation with the new cloth 1, an operation for visually observing the printed state of the cloth 1 immediately after completion of the printing operation can be performed at the same position as mentioned above with the aid of the operation board 900.

The mirror 700 to be used as observing means may be made of glass. Otherwise, it may be made of a metallic material.

Figure 68:
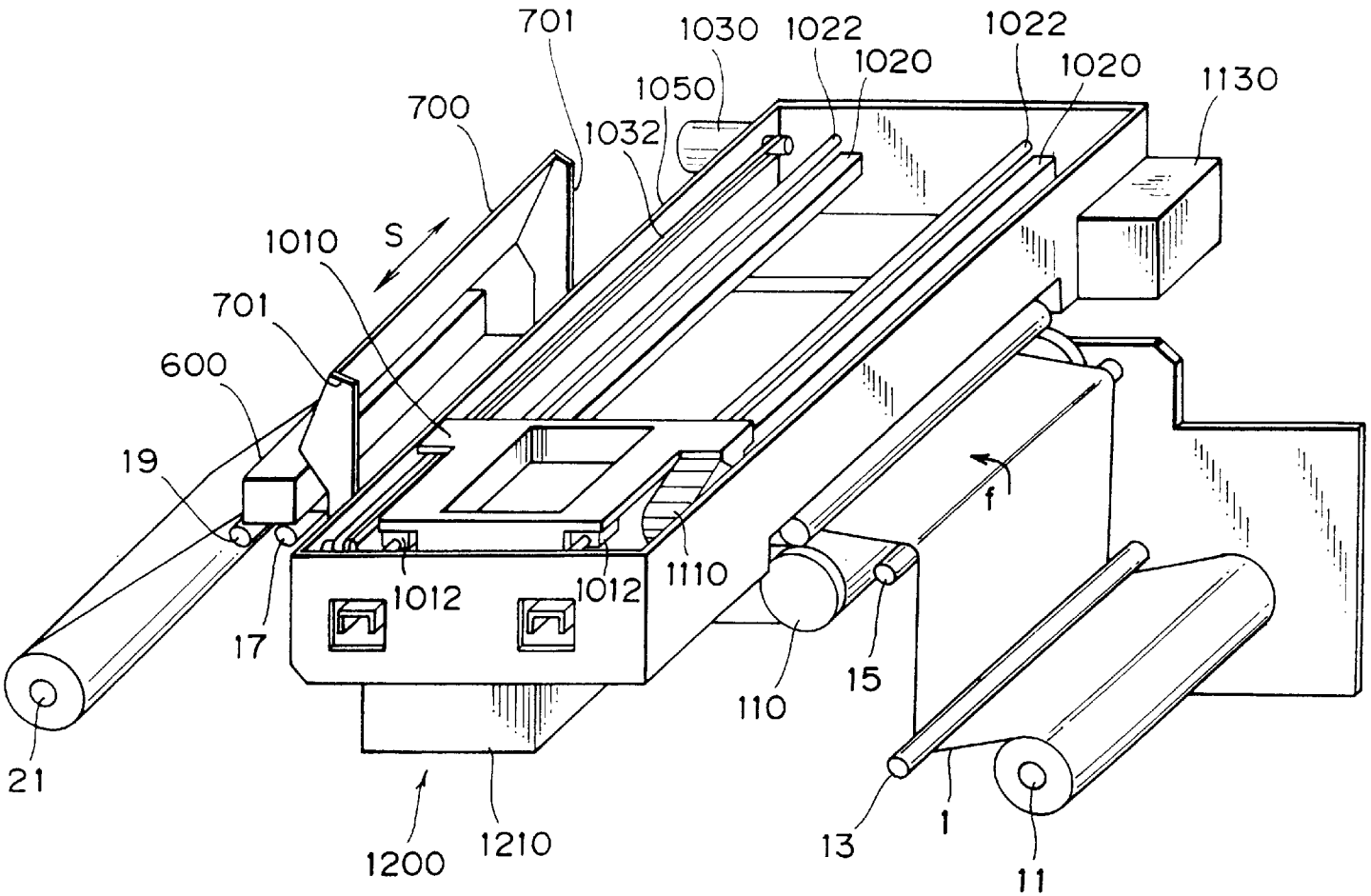
FIG. 68 is a perspective view of the textile printing apparatus shown in FIG. 64A.

FIG. 68 is a perspective view which schematically shows the structure of printing means and observing means located adjacent to the printing means. In FIG. 68, an arrow-like mark S represents a width of the mirror 700 serving as observing means. The width S is dimensioned at least based on the width of an image practically printed on a printing plane of the cloth 1. A pair of guide bars 1020 are arranged inside of the printer frame 1050 while extending in the main scanning direction (i.e., in the direction orienting at a right angle relative to the conveying direction). In addition, guide rails 1022 are arranged above the guide bars 1022 so as to allow a head carriage 1010 to be reciprocably displaced in the main scanning direction in cooperation with the guide rails 1020. The head carriage 1010 is driven via a driving belt 1032 by rotationally driving a motor 1030 affixed to the left-hand side wall of the printer frame 1050. A plurality of printing heads 1100 are attached to the lower surface of the head carriage 1010 for forming printed images on the cloth 1. The printing heads 1100 are constructed such that various kinds of inks can be supplied from a plurality of ink tanks as desired, and these ink tanks (not shown) can usually be mounted on the head carriage 1010. In addition, a suction recovering mechanism 1200 is arranged on the home position side of the printing heads 1100 in order to prevent ejection properties of respective ink ejection nozzles in each printing head 1100 from being degraded. The suction recovering mechanism 1200 is constructed in such a manner as to eliminate an occurrence of clogging or a similar malfunction by conducting suction treatment for the respective ink ejecting nozzles in each printing head 1100 and then storably receive the waste ink sucked therefrom after completion of the suction treatment in a tank 1210. To recover the degraded ejection properties, it is acceptable to conduct quasiejection for the respective ink ejecting nozzles in each printing head 1100 without any actual ink ejection in order to eliminate a malfunction of clogging of the respective ink ejection nozzles in place of the activation of the suction recovering mechanism 1200.

Figure 69:
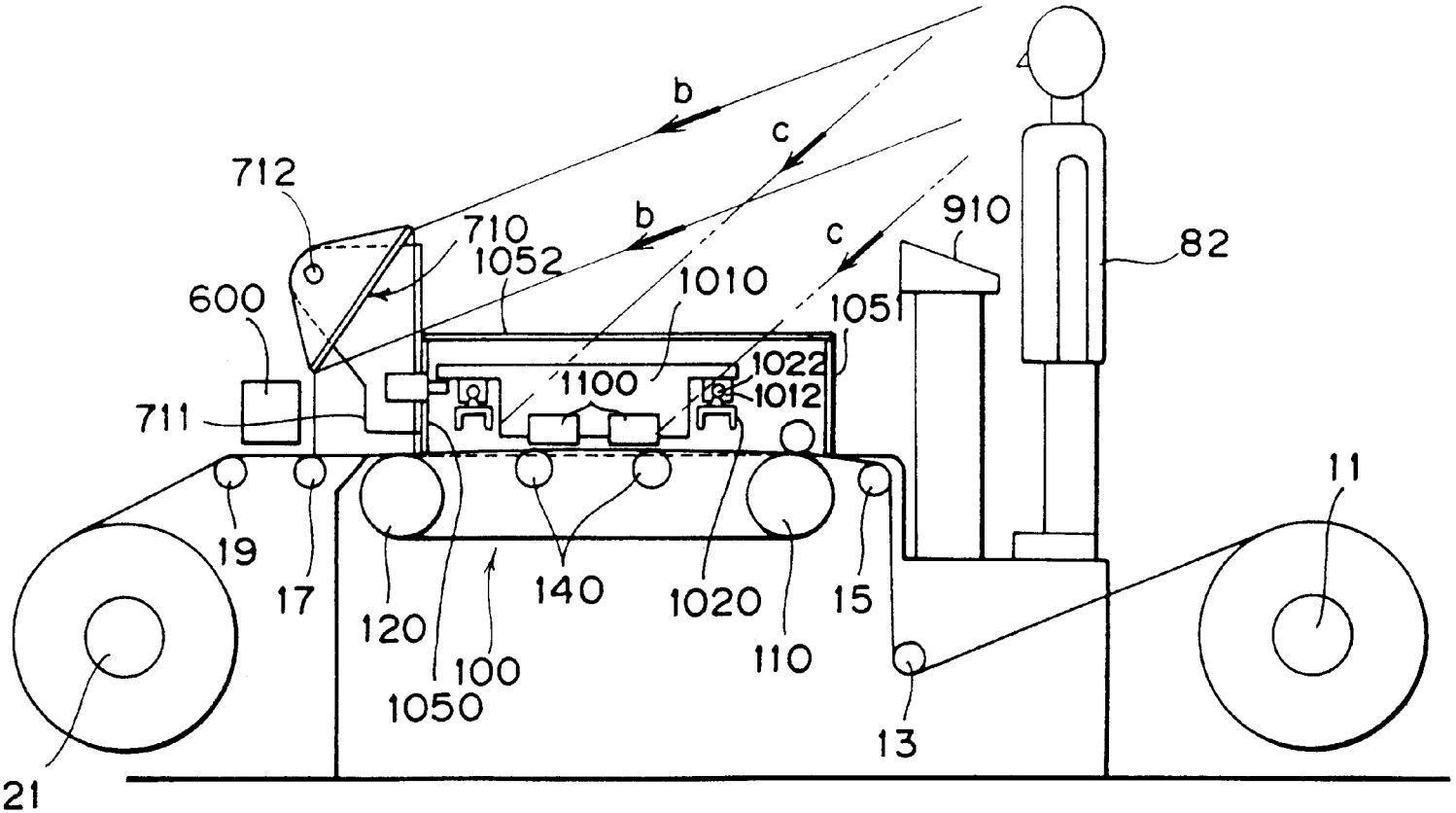
FIG. 69 is a schematic sectional view showing an embodiment wherein means for visually observing printed images immediately after images are printed on a printing medium is arranged in the textile printing apparatus.

FIG. 69 is a sectional view which schematically shows an embodiment wherein an image forming apparatus includes observing means for visually observing printed images immediately after images are formed on a printing medium.

A characterizing feature of the image forming apparatus constructed in accordance with this embodiment consists in that a handling section 910 is disposed between a conveying section 100 and an unwinding roll 11. This characterizing feature assures that the whole image forming apparatus can be constructed with smaller dimensions.

In this case, it is recommendable that an angle of a mirror 710 can be adjusted depending on the position of a fulcrum 712 on a support board 711 placed on a printer frame 1050 in consideration of the position of an operator 82.

Also in the preceding embodiment, it of course is obvious that an angle of the mirror may be adjusted as desired.

Usually, a head carriage 1010 is surrounded by printer frames 1050 and 1051 and an upper cover 1052 not only for the purpose of preventing ink mist from being scattered outside of the housing of the image forming apparatus but also for the purpose of protecting an operator 92 from an unexpected accident or injury caused due to rolling-in of part of his body in the carriage 1010 during main scanning of the latter. In the case that the handling section 910 is disposed at the shown position, it is possible for the operator 82 to visually check the operative state of each ink jet heads during each printing operation as represented by arrow marks c in the drawing, provided that the upper cover 1052 is fabricated using a transparent material (e.g., reinforced glass, acrylic resin plate).

Figure 70:
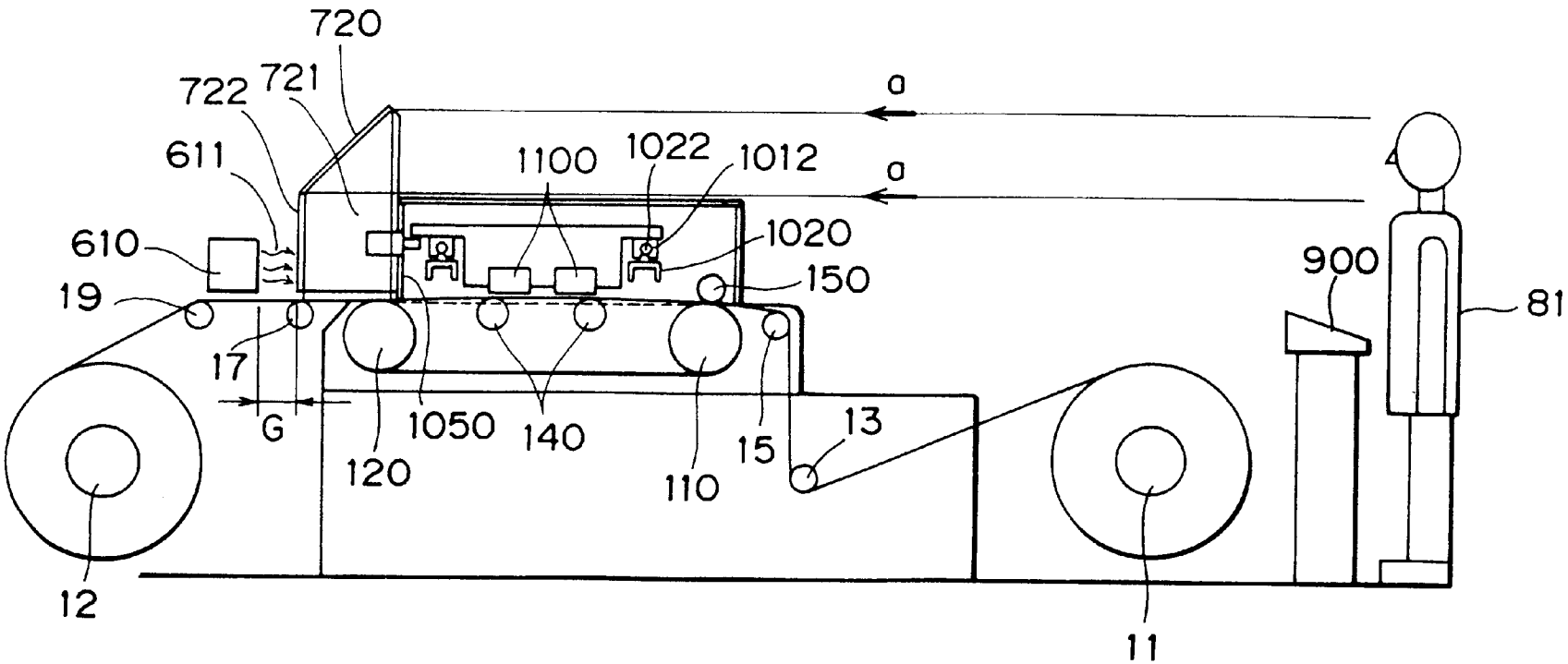
FIG. 70 is a schematic sectional view showing a modified embodiment wherein means for visually observing printed images immediately after images are printed on a printing medium is arranged in the textile.

FIG. 70 is a sectional view which schematically shows a modified embodiment wherein an image forming apparatus includes observing means for visually observing printed images immediately after images are printed on a printing medium. A characterizing feature of the image forming apparatus constructed in accordance with this modified embodiment consists in that a mirror 720 is immovably held on a support board 721 secured to a printer frame 1050, and moreover, a thermal insulative wall 722 is attached to the support board 721 in order to cut off heat rays 611 irradiated from a drying unit 610.

When the image forming apparatus is constructed in that way, there does not arise a malfunction that color deviation occurs attributable to slight delay of a quantity of feeding of the printing medium caused by thermal expansion of a belt driving roller 120 on receipt of irradiated heat rays 611.

A plate or a similar material made of gypsum or glass wool can preferably be employed for a thermal insulative wall 722.

Figure 71:
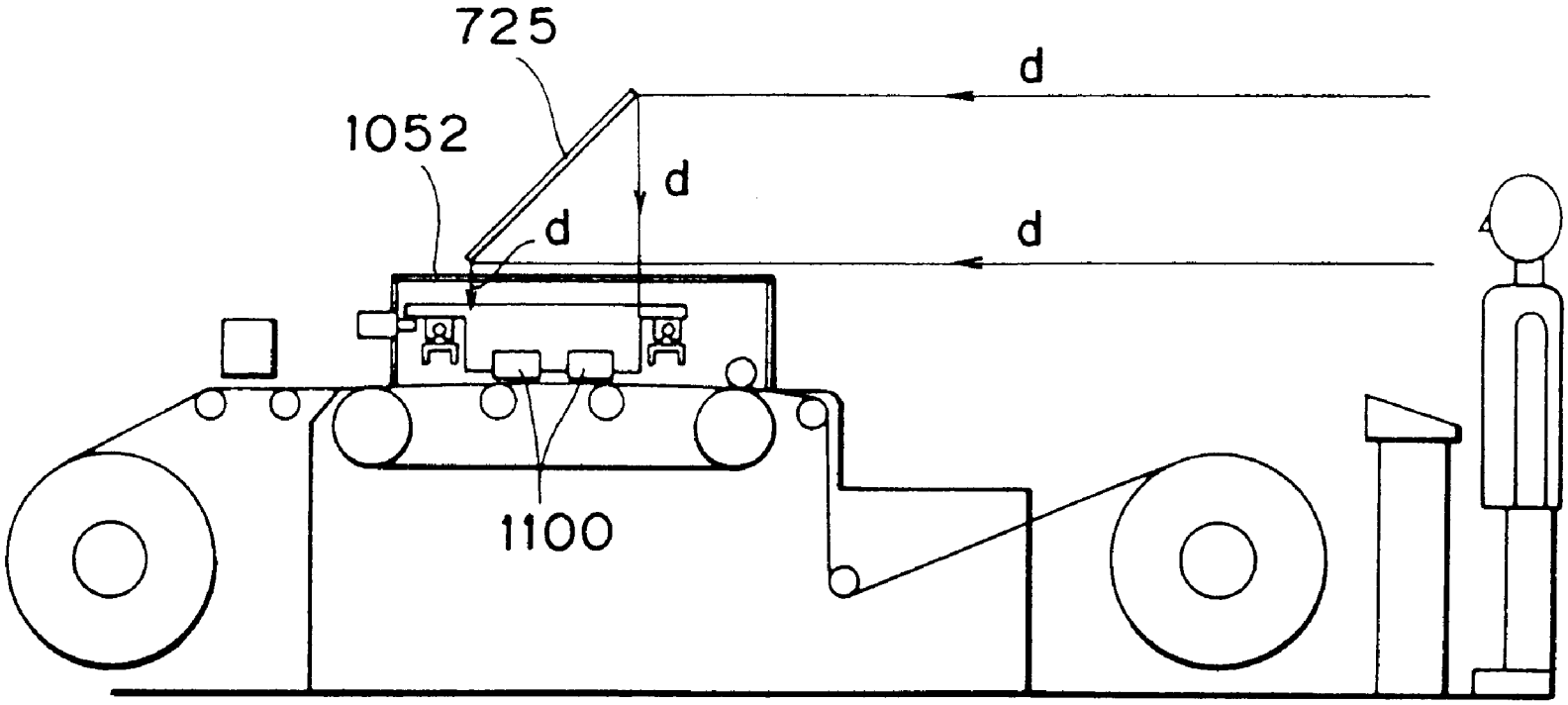
FIG. 71 is a schematic sectional view showing other modified embodiment wherein means for visually observing printed images immediately after images are printed on a recording medium is arranged in the textile printing apparatus.

FIG. 71 is a sectional view which schematically shows other modified embodiment wherein an image forming apparatus includes observing means for visually observing printed images immediately after images are printed on a printing medium. A characterizing feature of the image forming apparatus constructed in accordance with this embodiment consists in that a mirror 725 is disposed above a plurality of ink jet heads 1100 with the aid of a support board (not shown), and moreover, an upper cover 1052 is fabricated using a transparent material in the same manner as the aforementioned embodiment.

With this construction, the printed state of images on the printing medium can visually be confirmed through the upper cover 1052 via the mirror 725 at any time as represented by arrow-like marks d in the drawing.

Figure 72:
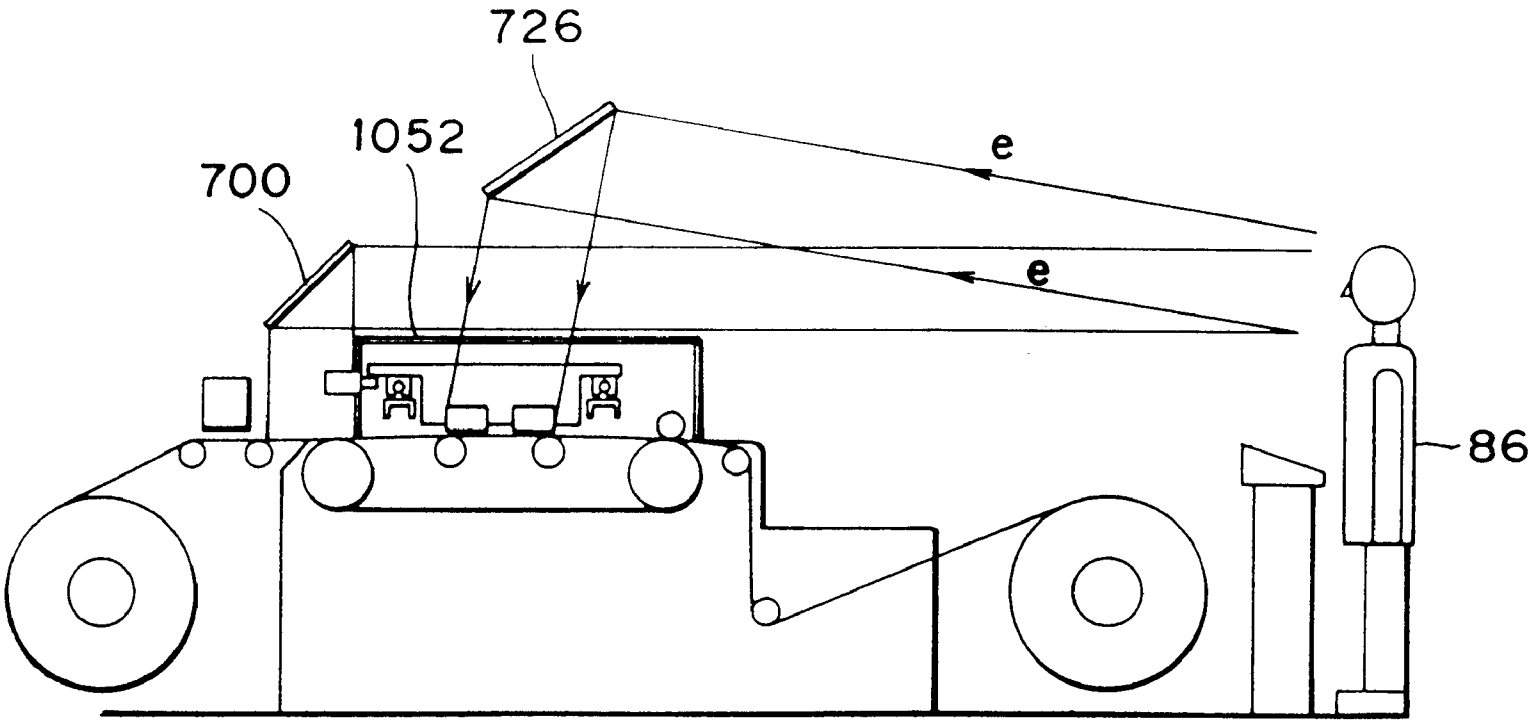
FIG. 72 is a schematic sectional view showing another modified embodiment wherein means for visually observing printed images immediately after images are printed on a printing medium is arranged in the textile printing apparatus.

FIG. 72 is a sectional view which schematically shows another modified embodiment wherein an image forming apparatus includes observing means for visually observing printed image immediately after images are printed on a printing medium. A characterizing features of the image forming apparatus constructed in accordance with this modified embodiment consists in that a mirror 726 is additionally disposed in addition to the mirror 700 in the aforementioned modified embodiment.

The mirror 726 is arranged above a plurality of ink jet heads 1100 while it is held in the slightly inclined state compared with the mirror 700. An upper cover 1052 is likewise fabricated using a transparent material in the same manner as the preceding embodiment.

With this construction, the printed state of printed images immediately after images are printed on a printing medium as well as the printing state of the image forming apparatus in the range as defined by the ink jet heads 1100 can visually be observed by an operator 86 standing upright at the same position as that in the preceding embodiment as represented by arrow-like marks e in the drawing.

Figure 73:
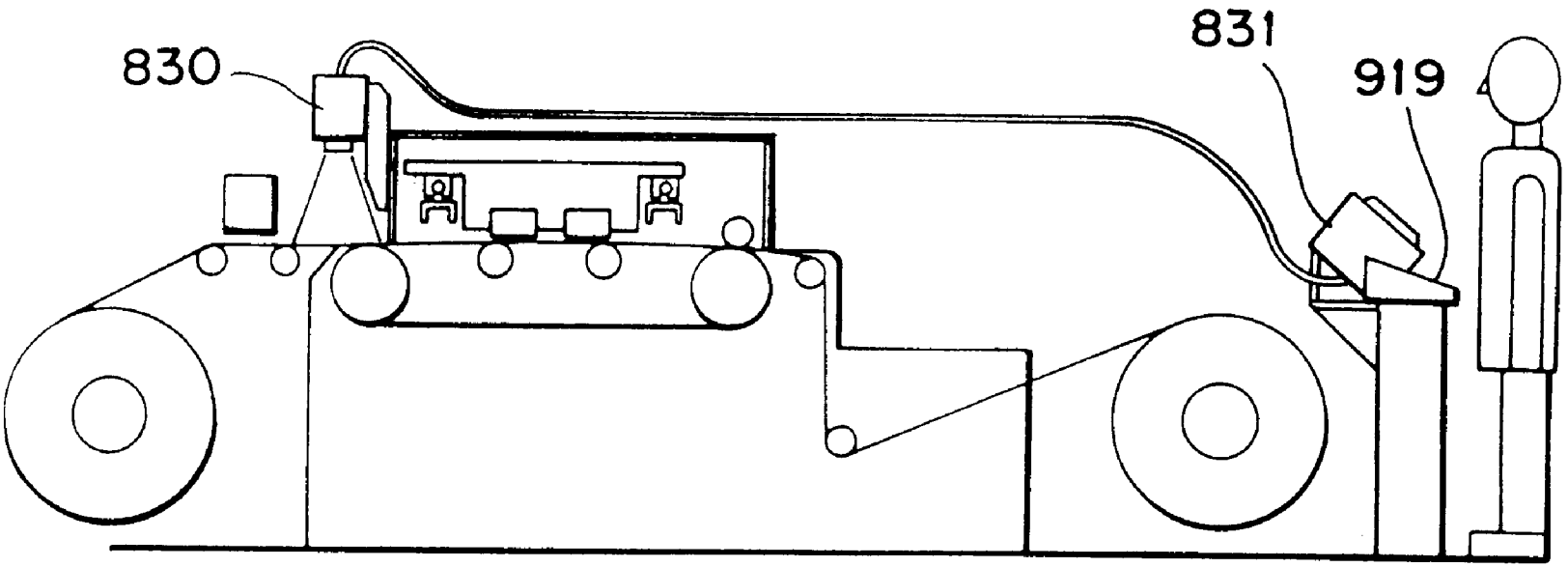
FIG. 73 is a schematic sectional view showing another modified embodiment wherein means for visually observing printed images immediately after images are printed on a printing medium is arranged in the textile printing apparatus.

FIG. 73 is a sectional view which schematically shows further modified embodiment wherein an image forming apparatus includes observing means for visually observing printed images immediately after images are printed on a printing medium. A characterizing feature of the image forming apparatus constructed in accordance with this modified embodiment consists in that at least one video camera 830 arranged in the transverse direction of a cloth 1 is substituted for the mirror serving as observing means in each of the aforementioned embodiments, and moreover, a monitoring unit 831 electrically connected to the television camera 830 is disposed on a handling section 919.

With this construction, the printed state of printed images across the whole width of the cloth 1 can easily be watched by anyone.

It is acceptable that the video camera 830 is arranged at the same position located in the vicinity of an operator as that in each of the aforementioned embodiments, and moreover, a mirror is additionally disposed above the ink jet heads so as to enable the printed state of printed image to be visually observed via the mirror in the same manner as mentioned above.

In each of the aforementioned embodiments, description has been made with respect to the case that a cloth is used as a printing medium. It of course is obvious that the present invention may equally be applied to a roll-shaped paper or a roll-like film.

Figure 74:
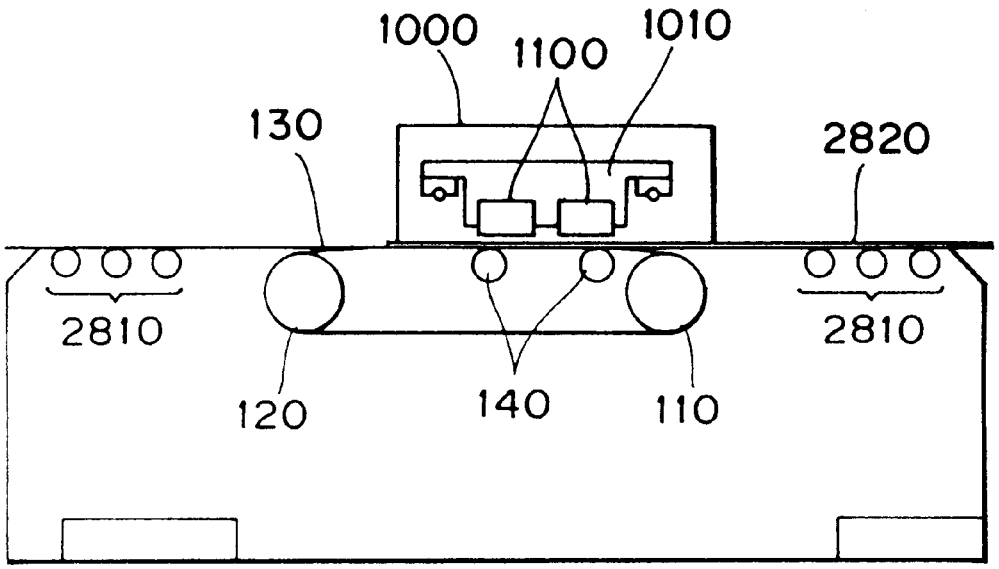
FIG. 74 is a schematic sectional view showing further modified embodiment wherein means for visually observing printed images immediately after images are printed on a printing medium is arranged in the textile printing apparatus.

FIG. 74 is a sectional view which schematically show further another modified embodiment wherein an image forming apparatus includes observing means for visually observing printed images immediately after images are printed on a printing medium. A characterizing features of the image forming apparatus constructed in accordance with this modified embodiment consists in that conveying rollers 2810 are arranged before and behind a conveying section 100 along a conveying path for the printing medium, and moreover, the upper surface of conveying section 100 is flush with the conveying surface of each of the conveying rollers 2810.

With this construction, it is possible to form printed images on the upper surface of a hardly bendable plate-like material or a heavy plate-shaped material 2820 usable as a printing medium.

Provided that observing means and a handling section employed in each of the aforementioned embodiments are arranged for the image forming apparatus for visually confirming the printed state of printed images, the image forming apparatus can be used while visually checking the printed state of printed images on the hardly bendable plate-like material or the heavy plate-shaped material 2820.

(11) Other items

In each of the aforementioned embodiments, description has been made with respect to the case that a cloth is used as a printing medium. It of course is obvious that the present invention can equally be applied to an ordinary roll-like paper or a roll-shaped film to be used as a printing medium. When the present invention is carried out in accordance with a modified embodiment as shown in FIG. 61, images can be printed on a hardly bendable material or a heavy plate-shaped material.

In the modified embodiment as shown in FIG. 61, supporting rollers 2810 are arranged before and behind a conveying belt 130 recirculatively driven by conveying rollers 110 and 120 with the substantially same height as that of platen rollers 140 located opposite to a plurality of ink jet heads 1010, whereby a plate-like material 1A can be conveyed to a printer section 1000 so as to perform a printing operation with the plate-like material 1A.

According to the present invention, since the conveying path extends in the horizontal direction, the space required for holding a rigid printing medium such as a plate-like material or the like can easily be maintained, and moreover, a high intensity of holding force is not required for holding a heavy printing medium. Thus, a various kind of printing medium can easily be handled for the image forming apparatus.

Subsequently, the description will be made of the entire processes of the ink jet textile printing. After the ink jet textile printing process is executed by the use of the above-mentioned ink jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for the textile suitable for the ink jet textile printing:

(1) Colors should come out on ink in a sufficient density.

(2) Dye fixation factor is high for ink.

(3) Ink must be dried quickly.

(4) The generation of irregular ink spread is limited.

(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Application Laying-open No. 62-53492, for example. Also, in Japanese Patent Application Publication No. 3-46589, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori- ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethel cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to 10 compounds which produce typical ionic crystals, namely, halogenoid compounds of alkaline metals or alkaline earth metals, for example. As a typical example of these compounds, NaCl, $Na_2SO_4$, KCl and $CH_3$ COONa and the like can be named for the alkaline metals, for example. Also, $CaCl_2$, $MgCl_2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. The methods of machine stitch the textile to make clothes and other daily needs are disclosed well-known.

As described above, according to the present invention, it is possible to obtain a high cleaning effect of the liquid discharging surface of the liquid discharging head as well as a long-time stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying in droplets for the printing.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface is preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. An image forming apparatus comprising:

conveying means for conveying a printing medium in a substantially horizontal conveying direction in a printing range where ink as a printing agent is applied to the printing medium, while a printing plane of the printing medium is oriented to face in an upward direction;

a printer section including a plurality of ink jet printing heads for forming printed images on the printing medium therewith, each of said printing heads being adapted to eject the ink to the printing medium in a downward direction while said printer section is located opposite to a platen portion of said conveying means in the printing range;

supporting means, including guide members disposed on opposite sides of said conveying means as viewed in the conveying direction of the printing medium conveyed by said conveying means, for slidably supporting said printer section relative to said platen portion in such a manner as to enable sliding displacement of said printer section along said guide members in the conveying direction between an opposing position where said printer section and said platen portion are located opposite to each other and a non-opposing position spaced away from the opposing position; and adjusting means for adjusting a gap between said printing heads and the printing medium to be conveyed on said platen portion.

2. An image forming apparatus as claimed in claim 1, wherein said guide members are inclined relative to said platen portion in the vertical direction.

3. An image forming apparatus as claimed in claim 2, further comprising driving means for displacing said printer section along said guide members and position determining means for adjustably determining the position of said printer section on said guide members.

4. An image forming apparatus as claimed in claim 2, wherein said platen portion extends in the horizontal direction, and said guide members are inclined from the horizontal direction.

5. An image forming apparatus as claimed in claim 2, wherein said guide members extend in the horizontal direction, and said platen portion is inclined from the horizontal direction.

6. An image forming apparatus as claimed in claim 2, wherein said conveying means includes a conveying belt which is spanned between a pair of conveying rollers, said conveying belt being recirculatively extending therebetween.

7. An image forming apparatus as claimed in claim 6, wherein the printing medium comprises a cloth.

8. An image forming apparatus as claimed in claim 2, wherein each of said ink jet heads generates gas bubbles in the ink by utilizing thermal energy, and ejects the ink therefrom as the gas bubbles expand.

9. An image forming apparatus as claimed in claim 1, wherein said conveying means includes a pair of conveying rollers, one of said pair of rollers being disposed on the upstream side and another of said pair of rollers being disposed on the downstream side as viewed in the conveying direction and a conveying belt spanned between said pair of conveying rollers while recirculatively extending therebetween.

10. An image forming apparatus as claimed in claim 9, wherein said pair of conveying rollers are supported between supporting members located inside of said guide members.

11. An image forming apparatus as claimed in claim 9, wherein said platen portion comprises platen means for thrusting part of said conveying belt between said pair of conveying rollers to restrictively define the printing plane of the printing medium in cooperation with said printing heads, and said adjusting means, which adjusts the gap between said printing heads and the printing medium conveyed on said conveying means by raising and lowering said platen means.

12. An image forming apparatus as claimed in claim 11 further including means for adjusting tension to be applied to said conveying belt by changing a distance between said pair of conveying rollers as said platen means is raised or lowered.

13. An image forming apparatus as claimed in claim 9, wherein the printing medium comprises a cloth.

14. An image forming apparatus as claimed in claim 13, further comprising a labelling member for adhesively placing the cloth to a tacky layer on said conveying belt of said conveying means, said labelling member being disposed on a side of said printer section, wherein said labelling member is supported so as not to obstruct slidable displacement between the opposing position and the non-opposing position.

15. An image forming apparatus as claimed in claim 1, wherein each of said ink jet printing heads ejecting ink therefrom.

16. An image forming apparatus as claimed in claim 1, wherein said supporting means comprises a support member having sliders secured thereto so as to enable sliding displacement along said guide members, via said adjusting means, which adjusts the gap between said printing heads and the printing medium to be conveyed on said conveying means by changing a height of said printer section relative to said support member.

17. An image forming apparatus as claimed in claim 16, wherein a plurality of jacks are arranged between said support member and said printer section so as to enable said adjusting means to be actuated while said adjusting means and said support member are disengaged from each other.

18. An image forming apparatus comprising:

conveying means for conveying a printing medium in a substantially horizontal conveying direction in a printing range where a printing agent is applied to the printing medium, while a printing plane of the printing medium is oriented to face in an upward direction;

a printer section including a plurality of printing heads for forming printed images on the printing medium therewith, each of said printing heads being adapted to eject the printing agent to the printing medium in a downward direction with a plurality of printing elements while said printer section is located opposite to a platen portion of said conveying means in the printing range;

supporting means for slidably supporting said printer section relative to said platen portion in such a manner as to enable sliding displacement of one of said printer section and said platen portion in the conveying direction of the printing medium conveyed by said conveying means between an opposing position where said printer section and said platen portion are located opposite to each other and a non-opposing position spaced away from the opposing position; and a test pattern forming section located opposite to said printer section when said printer section and said conveying means are located at the non-opposing position, so as to allow a test pattern to be formed by said printer section, the test pattern being used for measuring fluctuation in a quantity of the printing agent applied to the printing medium from said printing elements.

19. An image forming apparatus as claimed in claim 18, wherein said supporting means includes guide members disposed on opposite sides of said conveying means as viewed in the conveying direction so as to enable said printer section to be slidably displaced along said guide members, and said test pattern forming section is arranged at an end section of said slide members.

20. An image forming apparatus as claimed in claim 19, wherein said test pattern forming section is arranged above a supplying portion for supplying the printing medium to said conveying means.

21. An image forming apparatus as claimed in claim 18, wherein said test pattern forming section includes a placing portion for placing a cut sheet for a test pattern thereon.

22. An image forming apparatus as claimed in claim 18, wherein said test pattern forming section includes means for conveying a continuous sheet-like test pattern forming medium to a position located opposite to said printing heads.

23. An image forming apparatus as claimed in claim 22, further comprising reading means for measuring the fluctuation by optically reading the continuous sheet-like test pattern forming medium, said reading means being disposed downstream in the conveying direction of a conveying path of the continuous sheet-like test pattern forming medium relative to a position located opposite to said printing heads.

24. An image forming apparatus as claimed in claim 23, further comprising means for correcting a driving signal for each of said printing elements based on the measured fluctuation.

25. An image forming apparatus as claimed in claim 18, wherein ink is used as the printing agent, and each of said printing heads is comprises an ink jet printing head for ejecting ink therefrom.

26. An image forming apparatus as claimed in claim 25, wherein each of said printing elements generates thermal energy required for allowing a phenomenon of film boiling to appear in the ink as energy to be utilized for ejecting the ink.

27. An image forming apparatus as claimed in claim 18, wherein the printing medium comprises a cloth.

28. An image forming apparatus including conveying means for conveying a printing medium at least in a printing range while the printing medium is adhesively placed on a tacky sheet on a conveying belt and a printer section located opposite to a platen portion of said conveying means in the printing range, said image forming apparatus comprising:

a labelling roller on an upstream side of said conveying belt for bringing the printing medium in adhesive contact with said tacky sheet on said conveying belt, wherein said labelling roller serves also as a sheet labelling roller for allowing said tacky sheet to adhere to said conveying belt.

29. An image forming apparatus as claimed in claim 28, wherein said conveying belt conveys the printing medium in a substantially horizontal direction.

30. An image forming apparatus as claimed in claim 28, further comprising a holding portion for holding said printer section, wherein a space located on the upstream side of said labelling roller as viewed in a conveying direction is not covered with said printer section and said holding portion.

31. An image forming apparatus as claimed in claim 30, wherein said printer section and said holding portion for holding said printer section are displaceable away from a position where said printer section is located opposite to said conveying belt by actuating a displacing mechanism and when said printer section and said holding section are displaced away, the space located on the upstream side of said labelling roller as viewed in the conveying direction is not covered by said conveying means, said printer section and said holding portion for holding said printer section.

32. An image forming apparatus as claimed in claim 28, wherein a surface of said labelling roller is coated with a layer of fluororesin.

* * * * *

UNITED STATES PATENT AND TRADEMARK OFFICE

CERTIFICATE OF CORRECTION

PATENT NO. : 6,068,374
DATED : May 30, 2000
INVENTOR(S) : Kurata et al.

It is certified that error appears in the above-identified patent and that said Letters Patent is hereby corrected as shown below:

Title page,
Item [56], References Cited,
Foreign Patent Documents, "844560 7/1976 Belgium.",
"62-053492 3/1987 Japan.",
"346589 7/1991",
"4039042 2/1993 Japan." and
"531905 2/1992" should be deleted.
"3046589" should read -- 3-46589 --.
"439042" should read -- 4-39042 --.
"5031905 2/1993 Japan.....Japan.....B41J 2/05"
should read -- 5-31905 2/1993 Japan.....B41J 2/05 --.
"5212851" should read -- 5-212851 --.

Column 2,
Line 17, "can not" should read -- cannot --.

Column 4,
Line 17, "can not" should read -- cannot --.

Column 6,
Line 56, "determine" should read -- determining --.

Column 7,
Line 7, "ejects" should read -- eject --.

Column 17,
Line 47, "to" should be deleted.

Column 18,
Line 26, "can not" should read -- cannot --.

Column 20,
Line 56, "few" should read -- not --.

Column 24,
Line 20, "shows" should read -- show --.

UNITED STATES PATENT AND TRADEMARK OFFICE

CERTIFICATE OF CORRECTION

PATENT NO. : 6,068,374
DATED : May 30, 2000
INVENTOR(S) : Kurata et al.

It is certified that error appears in the above-identified patent and that said Letters Patent is hereby corrected as shown below:

Column 31,
Line 27, "an" should read -- a --.

Column 33,
Line 1, "importance" should read -- important --.
Line 31, "in" should be deleted.

Column 35,
Line 58, "die" should read -- due --.

Column 36,
Line 57, "another" should read -- other --.
Line 59, "can not" should read -- cannot --.

Column 41,
Line 3, "the" should read -- The --.
Line 24, "can not" should read -- cannot --.
Line 32, "can not" should read -- cannot --.

Column 42,
Line 62, "can not" should read -- cannot --.

Column 46,
Line 34, "relative" should read -- relative to --.

Column 49,
Line 20, "drive" should read -- driving --.

Column 51,
Line 41, "displace" should read -- displaced --.
Line 66, "for" should read -- to --.

Column 55,
Line 39, "quasiejection" should read -- quasi-ejection --.

UNITED STATES PATENT AND TRADEMARK OFFICE

CERTIFICATE OF CORRECTION

PATENT NO. : 6,068,374
DATED : May 30, 2000
INVENTOR(S) : Kurata et al.

It is certified that error appears in the above-identified patent and that said Letters Patent is hereby corrected as shown below:

Column 57,
Line 23, "show" should read -- shows --.

Column 58,
Line 36, "in" (second occurrence) should read -- ink --.
Line 52, "salt" should read -- salts --.

Column 59,
Line 14, "salt" should read -- salts --.
Line 47, "stitch" should read -- stitching --.
Line 48, "well-known" should read -- and well-known --.

Column 60,
Line 34, "full line" should read -- full-line --.
Line 44, "assemble," should read -- asembly, --.

Column 62,
Line 31, "claim 11" should read -- claim 11, --.
Line 46-48, should read as follows:
-- 15. An image forming apparatus as claimed in claim 1, wherein each of said ink jet printing heads includes an element for generating thermal energy required for allowing a phenomenon of film boiling to appear in ink as energy to be utilized for ejecting ink therefrom --.

Column 64,
Line 7, "is" should be deleted.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*